United States Patent [19]

Koboshi et al.

[11] Patent Number: 4,937,178

[45] Date of Patent: Jun. 26, 1990

[54] PROCESSING METHOD FOR SILVER HALIDE COLOR PHOTOGRAPHIC LIGHT-SENSITIVE MATERIAL AND COLOR DEVELOPER USED THEREIN

[75] Inventors: Shigeharu Koboshi; Satoru Kuse; Masayuki Kurematsu; Moeko Hagiwara, all of Hino, Japan

[73] Assignee: Konica Corporation, Tokyo, Japan

[21] Appl. No.: 171,867

[22] PCT Filed: Jul. 10, 1987

[86] PCT No.: PCT/JP87/00494

§ 371 Date: Mar. 7, 1988

§ 102(e) Date: Mar. 7, 1988

[87] PCT Pub. No.: WO88/00724

PCT Pub. Date: Jan. 28, 1988

[30] Foreign Application Priority Data

| | | | |
|---|---|---|---|
| Aug. 5, 1986 | [JP] | Japan | 61-184090 |
| Aug. 5, 1986 | [JP] | Japan | 61-184087 |
| Aug. 14, 1986 | [JP] | Japan | 61-191105 |
| Dec. 10, 1986 | [JP] | Japan | 61-294554 |
| Dec. 15, 1986 | [JP] | Japan | 61-298497 |
| Mar. 12, 1987 | [JP] | Japan | 62-57700 |
| Jul. 10, 1987 | [JP] | Japan | 61-162885 |

[51] Int. Cl.[5] ..... G03C 7/30; G03C 7/32

[52] U.S. Cl. ..... 430/375; 430/376; 430/387; 430/445; 430/446; 430/447; 430/464; 430/467; 430/468; 430/474; 430/476; 430/484; 430/567

[58] Field of Search ..... 430/375, 376, 567, 502, 430/381, 386, 387, 391, 603, 601, 445, 446, 447, 464, 467, 468, 470, 474, 476, 484, 567

[56] References Cited

U.S. PATENT DOCUMENTS

| | | | |
|---|---|---|---|
| 3,201,242 | 8/1965 | Schwan et al. | 430/469 |
| 3,706,562 | 12/1972 | Herz et al. | 430/446 |
| 3,985,564 | 10/1976 | King | 96/95 |
| 4,465,762 | 8/1984 | Ishikawa et al. | 430/376 |
| 4,482,626 | 11/1984 | Twist et al. | 430/380 |
| 4,546,068 | 10/1985 | Kuse | 430/375 |

(List continued on next page.)

FOREIGN PATENT DOCUMENTS

| | | |
|---|---|---|
| 0135883 | 9/1984 | European Pat. Off. . |
| 2215640 | 1/1974 | France . |
| 55-62450 | 5/1980 | Japan . |
| 55-62451 | 5/1980 | Japan . |
| 5574542 | 6/1980 | Japan . |
| 5595949 | 7/1980 | Japan . |
| 0162253 | 8/1985 | Japan . |

OTHER PUBLICATIONS

Derwent Abstracts of J60162253, J5595949 and J5574542.

(List continued on next page.)

*Primary Examiner*—Paul R. Michl
*Assistant Examiner*—Patrick Doody
*Attorney, Agent, or Firm*—Frishauf, Holtz, Goodman & Woodward

[57] ABSTRACT

The present inventions relate to a processing method for processing, with a developing time of not more than 180 seconds, a silver halide color photographic light-sensitive material comprising a support, provided thereon, with at least one silver halide emulsion layer, and at least one emulsion layer containing silver iodo-bromide with not less than 0.5 mole% of silver iodine, in particular to an active processing method wherein, a light-sensitive material B not only containing silver iodo-bromide with an iodine content of not less than 0.5 mole% but also a magenta coupler and providing a maximum magenta density, after exposed, and being capable of only satisfying the maximum magenta dye density M of $M<2.0$ if exposed under specific conditions and then subjected to color developing of a duration of three minutes 15 seconds at 38° C. with a specific developer solution, is capable of offering a maximum magenta density satisfying $M \geqq 2.0$, when the light-sensitive material is exposed under the exposure conditions and subjected to color developing with a duration of not more than 2.5 minutes, whereby excellent image in terms of image quality is resulted.

11 Claims, 1 Drawing Sheet

U.S. PATENT DOCUMENTS

| | | | |
|---|---|---|---|
| 4,634,660 | 1/1987 | Mifune et al. | 430/375 |
| 4,668,614 | 5/1987 | Takada et al. | 430/567 |
| 4,728,602 | 3/1988 | Shibahara et al. | 430/567 |
| 4,745,047 | 5/1988 | Asami et al. | 430/376 |
| 4,762,778 | 8/1988 | Yamazaki et al. | 430/567 |
| 4,774,166 | 9/1988 | Sasaki et al. | 430/376 |
| 4,774,167 | 9/1988 | Koshimizu et al. | 430/467 |

OTHER PUBLICATIONS

Hiroko Arai et al. Research Report Eng. Dept. Chiba Univ. vol. 33, No. 1, whole number 63, 1980 pp. 45–48.

Radiation Chemistry and Photochemistry, vol. 67, 1967 69415t–Mechanism of Polyethylenglycol Action in Photographic Emulsions and developers, p. 6529.

Dye Image Forming Method, vol. 9, No. 137 (p. 363) [1860], Jun. 12, 1985, Abstract Only.

Research Disclosure, No. 16480, Dec. 1977, pp. 60–63, Industrial Opportunities, Ltd., Photographic Color Developer Compositions.

Photofinishing Techniques and Equipment, Jack H. Coote, 1970, pp. 164–165.

PROCESSING METHOD FOR SILVER HALIDE COLOR PHOTOGRAPHIC LIGHT-SENSITIVE MATERIAL AND COLOR DEVELOPER USED THEREIN

FIELD OF THE INVENTION

The present invention relates to a processing method for a silver halide color photographic light-sensitive material and a color developer used therein, in particular to a processing method for a silver halide color photographic light-sensitive material providing a dye image with excellent graininess and a color developer used to embody this method.

BACKGROUND OF THE INVENTION

Recently, miniaturization of a silver halide color photographic light-sensitive material is being developed. More specifically, to miniature a camera for better portability, miniaturization of an image size on a film is in progress. It is, however, well known that such an arrangement incurs a deteriorated printed image quality. More specifically, a smaller image size in a color photographic light sensitive-material necessitates a greater enlargement ration for preparing a specific size of final print, and such a printed image accordingly has high graininess as well as poor sharpness. Therefore, it is necessary, in preparing an excellent print even with a miniaturized image size on a film, to improve the graininess, resolution and sharpness of a film.

As the method to improve graininess, among these requirements for improved silver halide color photographic light-sensitive materials, the following are available: a method, as described in Japanese Patent Publication Open to Public Inspection (hereinafter referred to as Japanese Patent O.P.I. Publication) No. 62454/1980, for using a rapid-reacting type coupler; a method, as described in the Theory of the Photographic Process, 4th Ed., pp. 620–621, by T. H. James, increasing the number of silver halide particles per unit of photographic material; a method, as described in British Pat. No. 2,080,640A, for using a non-diffusion type coupler for forming a diffusion type dye which emit an appropriately small amount of dye upon reaction with an oxidation product of color developing agent; a method, as described in Japanese Patent O.P.I. Publication No. 128443/1985, for increasing a ratio of silver iodide content to more than 8 mol %; other improvement methods as described in Japanese Patent O.P.I. Publication Nos. 191036/1984, 3682/1985, 128440/1985 and the like; a technique, as described in Japanese Patent Examined Publication No. 15495/1974, Japanese Patent O.P.I. Publication Nos. 7230/1978, 155539/1982 and the like, wherein an improvement is achieved by modifying the constitution of structural layers in a silver halide color photographic light-sensitive material.

Though the above-mentioned methods for improving a light-sensitive material positively improves graininess, the degree of improvement is not yet satisfactory. Poor graininess poses an obstacle against common use of a light-sensitive material in an extremely small format for example in the case of so-called "disk-film", and therefore has necessitated improvement.

In Chiba University, Engineering Department, Research Report Vol. 33 (1), Vol. 63 in whole number, (1980), pp. 45–48, is described the technique of "Image improvement of color negative film by rapid processing" by Arai et. al. In this report, it is mentioned that two layers i.e. cyan and magenta layers which are separated from a support are provided with approximately 20 to 30% increase in image information by means of highly active color developer as well as high-temperature rapid processing, and results in increase in sharpness, at a cost of deteriorated graininess in an image. This has been a theory established in the photographic art.

The present invention is intended to solve the above disadvantage. Therefore, the object of the invention is to a rapid processing method for a silver halide color photographic light-sensitive material providing a dye image with excellent sharpness and graininess, as well as a color developer used to embody this method.

DISCLOSURE OF THE INVENTION

The inventors have continued devoted research in order to attain the above object, and found that such a processing method complies with the above object. That is a processing method for processing a silver halide color photographic light-sensitive material comprising a support, provided thereon, at least one silver halide emulsion layer, and at least one silver halide contains silver iodo-bromide with not less than 0.4 mol % iodine, wherein the development time is not more than 180 seconds and the method satisfies the following criteria.

The processing method of the invention is characterized in that an image defined below is obtained when light-sensitive material B specified below containing silver iodo-bromide with iodine content of not less than 0.5 mol % as well as magenta coupler is exposed under the following conditions C and then subjected to color developing at 38° C. with a duration of 3 min. 15 sec. by using developer A specified below, with an assumption that the maximum magenta density of the light sensitive material satisfies the expression $M<2.0$.

In other words, it is a processing method, for a silver halide color photographic light-sensitive material, according to the first invention in the present application that a dye image having maximum magenta density M21 2.0 is available from the light-sensitive material B, of which magenta dye image has maximum density of $M \geqq 2$, when the light-sensitive material B is exposed under exposure conditions identical with the above and then the exposed material is subjected to color developing with a duration of shorter than 2 min.

Developer A used for specifying light-sensitive material B is as follows:

| Developer A | |
|---|---|
| Potassium carbonate | 37.5 g |
| Sodium sulfite | 4.25 g |
| Potassium iodide | 2 mg |
| Sodium bromide | 1.3 g |

-continued

| Developer A | |
|---|---|
| Hydroxylamine sulfate | 2.0 g |
| 3-methyl-4-amino-N-ethyl-(β-hydroxyethyl)-aniline sulfate | 4.75 g |

Water is added to the above components to prepare one liter solution, which is adjusted to pH 10.0 with 45% potassium hydroxide or with 50% sulfuric acid.

The exposure conditions C mentioned above are as follows: using a tungsten light source and filter, a color temperature is adjusted to 4800° K., in order to provide 3.2 CMS wedge exposure light.

The above processing method of the invention may be defined as a processing method which is capable of forming an image having a density higher than a color density, by subjecting a light-sensitive material B, which only produces an image of lower color density when developed under a specific condition, to color developing with a duration of not more than 2.5 min.

The above developer A and the developing conditions C used to specify the light-sensitive material B are those conventionally used in the art. In contrast, the processing method of the invention, which is capable of attaining magenta coloration of $M<2.0$ when the light-sensitive material B otherwise only having magenta coloration of $M\geqq 2.0$, may be called a process performed under an unconventionally active condition.

It is an unexpected fact even for the inventors that the above object. i.e. improved graininess is attained by a rapid and active process of which color developing time is unconventionally short, not more than 180 seconds.

The operation of the invention is yet to be known. However, the estimated reason is that performing a color developing process under such an active condition as of the invention somehow prevents dye formed around silver halide particles from being dispersed, and, resultingly, an image of excellent graininess is obtained.

The second invention in the present application is characterized by a developing temperature of higher than 40° C. in performing the above color developing process. The developing temperature of not lower than 40° C. ensures a rapid and active developing process.

The third invention in the present application is that the concentration of developing agent in developer solution is not lower than $1.5\times10^{-1}$ mol/liter in performing the color developing process. Such a high concentration of color developing agent ensures a rapid and active developing process.

The fourth invention in the present application is the developing time ranges from 20 to 150 seconds in performing the color developing process.

The fifth invention in the present application is the membrane swelling rate in relation to the light-sensitive material in the course of the color developing process is not more than 20 seconds.

This feature enables image quality, in particular, graininess.

In embodying the respective inventions in the present application, incorporating a combination composed of a compound represented by any of general formulas [R-I] through [R-IV] described layer, a compound represented by any of general formulas [A-I] through [A-VI], and at least one compound selected from polymers individually having a pyrolidone nucleus in the molecular structure, into a color developer solution is capable of effectively suppressing fog in a non-exposure portion, adjust a tone properly, and further improves image quality. For this reason, the above compounds are favorably used in embodying the above respective inventions.

The sixth invention in the present application is the use of above processing method for a silver halide color photographic light-sensitive material comprising a support, provided thereon, at least one silver halide emulsion layer containing a coupler represented by the following general formula [M-I], wherein at least one emulsion layer contains silver iodo-bromide.

[M-I]

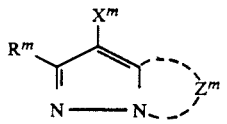

$Z^m$ represents a plurality of non-metal atoms necessary for forming a nitrogen heterocycle. The heterocycle formed by $Z^m$ may have a substituent.

$X^m$ represents a hydrogen atom, or a group capable of split off upon reaction with an oxidation production of a color developing agent.

$R^m$ represents a hydrogen atom, or a substituent.

The seventh invention in the present application is use of the above-mentioned processing method in treating a silver halide color photographic light-sensitive material comprising a support, provided thereon, at least one silver halide emulsion layer containing a coupler represented by the following general formula O[C-I], wherein at least one emulsion layer contains silver iodo-bromide.

General formula [C-I]

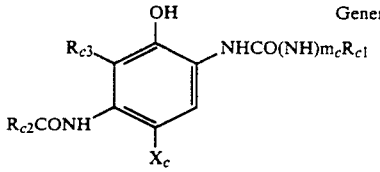

In this formula, $R_{c1}$ and $R_{c2}$ independently represent an alkyl group, cycloalkyl group, alkenyl group, aryl group or heterocyclic group. Each of these groups may have a substituent. $R_{c3}$ represents a hydrogen atom, halogen atom, alkyl group or alkoxy group. Such an alkyl or alkoxy group may have a substituent. Such a substituent may be a ring which $R_{c2}$ and $R_{c3}$ combinedly form. X represents a hydrogen atom, or a group capable of split off upon reaction with an oxidation product of a color developing agent. mc represents 0 or 1.

The eighth invention in the present application is a color developer for a silver halide color photographic light-sensitive material, containing at least one compound selected from the following group [A] and subjected to at least one means selected from the following group [B].

Group [A]

(A-1) Compounds represented by the following general formula [R-I]

General formula [R-I]

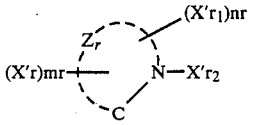

In this formula, X'r and X'r$_1$ independently represent a halogen atom, alkyl group, aryl group, amino group, hydroxy group, nitro group, carboxyl group or sulfonyl group. X'r$_2$ represents a hydrogen atom, alkyl group, aryl group, or a double-bond capable of forming a ring. Zr represents a plurality of atoms comprising a carbon atom, oxygen atom, nitrogen atom and sulfur atom, being necessary for forming a ring. nr and mr independently represent 0, 1, 2 or 3.

(A-2) Compounds represented by the following general formula [R-II]

Gerneral formula [R-II]

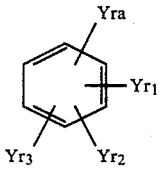

In this formula, Yra, Rr$_1$, Yr$_2$ and Yr$_3$ independently represent a hydrogen atom, halogen atom, alkyl group, amino group, hydroxy group, nitro group, carboxyl group or sulfonyl group.

(A-3) Compounds represented by the following general formula [R-III]

General formula [R-III]

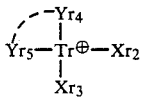

In this formula, Tr represents a nitrogen atom, or phosphor atom. Xr$_2$ and Xr$_3$ independently represent a hydrogen atom, alkyl group, aryl group, or halogen atom. Yr$_4$ and Yr$_5$ independently represent an alkyl group, or aryl group. Yr$_4$ and Yr$_5$ may jointly undergo ring closure to form a heterocycle.

(A-4) Compounds represented by the following general formula [R-IV]

General formula [R-IV]

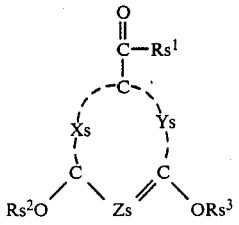

In Formula [R-IV], Rs$^1$ represents —OH, —ORs$^4$ or

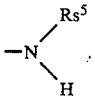

Rs$^4$ and Rs$^5$ independently represent an alkyl group. The alkyl group represented either by Rs$^4$ or Rs$^5$ may have a substituent (for example, an aryl group such as a hydroxyl group and phenyl group) and is typified by a methyl group, ethyl group, propyl group, butyl group, benzyl group, β-hydroxyethyl group, dodecyl group or the like.

Rs$^2$ and Rs$^3$ independently represent —H or

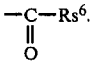

Rs$^6$ represents an alkyl group or aryl group. The examples of the alkyl group represented by Rs$^6$ include a long-chained alkyl group such an undecyl group.

Xs and Ys respectively represent a carbon atom and a hydrogen atom, each of which forms a six-membered ring together with other plurality of atoms. Zs represents —N═ or —CH═.

If Zs is —N═, a compound of the invention represented by general formula [R-IV] is typically a citradinic derivative. If Z represents —C═, a compound of the invention represented by general formula [R-IV] is typically a bezoic derivative. The six-membered ring within this compound may have a substituent such as a halogen atom.

Zs is favorably —N═.

(A-5) Polymer or copolymer, which has a pyrolidone nucleus within the molecular structure (A-6) Polyethylene glycol derivative

[Group B]

(B-I) Concentration of p-phenylenediamine developing agent within color developer solution is higher than $1.5\times10^{-1}$ mol/liter (B-II) pH of color developer solution is greater than 10.4

(B-III) Concentration of sulfite in color developer solution is less than $1.5\times10^{-1}$ mol/liter (B-IV) Concentration of bromide in color developer solution is less than $0.8\times10^{-1}$ mol/liter (B-V) Color developer contains at least one of compound selected from those represented by the following general formulas [A-I] through [A-VI]

General formula [A-I]

$$X_{a1}-(CH_2)_{\overline{na1}}(X_{a2}-(CH_2)_{\overline{na2}})_{\overline{ma1}}X_{a3}-(CH_2)_{\overline{na3}}X_{a4}$$

In this formula, Xa$_2$ and Xa$_3$ independently represent a sulfur atom or oxygen atom. Xa$_1$ and Xa$_4$ independently represent a SH group or OH group. na$_1$, na$_2$, na$_3$ and ma$_1$ independently represent an integer ranging from 0 to 500, whereby at least one of na$_1$, na$_2$ and na$_3$ is an integer greater than 0. Additionally, at least one of $Xa_1$, $Xa_2$, $Xa_3$, and $Xa_4$ is a sulfur atom.

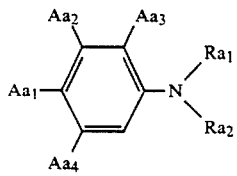

General formula [A-II]

In this formula, $Ra_1$ and $Ra_2$ independently represent a hydrogen atom; or an alkyl group such as a methyl group, ethyl group or propyl group; or a heterocyclic group which is capable of forming a ring, involving an oxygen or nitrogen atom, together with $Ra_1$ and $Ra_2$. $Aa_2$, $Aa_3$ and $Aa_4$ independently represent a hydrogen atom; or an alkyl group such as a methyl or ethyl group; or a halogen atom such as a chlorine, fluorine, or bromine atom. $Aa_1$ represents a hydroxy group or

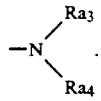

Additionally, $Ra_3$ and $Ra_4$ independently represent a hydrogen atom, or an alkyl group having 1 to 3 carbon atoms.

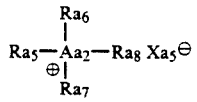

General formula [A-III]

In this formula, $Ra_5$, $Ra_6$, $Ra_7$ and $Ra_8$ independently represent a hydrogen atom, alkyl group, aralkyl group; or a substituted or unsubstituted aryl group. $Aa_2$ represents a nitrogen or phosphor atom. $Ra_8$ represent a substituted or unsubstituted alkylene group. $Ra_5$ and $Ra_8$ may form a ring, or independently be substituted or unsubstituted pyridinium group. $Xa_5$ represents an anion group such as a halogen atom, OH, sulfuric group or nitric group.

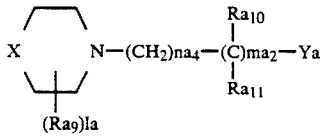

General formula [A-IV]

In this formula, Ya represents a hydrogen atom, hydroxy group or

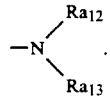

$Ra_9$, $Ra_{10}$, $Ra_{11}$, $Ra_{12}$ and $Ra_{13}$ independently represent a hydrogen atom; or a substituted or unsubstituted group, having 1 to 3 carbon atoms, such as an alkyl group, carbamoyl group, acetyl group and amino group. X represents an oxygen atom, sulfur atom or

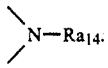

At the same time, $Ra_{11}$ represents a hydrogen atom, or a substituted or unsubstituted alkyl group having 1 to 3 carbon atoms. 1*a*, $ma_2$ $na_4$ independently represent an integer 0, 1, 2 or 3.

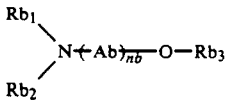

General formula [A-V]

In this formula $Rb_1$ and $Rb_2$ independently represent a hydrogen atom, alkyl group, alkoxy group, aryl group; or a nitrogen-containing heterocycle which may be formed by $Rb_1$ and $Rb_2$; or a nitrogen-containing heterocycle which may be formed by $Rb_1$ and Ab, or by $Rb_2$ and Ab. $Rb_3$ represents an alkyl group. Ab represents an alkylene group. nb represents an integer ranging from 0 to 6.

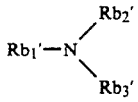

General formula [A-VI]

In this formula, $Rb_1'$ represents a hydroxy alkyl group having 2 to 6 carbon atoms. $Rb_2'$ and $Rb_3'$ independently represent a hydrogen atom; or an alkyl group having 1 to 6 carbon atoms; or a hydroxy alkyl group or benzyl group each having 2 to 6 carbon atoms; or —Cnb', $H_2$nb',

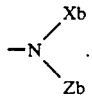

In these formulas, nb' represents an integer ranging from 1 to 6; Xb and Zb independently represent a hydrogen atom, an alkyl group having 1 to 6 carbon atoms or a hydroxy alkyl group having 2 to 6 carbon atoms.

The respective inventions are described in detail below.

The first invention is hereinunder described.

The first invention in the present application is a processing method for a silver halide color photographic light-sensitive material having at least one silver halide emulsion layer disposed on a support, wherein at least one emulsion layer contains silver iodo-bromide having more than 0.5 mol % of iodine content.

A light-sensitive material subject to the process of the invention is arbitrarily selected from those satisfying the previously specified conditions.

Light-sensitive material B, which is a standard sample for specifying the method of the invention, contains not only silver iodo-bromide with more than 0.5 mol % of iodine content, but a magenta coupler. This light-sensitive material B, when exposed and then subjected to a color developing process under the conditions of 38° C. and three minutes 15 seconds using the previously specified developer A, provides maximum magenta density M of M<2.0. The processing method of the invention is capable of produce a dye image of which maximum magenta density M available from the light-sensitive material B satisfies M≧2.0, when the light-sensitive material in compliance with the above conditions is subjected to color developing 2.5 minutes after the exposure in compliance with the above specified conditions. (As mentioned previously, light-sensitive material B is a standard sample for specifying the processing method. Correspondingly, any color light-sensitive material treated by the method of the invention is arbitrarily used, as far as it contains the above-mentioned type of silver iodo-bromide.)

Light-sensitive material B, i.e. a standard sample for specifying the processing method, may contain arbitrary magenta coupler, and have an arbitrary silver halide composition, as far as the composition comprises silver iodo-bromide with not less than 0.5 mol % of iodine. Any processing method is included in the scope of the invention, as far as the method is capable of satisfying M≧2.0 when subjecting light-sensitive material B having undergone exposure under a specific exposure condition to processing with a duration not longer than 2.5 minutes and if the same light-sensitive material having undergone exposure under the same specific exposure condition produces a magenta dye image with M<2.0 when treated in the above specified conditions using the above developer A.

The exposure condition for exposing light-sensitive material B used to specify the processing method is as follows; using a tungsten source, color temperature is adjusted to 4800° K. with a filter, in order to provide 3.2 CMS wedge exposure.

An arbitrary magenta coupler is contained in light-sensitive material B. For example, light-sensitive material B may contain, as a coupler, a compound of general formula [M-I].

A preferred embodiment of the processing method of the invention is a method being capable of forming a dye image of which magenta fog density in the non-exposure portion is less than 0.5, if light-sensitive material B is subjected to the above-mentioned processing with a duration of less than 2.5 minutes.

The first invention in the present application is further described in detail below.

A silver halide color photographic light-sensitive material used in the processing according to the invention contains, in at least one silver halide emulsion layer, silver iodo-bromide with not less than 0.5 mol % of silver iodide. However, the preferred light-sensitive material in embodying the invention has not less than 1.0 mol %, in particular, 3 to 10 mol %, or more favorably, 5 to 8 mol % of silver iodide content.

The scope of silver halide particles including the above-mentioned silver iodide is not specifically limited. However, in embodying the invention, the preferred silver halide particles are core/shell type silver halide particles, and tabular silver halide particles.

The core/shell type silver halide particles, and tabular silver halide particles respectively having silver iodide content of not less than 0.5 mol % are advantageously used in embodying the invention. These types of silver halide particles are hereinunder described in detail.

With the core/shell type silver halide emulsion particles advantageously used in embodying the invention, individual particles have a particle structure comprising more than two layers respectively having a different silver iodide content. The preferred silver halide particles are silver iodo-bromide particles, wherein a layer having maximum silver iodide content (referred to as shell) is any layer other than the outermost layer (referred to as core). The preferred silver iodide content in the internal layer (core), which has the maximum silver iodide content, is 6 to 40 mol %, in particular, 10 to 20 mol %. The preferred silver iodide content in the outermost layer (shell) is less than 6 mol %, in particular 0.1 to 4.0 mol %.

When using the core/shell type silver halide particles, the preferred proportion of shell portions is 10 to 80%, in particular, 15 to 70%, more specifically, 20 to 60%.

The preferred proportion of core portions among total particles is 10 to 80%, in particular, 20 to 50%.

According to the invention, if the silver halide particles are core/shell type particles, individually comprising a core portion having a higher silver iodide content and a shell portion having a lower silver iodide content, there may be a clear-cut border in terms of difference in iodine contents, or, otherwise, the content may continuously change from the core to shell portion. Additionally, such particles individually having an intermediate layer between the core and shell portions, whereby the silver iodide content of the intermediate layer is virtually an average of those of the core and shell portions.

When using core/shell type silver halide particles having the above-mentioned intermediate layers, the volume of intermediate layers is 5 to 60%, and, favorably, 20 to 55% of the total volume of all the particles. The difference in silver iodide content between the shell and the intermediate layer, as well as the difference in the intermediate layer and the core, should be respectively not less than 3 mol %. The difference in silver iodide content between the shell and the core should be favorably not less than 6 mol %.

When using the core/shell type silver halide particles in embodying the invention, the preferred average silver iodide content of such particles should be 4 to 20 mol %, in particular, 5 to 15 mol %. Also, such particles may contain silver chloride, as far as the amount of silver chloride does not deteriorate the effect of the invention.

The core/shell type emulsion used for a light-sensitive material subjected to the processing method of the invention may be prepared in compliance with known methods disclosed, for example, in Japanese Patent O.P.I. Publications No. 177535/1984, No. 138538/1985, No. 52238/1984, No. 143331/1985, No. 35276/1985 and No. 258536/1985.

When preparing core/shell type silver halide emulsion starting from seed particles, as in a method described in an example in Japanese Patent O.P.I. Publication No. 138538/1985, some particles may have, in the respective center portions, an area with a different silver halide composition. In such a method, the halide composition of the seed particles is arbitrarily selected from silver bromide, silver iodo-bromide, silver chloro-iodo-bromide, silver bromide, silver chloride and others. However, the preferred compositions are silver iodo-bromide or silver bromide respectively having not more than 10 mol % of silver iodide content. Additionally, the preferred proportion of seed particles to the total silver halide is not more than 50 mol %, in particular, less than 10 mol %.

The status of silver iodide distribution in the above-mentioned core/shell type silver halide particles is determined using various physical measuring methods. Such methods include the measurement of luminescence in a low temperature range, and the X-ray diffraction method both described in excerpts of lectures in 1981 Annual Meeting of the Photographic Society of Japan.

The above-mentioned core/shell type silver halide particles may be regular crystals such as cubic, tetrahedral or octahedral crystals, or may be twin crystals, or include mixture of any of these crystals. However, the regular crystals are advantageous.

The preferred core/shell type silver halide emulsion according to the invention is a monodispersed emulsion. A monodispersed silver halide emulsion means the emulsion of which weight of silver halide particles having particle sizes within ±20% of an average particle diameter $\bar{r}$ accounts for more than 60% of the total weight of silver halide particles. Preferably, this percentage is more than 70%, in particular, more than 80%.

The average particle diameter $\bar{r}$ is defined as $r^i$, where the product of frequency $n^i$ of particles individually having the particle diameter $r^i$ and $r^{i3}$. i.e. the product $n^i \times r^{i3}$ becomes maximum. (A least significant figure is rounded up or down to provide a three significant figures.)

The term "particle diameter" in this text means a diameter of an individual silver halide particle if it is a spherical crystal, or, a diameter of an circular image which is converted from a projected image of an individual silver halide particle having an area equal to that of the circular image if an individual particle is not spherical.

Additionally, the particle diameter may be determined by projecting an image of an individual silver halide particle magnified ten thousand times to fifty thousand times using an electron microscope, and, by actually measuring the diameter on a photographic print or the area of the projected image. (The number of particles to be measured is for more than one thousand of arbitrarily selected particles.)

The particularly preferred high-grade monodispersed emulsion has a distribution of less than 20%, or, more specifically, less than 15% when defined by the following expression for wideness of distribution;

$$\frac{\text{Standard deviation}}{\text{Average particle diameter}} \times 100 = \text{Wideness of distribution (\%)}$$

The average particle diameter as well as the standard deviation in this expression are determined by the previously defined $r^i$.

A monodispersed emulsion is prepared by a double jet precipitation method, wherein an aqueous solution of water soluble silver salt and an aqueous solution of water soluble halide are added to gelatin solution containing seed particles, with the pAg and pH being controlled. In specifying the rate of addition, Japanese Patent O.P.I. Publications No. 48521/1979 and No. 49938/1983 may be referred to.

Furthermore, as a method for preparing more improved monodispersed emulsion, a particle-growing method with the presence of tetrazaindene disclosed in Japanese Patent O.P.I. Publication No. 122935/1985 is applicable.

The scope of the present invention includes a case where an silver halide emulsion for forming at least one silver halide emulsion layer in a light-sensitive material to be processed in an emulsion having tabular silver halide particles. More specifically, with the preferred silver halide emulsion used for forming silver halide emulsion layer according to the invention, the silver halide particles are as follows:

(1) the previously mentioned core/shell type silver halide particles (2) the tabular silver halide particles (such tabular silver halide particles may be either core/shell type particles of another type of particles)

(3) the mixture of the above-defined (1) and (2).

Any of these types of silver halide particles are included as preferred embodiments in the invention.

The tabular silver halide particles advantageously used in embodying the invention are hereinunder described in detail.

When using the tabular silver halide particles in embodying the invention, the preferred diameters of these particles are five times as large as their thicknesses. Such tabular silver halide particles may be prepared using any conventional method such as described in Japanese Patent O.P.I. Publications No. 113930/1983, No. 113934/1983, No. 127921/1983, and No. 108532/1983. In consideration of image quality or the like, the preferred particle diameters are more than five times, in particular, five to 100 times, or, more specifically, seven to 30 times as large as the particles thicknesses. The preferred particle diameters are not less than 0.3 μm, in particular, 0.5 to 6 μm. When contained in at least one silver halide emulsion layer at a rate of at least 50% by weight, these tabular silver halide particles more advantageously attain the effect of the invention. If most of the silver halide particles are the above-defined tabular silver halide particles, the effect of the invention is optimized.

The present invention is especially effective when the tabular silver halide particles are core/shell type particles. In this case, the core/shell type particles should preferably satisfy all the requirements previously specified.

Generally, an tabular silver halide particle has two parallel faces. Accordingly, the "thickness" of such a particle is defined as a distance between the two parallel faces constituting an individual tabular silver halide particle.

The preferred halide composition of the tabular silver halide particles are silver iodo-bromide particles having a silver iodine content of not less than 0.5 mol %, in particular, 3 to 10 mol %.

The preparation of the tabular silver halide particles is hereinunder described.

The tabular silver halide particles may be prepared using arbitrarily combining methods known in the photographic art.

Such particles are obtained, for example, at first by forming seed crystals involving more than 40% by weight of tabular silver halide particles in a comparatively high pAg atmosphere of not more than 1.3 of pBr, and then, by growing the seed particles with silver and halogen solutions being simultaneously added while maintaining pBr value roughly constant.

However, in the course of particle growth, it is preferable that silver and halogen solutions be further added in order to prevent further generation of new crystal nuclei.

The sizes of the tabular silver halide particles are adjusted by controlling a temperature, by deliberately selecting the types and amounts of solutions, and by controlling the adding rates of silver salt and halide used during the particle growth.

Using a silver halide solvent in compliance with a specific requirement in the course of preparation of the tabular silver halide particles controls the particles sizes, particle configurations (diameter/thickness ratio and others), the particle size distribution, the growth rate of the particles. The amount of added silver halide solvent is $1\times10^{-3}$ to 1.0 weight %, or, preferably, $1\times10^{-2}$ to $1\times10^{-1}$ weight % per amount of a reaction solution.

Increasing the amount of silver halide solvent being added positively makes the silver halide particle size distribution more monodispersed, and accelerates the particle growth rate. On the other hand, the increase in the amount of silver halide solution at the same time increases the thicknesses of the silver halide particles.

The silver halide solvents useful in this process are ammonia solution, thioether solution, and thiourea solution. In using a thioether solution, U.S. Pat. Nos. 3,271,157, 3,790,387, 3,574,628 and others may be referred to.

In preparing the tabular silver halide particles, preferred methods are such that the adding rates, added amounts, adding concentratins of the silver salt solution (for example, aqueous $AgNO_3$ solution) and halide solutin (for example, aqueous KBr solution) are incrased in order to accelerate the particle growth.

For details of these methods, British Patent No. 1,335,925, U.S. Pat. Nos. 3,672,900, 3,650,757 and 4,424,445, and Japanese Patent O.P.I. Publications No. 142329/1980, No. 158124/1980 and others may be referred to.

The tabular silver halide particles may be chemically sensitized in compliance with a specific requirement. For the chemical sensitization method, the description of sensitization methods previously described for the core/shell type particles may be referred to. More specifically, in consideration of more economically using silver, the tabular silver halide particles should be preferably sensitized with a gold sensitization method or sulfur sensitization method or combination of these two methods.

In a layer containing the tabular silver halide particles, such particles should be present at a rate by weight of more than 40%, in particular, more than 60% per total silver halide particles of the same layer.

The silver halide color photographic light-sensitive materials subjected to the process of the invention are not limited only to the above-described materials, but include the materials having the tabular silver halide particles described below.

For example, Japanese Patent O.P.I. Publication No. 113930/1983 discloses a multi-layered color photographic light-sensitive material comprising a two-layered dye forming unit including an upper emulsion layer containing tabular silver halide particles with an aspect ratio of greater than 8:1; Japanese Patent O.P.I. Publication No. 113934/1983 discloses a multi-layered color photographic light-sensitive material comprising green-sensitive and red-sensitive layers containing tabular silver iodo-bromide or silver bromide emulsion of which particles having an aspect ratio of greater than 8:1, Japanese Patent O.P.I. Publication No. 113927/1983 discloses a multi-layered color photographic light-sensitive material having tabular silver halide particles having an aspect ratio of greater than 8:1, wherein the center region of individual particles has a higher silver iodine content than the outer circular region; Japanese Patent O.P.I. Publication No. 55426/1984 discloses a silver halide photographic light-sensitive material containing tabular silver halide particles having an aspect ratio of greater than 3:1 as well as a specific sensitizing dye, wherein the material may be also used as a color photographic light-sensitive material; Japanese Patent O.P.I. Publication No. 111696/1985 discloses a silver halide photographic light-sensitive material containing tabular silver halide particles having an aspect ratio of greater than 3:1, wherein the particles mainly composed of (111) faces. These silver halide color photographic light-sensitive materials may be subjected to the processing method of the invention.

It is also advantageous to incorporate silver halide particles having epitaxy bonds described in Japanese Patent O.P.I. Publication No. 103725/1978 and the like into emulsions of the invention.

The present invention is applicable to any silver halide color photographic light-sensitive material containing, in at least one silver halide emulsion layer, silver halide particles with silver iodine (the preferred embodiment of such silver halide particles are the previously defined core/shell type silver halide particles and/or tabular silver halide particles). All or only one of the silver halide emulsion layers disposed on a support may contain the above-mentioned silver halide particles with the above-mentioned silver iodide.

One preferred embodiment of the invention is a silver halide color photographic light-sensitive material of which total silver halide applied on a support is at a rate of more than 30 mg per 100 $cm^2$, or, preferably, 30 to 150 mg per 100 $cm^2$, in particular, 30 to 100 mg per 100 $cm^2$ support. In addition, generally speaking, a silver halide emulsion layer nearer to the support should preferably have a greater silver amount.

The silver halide color photographic light-sensitive material used in embodying the invention should preferably contain a compound capable of releasing (or allowing elution of), in the course of color developing, an inhibitor which forms silver salt with the solubility product with silver ion of not more than $1\times10^{-9}$.

A compound advantageously used in embodying the invention and capable of releasing, in the course of color developing, an inhibitor which forms silver salt with the solubility product with silver ion of not more than $1\times10^{-9}$ may be a compound which is present as an inhibitor precursor within a predeveloping light-sensitive material and capable of releasing an inhibitor in the course of developing, or a compound which is present as an inhibitor within the light-sensitive material and capable of being eluted into a color developer solution in the course of developing. According to the invention, a DIR compound, tetrazaindene derivative, and 6-aminopurine derivative are advantageously used. Among them, a DIR compound is especially favorably used, as being capable of excellently attaining the objects of the invention. In addition to the DIR compound, a compound being capable of releasing a development inhibitor upon developing is included in the scope of the invention. The examples of such a compound include those described in U.S. Pat. Nos. 3,297,445, and 3,379,529, West German OLS No. 2,417,914, and Japanese Patent O.P.I. Publications No. 15271/1977, No. 9116/1978, No. 123838/1984 and No. 127038/1984.

A DIR compound advantageously incorporated in a light-sensitive material used in embodying the invention is a compound being capable of releasing a development inhibitor upon reaction with an oxidation product of a color developing agent.

Such a DIR compound, because releasing a development inhibitor in the course of color development, prevents eccessive color developing in processing steps following the color developing, thus supressing eccessive increase in image density and providing an image which is in compliance with a designed tone pattern and preventing hardness of the image.

The typical examples of such a DIR compound include DIR couplers individually incorporating, into the active site of the coupler, a group being capable of forming a compound having development inhibition activity once split off the active site. These DIR couplers are describe, for example, British Patent No. 935,454, U.S. Pat. Nos. 3,227,544, 4,095,984 and 4,149,386.

With the above-mentioned DIR couplers, a parent nucleus of coupler is capable of not only forming dye upon coupling reaction with an oxidation product of a color developing agent but releasing a development inhibitor. According to the invention, additionally, a compound capable of releasing a development inhibitor upon coupling reaction with an oxidation product of a color developing agent though not releasing a development inhibitor may be used as a DIR compound. The examples of such a compound are described in U.S. Pat. Nos. 3,652,345, 3,928,041, 3,958,993, 3,961,959, and 4,052,213, and Japanese Patent O.P.I. Publications No. 110529/1978, No. 13333/1979, and 161237/1980.

Furthermore, according to the invention, a so-called timing DIR compound may be used. With a timing DIR compound, when it is allowed to react with an oxidation product of a color developing agent, the parent nucleus is capable of forming a dye or a colorless compound, and, at the same time, the split timing group release a development inhibitor by intramolecular nucleophilic substitution reaction or elimination reaction. The examples of such a timing DIR compound are described in Japanese Patent O.P.I. Publications No. 145135/1979, No. 114946/1981, and 154234/1982.

Additionally, other useful timing DIR compounds are those described in Japanese Patent O.P.I. Publication Nos. 160954/1983 and 162949/1983, wherein the above-described timing group connects to a coupler nucleus being capable of forming a perfectly diffusible dye upon reaction with an oxidation product of a color developing agent.

More advantageous DIR compounds may be represented the following general formula [D] or (D-1). The most advantageous DIR compounds are the compounds represented by the following general formula (D-1) and having diffusibility greater than 0.40.

General formula [D]

$$Ad_1—Zd_1$$

In this formula, $Ad_1$ represents a coupler component (compound) being capable of coupling with an oxidation product of p-phenylenediamine color developing agent. More specifically, the examples of such a coupler component are as follows: dye forming couplers including closed-chain ketomethylene compounds such as acylacetanilide, and acyl acetate; pyrazolones, pyrazolotriazoles, pyrazolinobenzimidazoles, indazolones, phenols, and naphthols; and coupling components, which do not form dyes, such as acetophenones, indanones, and oxazolones.

In the above formula, $Zd_1$ represents a component (compound) being capable of split off upon reaction with an oxidation product of p-phenylenediamine color developing agent, and inhibit development of silver halide. The preferred examples of such a compound include heterocyclic compounds such as benzotriazole, 3-octylthio-1,2,4-triazole; and heterocyclic mercapto compounds (as an example of heterocyclic mercapto compound, 1-phenyltetrazolylthio group or the like is available).

The examples of the above-mentioned heterocyclic group include a tetrazolyl group, thiazolyl group, oxadiazolyl group, thiazolyl group, oxazolyl group, imidazolyl group, triazolyl group and the like.

In the above general formula [D], $Zs_1$ is bonded to the active site on $Ad_1$.

Diffusibility of the above DIR compound may be evaluated using the following procedure.

Light-sensitive material samples (a) and (b) respectively comprising layers of the following compositions being disposed on a transparent support.

Sample (a): Sample having a green-sensitive silver halide emulsion layer

Gelatin coating solution containing silver iodo-bromide (silver iodide, 6 mol %; average particle size, 0.48 μm) spectrally sensitized to have green-sensitivity, as well as the following coupler at a rate of 0.07 mol per mol silver, is applied so that the amount of coated silver is at a rate of 1.1 g/m², and the amount of deposited gelatin in 3.0 g/m². Upon this emulsion layer is formed a protective layer, by applying gelatin coating solution containing silver iodo-bromide (silver iodide, 2 mol %; average particle size, 0.008 μm) not undergone either chemical or spectral sensitization, so that the amount of coated silver is at a rate of 0.1 g/m² and the amount of deposited gelatin is 0.8 g/m².

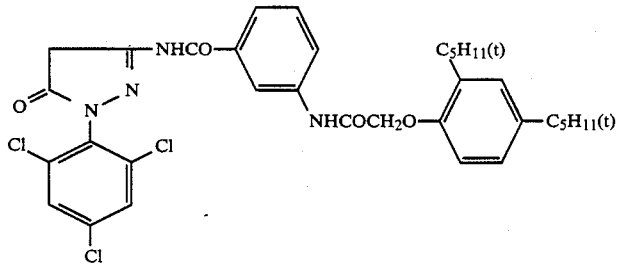

Sample (b): Identical with the above Sample (a), except that silver iodo-bromide not contained in the protective layer.

Each layer incorporates, in addition to the above components, a gelatin-hardening agent and a surfactant.

Samples (a) and (b) are subjected to white exposure using an optical wedge, and the treated in the following manner. One developer solution contains various types of development inhibitors with a total amount to suppress the sensitivity of Sample (b) to 60% (in logarithmic expression, $-\Delta \log E=0.22$). The other developer solution does not contain such inhibitors.

| Processing (38° C.) | |
|---|---|
| Color developing | 2 min 40 sec |
| Bleaching | 6 min 30 sec |
| Washing | 3 min 15 sec |
| Fixing | 6 min 30 sec |
| Stabilizing | 1 min 30 sec |
| Drying | |

Compositions of the processing solutions used in the respective processing steps are as follows:

| (Color developer solution) | |
|---|---|
| 4-amino-3-methyl-N-ethyl-N-(β-hydroxyethyl)-aniline sulfate | 4.75 g |
| Sodium sulfite anhydride | 4.25 g |
| Hydroxylamine.½ sulfate | 2.0 g |
| Potassium carbonate anhydride | 37.5 g |
| Trisodium nitrilotriacetage (monohydride) | 2.5 g |
| Potassium hydroxide | 1.0 g |

Water is added to the above components to prepare one liter solution.

| (Bleacher) | |
|---|---|
| Ferric ammonium ethylenediamine tetraacetate | 100 g |
| Diammonium ethylenediamine tetraacetate | 10.0 g |
| Ammonium bromide | 150.0 g |
| Glacial acetic acid | 10.0 g |

Water is added to the above components to prepare one liter solution, which is adjusted to pH=6.0 using aqueous ammonium.

| (Fixer) | |
|---|---|
| Ammonium thiosulfate | 175.0 g |
| Sodium sulfite anhydride | 8.5 g |
| Sodium metasulfite | 2.3 g |

Water is added to the above components to prepare one liter solution, which is adjusted to pH=6.0 using acetic acid.

| (Stabilizer) | |
|---|---|
| Formalin (37% aqueous solution) | 1.5 ml |
| Konidax (manufactured by Konica Corporation) | 7.5 ml |

Water is added to the above components to prepare one liter solution.

Assuming that the sensitivity of Sample (a) with a development inhibitor not added is $S_O'$ the sensitivity of Sample (b) with a development inhibitor not added is $S_O'$, and that the sensitivity of Sample (a) with a development inhibitor added is $S_A$, and the sensitivity of Sample (b) with development inhibitor added is $S_B$, the following expressions are valid:

| | |
|---|---|
| Desensitization ratio: | $\Delta S = S_0 - S_A$ |
| Desensitization ratio: | $\Delta S = S_0' - S_B$ |

-continued

| |
|---|
| Diffusibility = $\Delta S/\Delta S_0$ |

wherein each sensitivity is defined as a logarithmic number (−log E) of a reciprocal of an exposure amount corresponding with a density status of "fog density + 0.3".

Diffusibility of several types of development inhibitors, determined in this method, is listed in the following table.

TABLE

| Structure | Amount added (mol/l) | Desensitization $\Delta S_0$ | Desensitization $\Delta S$ | Diffusibility $\Delta S/\Delta S_0$ |
|---|---|---|---|---|
| 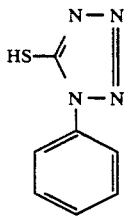 | $1.3 \times 10^{-5}$ | 0.22 | 0.05 | 0.23 |
| 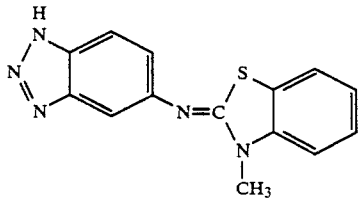 | $1.3 \times 10^{-5}$ | 0.23 | 0.08 | 0.34 |
| 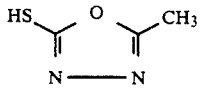 | $2.5 \times 10^{-5}$ | 0.22 | 0.10 | 0.45 |
| 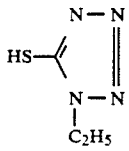 | $3.0 \times 10^{-5}$ | 0.21 | 0.10 | 0.48 |
| 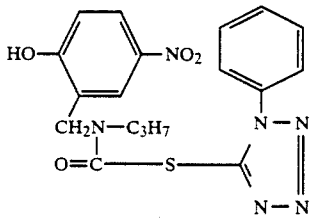 | $1.4 \times 10^{-5}$ | 0.23 | 0.11 | 0.48 |
| 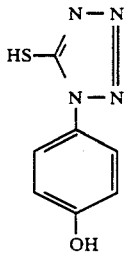 | $2.5 \times 10^{-5}$ | 0.22 | 0.13 | 0.59 |
| 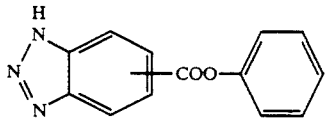 | $3.5 \times 10^{-5}$ | 0.23 | 0.15 | 0.65 |

TABLE-continued

| Structure | Amount added (mol/l) | Desensitization $\Delta S_0$ | Desensitization $\Delta S$ | Diffusibility $\Delta S/\Delta S_0$ |
|---|---|---|---|---|
| 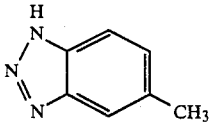 | $4.3 \times 10^{-5}$ | 0.22 | 0.16 | 0.73 |
| 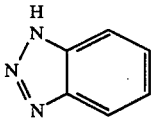 | $1.7 \times 10^{-5}$ | 0.21 | 0.20 | 0.95 |

Next, a compound indicating diffusibility of greater than 0.40 and therefore favorably used in embodying the invention, that is, a compound represented by the previously mentioned general formula (D-1) and known as a diffusible DIR compound is hereinunder described.

As the diffusible DIR compound, any compound having any chemical structure may be used, as far as the compound releases a group of which diffusibility is within the above-defined range.

The typical structural formula of general formula (D-1) is given below.

General formula (D-1)

$$A_d\text{-}(Y_d)M_d$$

wherein Ad represents a coupler residue; md represents 1 or 2; Yd represents a group being capable of split off upon reaction with an oxidation product of a color developing agent by coupling with the coupling site on the coupler residue A, and, more specifically, represents a group being capable of releasing a development inhibitor group or development inhibitor with diffusibility of greater than 0.40.

Yd in general formula (D-1) is typically represented each of the following general formulas (D-2) through (D-19).

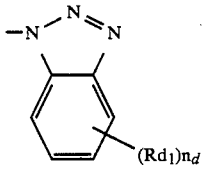

General formula (D-2)

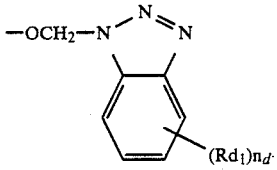

General formula (D-3)

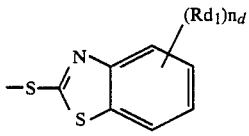

General formula (D-4)

-continued

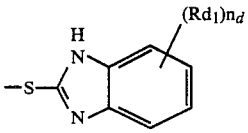

General formula (D-5)

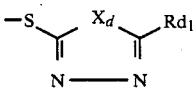

General formula (D-6)

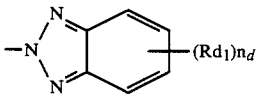

General formula (D-7)

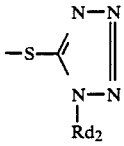

General formula (D-8)

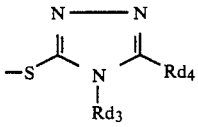

General formula (D-9)

In general formulas (D-2) through (D-19), $Rd_1$ represents a hydrogen atom or halogen atom, or an alkyl group, alkoxy group, acylamino group, alkoxycarbonyl group, thiazolydene group, aryloxcarbonyl group, acyloxy group, carbamoyl group, N-alkylcarbamoyl group, N,N-dialkycarbamoyl group, nitro group, amino group, N-arylcarbamoyloxy group, sulfamoyl group, N-alkylcarbamoyloxy group, hydroxy group, alkoxycarbonylamino group, alkylthio group, arylthio group, aryl group, heterocyclic group, cyano group, alkylsufonyl group or aryloxycarbonylamino group. nd represents 0, 1 or 2. When nd is 2, Rd s may be identical or different with each other. The total number of carbon atoms contained within n units of $Rd_1$s ranges from 0 to 10. Additionally, the total number of carbon atoms contained within $Rd_1$s in general formula (D-6) ranges from 0 to 15.

Xd in this general formula (D-6) represents an oxygen atom or a sulfur atom.

In general formula (D-8), $Rd_2$ represents an alkyl group, aryl group or heterocyclic group.

In general formula (D-8), $Rd_3$ represents a hydrogen atom, or an alkyl group, cycloalkyl group, aryl group or heterocyclic group. $Rd_4$ represents a hydrogen atom or halogen atom, or an alkyl group, cycloalkyl group, aryl group, acylamino group, alkoxycarbonylamino group, aryloxycarbonylamino group, alkanesulfonamide group, cyano group, heterocyclic group, alkylthio group or amino group.

If $Rd_1$, $Rd_2$, $Rd_3$ or $Rd_4$ represents an alkyl group, such an alkyl group may have a substituent, and be either straight-chained or branched.

If $Rd_1$, $Rd_2$, $Rd_3$ or $Rd_4$ represents an aryl group, such an alkyl group may have a substituent.

If $Rd_1$, $Rd_2$, $Rd_3$ or $Rd_4$ represents a heterocyclic group, such a heterocyclic group may have a substituent. More specifically, such a heterocyclic group is a five- or six-membered single or condensed ring containing at least one hereto atom selected from a nitrogen atom oxygen atom and sulfur atom. The preferred heterocyclic group is selected from a pyridyl group, quinolyl group, furil group, benzothiazolyl group, oxazolyl group, imidazolyl group, thiazolyl group, triazolyl group, benzotriazolyl group, imide group, oxadine group and the like.

The number of carbon atoms contained in $Rd_2$ of general formula (D-6) or (D-8) is 0 to 15.

The number of carbon atoms contained in $Rd_3$ or $Rd_4$ of general formula (D-9) is 0 to 15.

General formula (D-10)

-TIME-INHIBIT

In this formula, TIME group is a group being capable of bonding to the coupling site on A and also capable of split off upon reaction with an oxidation product of a color developing agent; once split off from the coupler, this group controllingly releases an INHIBIT group. The INHIBIT group is a group which serves, once released as mentioned above, as a development inhibitor (a group, for example, represented any of the above-mentioned general formulas (D-2) through (D-9)).

-TIME-INHIBIT group is general formula (D-10) is typically represented by any of the following general formulas (D-11) through (D-19).

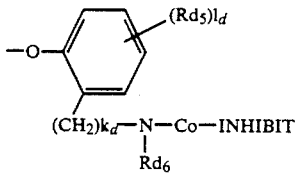

General formula (D-11)

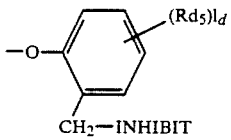

General formula (D-12)

-continued

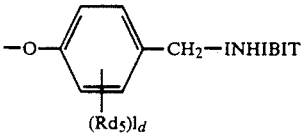

General formula (D-13)

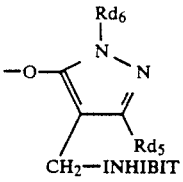

General formula (D-14)

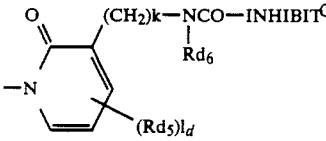

General formula (D-15)

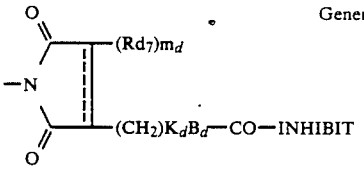

General formula (D-16)

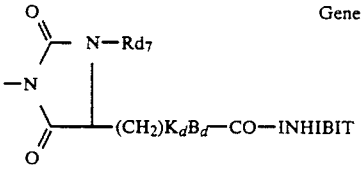

General formula (D-17)

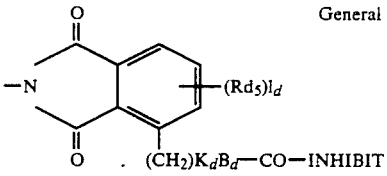

General formula (D-18)

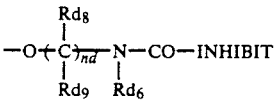

General formula (D-19)

In general formula (D-11) through (D-15) and (D-18), $Rd_5$ represents a hydrogen atom or halogen atom, or an alkyl group, cycloalkyl group, alkenyl group, aralkyl group, alkoxy group, alkoxycarbonyl group, anilino group, acylamino group, ureide group, cyano group, nitro group, sulfonamide group, sulfamoyl group, carbamoyl group, aryl group, carboxy group, sulfo group, hydroxy group or alkanesulfonyl group. In regards to general formulas (D-11) through (D-13), (D-15) and (D-18), $Rd_5$s may bond together to form a condensed ring. In general formulas (D-11), (D-14), (D-15) and (D-19), $Rd_5$ represents an alkyl group, alkenyl group, aralkyl group, cycloalkyl group, heterocyclic group or aryl group. In general formulas (D-16) and (D-17), $Rd_7$ represents a hydrogen atom, or alkyl group, alkenyl group, aralkyl group, cycloalkyl group, heterocyclic group or aryl group. $Rd_8$ and $Rd_9$ in general formula (D-19) independently represent a hydrogen atom, or an alkyl group (favorably, an alkyl group having 1 to 4 carbon atoms). k in general formulas (D-11), (D-15) through (D-18) represents an integer 0, 1 or 2. $l_d$ in general formulas (D-11), (D-15) through (D-18) represents an integer 1 to 4. $m_d$ in general formula (D-16) represents an integer 1 or 2. If $m_d$ is 2, the respective $Rd_7$ may be either identical or different with each other. $n'_d$ in general formula (D-19) represents an integer 2 to 4. $n'_d$ units of respective $Rd_8$s or $Rd_9$s may be either identical or different with each other. B in general formulas (D-16) through (D-18) represents an oxygen atom, or $$-\underset{\underset{Rd_6}{|}}{N}-$$

($Rd_6$ is identical with the previously defined $Rd_6$). ═ in general formula (D-16) means either single bond or double bond is possible. In the case of single bond, $m_d$ represents 2; in the case of double bond, $m_d$ represents 1. The definition of INHIBIT group is identical with a group represented by any of general formulas (D-2) through (D-9), except the number of carbon atoms.

With an INHIBIT group, the total number of carbon atoms within $R_1$s in one molecule represented any of general formulas (D-2) through (D-7) is 0 to 32. The number of carbon atoms within $R_2$s in one molecule represented general formula (D-8) is 1 to 32. The total number of carbon atoms within $Rd_3$s and $Rd_4$s in one molecule represented general formula (D-9) is 0 to 32.

When $Rd_5$, $Rd_6$ or $Rd_7$ represents an alkyl group, aryl group or cycloalkyl group, such a group may have a substituent.

Among diffusible DIR compounds, the preferred is a compound of which Yd is represented by general formula (D-2), (D-3) or (D-10). With the examples of Yd represented by (D-10), those preferred have an INHIBIT group represented by any of general formulas (D-2), (D-6) (especially when Xd is general formula (D-6) is an oxygen atom), and (D-8) (especially when $Rd_2$ is general formula (D-8) is a hydroxyaryl group; or an alkyl group having 1 to 3 carbon atoms).

The examples of a coupler component represented by Ad in general formula (D-1) include a yellow dye image-forming coupler residue, magenta dye image-forming coupler residue, cyan dye-image forming coupler residue, and colorless coupler residue.

The typical examples of the preferred diffusible DIR compounds useful in embodying the invention are those described, for example, in U.S. Pat. Nos. 4,234,678, 3,227,554, 3,617,291, 3,958,993, 4,149,886, and 3,933,500, Japanese Patent O.P.I. Publication Nos. 56837/1982, and 13239/1976, U.S. Pat. Nos. 2,072,363, and 2,070,266, and Research Disclosure, 1981, Dec., No. 21228.

When incorporating any of the above-mentioned DIR compounds into the light-sensitive material of the invention, the preferred amount of addition is 0.0001 to 0.1 mol, in particular, 0.001 to 0.05 mols per mole silver halide.

In embodying the invention, a DIR compound represented by general formula (D-1) among those described above is capable of much excellent effects.

The typical examples of DIR compounds represented general formula [D] or (D-1) are listed below. However, the scope of the invention is not limited only to these compounds.

(Example compounds of general formula [D]).

| Example compound No. | $R_d^1$ | $R_d^2$ | $Y_d^1$ |
|---|---|---|---|
| $R_d^1-COCH(Y_d^1)CO-R_d^2$ | | | |
| D-I-1 | (2) | (4) | (78) |
| D-I-2 | (2) | (4) | (55) |
| D-I-3 | (2) | (3) | (38) |
| D-I-4 | (2) | (3) | (30) |
| D-I-5 | (1) | (1) | (30) |
| D-I-6 | (67) | (67) | (34) |
| D-I-7 | (7) | (68) | (84) |
| D-I-8 | (58) | (58) | (30) |
| D-I-9 | (2) | (4) | (91) |
| D-I-10 | (2) | (4) | (90) |
| D-I-11 | (62) | (62) | (76) |
| D-I-12 | (68) | (68) | (80) |
| D-I-13 | (66) | (74) | (81) |
| D-I-14 | (66) | (64) | (82) |
| D-I-15 | (2) | (4) | (83) |
| D-I-16 | (5) | (6) | (31) |
| D-I-17 | (67) | (67) | (34) |
| D-I-18 | (2) | (4) | (32) |
| 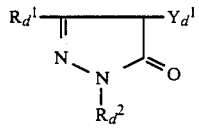 | | | |
| D-I-19 | (69) | (10) | (30) |
| D-I-20 | (70) | (10) | (87) |
| D-I-21 | (12) | (7) | (34) |
| D-I-22 | (11) | (10) | (79) |
| D-I-23 | (7) | (72) | (32) |
| D-I-24 | (15) | (73) | (92) |
| D-I-25 | (71) | (10) | (36) |
| D-I-26 | (9) | (10) | (30) |
| D-I-27 | (12) | (13) | (35) |
| D-I-28 | (60) | (10) | (85) |
| D-I-29 | (59) | (10) | (86) |
| D-I-30 | (57) | (10) | (30) |
| D-I-31 | (75) | (72) | (78) |
| 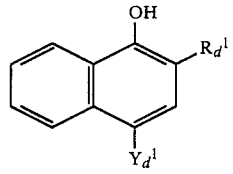 | | | |
| D-I-32 | (63) | | (78) |
| D-I-33 | (63) | | (40) |
| D-I-34 | (65) | | (93) |
| D-I-35 | (65) | | (38) |
| D-I-36 | (63) | | (43) |
| D-I-37 | (63) | | (77) |
| D-I-38 | (19) | | (95) |
| D-I-39 | (94) | | (47) |
| D-I-40 | (21) | | (47) |
| D-I-41 | (19) | | (46) |
| D-I-42 | (94) | | (46) |

The symbols representing substituents $Rd^1$, $Rd^2$ and $Yd^1$ in the above tables are used for convenience of classifying the compounds of general formula [D].

D-I-43
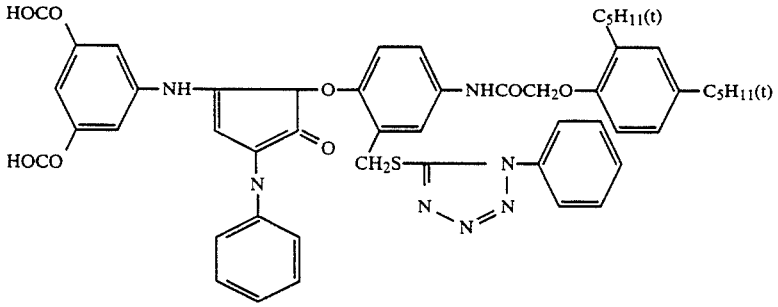
D-I-44
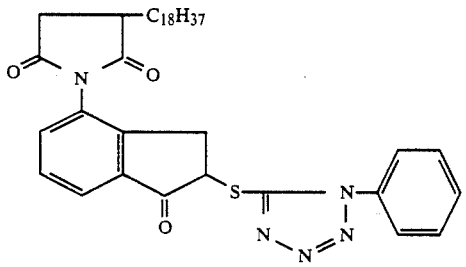
D-I-45
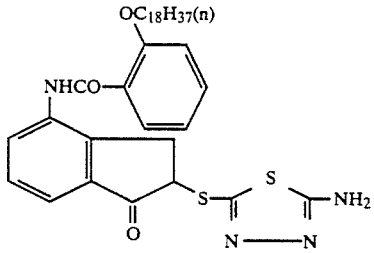
D-I-46
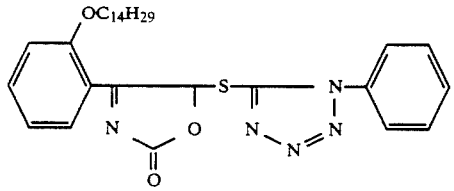
D-I-47
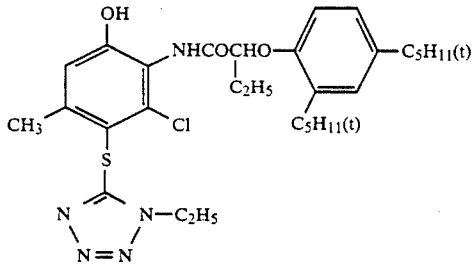
D-I-48
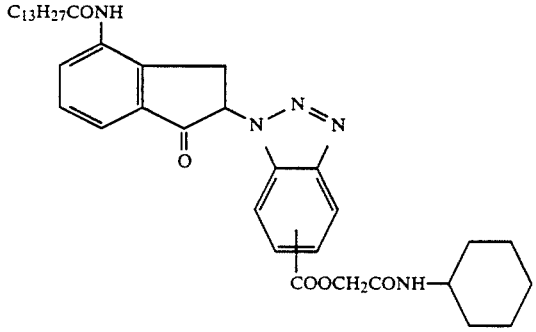

(Example compounds of general formula (D-1)
D'-1
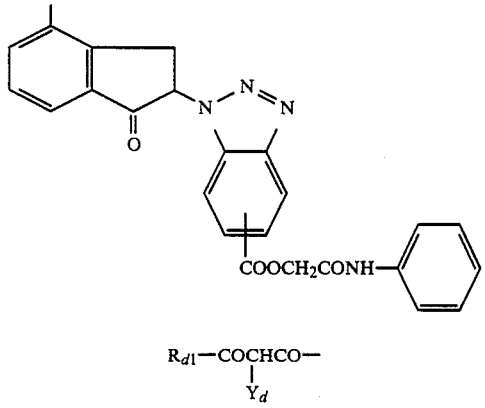
| Example compound No. | $R_{d1}$ | $R_{d2}$ | $Y_d$ |
|---|---|---|---|
| D'-2 | (1) | (1) | (30) |
| D'-3 | (2) | (3) | (30) |
| D'-4 | (2) | (4) | (30) |
| D'-5 | (5) | (6) | (31) |
| D'-6 | (2) | (4) | (32) |
| D'-7 | (2) | (3) | (32) |
| D'-8 | (7) | (8) | (33) |
| D'-33 | (2) | (4) | (55) |
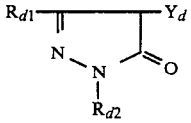
| | | | |
|---|---|---|---|
| D'-9 | (9) | (10) | (30) |
| D'-10 | (11) | (10) | (30) |
| D'-11 | (12) | (7) | (34) |
| D'-12 | (12) | (13) | (35) |
| D'-13 | (9) | (14) | (36) |
| D'-14 | (15) | (16) | (37) |
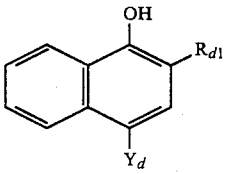
| | | |
|---|---|---|
| D'-15 | (17) | (38) |
| D'-16 | (17) | (39) |
| D'-17 | (18) | (40) |
| D'-18 | (20) | (41) |
| D'-19 | (18) | (42) |
| D'-20 | (18) | (43) |
| D'-21 | (18) | (44) |
| D'-22 | (18) | (45) |
| D'-23 | (19) | (46) |
| D'-24 | (21) | (47) |
| D'-25 | (21) | (48) |
| D'-26 | (22) | (49) |
| D'-27 | (22) | (50) |
| D'-28 | (22) | (51) |
| D'-29 | (23) | (52) |
| D'-30 | (18) | (53) |
| D'-31 | (18) | (54) |
| D'-32 | (23) | (49) |
| D'-33 | (63) | (96) |
(1) through (95) in the tables above represent the following species.
(1)
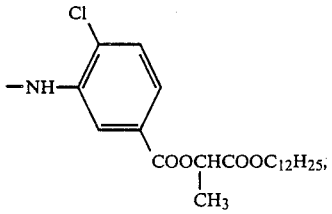
(2)
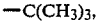
(3)
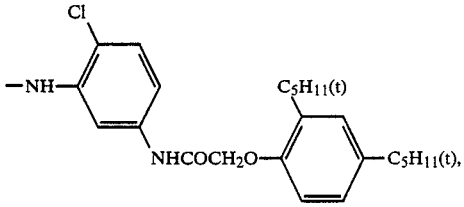
(4)
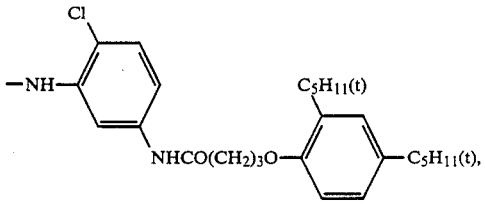
(5)
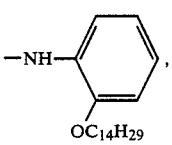
(6)
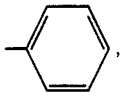
(7)
(8)
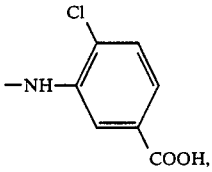
(9)
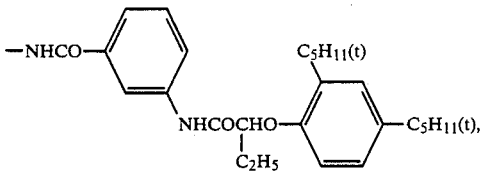
(10)
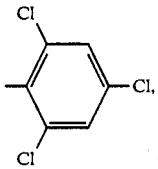

-continued
(11)
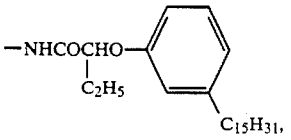
(12) $-C_{17}H_{35}$,
(13)
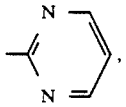
(14)
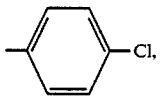
(15) $-CH_3$,
(16)
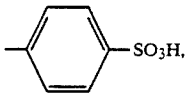
(17) $-CONHC_{18}H_{37}$,
(18)
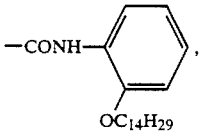
(19)
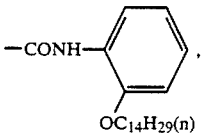
(20)
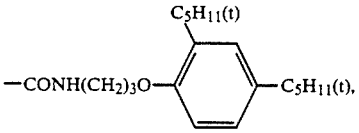
(21)
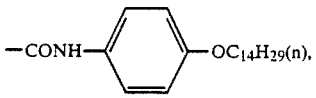
(22) $-CONHCH_2CH_2COOH$
(23) $-CONHCH_2CH_2COOCH_3$
(30)
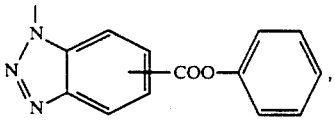
(31)
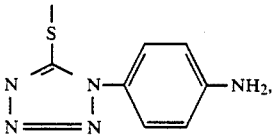
-continued
(32)
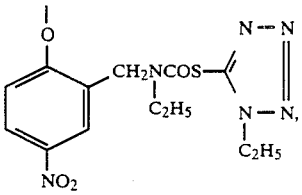
(33)
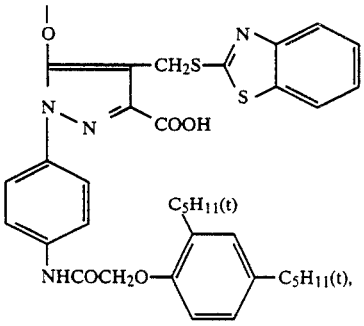
(34)
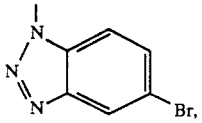
(35)
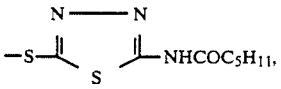
(36)
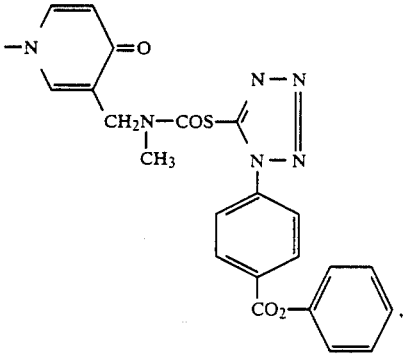
(37)
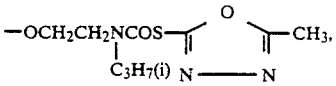
(38)
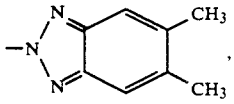
(39)
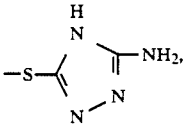

-continued
(40)
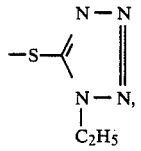
-continued
(41)
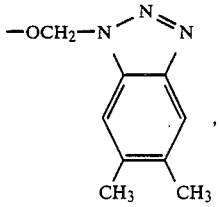
The other preferred examples of DIR compounds advantageously used are the following example compounds. [Example compounds]
($D^{\alpha}$-1)
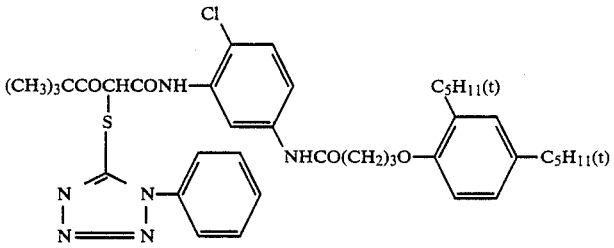
($D^{\alpha}$-2)
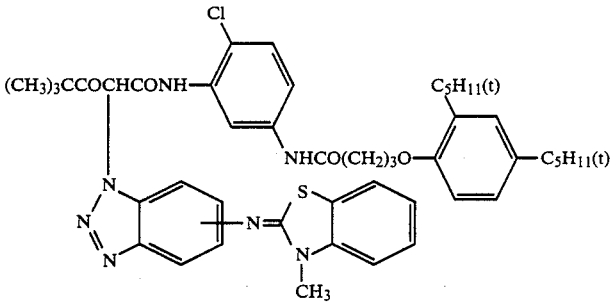
($D^{\alpha}$-3)
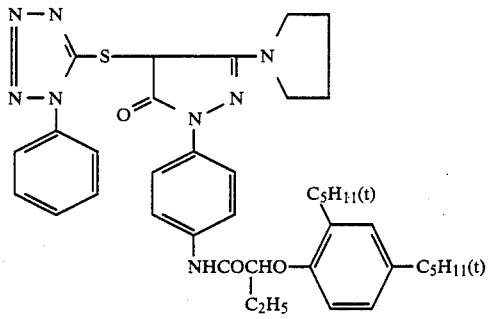
($D^{\alpha}$-4)
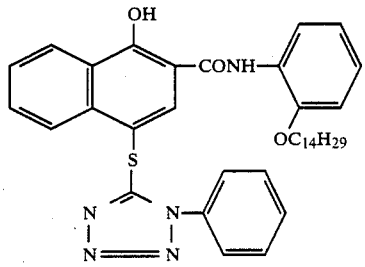

-continued
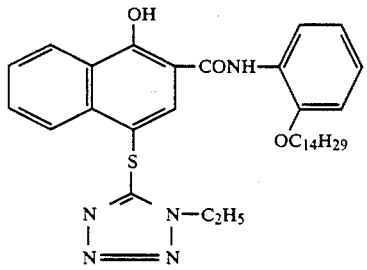
($D^{\alpha}$-5)
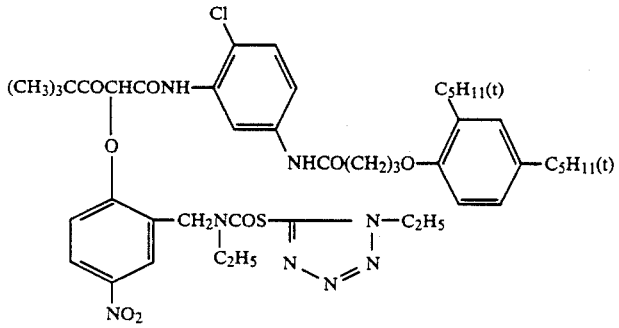
($D^{\alpha}$-6)
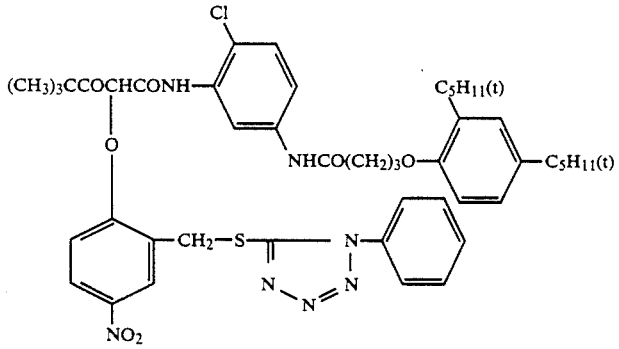
($D^{\alpha}$-7)
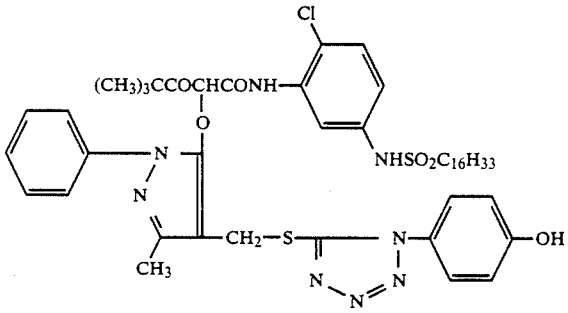
($D^{\alpha}$-8)
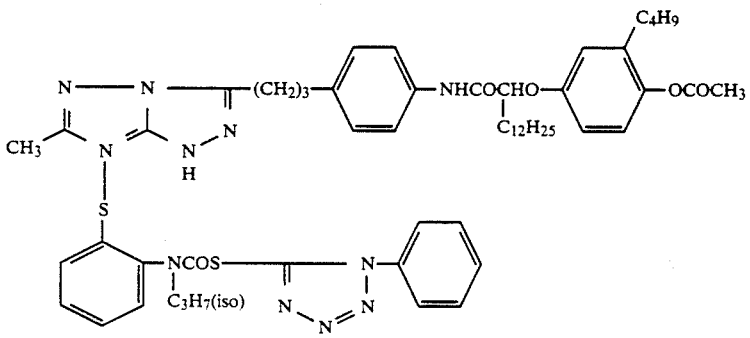
($D^{\alpha}$-9)

-continued
(D$^{\alpha}$-10)
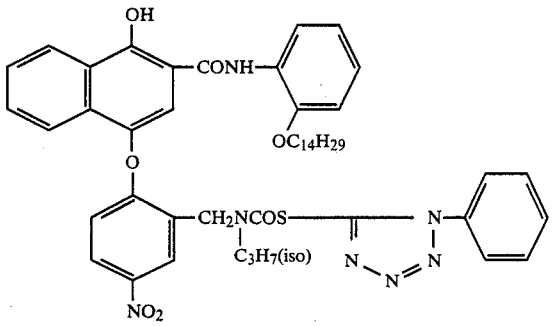
(D$^{\alpha}$-11)
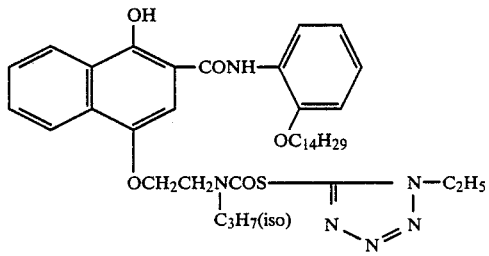
(D$^{\alpha}$-12)
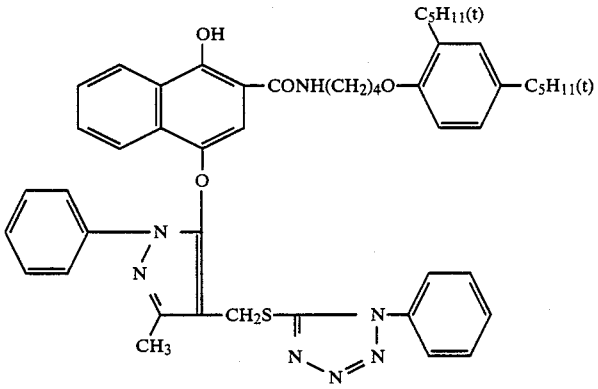
(D$^{\alpha}$-13)
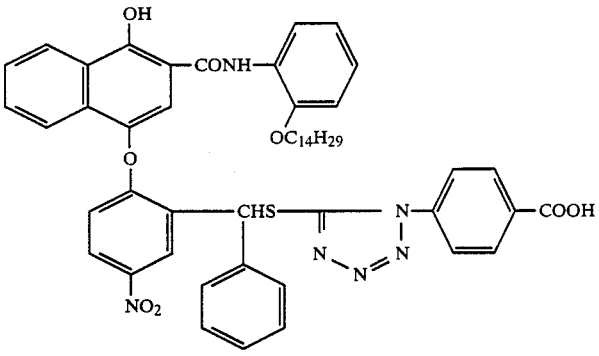
(D$^{\alpha}$-14)
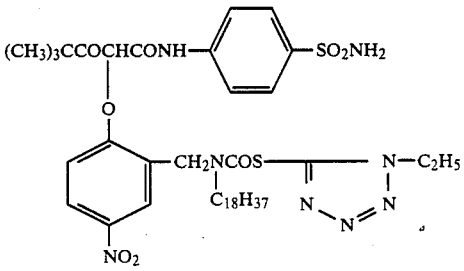

-continued
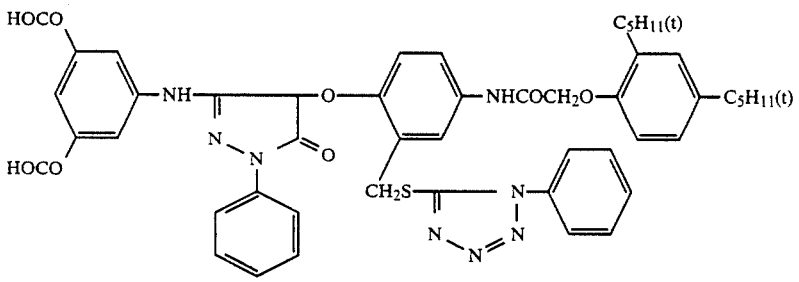
(D$^{\alpha}$-15)
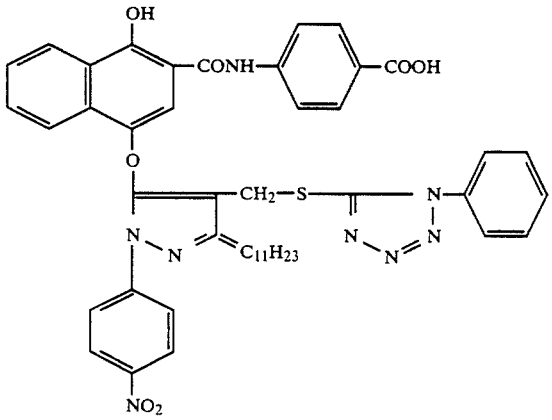
(D$^{\alpha}$-16)
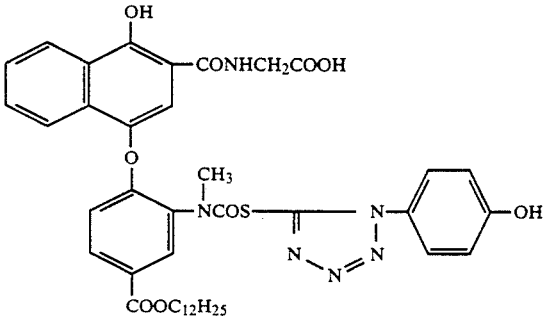
(D$^{\alpha}$-17)
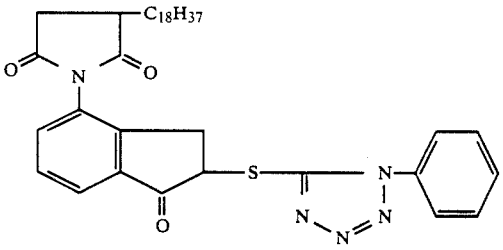
(D$^{\alpha}$-18)
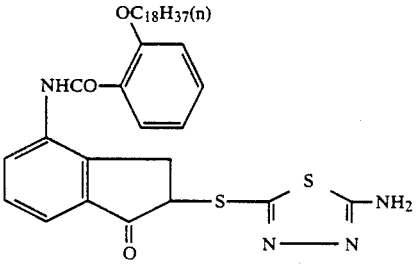
(D$^{\alpha}$-19)

-continued
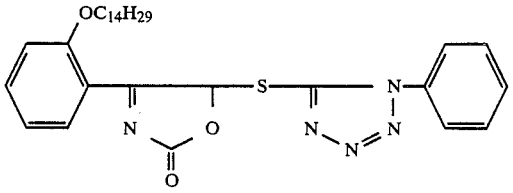
(Dα-20)
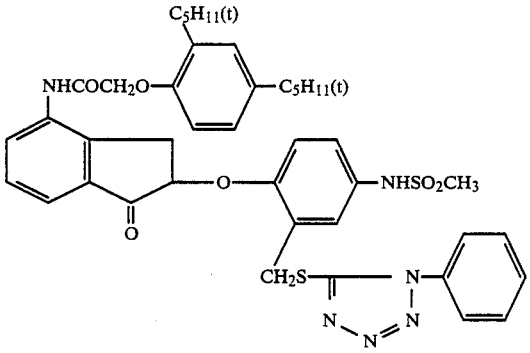
(Dα-21)
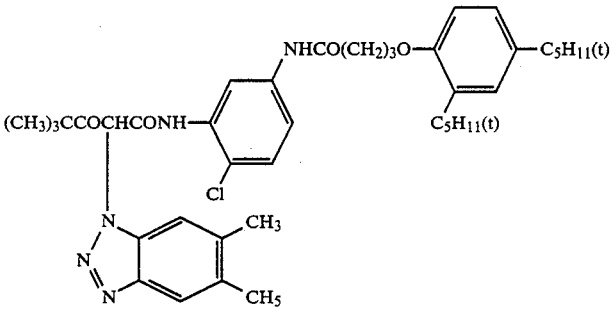
(Dα-22)
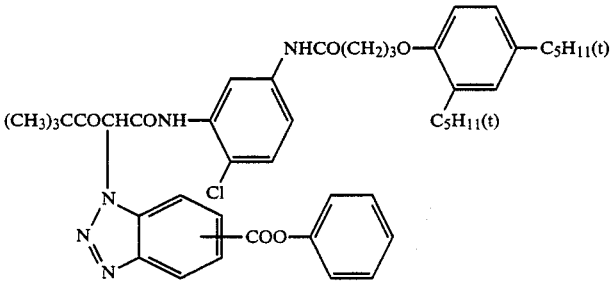
(Dα-23)
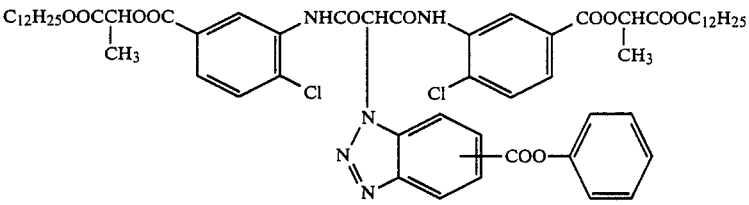
(Dα-24)
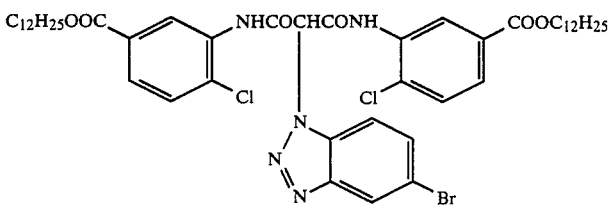
(Dα-25)

-continued
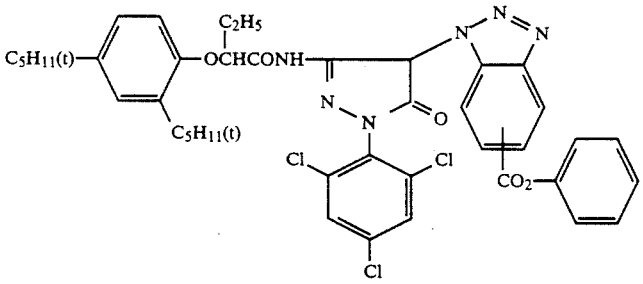
(D$^{\alpha}$-26)
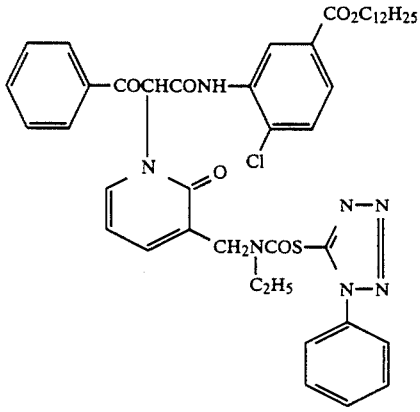
(D$^{\alpha}$-27)
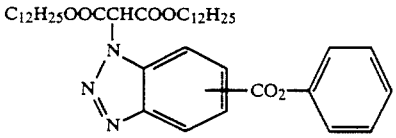
(D$^{\alpha}$-28)
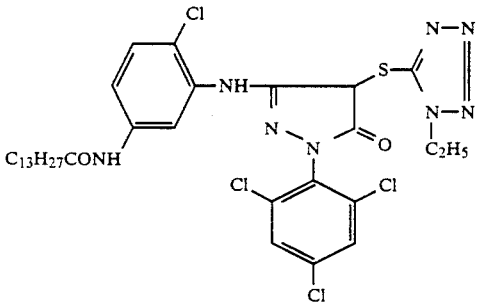
(D$^{\alpha}$-29)
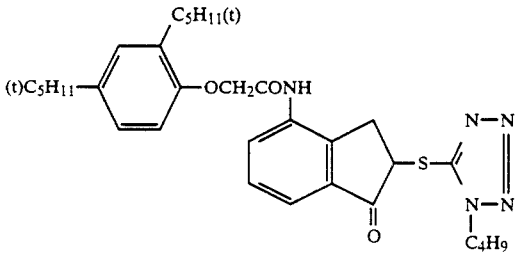
(D$^{\alpha}$-30)

-continued
(D$^{\alpha}$-31)
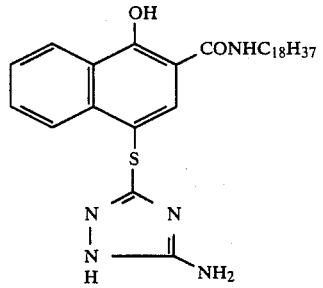
(D$^{\alpha}$-32)
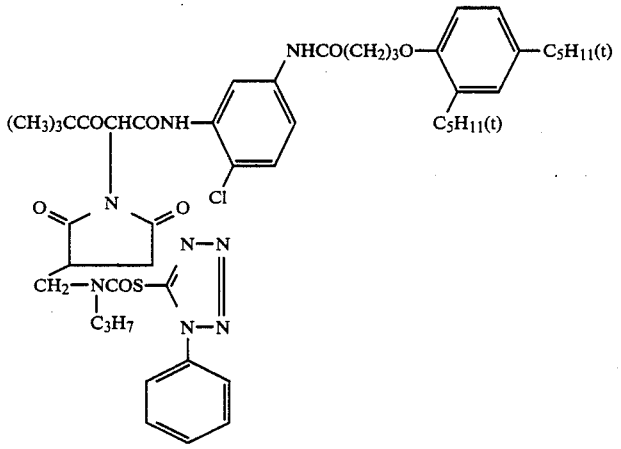
(D$^{\alpha}$-33)
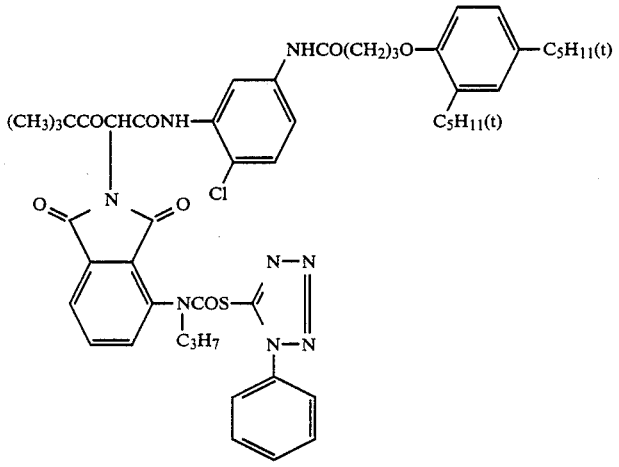
(D$^{\alpha}$-34)
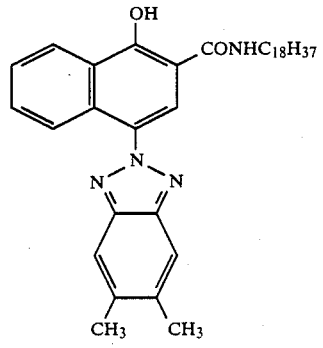

-continued
(D$^{\alpha}$-35)
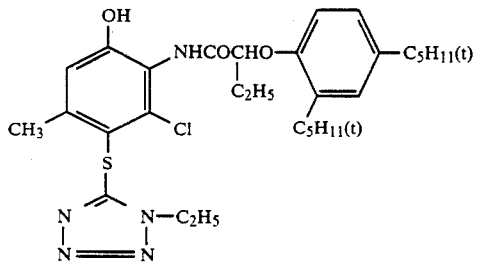
(D$^{\alpha}$-36)
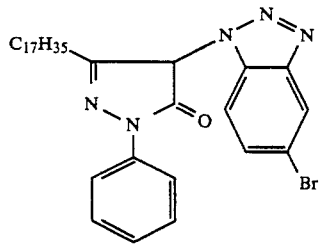
(D$^{\alpha}$-37)
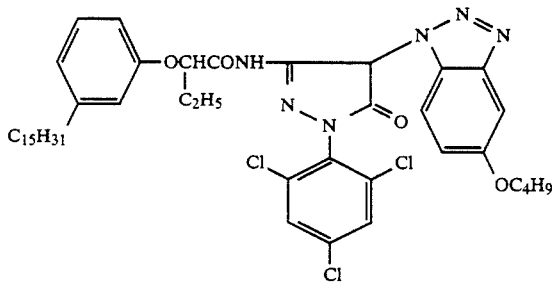
(D$^{\alpha}$-38)
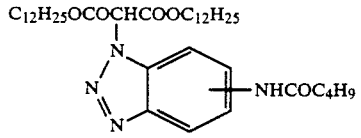
(D$^{\alpha}$-39)
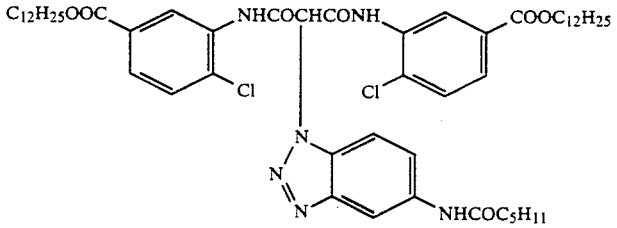
(D$^{\alpha}$-40)
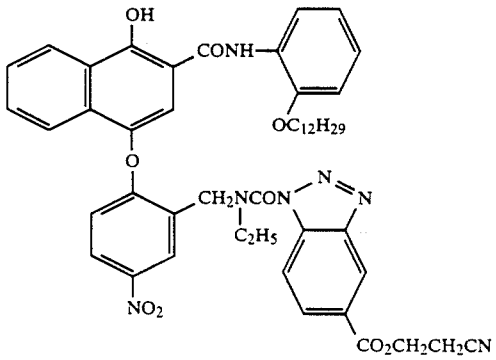

-continued
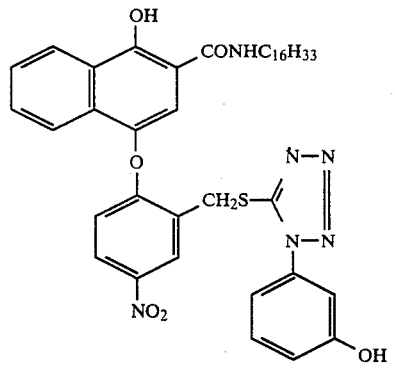
(D$^{\alpha}$-41)
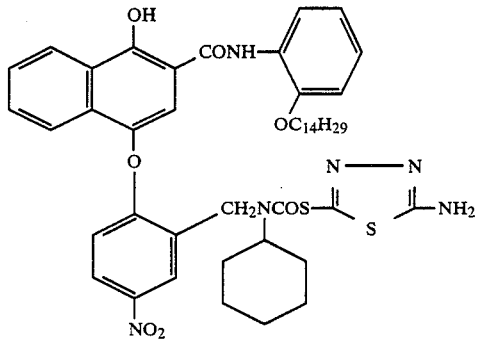
(D$^{\alpha}$-42)
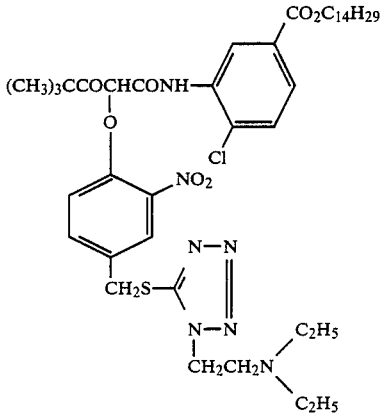
(D$^{\alpha}$-43)
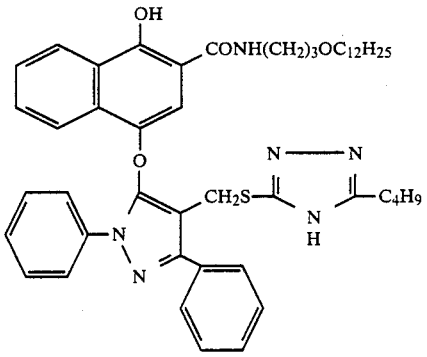
(D$^{\alpha}$-44)

-continued
(D$^{\alpha}$-45)
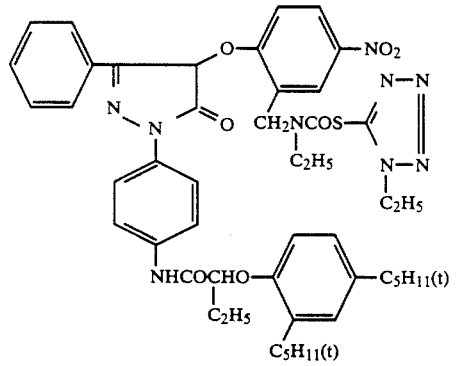
(D$^{\alpha}$-46)
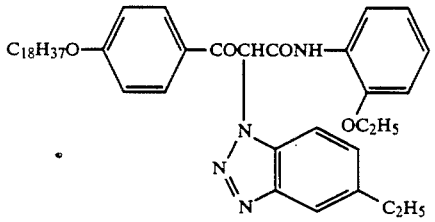
(D$^{\alpha}$-47)
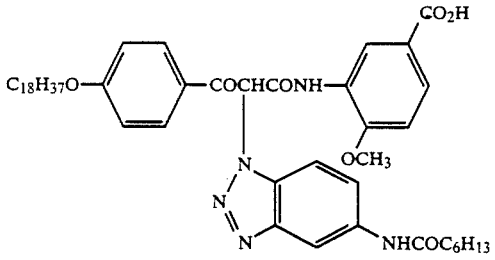
(D$^{\alpha}$-48)
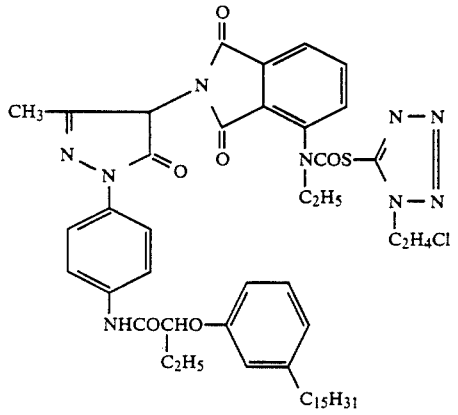
(D$^{\alpha}$-49)
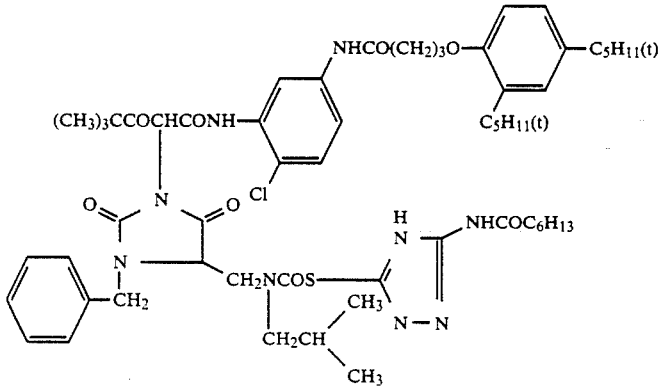

-continued
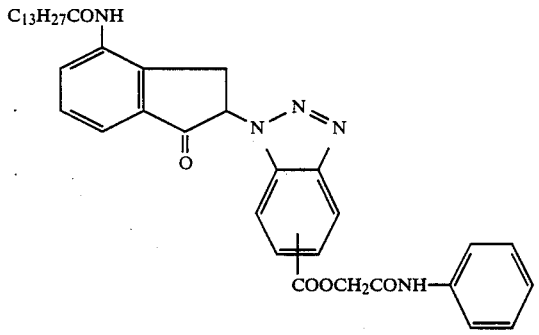
(Dα-50)
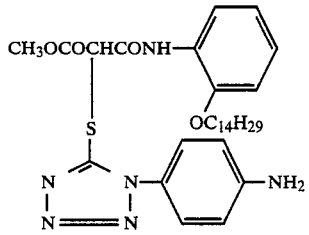
(Dα-51)
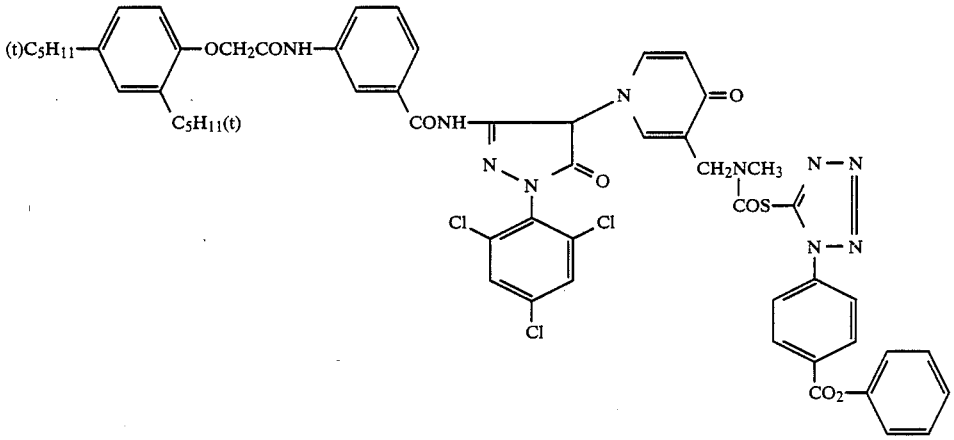
(Dα-52)
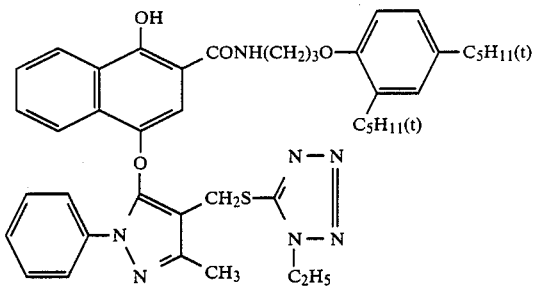
(Dα-53)
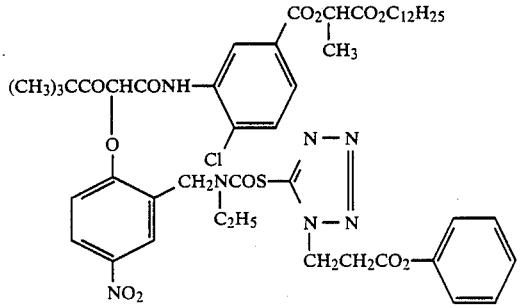
(Dα-54)

-continued
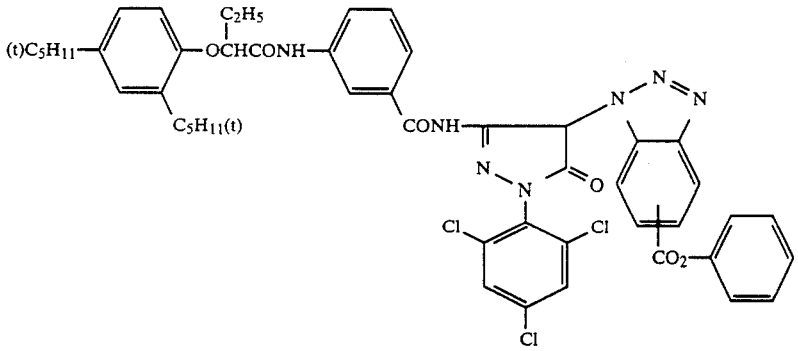
(D$^{\alpha}$-55)
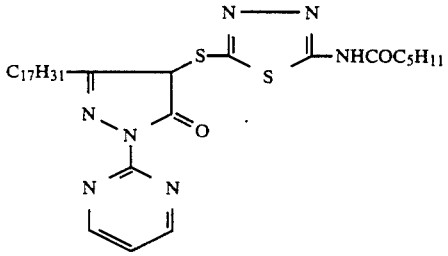
(D$^{\alpha}$-56)
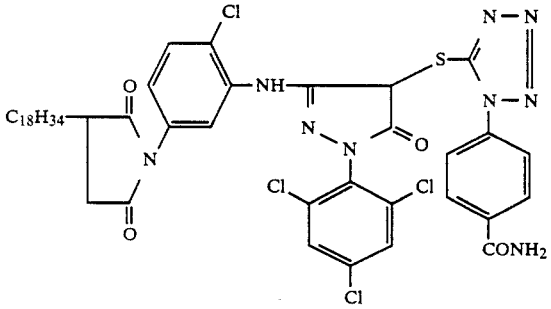
(D$^{\alpha}$-57)
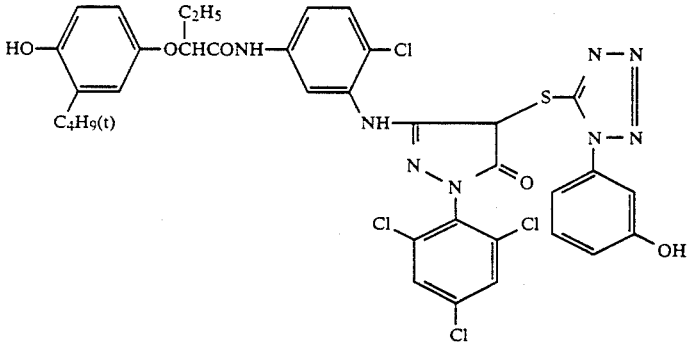
(D$^{\alpha}$-58)
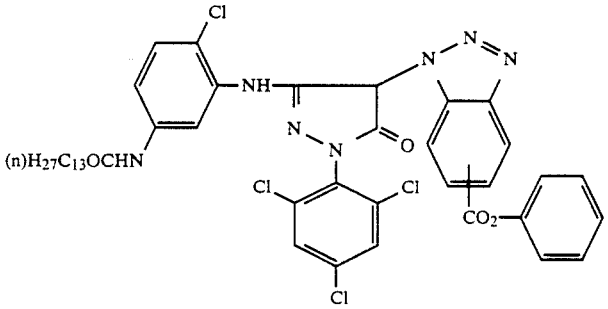
(D$^{\alpha}$-59)

-continued
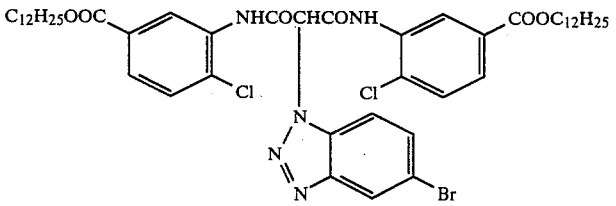
($D^{\alpha}$-60)
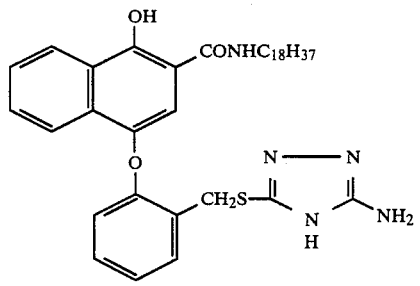
($D^{\alpha}$-61)
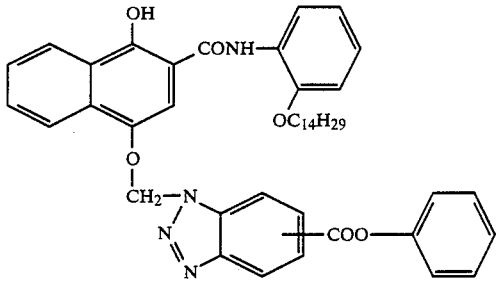
($D^{\alpha}$-62)
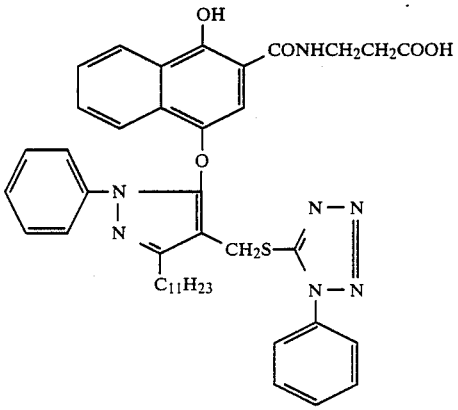
($D^{\alpha}$-63)
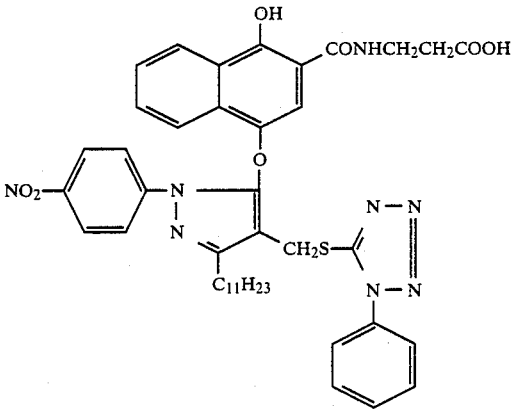
($D^{\alpha}$-64)

-continued
(D$^{\alpha}$-65)
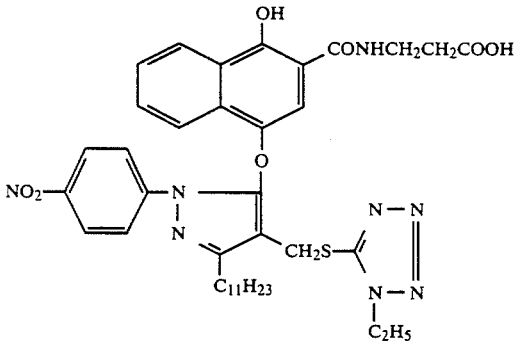
(D$^{\alpha}$-66)
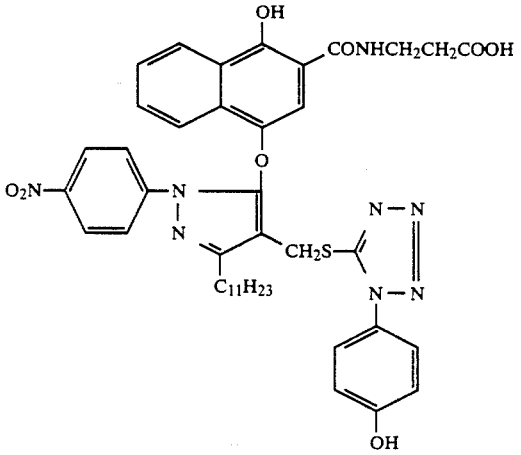
(D$^{\alpha}$-67)
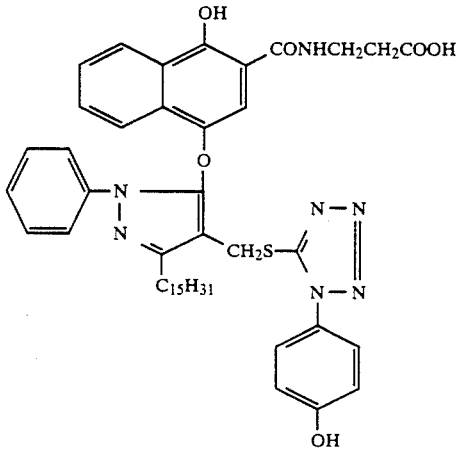
(D$^{\alpha}$-68)
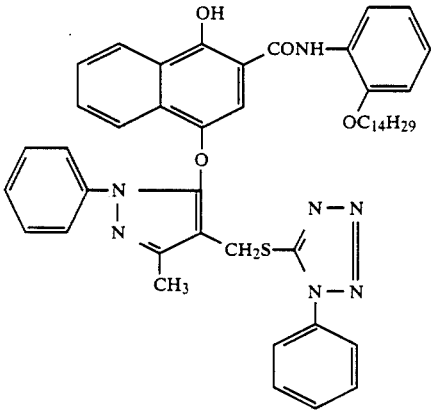

-continued
(D$^{\alpha}$-69)
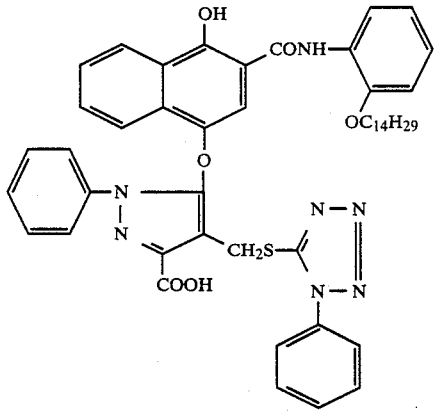
(D$^{\alpha}$-70)
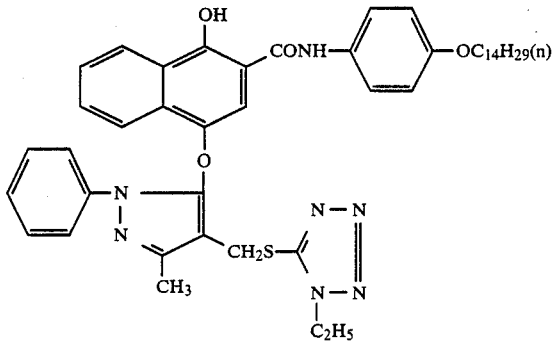
(D$^{\alpha}$-71)
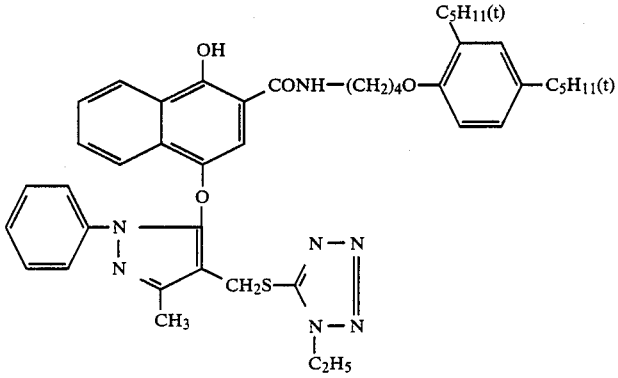
(D$^{\alpha}$-72)
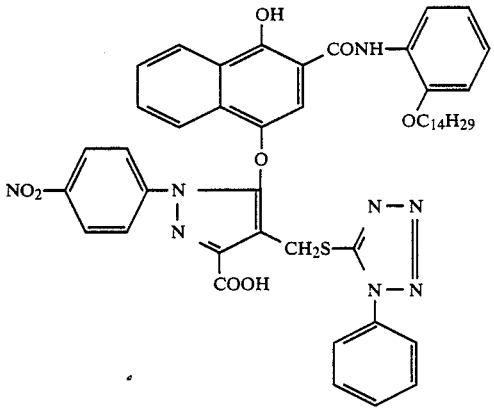

-continued
(D$^{\alpha}$-73)
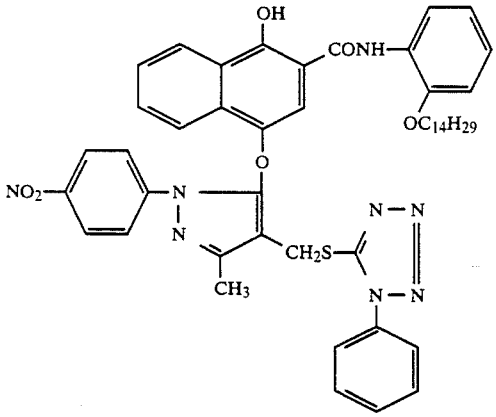
(D$^{\alpha}$-74)
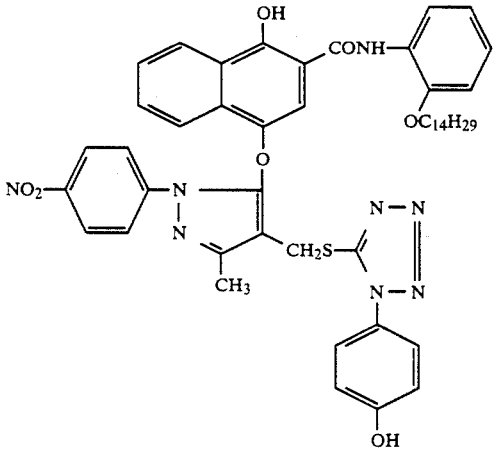
(D$^{\alpha}$-75)
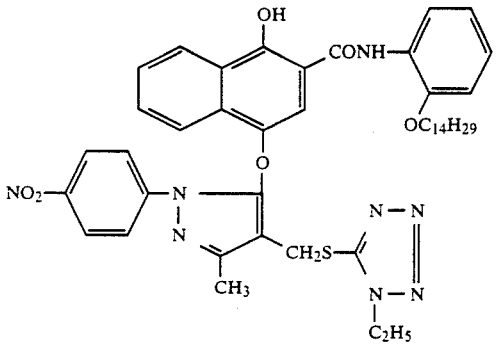
(D$^{\alpha}$-76)
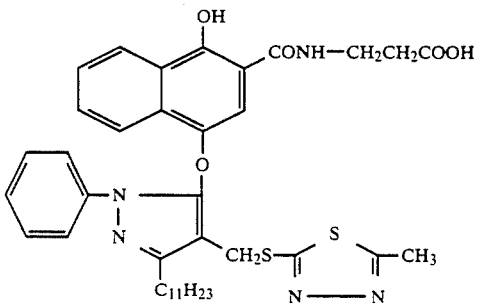

-continued
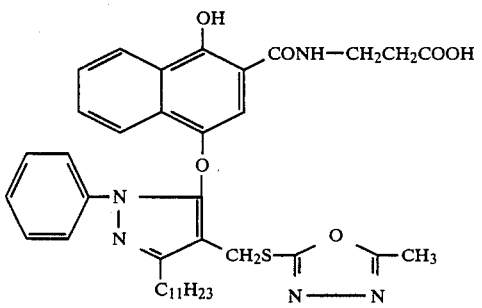
($D^{\alpha}$-77)
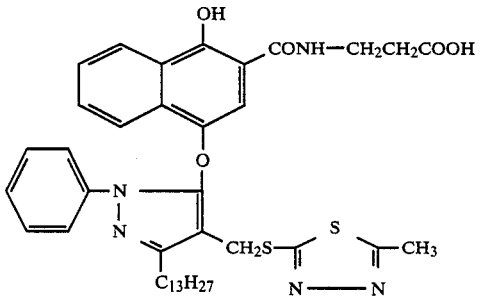
($D^{\alpha}$-78)
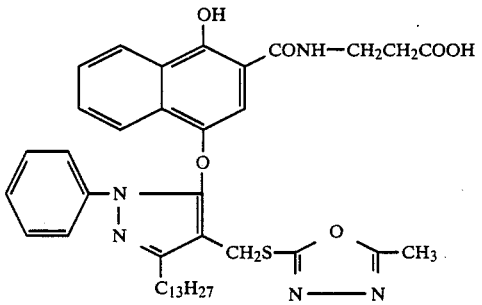
($D^{\alpha}$-79)
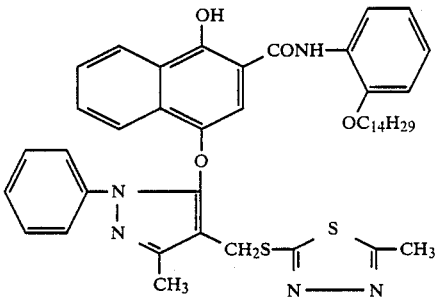
($D^{\alpha}$-80)
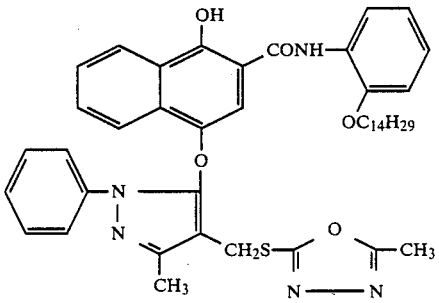
($D^{\alpha}$-81)

-continued
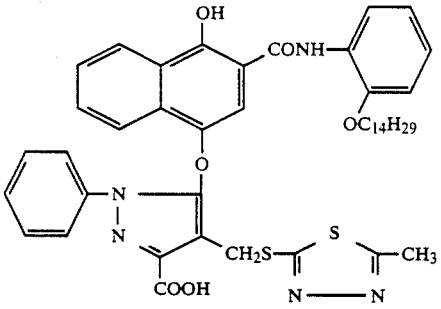
($D^{\alpha}$-82)
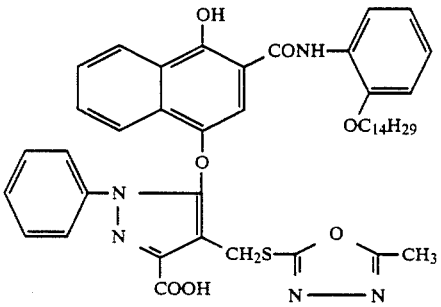
($D^{\alpha}$-83)
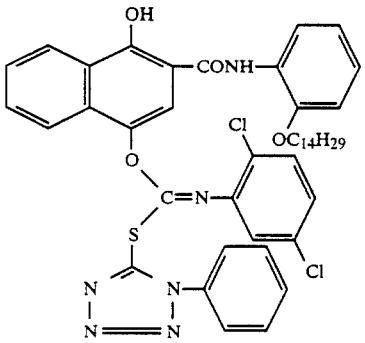
($D^{\alpha}$-84)
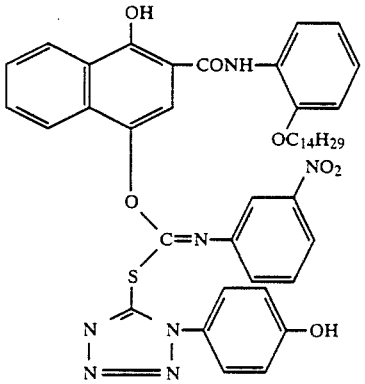
($D^{\alpha}$-85)

-continued

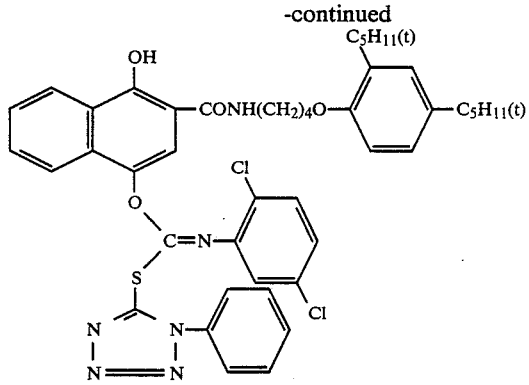

($D^{\alpha}$-86)

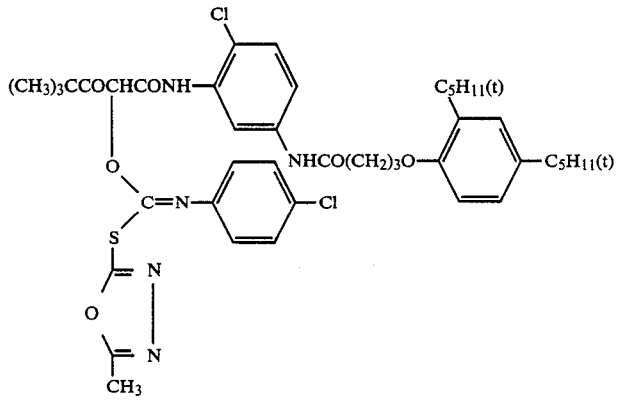

($D^{\alpha}$-87)

Any of the above-mentioned DIR compounds may be incorporated into the light-sensitive silver halide emulsion layer and/or the non-light-sensitive photographic structural layer; preferably it is included in the light-sensitive silver halide emulsion layer.

Two or more kinds of DIR compounds may be included in one layer, or one and same kind of such compound may be included in two or more different layers.

These DIR compounds are preferably included in the emulsion layer in the amount of $2\times10^{-5}$ to $5\times10^{-1}$ mols, more favorably $1\times10^{-4}$ to $1\times10^{-1}$ mols, per mol of the silver in the emulsion layer.

To incorporate such DIR compounds in the silver halide emulsion or in the coating solution for another photographic structural layer, where the DIR compound is alkali-soluble, it may be added in the form of an alkaline solution. If the compound is oil-soluble, it is preferred that the compound is added to the silver halide emulsion according to any of the procedures described in the respective specifications of, for example, U.S. Pat. Nos. 2,322,027; 2,801,171; 2,272,191; and 2,304,940, that is, the DIR compound is dissolved in a high-boiling solvent, or if necessary, in a combination of such solvent and a low-boiling solvent, so that it is dispersed as fine particles therein, such dispersion can be added to the emulsion. In this conjunction, a mixture of two or more kinds of DIR compounds may be used. A further preferred method for addition of such DIR compound will be described in detail. The preferred method comprises dissolving one or more kinds of the above-mentioned DIR compounds in organic acid imides, carbamates, esters, ketones, urea derivatives, ethers, or hydrocarbons, or in particular, any of such high-boiling solvents di-n-butyl phthalate, tri-cresyl phosphate, triphenyl phosphate, di-isoctyl azelate, di-n-butyl sebacate, tri-n-hexyl phosphate, N,N-di-ethyl-caprylamide butyl, N,N-diethyl laurylamide, n-pentadecyl phenylether, di-octylphthalate, n-nonyl phenol, 3-pentadecyl phenylethyl ether, 2,5-di-secamylphenyl butylether, monophenyl-di-o-chlorophenyl phosphate, and fluoroparaffin, and/or any of such low-boiling solvents as methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl alcohol, acetonitrile, dimethylformamide, dioxane, and methyl ethyl ketone, mixing the solution with an aqueous solution containing anionic surfactants, such as alkyl benzosulfonic acid and alkyl naphthalenesulfonic acid, and/or nonionic surfactants, such as sorbitan sesquioleate and sorbitan mono-laurate, and/or a hydrophilic binder, such as gelatin or the like, then emulsifying and dispersing the mixture in a high-speed rotary mixer or a colloid mill, or in an ultrasonic dispersion apparatus, and adding the dispersion to the silver halide emulsion.

Alternatively, the DIR compound or compounds may be dispersed by employing any of known latex dispersion techniques. Various latex dispersion methods and their advantages are described in Japanese Patent O.P.I. Publication Nos. 74538/1974, 59943/1976, and 32552/1979, and also in "Research Disclosure", No. 14850, Aug. 1976, pp 77 to 79.

Examples of latex suitable for this purpose are homopolymers, copolymers, and terpolymers of various monometers, such as styrene, acrylate, n-butyl acrylate, n-butyl methacrylate, 2-acetoacetoxy ethyl methacrylate, 2-(methacryloyloxy)ethyl trimethyl ammonium methosulfate, 3-(methacryloyloxy)propane-1-sodium sulfonate, N-isopropyl acrylamide, N-[2-(2-methyl-4-oxopentyl)]acrylamide, and 2-acrylamide-2-methylpropane sulfonic acid.

Aforesaid DIR compounds may be synthesized according to various methods described in the following publications: U.S. Pat. Nos. 3,227,554; 3,615,506; 3,617,291; 3,632,345; 3,928,041; 3,933,500; 3,938,996; 3,958,992; 3,961,959; 4,046,574; 4,052,213; 4,063,950; 4,095,984; 4,149,886; and 4,234,678; U.K. Patent Nos. 2,072,363 and 2,070,266; Research Disclosure No. 21228 (1981); Japanese Patent O.P.I. Publication Nos. 81144/1975, 81145/1975, 13239/1976, 64927/1976, 104825/1976, 105819/1976, 65433/1977, 82423/1977, 117627/1977, 130327/1977, 154631/1977, 7232/1978, 9116/1978, 29717/1978, 70821/1978, 103472/1978, 10529/1978, 135333/1978, 143223/1978, 13333/1979, 49138/1979, 114241/1979, 35858/1982, 145135/1979, 161237/1980, 114946/1981, 154234/1982, and 56837/1982; and Japanese Patent Application Nos. 44831/1982 and 45809/1982.

The DIR compound or compounds may be added to the light-sensitive silver halide emulsion layer and/or the non-light-sensitive photographic structural layer as stated above, but preferably such compound or compounds are incorporated into at least one silver-halide emulsion layer. For example, for use with a multi-layered color photographic light-sensitive material of the conventional type having a blue-sensitive silver halide emulsion layer, a green-sensitive silver halide emulsion layer, and a red-sensitive silver halide emulsion layer, such compound may be incorporated in one or more of these layers.

The tetrazaindene derivatives which can be used in the practice of the present invention are known as stabilizers for silver halide emulsions in light-sensitive materials, and among them, especially one expressed by the following general formula [T-VIII] can be advantageously used:

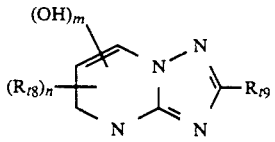

General formula [T-VIII]

wherein m and n respectively stand for an integer of 2 or 3; $R_{t8}$ and $R_{t9}$ independently represent a hydrogen atom, or an alkenyl or alkyl group having 1 to 4 carbon atoms which may have a substituent group, or an acryl group which may have substituent group.

While the tetrazaindene derivatives expressed by the foregoing general formula [T-VIII] are especially effective for the purpose of the invention, there are various other tetrazaindene derivatives which can be advantageously used in the practice of the invention, as enumerated below by way of example and not by way of limitation.

[Example compounds]

T-1: 4-hydroxy-1,3,3*a*,7-tetrazaindene;
T-2: 4-hydroxy-6-methyl-1,3,3*a*,7-tetrazaindene;
T-3: 4-hydroxy-6-hydroxy-1,3,3*a*,7-tetrazaindene;
T-4: 4-hydroxy-6-butyl-1,3,3*a*,7-tetrazaindene;
T-5: 4-hydroxy-5,6-dimethyl-1,3,3*a*,7-tetrazaindene;
T-6: 2-ethyl-4-hydroxy-6-propyl-1,3,3*a*,7-tetrazaindene;
T-7: 2-allyl-4-hydroxy-1,3,3*a*,7-tetrazaindene;
T-8: 4-hydroxy-6-phenyl-1,3,3*a*,7-tetrazaindene.

The compounds can be synthesized with reference to the relevant descriptions given in Japanese Patent Publication Nos. 18102/1971 and 2533/1969. Of these compounds, those having a hydroxy group at the 4-position are preferred, and those having an alkyl or aryl group at the 6-position are particularly preferred.

The 6-aminopurine derivatives useful for the purpose of the invention embrace those known as stabilizers for silver halide emulsions in light-sensitive materials, and in particular, those expressed by the following general formula [P-IX] can be advantageously used:

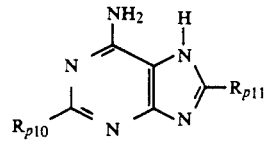

General formula [P-IX]

wherein $R_{p10}$ represents a hydrogen atom or hydroxy group; or an alkyl group with 1 to 4 carbon atoms which may have a substituent group; and $R_{p11}$ represents a hydrogen atom; or an alkyl group with 1 to 4 carbon atoms which may have a substituent group; or an aryl group which may have a substituent group.

When the 6-aminopurine derivatives expressed by the foregoing general formula [P-IX] are especially effective for the purpose of the invention, there are various other 6-aminopurine derivatives which can be advantageously used in the practice of the invention, as enumerated below by way of example and not by way of limitation.

[Compounds exemplified]

P-1: 6-aminopurine;
P-2: 2-hydroxy-6-aminopurine;
P-3: 2-methyl-6-aminopurine;
P-4: 6-amino-8-methylpurine;
P-5: 6-amino-8-phenylpurine;
P-6: 2-hydroxy-6-amino-8-phenylpurine;
P-7: 2-hydroxymethyl-6-aminopurine.

These tetrazaindene derivatives and 6-aminopurine derivatives are highly effective for the purpose of the invention if they are added to the silver halide emulsion, preferably within the range of from 5 mg to 18 g per mol silver halide.

Of these compounds, which can form a silver salt having a solubility product constant of not more than $1\times10^{-9}$ in conjunction with silver ions, those which are not more than $1\times10^{-11}$ in solubility product terms are especially effective.

With respect to DIR compounds, tetrazaindene derivatives, and 6-aminopurine derivatives, it has been known that when added to conventional silver halide emulsions, they contribute for improvement of image quality and can also inhibit repening fogging that may possibly develop in the process of emulsion preparation. Prior to the present invention, however, it was not known in the art that when used in conjunction with the process to which the invention is directed, those compounds would contribute to improve graininess.

In the present invention, the silver-halide color photographic light-sensitive material to be processed is preferably such that the thickness of its photographic structural layer is not more than 25 μm. The expression "thickness of the photographic structural layer" used herein means the total thickness of all constituent layers of the photographic structural layer other than the support, that is, all the hydrophilic colloidal layers including the silver-halide emulsion layer (which consists of at least three layers in the case of a full color photographic material), and other layers formed as required, such as subbing layer, antihalation layer, intermediate layer, filter layer, and protective layer, which thickness refers to dry state thickness. For the hydrophilic colloid, gelatin is often used, in which case the layer thickness may be referred to as the gelatin coat thickness. Thickness measurements may be carried out on a micrometer. The total thickness of the photographic structural layer is more favorably not more the 22 μm, still more favorably less than 20 μm, and especially preferably not more than 18 μm. From the standpoint of photographic performance, a layer thickness of not less than 8 μm is preferred.

Next, preferred conditions for development and other photographic processing steps in connection with the practice of the invention will be explained.

One preferred mode for carrying out the invention is such that the concentration of the developing agent in the developer solution used is not less than $1.5\times10^{-2}$ mols/l. This condition constitutes an essential feature of the third invention which will be hereinafter described in detail. The developing agent to be used and further preferred conditions will be discussed hereinafter.

Another preferred mode for carrying out the invention is such that the pH of the developer solution is 10.4 or higher. By adopting such high pH value it is possible to accelerate development and also to obtain further improved graininess. The pH is more favorably 10.5 to 12.0, still more favorably 10.6 to 11.5.

A further preferred mode for carrying out the invention is such that the developing temperature is not less than 40° C. Processing at such high temperature can accelerate development and provide further improved graininess. Development is performed preferably at temperatures of 40° C. to 70° C., more favorably 45° C. to 60° C. This condition constitutes an essential feature of the second invention, which will be discussed hereinafter in further detail.

Another preferred mode for carrying out the invention is such that the concentration of the sulfite in the developer solution used is not more than $1.5\times10^{-2}$ mols/l. Such low concentration of sulfite in the developer solution is intended to accelerate development and also to provide improved graininess. The concentration range of the sulfite is preferably 0 to $1.0\times10^{-2}$ mols/l, inclusive of zero, more favorably 0 to $0.5\times10^{-2}$ mols/l, inclusive of zero.

For preferred types of sulfite to be included in the developer solution, the following are mentioned.

Typical examples include potassium sulfite, sodium sulfite, lithium sulfite, potassium metabisulfite, and sodium metabisulfite. Also, those compounds which, when dissolved in the developer solution, can release sulfite ions are useful for the purpose of the invention. Examples of these compounds are formaldehyde bisulfite adduct, glutaric aldehyde bisulfite adduct, and the like, which are also included in the scope of sulfites which can be used the purpose of the invention.

Another preferred mode for carrying out the invention is such that the concentration of the bromide in the developer solution used is not more than $0.8\times10^{-2}$ mols/l. By limiting the concentration of the bromide to such low degree it is possible to obtain same effect as above mentioned. The bromide concentration is more favorably $0.05\times10^{-2}$ to $0.7\times10^{-2}$ mols/l, still more favorably $0.2\times10^{-2}$ to $0.6\times10^{-2}$ mols/l.

For preferred types of bromides for inclusion in the developer solution, sodium bromide, potassium bromide, and lithium bromide are available.

Another preferred mode for carrying out the invention is such that the developer solution used contains at least one kind of compound of those expressed respectively by the general formulas [A-I] through [A-VI] shown hereinbelow. Any of these compounds functions as a development accelerator.

General formula [A-I]

$$X_{a1}\text{-}(CH_2)_{\overline{na1}}(X_{a2}\text{-}(CH_2)_{\overline{na2}})_{\overline{ma1}}X_{a3}\text{-}(CH_2)_{\overline{na3}}X_{a4}$$

In the above formula, $Xa_2$ and $Xa_3$ independently represent a sulfur or oxygen atom; $Xa_1$ and $Xa_4$ independently represent SH or OH groups; and $na_1$, $na_2$, $na_3$, each stands for a positive integer of 0 to 500, at least one of the above-mentioned $na_1$, $na_2$, and $na_3$ being an integer larger than zero; provided that at least one of the above-mentioned $Xa_1$, $Xa_2$, $Xa_3$, and $Xa_4$ is a sulfur atom.

General formula [A-II]

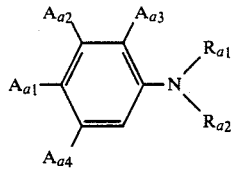

In the above formula [A-II], $Ra_1$ and $Ra_2$ independently represent a hydrogen atom; or an alkyl group, such as methyl, ethyl, or propyl group, or a heterocyclic group which is a ring $Ra_1$ and $Ra_2$ may form together with an oxygen or nitrogen atom; $Aa_2$, $Aa_3$, and $Aa_4$ independently represent a hydrogen atom; or an alkyl group, such as methyl or ethyl group; or a halogen atom, such as fluorine or bromine atom; and $Aa_1$ represents a hydroxyl group, or

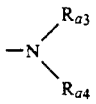

in which $Ra_3$ and $Ra_4$ independently represent a hydrogen atom, or an alkyl group having 1 to 3 carbon atoms.

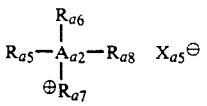

General formula [A-III]

In the above formula [A-III], $Ra_5$, $Ra_6$, $Ra_7$, and $Ra_8$ independently represent a hydrogen atom, or an alkyl group, aralkyl group, or substituted or unsubstituted allyl group; and $Aa_2$ represents a nitrogen or phosphorus atom. $Ra_8$ may be a substituted or unsubstituted alkylene group; and $Ra_5$ and $Ra_8$ may form a ring; or may be substituted or unsubstituted pyridinium groups. Symbol $Xa_5$ represents an anion group such as a halogen atom, OH, or an anionic group, such as sulfate or nitrate group.

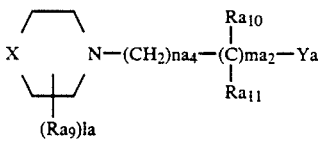

In the above formula [A-IV], Ya represents a hydrogen atom, a hydroxyl group, or

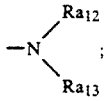

$Ra_9$, $Ra_{10}$, $Ra_{11}$, $Ra_{12}$, and $Ra_{13}$ independently represent a hydrogen atom, or a substituted or unsubstituted alkyl, carbamoyl, acetyl, or amino group having 1 to 3 carbon atoms; X represents an oxygen or sulfur atom, or

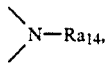

in which $Ra_{14}$ represents a hydrogen atom, or a substituted or unsubstituted alkyl group having 1 to 3 carbon atoms; and la, $ma_2$, and $na_4$, each represents 0, 1, 2, or 3.

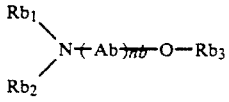

In the above formula [A-V], $Rb_1$ and $Rb_2$ independently represent a hydrogen atom, or an alkyl, alkoxy, or aryl group, or a nitrogen-containing heterocycle in which $Rb_1$ and $Rb_2$ may form a ring or in which $Rb_1$ or $Rb_2$ together with Ab may form a ring; $Rb_3$ represents an alkyl group; Ab represents an alkylene group; and nb represents an integer of 0 to 6.

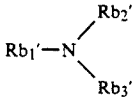

In the above formula [A-VI], $Rb_1'$ represents a hydroxyalkyl group having 2 to 6 carbon atoms; $Rb_2'$ and $Rb_3'$ independently represent a hydrogen atom, or an alkyl group having 1 to 6 carbon atoms, or a hydroxyalkyl or benzyl group having 2 to 6 carbon atoms, or formula Cnb' $H_2$nb'

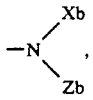

in which nb' represents an integer of 1 to 6; and Xb and Zb independently represent a hydrogen atom, or an alkyl group having 1 to 6 carbon atoms, or a hydroxyalkyl group having 2 to 6 carbon atoms.

Examples of the compounds expressed by the general formula [A-I] are enumerated below.

A-I-1 $HO(CH_2)_2S(CH_2)_2S(CH_2)_2OH$
A-I-2 $HO(CH_2)_{10}S(CH_2)_2S(CH_2)_{10}OH$
A-I-3 $HS—(CH_2CH_2O)_{35}—CH_2CH_2SH$
A-I-4 $(HOCH_2CH_2)$ ⟶$_2$
A-I-5 $HO(CH_2)_3S(CH_2)_3S(CH_2)_3OH$
A-I-6 $HO(CH_2)_2S(CH_2)_2O(CH_2)_2S(CH_2)_2OH$
A-I-7 $HO(CH_2CH_2O)_{15}CH_2CH_2SH$
A-I-8 $HO(CH_2)_4S(CH_2)_3S(CH_2)_4OH$
A-I-9 $HSCH_2CH_2OH$
A-I-10 $HO(CH_2)_3S(CH_2)_2S(CH_2)_3OH$
A-I-11 $HO(CH_2)_2S(CH_2)_2OH$

Illustrative of the compounds expressed by the general formula [A-II] are as follows:

A-II-1

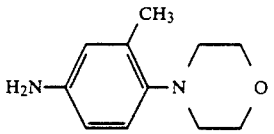

A-II-2

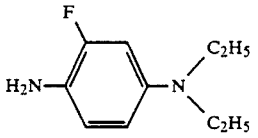

A-II-3

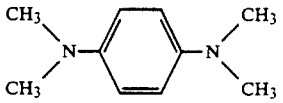

A-II-4

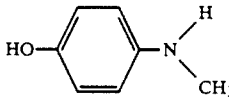

-continued

A-II-5

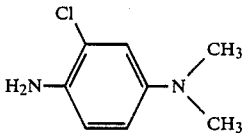

A-II-6

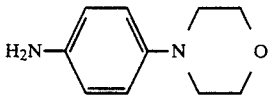

A-II-7

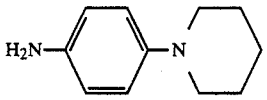

A-II-8

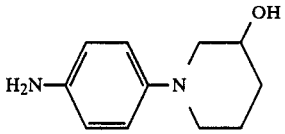

A-II-9

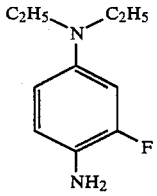

A-II-10

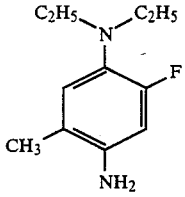

A-II-11

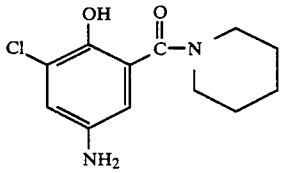

A-II-12

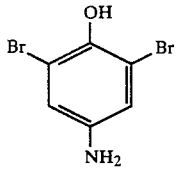

A-II-13

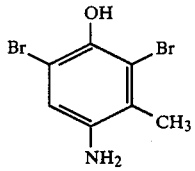

Examples of the compounds expressed by the general formula [A-III] are enuemrated below.

A-III-1 (1-carboxyethyl)methyl dodecylsulfonium hydroxide

A-III-2 (4-sulfobutyl)dimethyl dodecylammonium hydroxide

A-III-3 (carboxymethyl)dimethyl octadeylammonium hydroxide

A-III-4 (1-carboxyethyl)methyl hexadecyl sulfonium hydroxide

Illustrative of the compounds expressed by the general formula [A-IV] are as follows:

A-IV-1

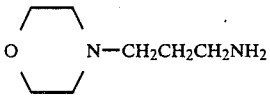

A-IV-2

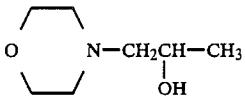

A-IV-3

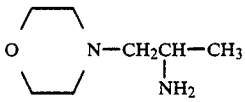

A-IV-4

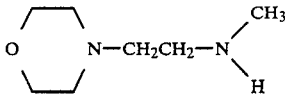

A-IV-5

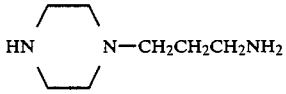

A-IV-6

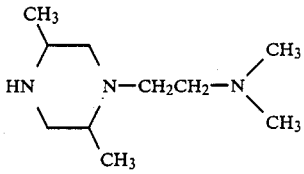

A-IV-7

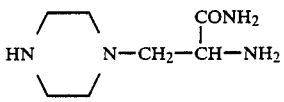

A-IV-8

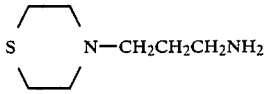

A-IV-9

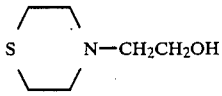

A-IV-10

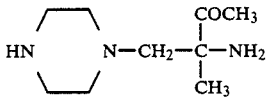

A-IV-11

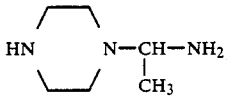

A-IV-12

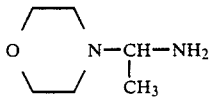

-continued

A-IV-13

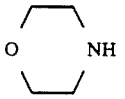

A-IV-14

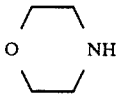

A-IV-15

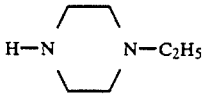

A-IV-16

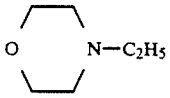

A-IV-17

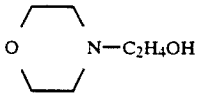

A-IV-18

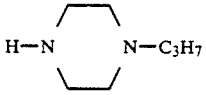

A-IV-19

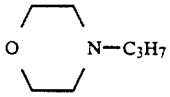

The compounds expressed by the foregoing general formulas [A-I] to [A-IV] can easily be synthesized according to the methods described in Japanese Patent O.P.I. Publication No. 15554/1975, U.S. Pat. No. 3,201,242, U.S. Pat. No. 2,950,970, U.S. Pat. No. 3,706,562, U.S. Pat. No. 3,893,862, and RD 15176.

The compounds expressed by these general formulas [A-I] to [A-IV] may be added to the color developer solution, preferably in the amount of 0.01 g to 60 g/liter, more favorably in the amount of 0.1 g to 30 g/liter.

General formula [A-V]

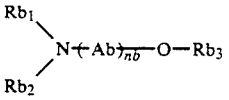

In the above formula, $Rb_1$ and $Rb_2$ independently represent a hydrogen atom, or an alkyl, alkoxy, or aryl group, or a nitrogen-containing heterocycle, in which $Rb_1$ and $Rb_2$ may form a ring together with Ab, or in which $Rb_1$ or $Rb_2$ together with Ab may form a ring; $Rb_3$ represents an alkyl group; Ab represents an alkylene group; and nb represents an integer 0 to 6.

In the above-mentioned general formula [A-V], the alkyl groups represented by $Rb_1$ and $Rb_2$ are preferably those having 1 to 5 carbon atoms, such as a methyl, ethyl, propyl, isopropyl, or butyl group; if each of them is an alkoxy group, it is preferably one having 1 to 5 carbon atoms, such as a methoxy, ethoxy, or propoxy group; if each of them is an aryl group, it may be, for example, a phenyl, 4-hydroxyphenyl, or 4-sulfophenyl group. If $Rb_1$ and $Rb_2$ form a nitrogen-containing heterocyclic ring, it may be, for example, a piperidine, morpholine, piperazine, or 1,4-thiazine ring. If $Rb_1$ or $Rb_2$ together with Ab form a nitrogen-containing heterocyclic ring, it may be, for example, a piperidine ring. The alkyl group represented by $Rb_3$ is preferably one having 1 to 8 carbon atoms, such as a methyl, ethyl, propyl, isopropyl, butyl, or hexyl group. The alkylene group represented by Ab may be of a branched chain configuration, for example, a methylene, ethylene, trimethylene, 2-methyl trimethylene, 2-methyl tetramethylene, propylene, 1-methyl trimethylene, or tetramethylene group.

Preferred typical examples of the compounds expressed by the general formula [A-V] are as follows:

A-V-1

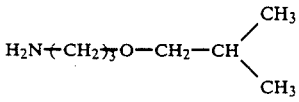

A-V-2 $H_2N(CH_2)_3O-C_3H_7(iso)$

A-V-3 $H_2N(CH_2)_3O-C_3H_7$

A-V-4 $H_2N(CH_2)_3O-CH_3$

A-V-5 $H_2N(CH_2)_3O-C_2H_5$

A-V-6 $H_2N(CH_2)_3O-C_4H_9$

A-V-7 $H_2N-O-CH_3$

A-V-8

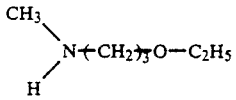

A-V-9

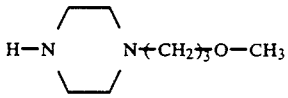

A-V-10

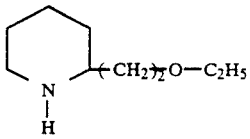

A-V-11 $H_2N(CH_2)_2O-C_2H_5$

A-V-12 $H_2N(CH_2)_2O-C_3H_7$

A-V-13 $H_2N(CH_2)_2O-C_3H_7(iso)$

A-V-14 $H_2N-CH_2-O-C_2H_5$

A-V-15 $H_2N-CH_2-O-C_3H_7$

A-V-16 $H_2N-CH(CH_3)CH_2-O-C_2H_5$

A-V-17 $H_2N-O-C_2H_5$

-continued

A-V-18

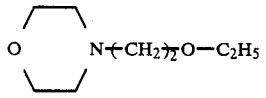

A-V-19

$H_2N(CH_2)_4O-C_3H_7$

A-V-20

$H_2N(CH_2)_4O-C_2H_5$

A-V-21

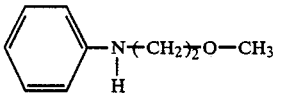

A-V-22

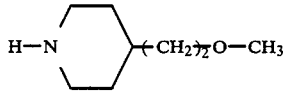

Of these compounds expressed by the general formula [A-V], those of (A-V-2), (A-V-4), (A-V-5), (A-V-7), (A-V-11), (A-V-150), and (A-V-18) are especially preferably used for the purpose of the invention.

These compounds are available from a commercial source (for example, Koei Chemical Co., Ltd.).

Any of the compounds expressed by the general formula [A-V] is used for addition to the color developer solution, preferably in the amount of 0.01 to 100 g, more favorably 0.1 to 50 g, per liter of the solution.

Of the compounds expressed by the foregoing general formula [A-VI], those expressed by the following general formula [A-VI'] are preferably used.

General formula [A-VI']

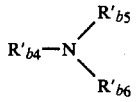

In the formula, $R'_{b4}$ represents a hydroxyalkyl group having 2 to 4 carbon atoms; $R'_{b5}$ and $R'_{b6}$ independently represent an alkyl group having 1 to 4 carbon atoms; or a hydroxyalkyl group having 2 to 4 carbon atoms.

Preferred examples of the compounds expressed by aforesaid general formula [A-V] are as follows.

Namely, ethanolamine, diethanol amine, triethanol amine, diisopropanol amine, 2-methyl aminoethanol, 2-ethyl aminoethanol, 2-dimethyl aminoethanol, 2-diethyl amino ether, 1-diethyl amino-2-propanol, 3-diethyl amino-1-propanol, 3-dimethylamino-1-propanol, isopropyl aminoethanol, 3-amino-1-propanol, 2-amino-2-methyl-1,3-propanediol, ethylene diamine tetraisopropanol, benzyl diethanolamine, and 2-amino-2-(hydroxymethyl)-1,3-propanediol.

Any of the compounds expressed by the general formula [A-VI] is used preferably in the amount of 3 g to 100 g, more favorably in the amount of 6 g to 50 g, per liter of the color developer solution.

A further preferred mode for carrying out the invention is such that the developer solution used contains at least one kind of compound of those expressed by the following general formulas [R-I] through [R-III].

General formula [R-I]

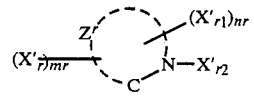

In the formula, $X'r$ and $X'R_1$ independently represent a halogen atom, or alkyl, aryl, amino, hydroxyl, nitro, carboxyl, or sulfonyl group; $X'r_2$ represents a hydrogen atom, an alkyl or aryl group, or a double bond for ring formation; $Z^r$ represents a plurality of atoms composed of carbon, oxygen, nitrogen, and sulfur atoms necessary for ring formation; and n and m, each represents 0, 1, 2, or 3.

General formula [R-II]

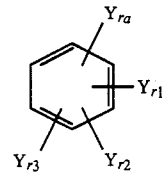

In the formula, $Y_{ra}$, $Y_{r1}$, $Y_{r2}$, and $Y_{r3}$ independently represent a hydrogen or halogen atom; or an alkyl, amino, hydroxyl, nitro, carboxyl, or sulfonyl group.

General formula [R-III]

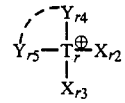

In the formula, Tr represents a nitrogen or phosphorus atom; $X_{r2}$ and $X_{r3}$ independently represent a hydrogen atom, or an alkyl or aryl group, or a halogen atom; $Y_{r4}$ and $Y_{r5}$ independently represent an alkyl or aryl groups, where $Y_{r4}$ and $Y_{r5}$ may form a heterocyclic ring through ring closure.

Any of the compounds expressed by the foregoing general formulas [R-I] through [R-III] can act as an inhibitor. In the practice of the invention, if an organic inhibitor is used in the developer solution, various compounds may be mentioned as those suitable for such use, including nitrogen-containing heterocyclic compounds, mercapto group-containing compounds, aromatic compounds, onium compounds, and compounds having iodine atoms in their substituent groups; among these, those expressed by aforesaid general formulas [R-I], [R-II], and [R-III] are preferred.

The compounds expressed by the general formula [R-I] are more favorably those expressed by the general formula [R'-IV] or [R'-V], most preferably those expressed by the general formulas [R'-VI] through [R'-XI].

Whilst, the compounds expressed by the general formula [R-II] are most favorably those expressed by the general formula [R'-XII] or [R'-XIII].

These compounds are used in the developer solution, preferably in the amount of 0.005 to 20 g, more favorably in the amount of 0.01 to 5 g, per liter of the solution.

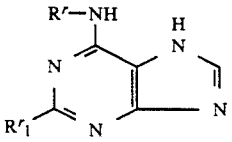

General formula [R'-VI]

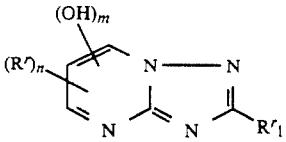

General formula [R'-VII]

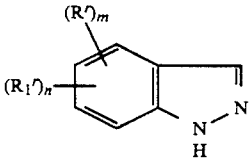

General formula [R'-VIII]

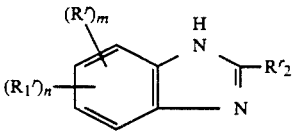

General formula [R'-IX]

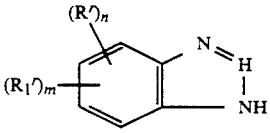

General formula [R'-X]

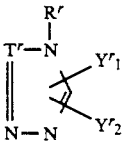

General formula [R'XI]

(where $T^r$ is C or N)

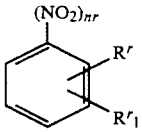

General formula [R'XII]

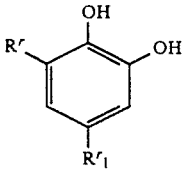

General formula [R'-XIII]

In the above formulas, $R^r$, $R^r_1$, and $R^r_2$ independently represent a hydrogen atom or halogen atom (Cl, Br, I, etc.), or an alkyl group which may have a substituent group, aryl group which may have a substituent group, carboxylic group, benzyl group, —NHCOR$^{r'}$ (in which R$^{r'}$ represents an alkyl or aryl group), thiocarboxylic group, carboxy alkylate group (such as —$COOCH_3$, —$COOC_2H_5$, and $COOC_3H_7$), alkoxy group (such as a methoxy, ethoxy, or propioxy group), hydroxyl group, sulfonyl halide group (—$SO_2Cl$, —$SO_2Br$, etc.) amino group which may have substituent group, sulfonic group, nitro group, mercapto group, or cyano group.

Symbols $Yr_1$ and $Yr_2$ respectively have same meanings as $Yr_1$ and $Yr_2$ in the foregoing formula [R-II].

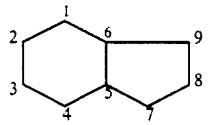

A compound having 1 to 9 carbon atoms of which 2 to 5 are replaced by nitrogen atoms, or its derivative.

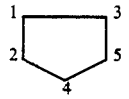

A compound having 1 to 5 carbon atoms of which 2 to 4 are replaced by nitrogen atoms, or its derivatives.

Preferred examples illustrative of the organic inhibitors expressed by aforesaid formulas are given hereinbelow. Needless to say, however, it is understood that the compounds of the formulas which are useful for the purpose of the invention are not limited to those exemplified below.

(Examples of organic inhibitors)

Z1

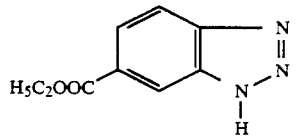

Z2

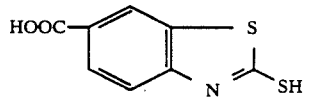

Z3

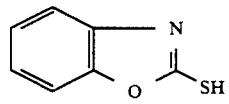

Z4

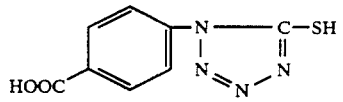

Z5

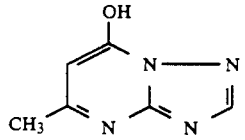

Z6

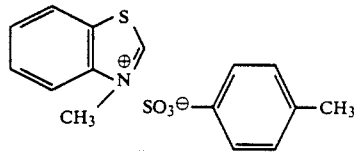

-continued
Z7
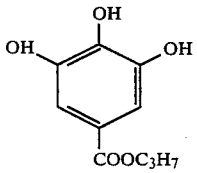
Z8
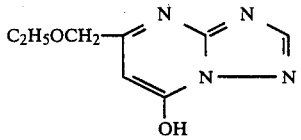
Z9
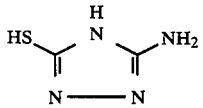
Z10
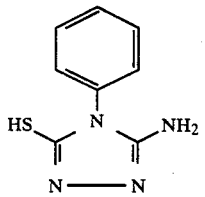
Z11
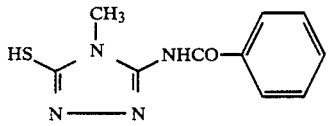
Z12
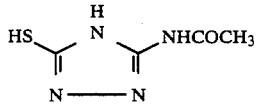
Z13
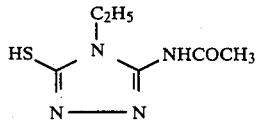
Z14
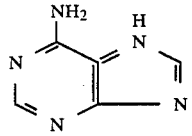
Z15
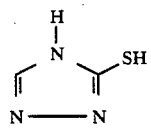
Z16
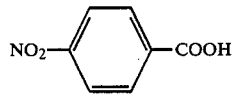
Z17
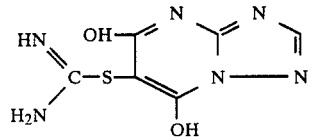
-continued
Z18
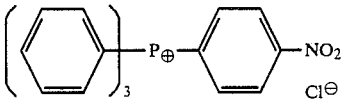
Z19
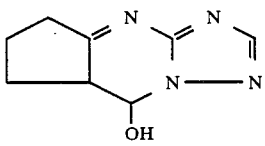
Z20
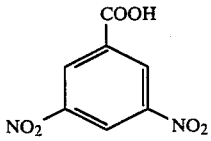
Z21
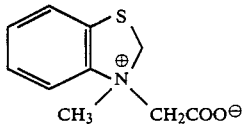
Z22
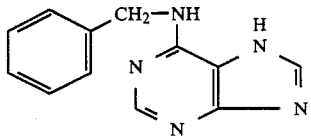
Z23
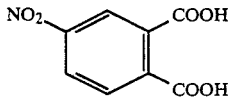
Z24
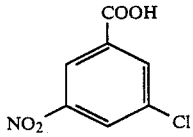
Z25
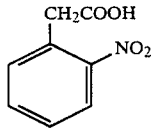
Z26
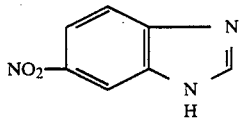
Z27
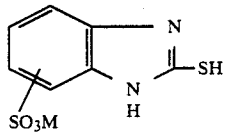
Z28
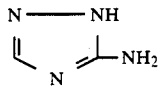

-continued

Z29

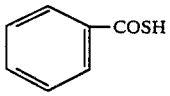

Z30

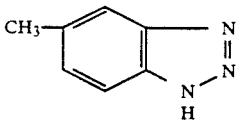

Z31

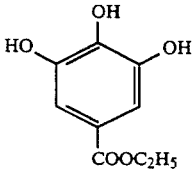

Z32

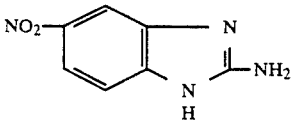

Z33

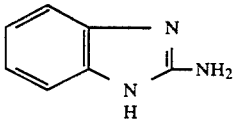

Z34

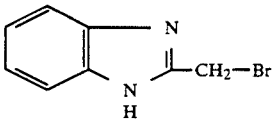

Z35

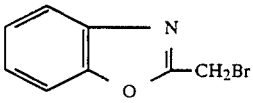

Z36

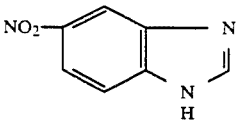

Z37

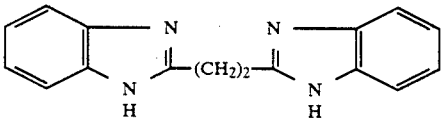

Z38

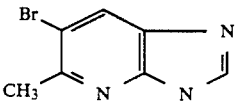

Z39

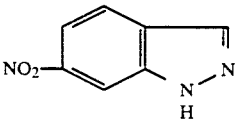

-continued

Z40

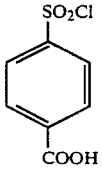

Z41

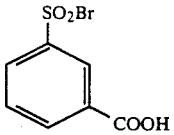

Z42

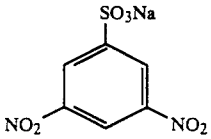

Z43

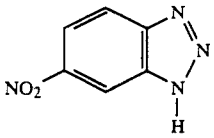

Z44

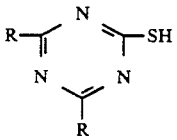

(where R represents —H, —SH, or —$NH_2$)

Of the above exemplified compounds of those expressed by the general formulas [R-I] through [R-III], the Z-4, Z-5, Z-7, Z-14, Z-20, Z-26, Z-30, Z-49, and Z-51 compounds are especially advantageously used for the purpose of the invention.

Another preferred embodiment of the invention is such that the developer solution used contains at least one kind of polymer or copolymer having a pyrolidone nucleus in the individual molecular structure, or at least one type of polyethylene glycol.

By this arrangement, it is possible to accelerate development and provide improved graininess.

The polymer or copolymer having a pyrolidone nucleus in the molecular structure and can be used in embodying the invention is every polymerizable polymer in which main chain or side chain of polymeric unit are replaced with pyrolidone nuclear units at any positions and in any number, and such a polymer or copolymer may be a monopolymer of such polymerizable polymers, or may be a copolymer formed by copolymerization of two or more kinds of copolymeric units. In the latter case, the copolymer is preferably such that one polymer as a copolymeric unit which has pyrolidone nuclear units in its molecular structure is included in the proportion of 20% or more in the copolymer produced by copolymerizing the above-mentioned one polymer with another polymer whiçh as no pyrolidone nuclear unit in its molecular structure. More favorably, the above-mentioned one polymer is so included in the proportion of 30% or more. For the above-mentioned other polymer having no pyrolidone nuclear unit which is to be copolymerized with the above-mentioned one polymer as a copolymeric constituent which has pyrolidone nuclear units in its molecular structure any polymer may be used insofar as a hydrophilic copolymer can be obtained.

Preferably, aforesaid polymer or copolymer has an average molecular weight of 1,000 to 70,000, typical examples of which are as follows.

[Example compounds]

[1] Poly-N-vinyl-2-pyrolidone (*No tel)
[2] Poly-N-(2-acryloyloxy)ethyl-1-pyrolidone
[3] Poly-N-glycidyl-2-pyrolidone
[4] Poly-N-allyl-2-pyrolidone
[5] Poly-N,N-dimethyl-N-[3(1-pyrolidonyl)-2-hydroxyl]propylamine-N'-acryloylimine
[6] Copoly-N-vinyl-2-pyrolidone/N-acryloyl morpholine (molar ratio, 42:58)
[7] Copoly-N-vinyl-2-pyrolidone/N-acryloyl piperidine (molar ratio, 35:65)
[8] Poly-N-vinyl-2-pyrolidone/N-methacryloyl-2-methylimidazole (molar ratio, 55:45)
[9] Copoly-N-(2-acryloyloxy)-ethyl-2-pyrolidone/diethylamide acrylate (molar ratio, 60:40)
[10] Copoly-N-(2-methacryloyloxy)ethyl-2-pyrolidone/sodium acrylate (molar ratio, 75:25)
[11] Copoly-N-(3-acryloyloxy)propyl-2-pyrolidone/-methyl methacrylate (molar ratio, 65:35)
[12] Copoly-N,N-dimethyl-N-(3-(1-pyrrolidonyl)-2-hydroxy]propylamine-N'-acryloylimine/ethyl acrylate (molar ratio, 70:30)
[13] Copoly-N-vinyl-2-pyrolidone/vinyl acetate (molar ratio 70:30)
[14] Copoly-N-vinyl-2-pyrolidone/methyl acrylate (molar ratio, 70:30)
[15] Copoly-N-vinyl-2-pyrolidone/styrene (molar ratio, 80:20)
[16] Copoly-N-vinyl-2-pyrolidone/amide acrylate/N-vinyl-2-methylimdazole (molar ratio, 50:30:20)
[17] Copoly-N-vinyl-2-pyrolidone/N-(1,1-dimethyl-3-oxo)-butylacrylamide (molar ratio, 70:30)
[18] Copoly-N-allyl-2-pyrolidone/vinyl acetate (molar ratio, 64:36)
[19] Copoly-N-vinyl-2-pyrolidone/4-vinyl pyridine (molar ratio, 60:40)
[20] Copoly-N-vinyl-2-pyrolidone/ethyl acrylate/-monoethanolamine acrylate (molar ratio, 50:45:5)
[21] Copoly-N-vinyl-2-pyrolidone/piperidinomaleamic piperidine (molar ratio, 53:47)
[22] Copoly-N-vinyl pyrolidone/4-vinylpyridino-N-methyliodide (molar ratio, 42:58)
[23] Copoly-N-vinyl pyrolidone/thiourea half ammonium maleate (molar ratio, 60:40)

*Note (1): Varieties of the example compound (1) are commercially available from General Aniline and Film Corp. under the tradenames of PVP K-15, PVP K-17, PVP K-30, PVP K-60 and PVP K-90, and also from BASF Aktiengesellschaft (Japan) under the tradenames of "Coridone 12", "Coridone 17", "Coridone 25", "Coridone 30", "Coridone 90", "Rubiscol K-17", "Rubiscol K-30", and "Rubiscol K-90".

The above exemplified polymers and/or copolymers, some of which are commercially available as above noted, can easily be synthesized according to the methods described in W. R. Sorenson and T. W. Campbell, "Preparative Methods of Polymer Chemistry", John Wilery and Sons, Inc., 1961.

Such polymers or copolymers may be used either singly or in a combination of two or more kinds. The amount of such polymer or copolymer used is preferably within a range of 0.01 g to 100 g, in particular 0.05 g to 10 g, per liter of the color developing solution. Such a polymer or copolymer may be added directly to the solution in the color developer tank, or added to a replenishing tank solution for subsequent replenishing of the color developing tank solution, or may be used in a combination of both ways.

Polyethylene glycol compounds useful in connection with the above described embodiment will now be explained.

In the practice of the invention, polyethylene glycol compounds expressed by the following formula can be preferably used:

$$HO(CH_2CH_2O)nCH_2CH_2OH \ (n=1 \text{ to } 1000)$$

More specifically, carbowax 1000, carbowax 1540, carbowax 2000, carbowax 4000, and carbowax 6000 are mentioned as useful compounds for the purpose. The amount of such polyethylene glycol to be added is generally at least 1 g/liter, preferably 1.5 g/liter to 40 g/liter.

Besides aforesaid polyethylene glycols, their derivatives can be used, though they are somewhat less effective.

Of the above-mentioned derivatives, polyethylene glycol-bis-pyridinium methane sulfonate, polyethylene glycol-bis-tri($\beta$-hydroxyethyl)ammonium methane sulfonate, polyethoxyethyl-bis(3,5-disulfobenzoate) tetrasodium, polyethylene glycol-bis-sulfonic acid, and polyethoxyethyl-bis-carboglutamic acid are rather less effective.

Next, the second invention of the present application will be explained.

This invention is characterized in that in the above described processing method of the first invention, a developing temperature is higher than 40° C. Processing at more than 40° C. can accelerate development and provide improved graininess. Processing is performed preferably at a temperature within a range of 42° C. to 70° C., in particular, within a range of 45° C. to 65° C.

Where development is performed at higher than 40° C., satisfactory development effect can be obtained even if a p-phenylenediamine-based developing agent is used in the concentration of $1.0\times10^{-2}$ to $1.5\times10^{-2}$ mol/liter. In this conjunction, a pH range of 10.2 and a processing time range of 20 to 150 seconds are even acceptable.

However, if the developing temperature condition of not lower than 40° C. is combined with such other conditions as a developing agent concentration of not lower than $1.5\times10^{-2}$ mol/liter, or a pH value of not lower than 10.4, or a sulfite concentration of lower than $1.5\times10^{-2}$ mol/liter, or a bromide concentration of not higher than $0.8\times10^{-2}$ mol/liter, or use of any of developing accelerators [A-I] through [A-VI], the object of the invention can be more satisfactorily accomplished.

Next, the third invention of the present application will be explained.

This third invention is characterized in that in the processing method of the first invention, the concentration of the developing agent in the developer solution is not lower than $1.5\times10^{-2}$ mol/liter. By using the developing agent in such high concentration, it is possible to effect active processing and provide improved graininess. Preferably, the color developer solution contains the developing agent at a concentration of not lower than $2\times10^{-2}$ mol per liter solution, more favorably in a concentration range of $2.5\times10^{-2}$ to $2\times10^{-1}$ more/-liter, still more favorably $3\times10^{-2}$ to $1\times10^{-1}$ mol/liter.

The color developing agents useful in the practice of the invention will be discussed hereinbelow. The following explanation on the color developing agents is applicable to the other inventions of the present application as well, unless it is contradictory to their respective essential features.

In the practice of the invention, there may be used, for example, aromatic primary amine-based color developing agents, including various kinds of known agents widely used as such in the art of color photographic processing. These developing agents include aminophenol and p-pheniline diamine derivatives. These compounds are generally used in the form of salt, for example, in the form of hydrochloride, phosphate, or sulfate, since they are more stable in such form than in their free state.

Among the aminophenol developing agents there are, for example, o-aminophenol, p-aminophenol, 5-amino-2-oxy-toluene, 2-amino-3-oxy-toluene, and 2-oxy-3-amino-1,4-dimethyl benzene.

Especially useful aromatic primary amine-based color developing agents are those having an amino group with at least one water-soluble group, and especially preferably, they are compounds expressed by the following general formula [X].

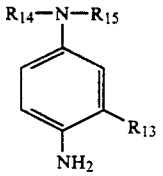

In the formula, $R_{13}$ represents a hydrogen atom, a halogen atom, or an alkyl group, wherein the above-mentioned alkyl group is a straight-chained or branched alkyl group having 1 to 5 carbon atoms, and may have a substituent group. $R_{14}$ and $R_{15}$ independently represent a hydrogen atom, or an alkyl or aryl groups, which may have a substituted group, wherein at least one of the $R_{14}$ and $R_{15}$ being an alkyl group having a water-soluble substituent, such as a hydroxyl group, carboxylic group, sulfonic group, amino group, or sulfonamide group; or $\left[(CH_2)_q O\right]_p R_{16}$. Such an alkyl group further may have a substituent.

It is noted that $R_{16}$ represents a hydrogen atom or an alkyl group, wherein the alkyl group being a straight-chained or branched alkyl group having 1 to 5 carbon atoms; and p and q respectively stands for an integer of 1 to 5.

Examples illustrative of the compounds expressed by the general formula [X] are given below; it is understood, however, that the scope of the compounds according to the invention is not limited to these examples.

[Example compounds]

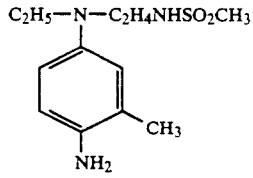
(E-1)

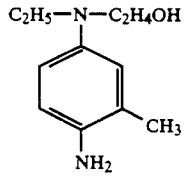
(E-2)

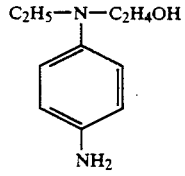
(E-3)

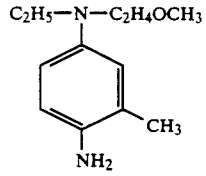
(E-4)

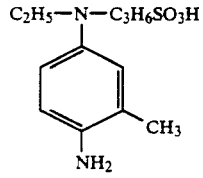
(E-5)

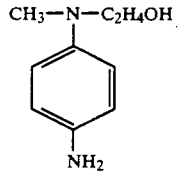
(E-6)

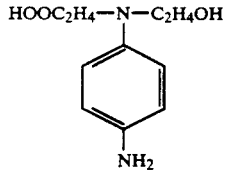
(E-7)

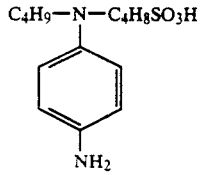
(E-8)

-continued (E-9)

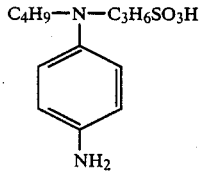

(E-10)

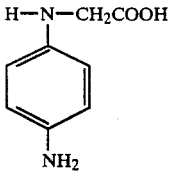

(E-11)

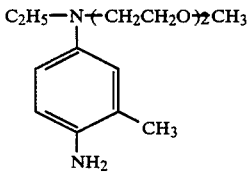

(E-12)

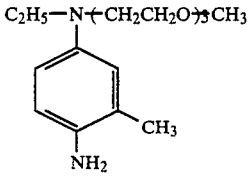

(E-13)

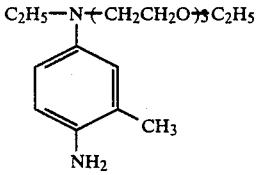

(E-14)

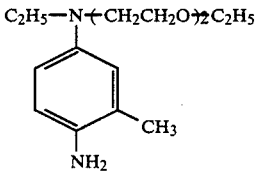

(E-15)

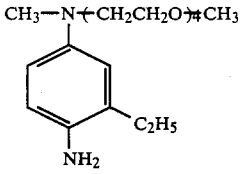

(E-16)

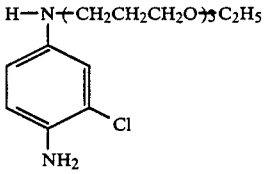

The p-phenylenediamine derivatives expressed by the general formula [X] may be used in the form of organic or inorganic acidic salt. For example, various salts such as hydrochloride, sulfate, phosphate, p-toluene sulfonate, sulfite, oxalate, and benzene sulfonate can be used for the purpose of the invention.

In the practice of the invention, among the p-phenylenediamine derivatives expresed by the above-mentioned formula [X], those in which $R_{14}$ and/or $R_{15}$ are expressed by the formula $-[(CH_2)_q O]_p R_{16}$ (in which p, q, and $R_{16}$ are as above defined) are especially effective for purposes of the inventions of the present application.

Next, the fourth invention of the present application will be explained.

This fourth invention is characterized in that in the processing method of the first invention, the developing time is less than 180 seconds.

In this fourth invention, the time for processing the silver halide color photographic light-sensitive material according to the above described processing method is within the range of 20 seconds to 150 seconds, preferably 30 to 120 seconds, more favorably 30 to 120 seconds, and still more favorably 40 to 100 seconds.

According to this invention, the silver halide color photographic light-sensitive material is processed for such a specific duration by employing the above described method, and surprisingly it has been found that this can result in considerably improved dye image graininess.

Next, the fifth invention of the present application is hereinunder described.

This fifth invention is characterized in that in the processing method of the first invention, the rate of layer swelling during the process of color development is less than 20 seconds.

Swelling rate $T_{\frac{1}{2}}$ can be measured according to any measurement technique known in the art. For example, it can be measured by employing a swellometer of the type described in a report made by A. Green et al in Photographic Science and Engineering, Vol. 10, No. 2, pp. 124 to 129. The above-mentioned $T_{\frac{1}{2}}$ is defined as the duration taken until ½ of a saturated gelatin thickness is reached, wherein the term "saturated gelatin thickness" means a maximum gelatin thickness resulting from 90% swelling which can be reached when processing is performed with the color developer solution at 30° C. for 3 minutes and 15 seconds. Referring to FIG. 1, time $T_{\frac{1}{2}}$ or one half of the time taken until the gelatin thickness is saturated by swelling (that is, the gelatin thickness levels off in the graph) is taken as the speed of gelatin swelling.

The swelling rate $T_{\frac{1}{2}}$ can be adjusted by adding a hardening agent to gelatin serving as a binder, or through varying combinations between the amounts of the hardening agent and gelatin in the photographic light-sensitive material on one hand and the characteristics of the developer solution on the other hand. For example, it can be adjusted by adding the hardening agent to the developer solution and/or by increasing the concentration of the salt in the solution.

For the hardening agent, various types of hardening agents can be used, including aldehyde-based ones, aziridine-based ones (e.g., those described in PB Report 19,921, U.S. Pat. Nos. 2,950,197, 2,964,404, 2,983,611, and 3,271,175, Japanese Patent Examined Publication No. 40898/1971, and Japanese Patent O.P.I. Publication No. 91315/1975), isooxazolium-based ones (e.g., those described in U.S. Pat. No. 3,321,323), epoxy-based ones (e.g., those described in U.S. Pat. No. 3,047,394, German Patent No. 1,086,663, British Patent No. 1,033,518, and Japanese Patent Examined Publication No. 35495/1973), vinylsulfone-based ones (e.g., those described in PB Report 19,920, German Patent Nos. 1,100,942, 2,337,412, 2,545,722, 2,635,518, 2,742,308, and 2,749,260, British Patent No. 1,251,091, and U.S. Pat. Nos. 3,539,644 and 3,490,911), acryloyl-based ones (e.g., those described in U.S. Pat. No. 3,640,720), carbodiimide-based ones (e.g., those described in U.S. Pat. Nos. 2,938,892, 4,043,818, 4,061,499, and Japanese Patent Examined Publication No. 38715/1971), triazine-based ones (e.g., those described in German Patent nos. 2,410,973 and 2,553,915, U.S. Pat. No. 3,325,287, and Japanese Patent O.P.I. Publication No. 12722/1977), and high-polymeric ones (e.g., those described in British Patent No. 822,061, U.S. Pat. Nos. 3,623,878, 3,396,029, and 3,226,234, and Japanese Patent Examined Publication Nos. 18578/1972, 18579/1972, 49986/1972). There are also known maleimide-based, acetylene-based, methane sulfonate-based, and N-methylol-based hardening agent. These hardening agents can be used either alone as such or in combination. Various useful combinations are disclosed in various publications including, for example, German Patent Nos. 2,447,587, 2,505,746, and 2,514,245, U.S. Pat. Nos. 4,047,957, 3,832,181, and 3,840,370, Japanese Patent O.P.I. Publication No. 43319/1973, 63062/1975, and 127329/1977, and Japanese Patent Examined Publication No. 32364/1973.

With the binder for photographic structural layers which is used in the color photographic light-sensitive material according to the invention, the smaller the speed of its swelling $T_{\frac{1}{2}}$, the better. However, if the lower limit of such speed is excessively small, gelatin hardening will not take place and thus scratches and the like troubles are likely to occur. Therefore, it is preferred that the lower limit should be more than 1 second. More favorably, the swelling rate is more than 2 seconds and not more than 20 seconds, especially preferably less than 15 seconds, and most favorably less than 10 seconds. If the rate of gelatin swelling is greater than 20 seconds, desilvering of the photographic material, and more particularly the process of bleach-fixing, are seriously hindered.

Next, the sixth invention of the present application will be described.

This sixth invention is characterized in that in the processing method of the first invention, the light-sensitive material to be processed has, on its support, at least one silver-halide emulsion layer containing a coupler expressed by the following general formula [M-I].

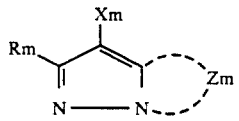

General formula [M-I]

In the above general formula [M-I], Zm represents a plurality of non-metal atoms necessary for forming a nitrogen-containing heterocycle, and the ring formed by the above-mentioned Zm may have a substituent group.

Symbol Xm represents hydrogen atom, or a group capable of split off upon the reaction an oxidation product of the color developing agent.

Symbol Rm represents a hydrogen atom, or a substituent group.

The substituent group represent by Rm is not particularly limited but is typically any of the following groups, namely, alkyl, aryl, anilino, acylamino, sulfonamide, alkylthio, arylthio, alkenyl, and cycloalkyl groups. Among others, the following are mentioned: halogen atom; cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxy carbonylamino, alkoxycarbonyl, aryloxy carbonyl, and heterocyclic thio groups; and spiro residue and bridged hydrocarbon residue.

The alkyl group expressed by Rm is preferably any of those having 1 to 32 carbon atoms, and may be straight-chained or branched.

The aryl group expressed by Rm is preferably a phenyl group.

Examples of the acylamino group expressed by Rm include alkylcarbonylamino and arylcarbonylamino groups.

Examples of the sulfonamide group represented by Rm include alkylsulfonylamino and arylsulfonylamino groups.

Examples of the alkyl and aryl components in the alkylthio and arylthio groups represented by Rm are alkyl and aryl groups each represented by Rm.

The alkenyl group expressed by Rm is preferably one having 2 to 32 carbon atoms, and the cycloalkyl group expressed by Rm is preferably one having 3 to 12, more favorably 5 to 7 carbon atoms; the alkenyl group may be straight-chained or branched.

The cycloalkenyl group expressed by Rm is preferably one having 3 to 12 carbon atoms, more favorably 5 to 7 carbon atoms.

Examples of the sulfonyl group expressed by Rm include alkylsulfonyl and arylsulfonyl groups.

Examples of the sulfinyl group expressed by Rm include alkylsulfinyl and arylsulfinyl groups.

Examples of the phosphonyl group expressed by Rm include alkylphosphonyl, aryloxysulfonyl, and arylphosphonyl groups.

Examples of acyl group expressed by Rm include alkylcarbonyl and arylcarbonyl groups.

Examples of carbamoyl group expressed by Rm include alkylcarbamoyl and arylcarbamoyl groups.

Examples of sulfamoyl group expressed by Rm include alkylsulfamoyl and arylsulfamoyl groups.

Examples of acyloxy group expressed by Rm include alkylcarbonyloxy and arylcarbonyloxy groups.

Examples of carbamoyloxy group expressed by Rm include alkylcarbamoyloxy and arylcarbamoyloxy groups.

Examples of ureido group expressed by Rm include alkylureido and arylureido groups.

Examples of sulfamoylamino group expressed by Rm include alkylsulfamoyl amino and arylsulfamoyl amino groups.

The heterocyclic group expressed by Rm is preferably five- to seven-member one, and more specifically, 2-furil, 2-thienyl, 2-pyrimidinyl, or 2-benzothiazolyl group.

The heterocyclic oxy group expressed by Rm is preferably one having a five- to seven-membered heterocyclic ring, and typically, 3,4,5,6-tetrahydropyranyl-2-oxy group or 1-phenyl-tetrazole-5-oxy group.

The heterocyclic thio group expressed by Rm is preferably a five- to seven-membered heterocyclic thio group, for example, 2-pyridylthio, 2-benzothiazolylthio, or 2,4-diphenoxy-1,3,5-triazone--thio group.

Examples of the siloxy group expressed by Rm include trimethylsiloxy, triethylsiloxy, and dimethylbutylsiloxy groups.

Examples of the imido group expressed by Rm include succinimido, 3-heptadecyl succinimido, phthalimide, and glutarimido groups.

Examples of spiro residue expressed by Rm include spiro [3,3]heptane-1yl.

Examples of the bridged hydrocarbon residue expressed by Rm include bicyclo [2,2,1]heptane-1-yl, tricyclo[3,3,1,1$^{3,7}$]decnae-1yl, and 7,7-dimethyl-bicyclo[2,2,1]heptane-1-yl.

Examples of the group expressed by Xm which is capable of split off upon the reaction with an oxidation product of the color developing agent are a halogen atom (e.g., chlorine bromine, and fluorine atoms); alkoxy, aryloxy, heterocyclic oxy, acyloxy, sulfonyloxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythio carbonylthio, acylamino, sulfonamide, N-atom bonded nitrogen-containing heterocycle, alkyloxycarbonylamino, aryloxycarbonylamino, carboxyl, and

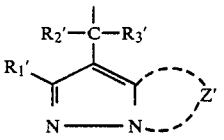

(in which $R_1'$ has same meaning as aforesaid Rm; Z' has same meaning as aforesaid Zm; and $R_2'$ and $R_3'$ independently represent a hydrogen atom, or aryl, alkyl, or heterocyclic group). Among the examples above, however, a particularly preferred one is a halogen atom, especially, chlorine atom.

Examples of the nitrogen-containing heterocyclic ring formed by Z or Z' include pyrazole, imidazole, triazole, and tetrazole rings. For the substituent groups which any of these rings may have, those mentioned with respect to the previously defined R are available.

The couplers expressed by the general formula [M-I] are more specifically expressed by the following general formulas [M-II] through [M-VII]:

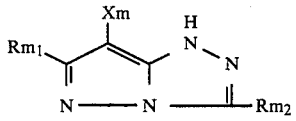

General formula [M-II]

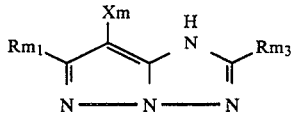

General formula [M-III]

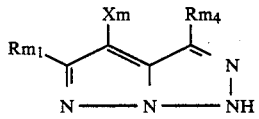

General formula [M-IV]

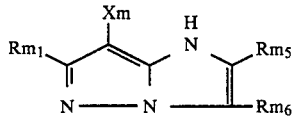

General formula [M-V]

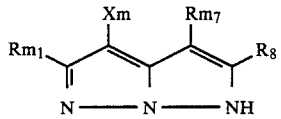

General formula [M-VI]

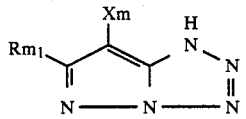

General formula [M-VII]

In the foregoing formulas [M-II] through [M-VII], $Rm_1$ through $Rm_8$ and Xm have same meanings as previously mentioned Rm and Xm.

Among the couplers expressed by the general formula [M-I], particularly preferred are those expressed by the following general formula [M-VIII].

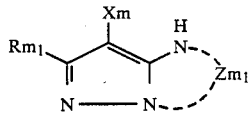

General formula [M-VIII]

In the formula, $Rm_1$, Xm, and $Zm_1$ have same meanings are $Rm_1$, Xm, and Zm in the general formula [M-I].

Of the magenta couplers expressed by the general formulas [M-II] to [M-VII], most advantageous are those expressed by the general formula [M-II].

As the substituent which a ring formed by Zm in general formula [M-I], or a ring formed by $Zm_1$ in the general formula [M-VIII], may have, or as any of $Rm_1$ through $Rm_8$ in the general formulas [M-II] through [M-VI], those expressed by the following general formula [M-IX]

$$-R^{m1}-SO_2-R^{m2}$$

In the formula, $R^{m1}$ represents an alkylene group, and $R^{m2}$ represents an alkyl group, a cyloalkyl group, or an aryl group.

The alkylene group expressed by $R^{m1}$ has a straight chain portion having preferably 2 or more carbon atoms, in particular, 3 to 6 carbon atoms, and may be of either straight chained or branched configuration.

As the cycloalkyl group expressed by $Rm_2$, a five- to six-membered one is preferred.

For the substituent groups Rm and $Rm_1$ on the previously mentioned heterocyclic ring, if the light-sensitive material is used for positive image formation, those expressed by the following general formula [M-X] are most favorable.

General formula [M-X]

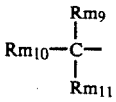

In the formula, $Rm_9$, $Rm_{10}$, and $Rm_{11}$ are synonymous with afore-mentioned R.

Two of the above-mentionned $Rm_9$, $Rm_{10}$, and $Rm_{11}$, for example, $Rm_9$ and $Rm_{10}$ may be combined with each other to form a saturated or unsaturated ring (e.g., cycloalkane, cycloalkene, or heterocycle), and further, $Rm_{11}$ may be combined with the ring to form a bridged hydrocarbon residue group.

In the general formula [M-X], it is preferred that (i) at least two of $Rm_9$ through $Rm_{11}$ are alkyl groups, or that (ii) one of $Rm_9$ through $Rm_{11}$, for example, $Rm_{11}$ is a hydrogen atom, whereby the other two i.e. $Rm_9$ and $Rm_{10}$ are combined with each other to form cycloalkyl together with a root carbon atom.

Further, in the above case (i), it is preferred that two of $Rm_9$ through $Rm_{11}$ are alkyl groups, while the other one is a hydrogen atom or an alkyl group.

As the substituent groups Rm and $Rm_1$ on the above-mentioned heterocycle, if the light-sensitive material of the invention is used for positive image formation, those expressed by the following general formula [M-XI] are most favorable.

General formula [M-XI]

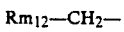

where $Rm_{12}$ is synonymous with aforesaid R.

$Rm_{12}$ is preferably a hydrogen atom, or an alkyl group.

Typical examples of the compounds according to the invention will be given below.

1

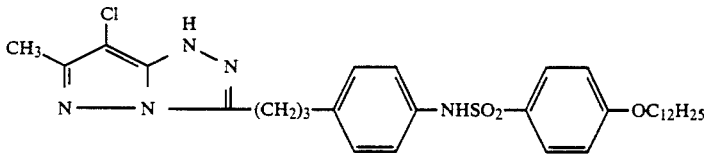

2

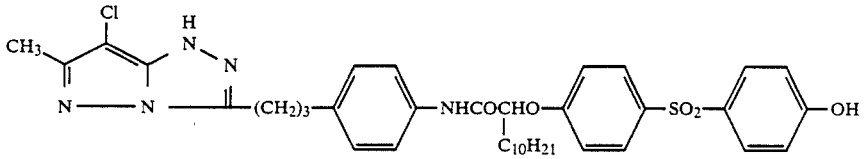

3

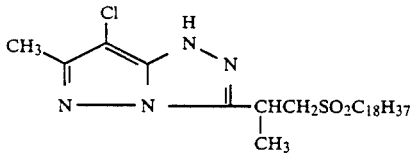

4

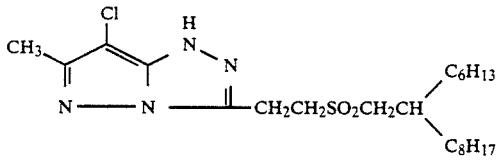

5

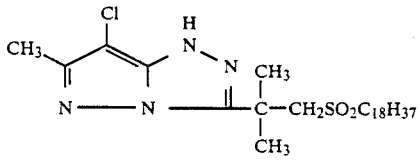

-continued
6
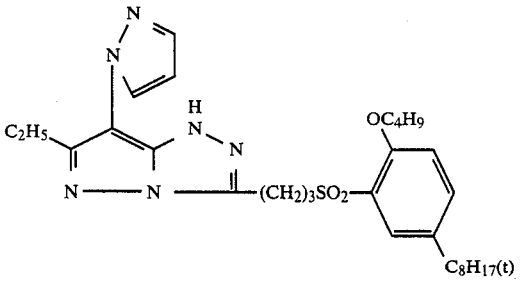
7
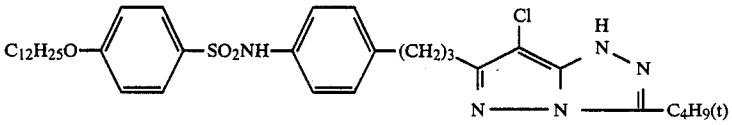
8
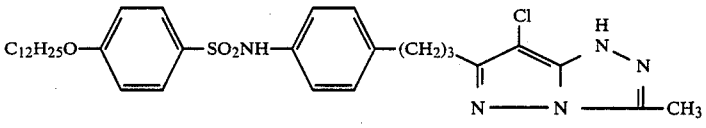
9
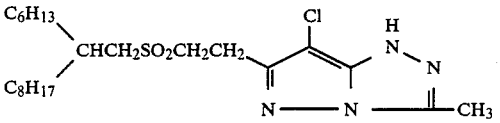
10
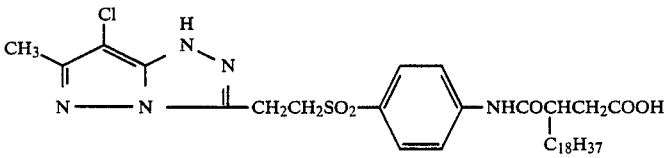
11
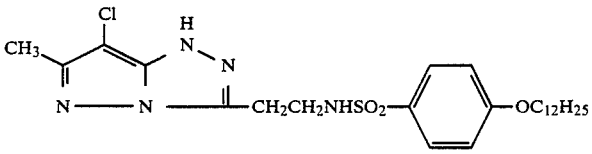
12
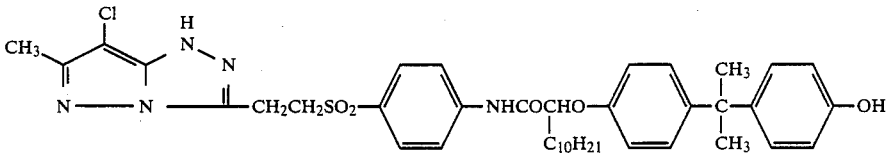
13
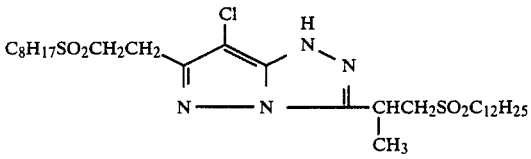
14
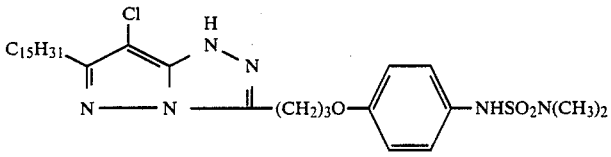

-continued
15
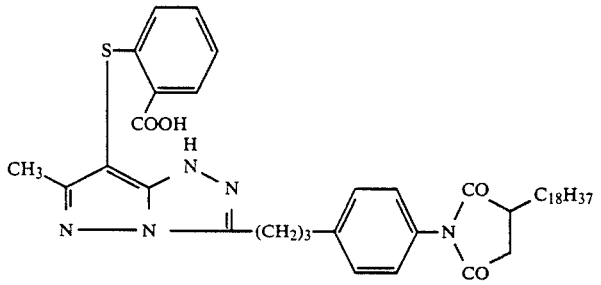
16
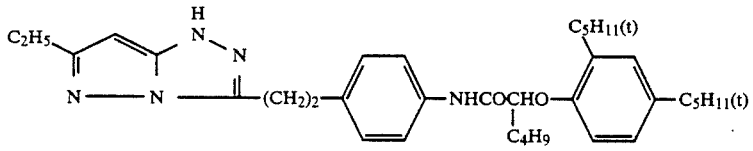
17
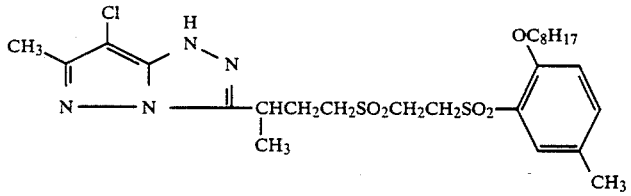
18
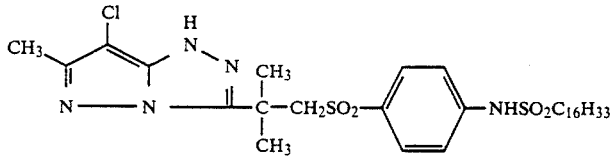
19
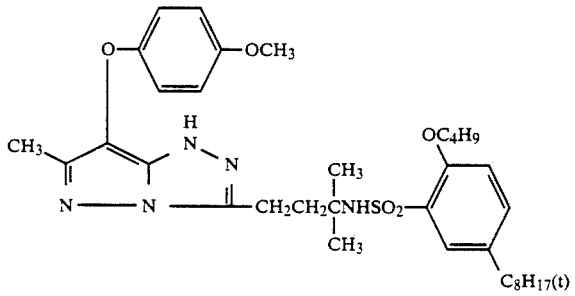
20
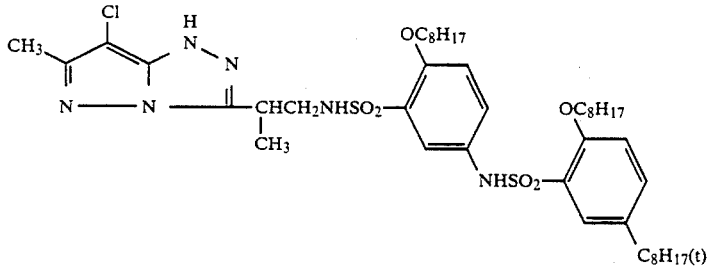
21
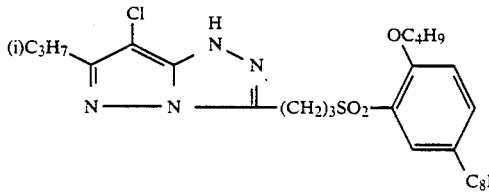

-continued
22
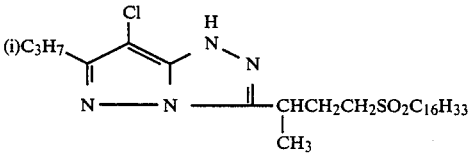
23
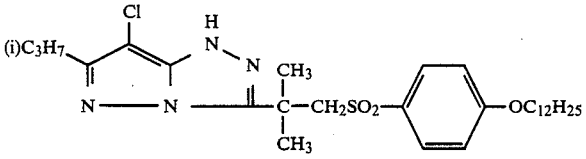
24
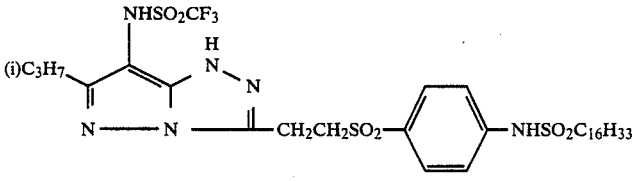
25
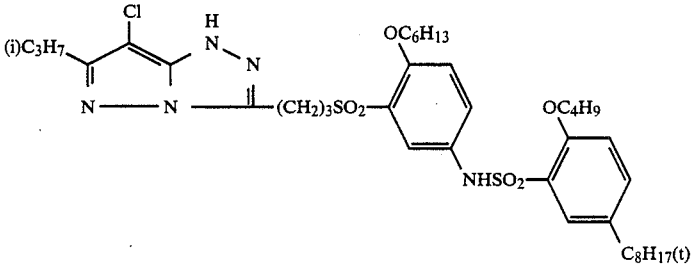
26
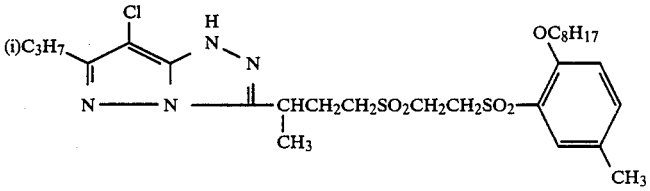
27
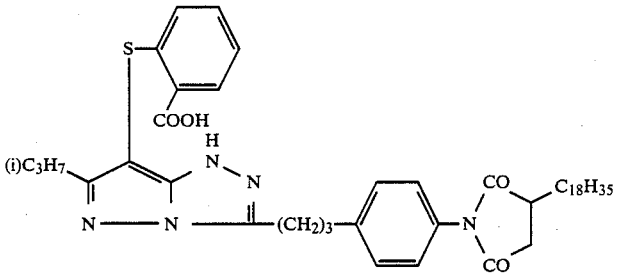
28
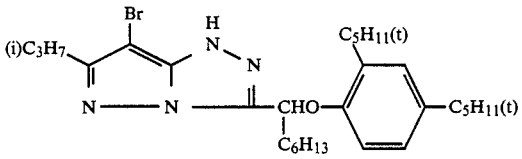
29
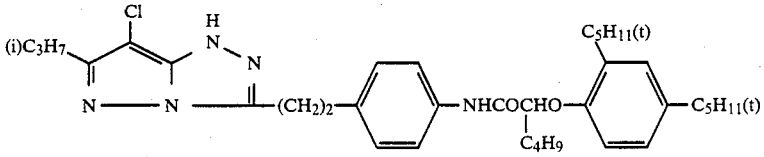

-continued
30
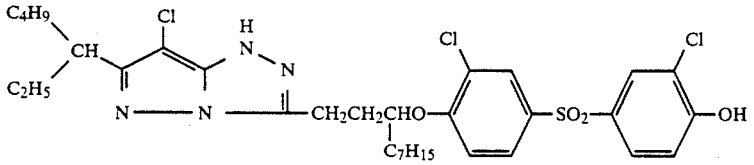
31
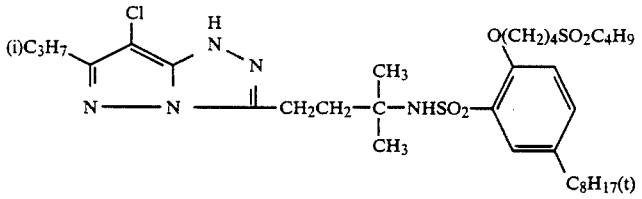
32
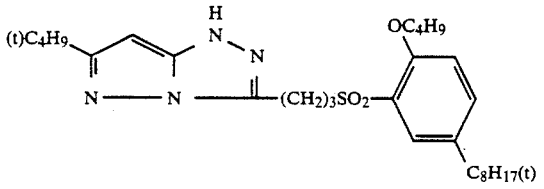
33
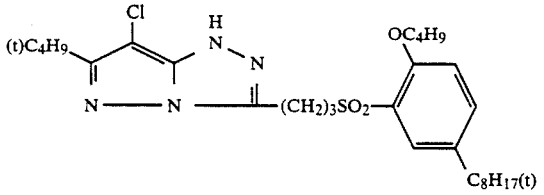
34
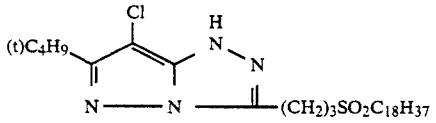
35
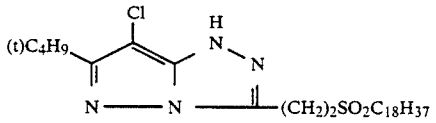
36
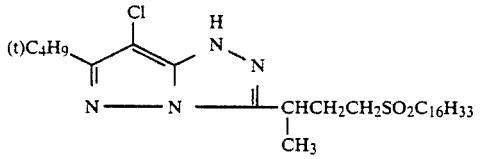
37
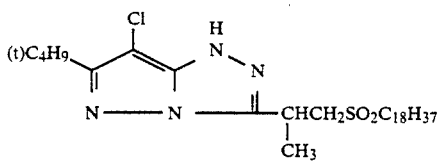
38
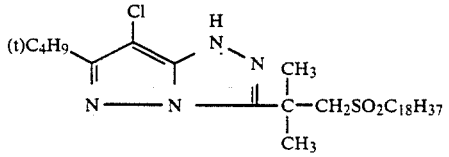

-continued
39
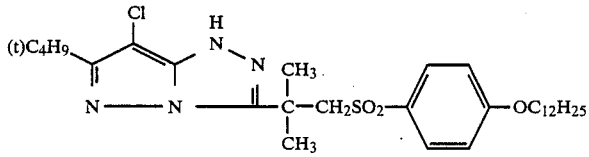
40
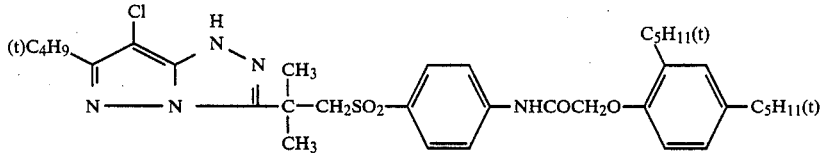
41
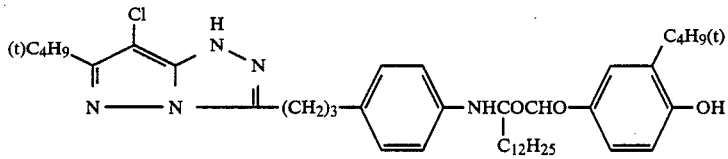
42
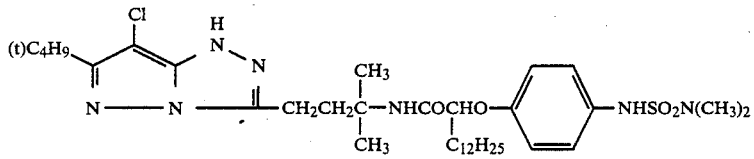
43
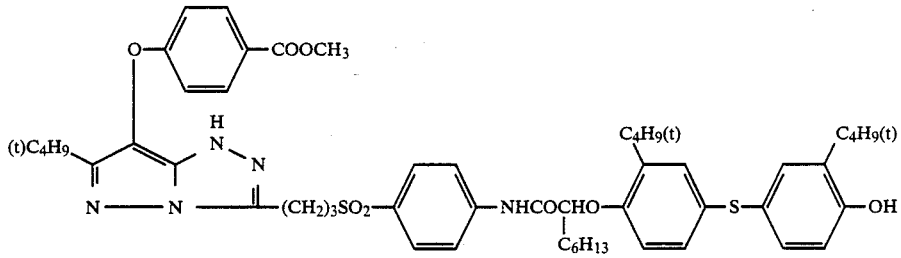
44
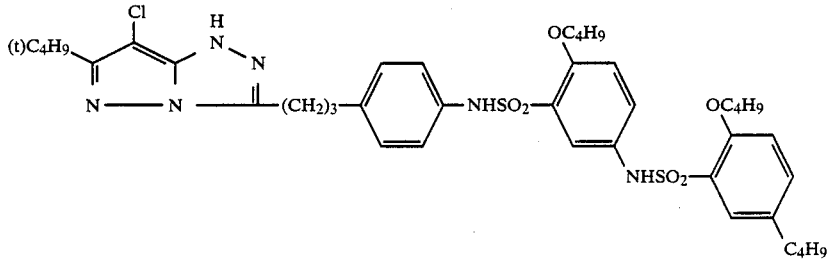
45
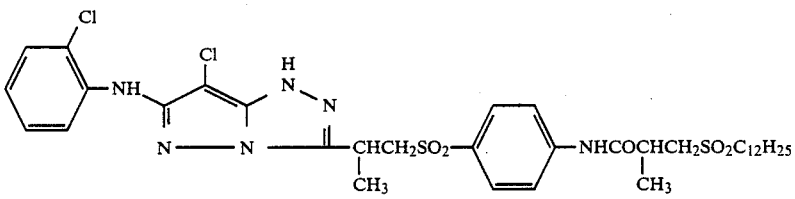
46
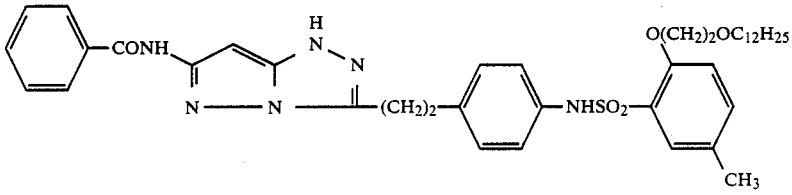

-continued
47
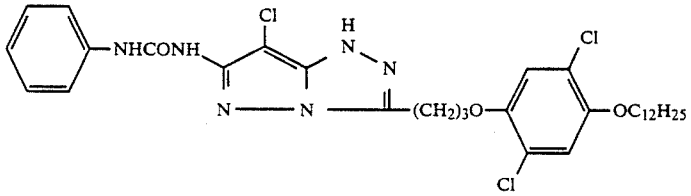
48
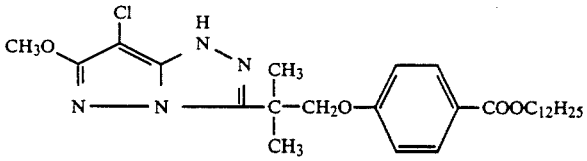
49
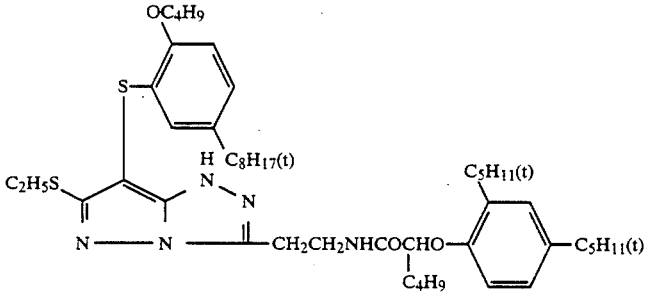
50
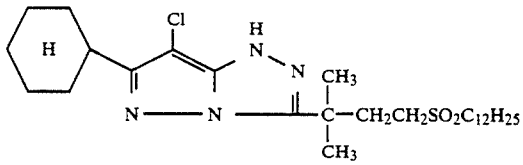
51
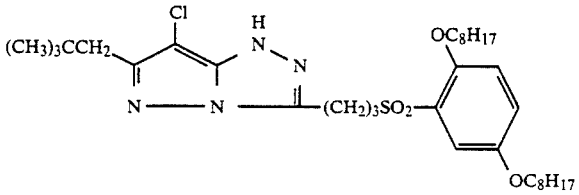
52
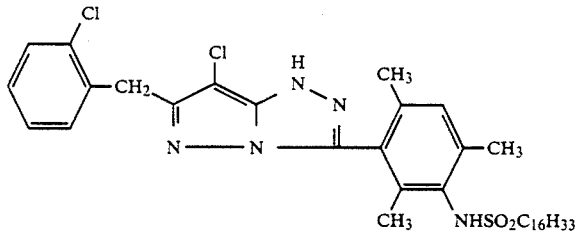
53
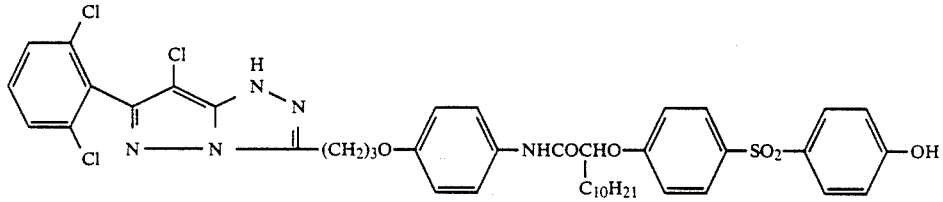

-continued
54
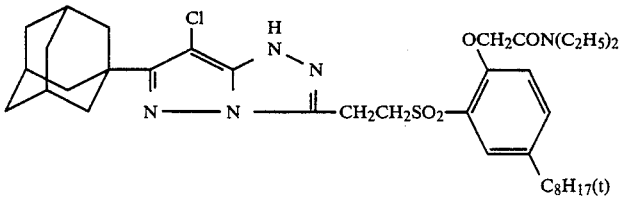
55
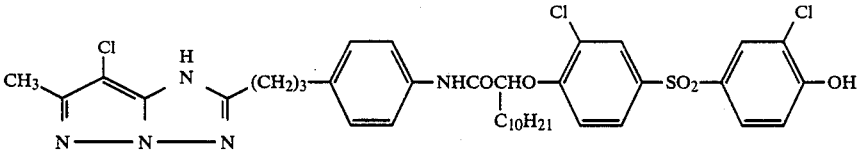
56
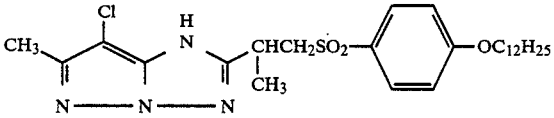
57
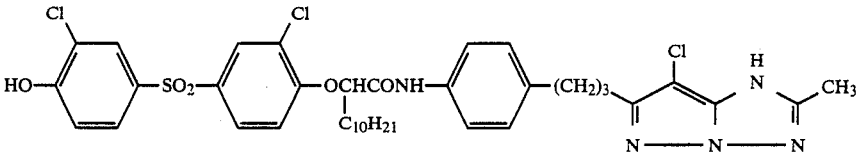
58
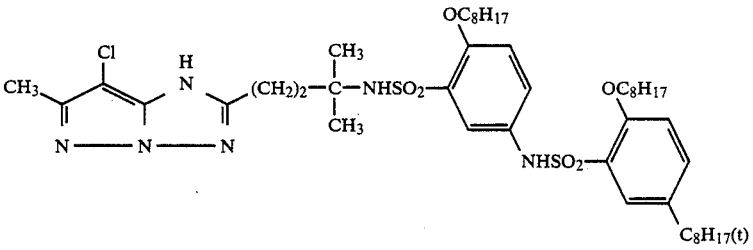
59
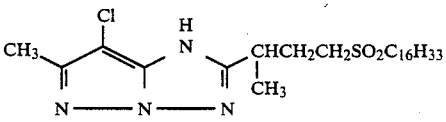
60
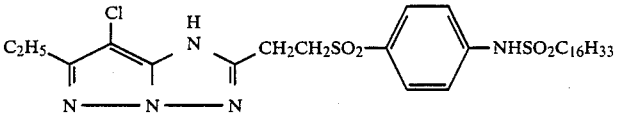
61
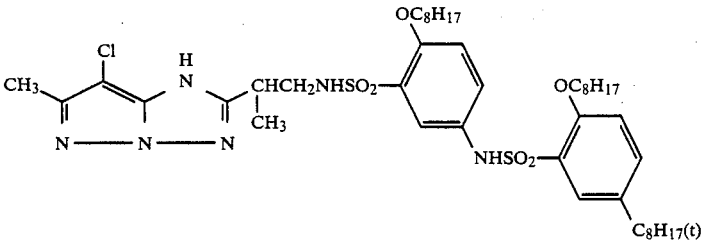
62
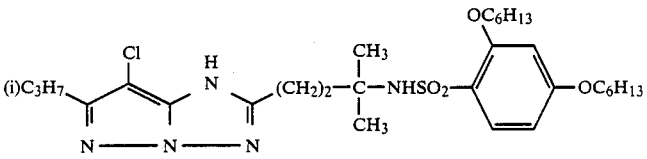

-continued
63
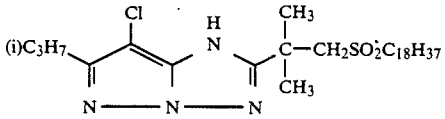
64
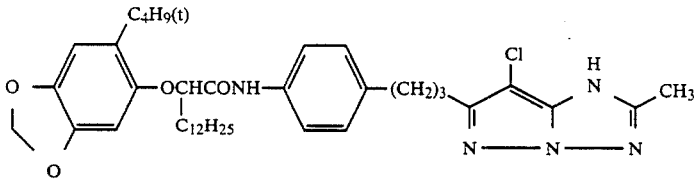
65
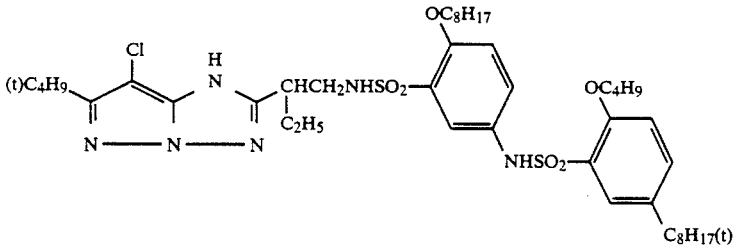
66
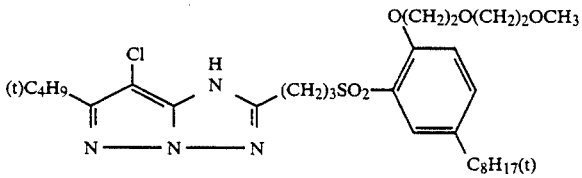
67
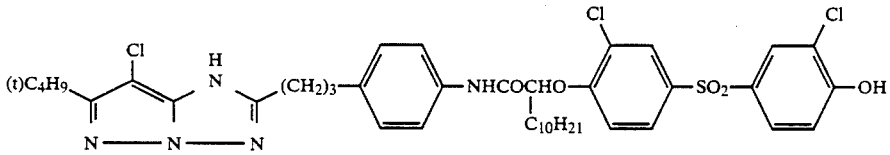
68
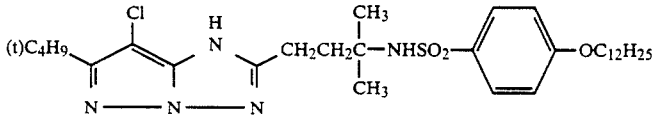
69
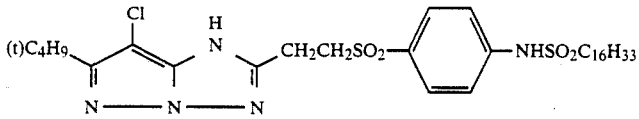
70
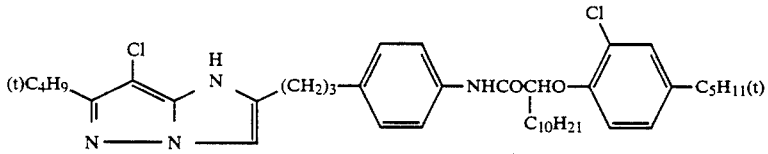
71
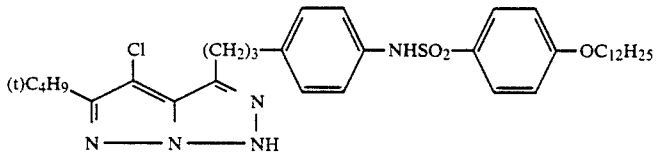

-continued

72

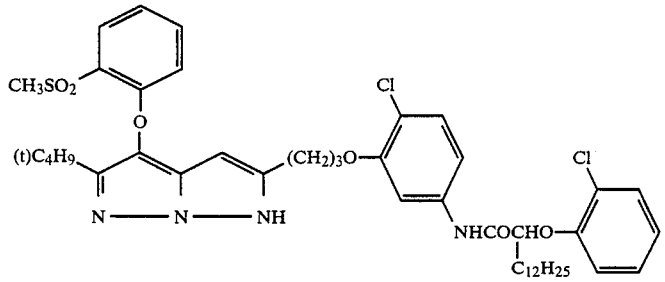

73

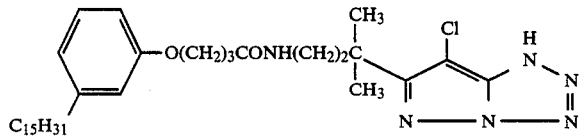

74

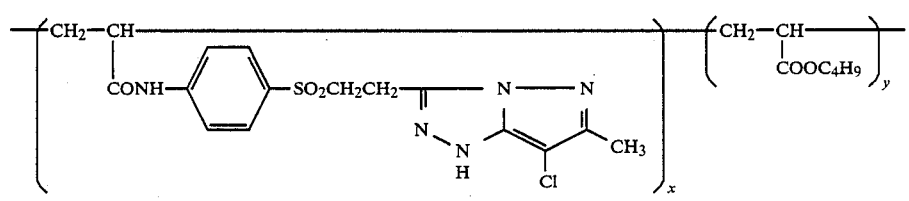

x:y = 50:50

75

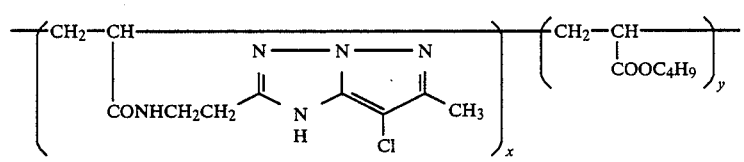

x:y = 50:50

76

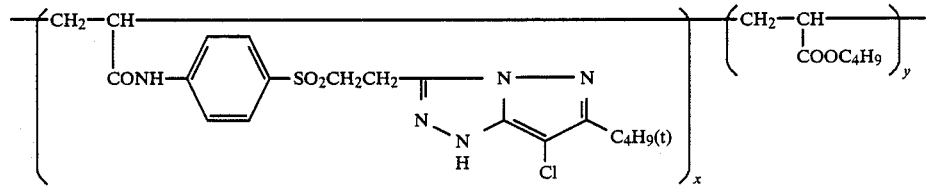

x:y = 50:50

77

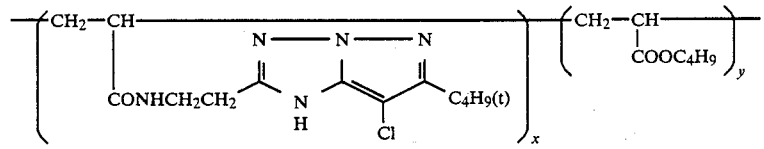

x:y = 50:50

In addition to the above given typical examples, the compounds shown by Nos. 1 to 4, 6, 8 to 17, 19 to 24, 26 to 43, 45 to 59, 61 to 104, 106 to 121, 123 to 162, and 164 to 223, of those described pp. 66 to 122 of the specification of Japanese Patent Application No. 9791/1986, are mentioned as examples of the couplers expressed by the general formula [M-I].

The foregoing couplers can be synthesized with reference to the Journal of the Chemical Society, Perkin I (1977), pp. 2047 to 2052; U.S. Pat. No. 3,725,067, and Japanese Patent O.P.I. Publication Nos. 99437/1984, 42045/1983, 162548/1984, 171956/1984, 33552/1985, 43659/1985, 172982/1985, and 190779/1985.

The above-mentioned couplers are normally used in the amount of $1\times10^{-3}$ mol to 1 mol, preferably $1\times10^{-2}$ mol to $8\times10^{-1}$ mols, per mol silver halide.

The couplers according to the invention can be used in combination with other kinds of magenta couplers.

Next, the seventh invention of the present application will be explained.

This seventh invention is characterized in that in the processing method of the first invention, the light-sensitive material to be processed has, on the support, at least one silver-halide emulsion layer containing a coupler expressed by the following general formula [C-I].

General formula [C-I]

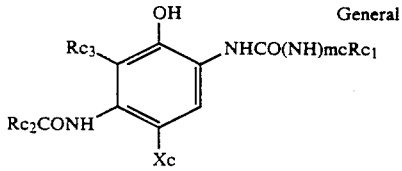

In the above formula, $Rc_2$ represent an alkyl, cycloalkyl, alkenyl, aryl, or heterocyclic group, each of which may have a substituent group. $Rc_3$ represents a hydrogen atom, halogen atom; or an alkyl or alkoxy group, which may have a substituent group. Provided that $Rc_2$ and $Rc_3$ may be those which form a ring in conjunction with each other. Symbol Xc represents a hydrogen atom; or a group being capable of split off upon the reaction with an oxidation product of the color developing agent. M stands for 0 or 1.

As the alkyl group represented by $Rc_1$ or $Rc_2$. those having 1 to 32 carbon atoms are available; and as the similarly represented cycloalkyl group, those haivng 3 to 12 carbon atoms are available; as the similarly represented alkenyl group, those having 3 to 12 carbon atoms are available. These alkyl, alkenyl, and cycloalkyl groups include those having a substituent group.

As the aryl group represented by $Rc_1$ or $Rc_2$, a phenyl groups is preferred, which may have a substituent group.

As the heterocyclic group represented by $Rc_1$ or $Rc_2$, a five- to seven-membered one is preferred, which may be substituted or condensed group.

Symbol $Rc_3$ represents a hydrogen or halogen atom, or an alkyl or alkoxy group, or, preferably, a hydrogen atom.

As the ring formed jointly by $Rc_2$ and $Rc_3$, a five- to six-membered ring is preferred. Examples of 5 to 6-membered rings so formed include

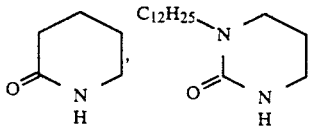

Examples of the group represented by Xc being capable of split off upon the reaction with an oxidation product of the color developing agent include a halogen atom, alkoxy, aryloxy, acyloxy, sulfonyloxy, acylamino, sulfonylamino, alkoxycarbonyloxy, aryloxycarbonyloxy, and imido groups. Of these, a halogen atom, and aryloxy and alkoxy groups are preferred.

Of said cyan couplers, those expressed by the following general formula [C-A] are especially preferred.

General formula [C-A]

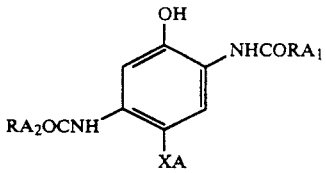

In the formula, $R_{A1}$ represents a phenyl group including a substituent of at least one halogen atom, wherein such a phenyl group may have a substituent other than a halogen atom. Symbol $R_{A2}$ is synonymous with $Rc_2$ in the foregoing general formula [C-I]. Symbol $X_A$ represents a halogen atom, or an aryloxy or alkoxy group.

$R_{A1}$ is preferably a phenyl group substituted by 2 to 5 halogen atoms.

The above-mentioned cyan couplers include, for example, the diacylamino phenol type cyan couplers described in the specification of Japanese Patent application No. 21843/1986, pp. 26 to 35, and Japanese Patent O.P.I. Publication No. 225155/1985, the diacylaminophenol type cyan couplers described in Japanese Patent O.P.I. Publication No. 222853/1985, the diacyl and ureidoaminophenol type cyan couplers described in Japanese Patent O.P.I. Publication No. 139031/1984. They can be synthesized according to the methods described in above cited publications.

The above-mentioned cyan couplers are usually incorporated in the silver halide emulsion layers, and more particularly, in the red-sensitive emulsion layer. The amount of such a cyan coupler used is within a range of $2\times10^{-3}$ to $8\times10^{-1}$, preferably $1\times10^{-1}$ to $5\times10^{-1}$ mols, per mol silver halide.

Typical examples of the cyan couplers expressed by afore-said general formula [C-I] are given below, but it is understood that the scope of said cyan couplers is not limited only to these examples.

[Example compounds ]

$C^c$-1

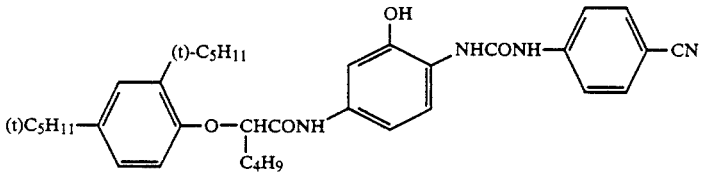

$C^c$-2

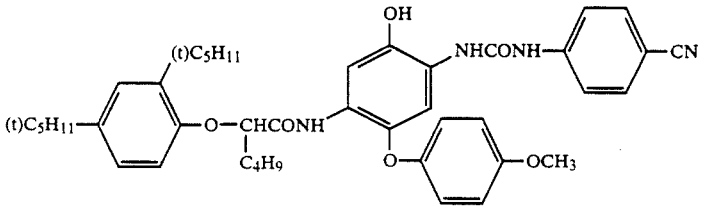

-continued
$C^c$-3
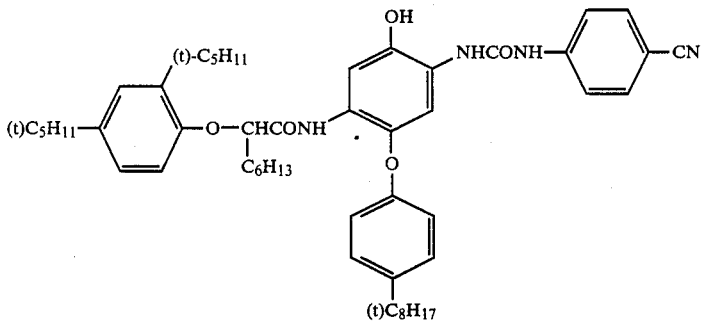
$C^c$-4
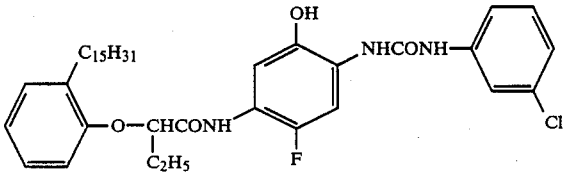
$C^c$-5
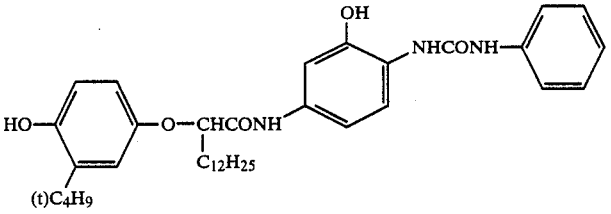
$C^c$-6
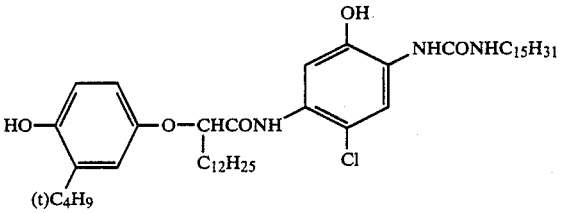
$C^c$-7
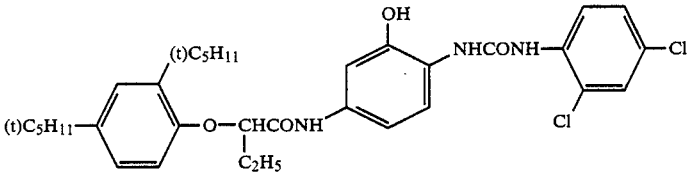
$C^c$-8
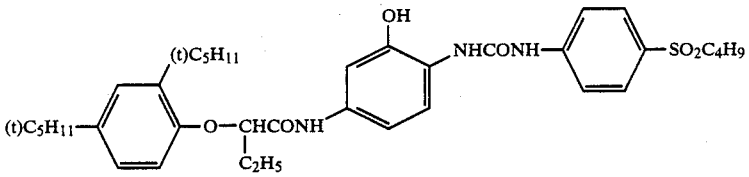
$C^c$-9
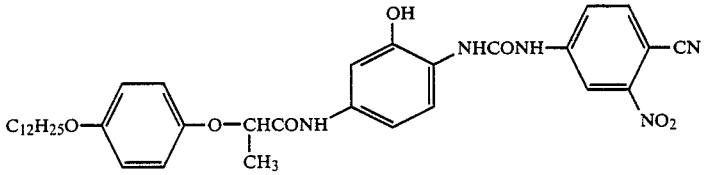

-continued
$C^c$-10
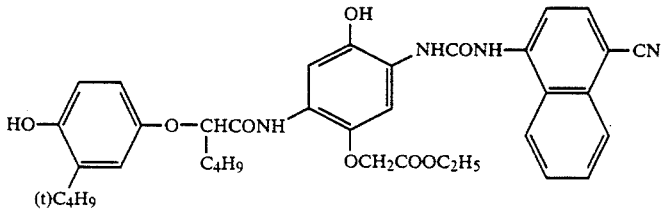
$C^c$-11
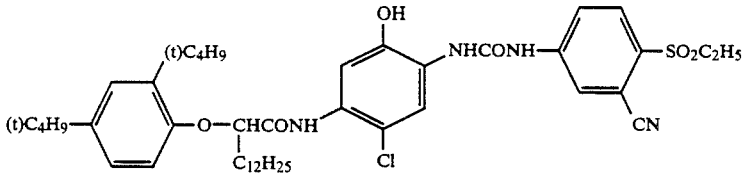
$C^c$-12
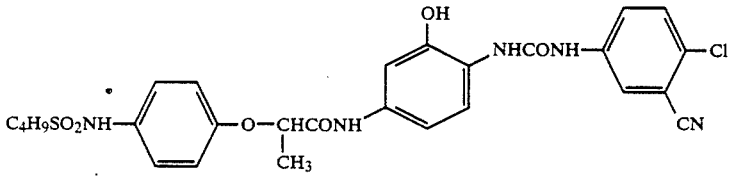
$C^c$-13
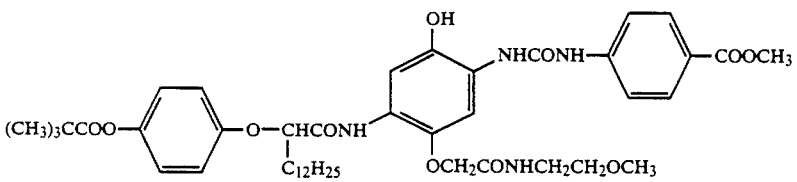
$C^c$-14
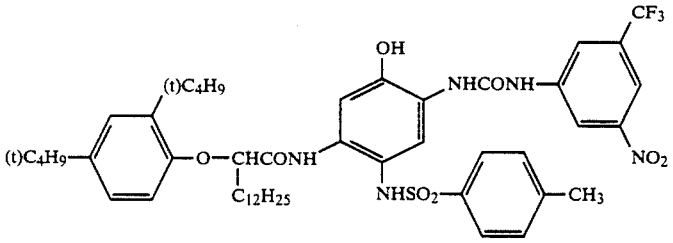
$C^c$-15
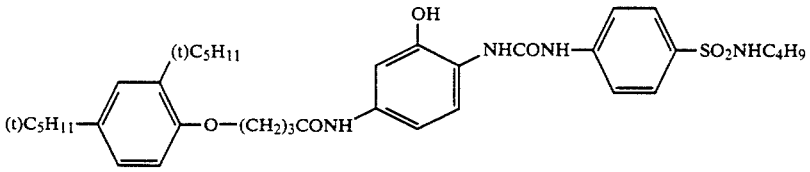
$C^c$-16
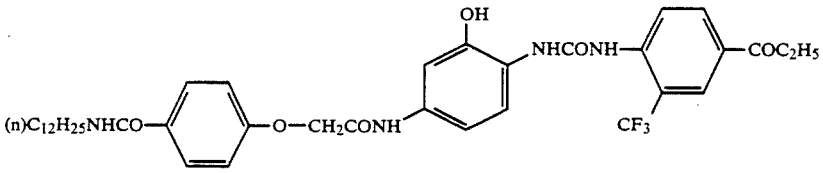
$C^c$-17
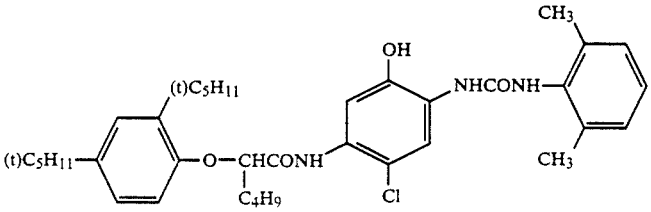

-continued
$C^c$-18
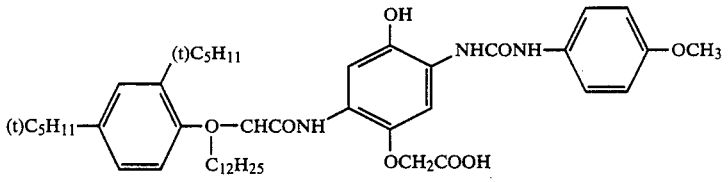
$C^c$-19
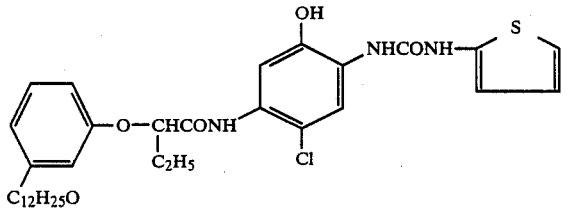
$C^c$-20
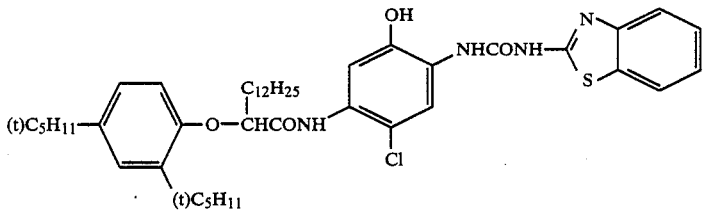
$C^c$-21
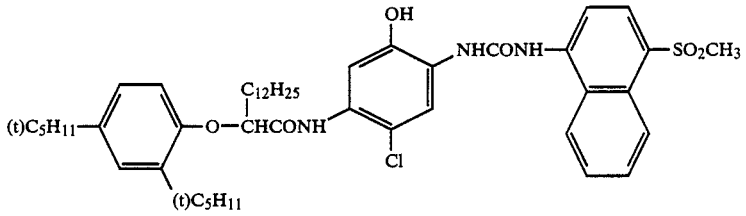
$C^c$-22
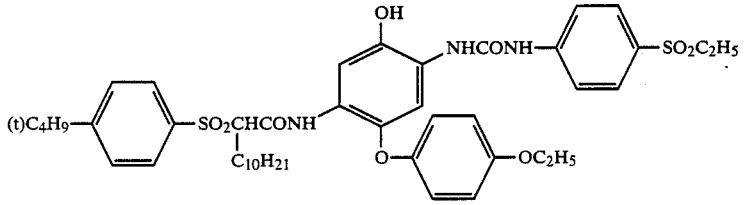
$C^c$-23
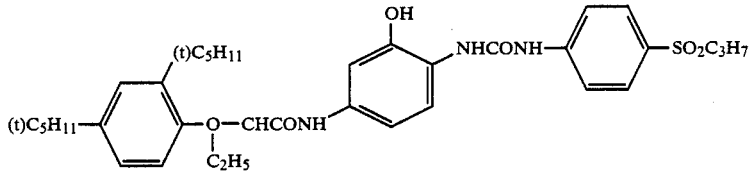
$C^c$-24
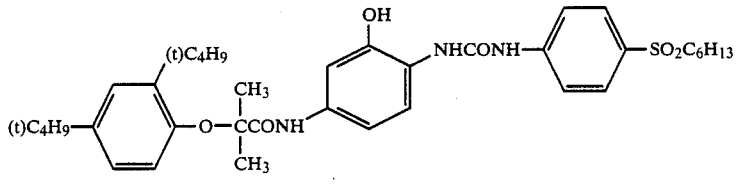

-continued
$C^c$-25
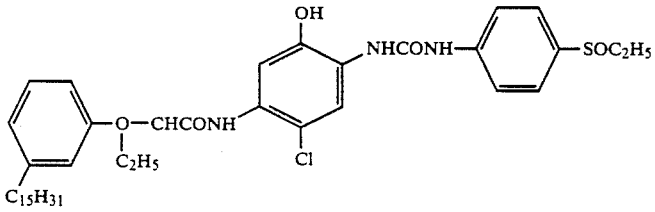
$C^c$-26
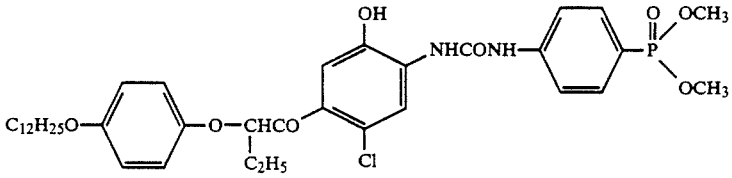
$C^c$-27
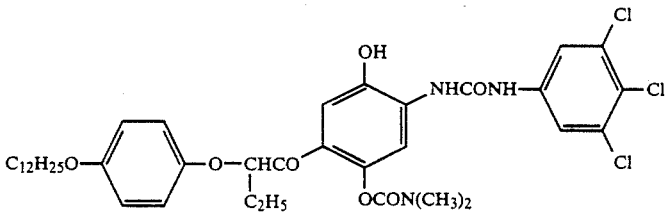
$C^c$-28
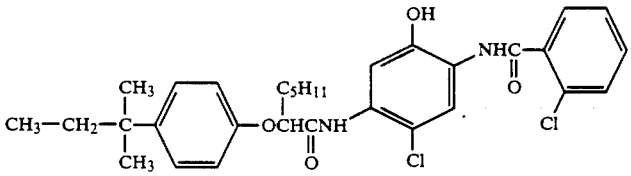
$C^c$-29
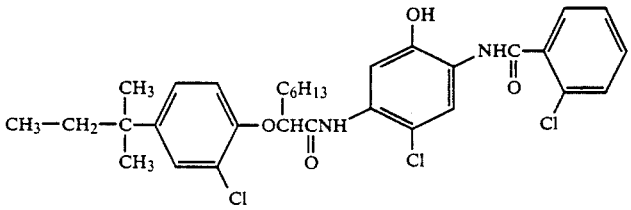
$C^c$-30
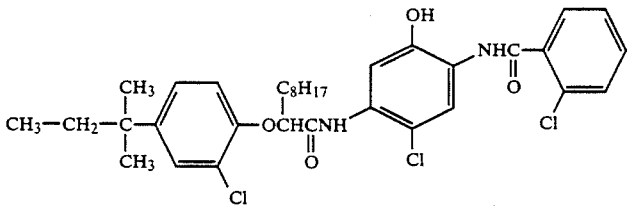
$C^c$-31
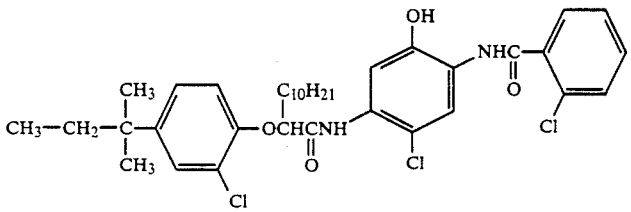

-continued
$C^c$-32
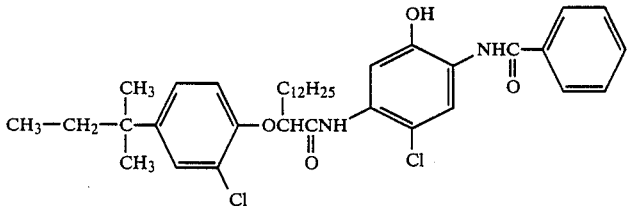
$C^c$-33
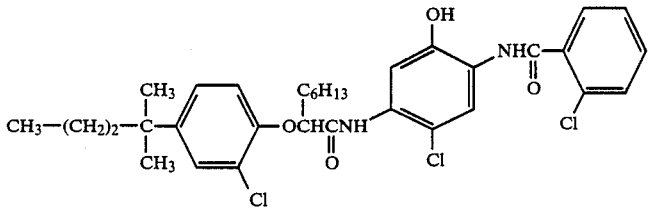
$C^c$-34
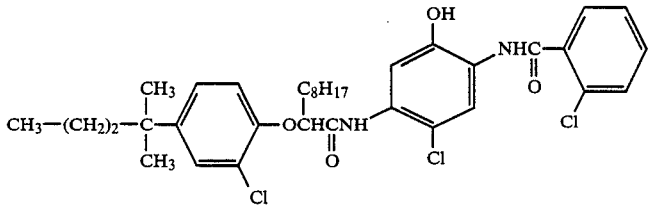
$C^c$-35
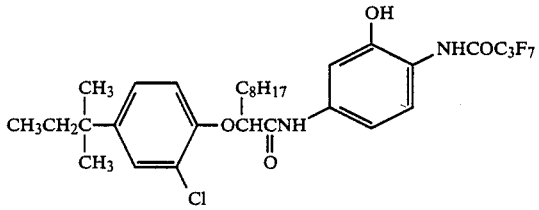
$C^c$-36
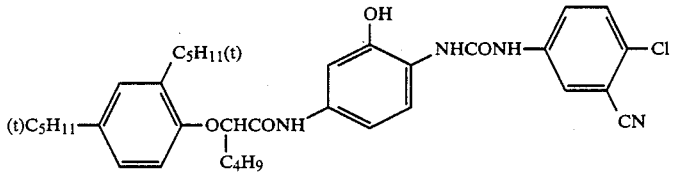
$C^c$-37
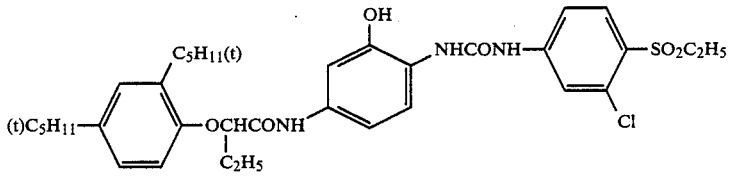
$C^c$-38
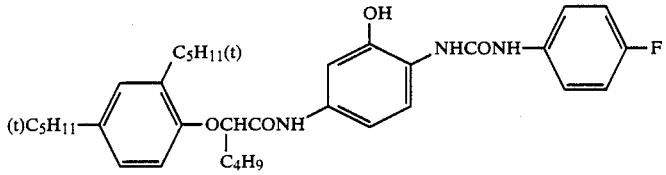

-continued
$C^c$-39
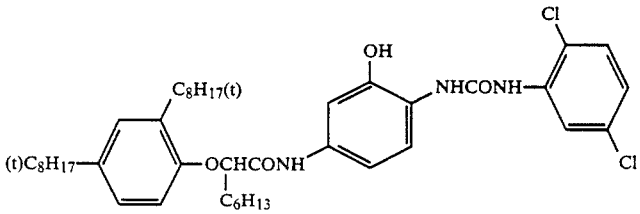
$C^c$-40
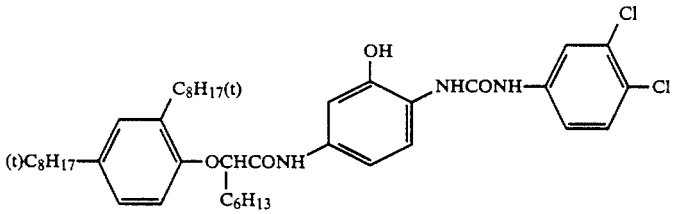
$C^c$-41
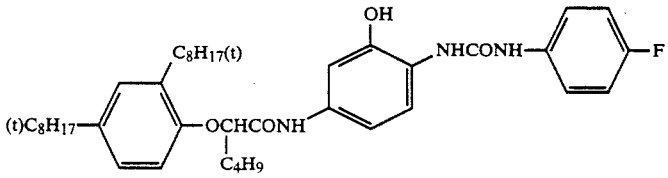
$C^c$-42
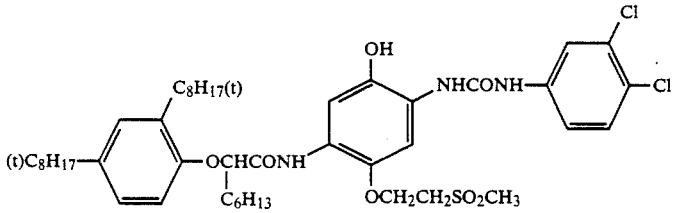
$C^c$-43
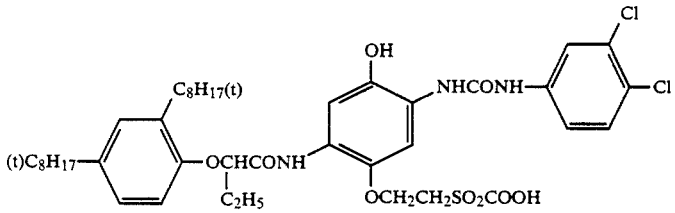
$C^c$-44
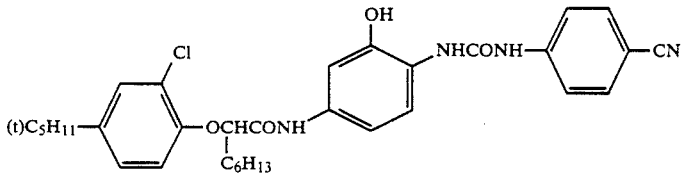
$C^c$-45
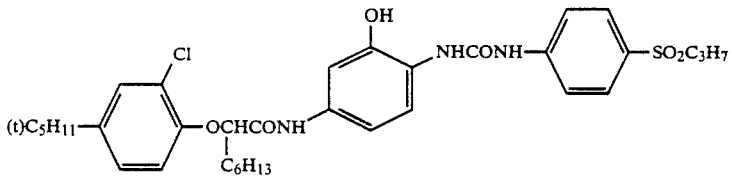
$C^c$-46
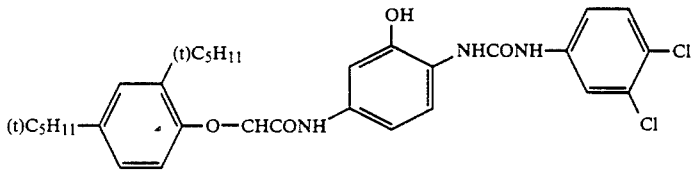

-continued
$C^c$-47
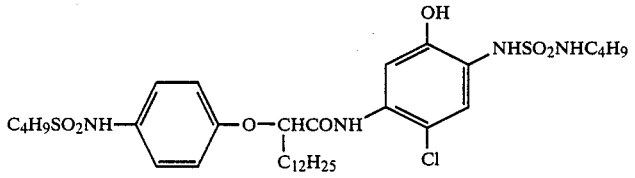
$C^c$-48
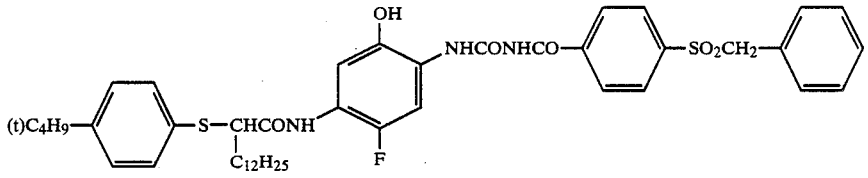
$C^c$-49
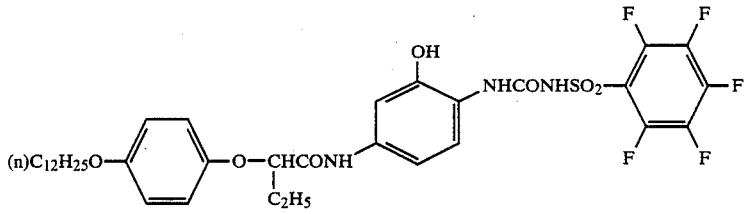
$C^c$-50
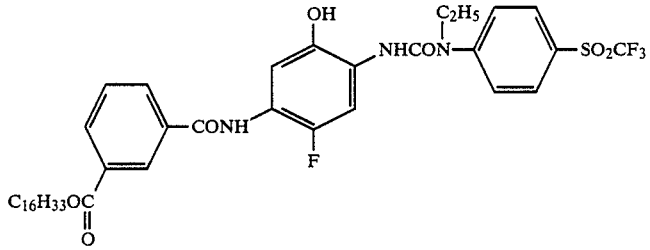
$C^c$-51
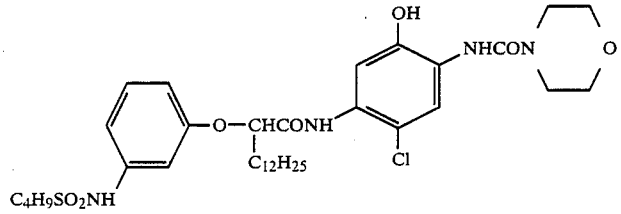
$C^c$-52
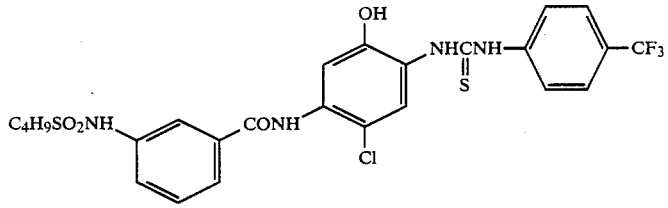
$C^c$-53
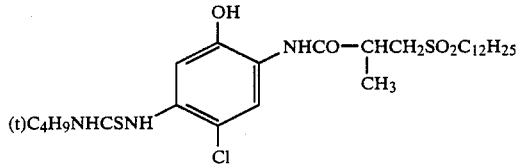

-continued
$C^c$-54
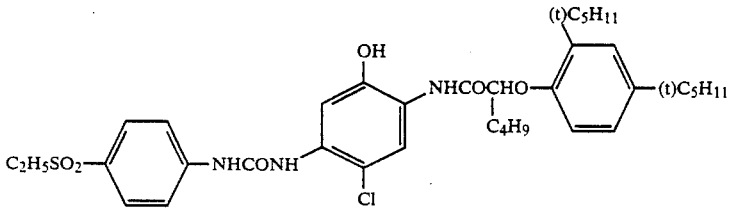
$C^c$-55
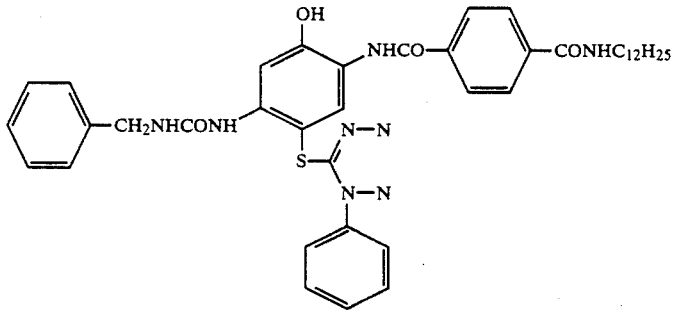
$C^c$-56
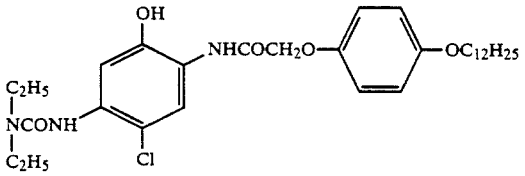
$C^c$-57
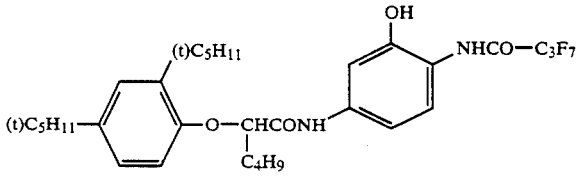
$C^c$-58
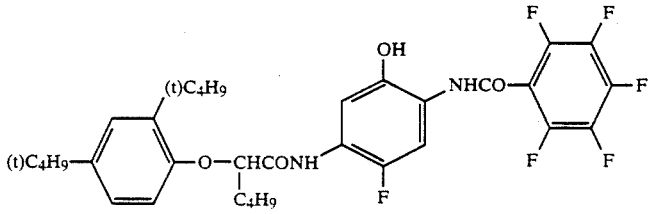
$C^c$-59
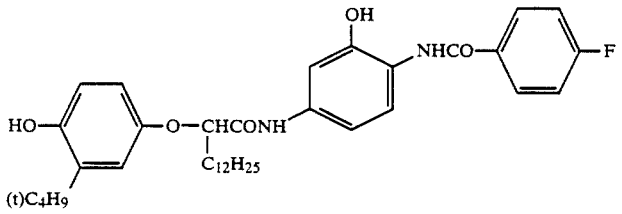
$C^c$-60
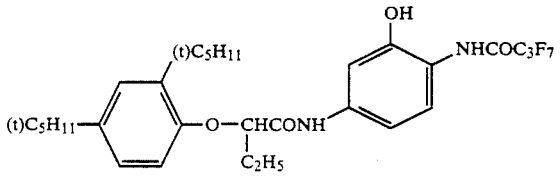

-continued
$C^c$-61
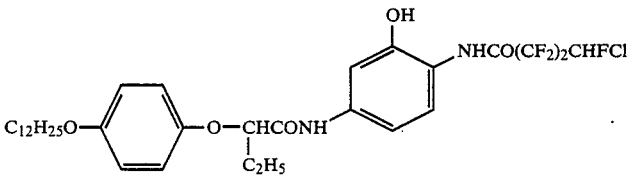
$C^c$-62
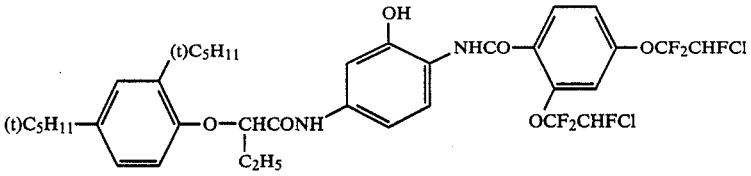
$C^c$-63
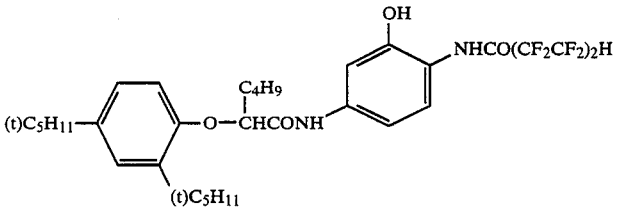
$C^c$-64
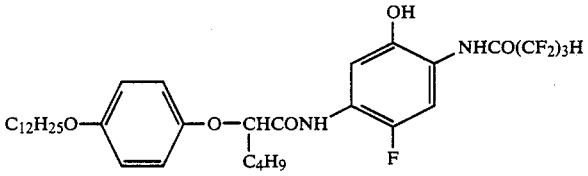
$C^c$-65
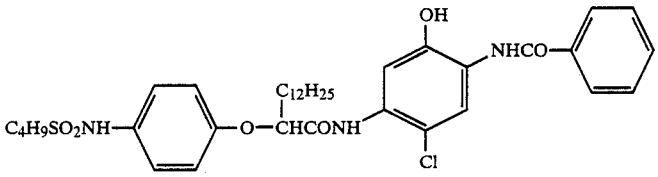
$C^c$-66
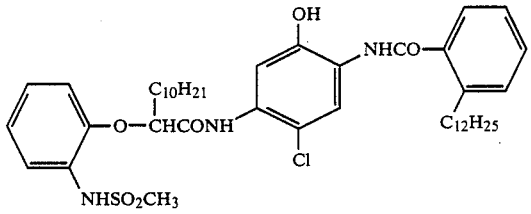
$C^c$-67
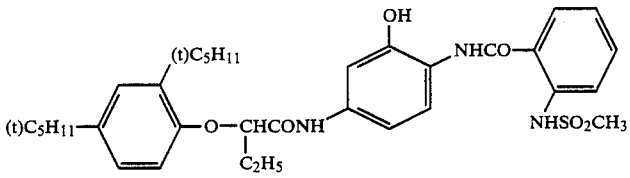
$C^c$-68
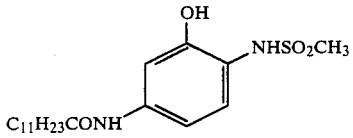

-continued
$C^c$-69
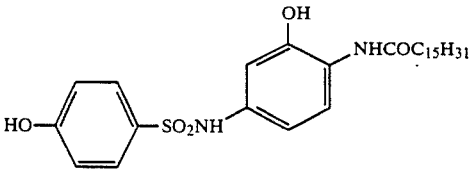
$C^c$-70
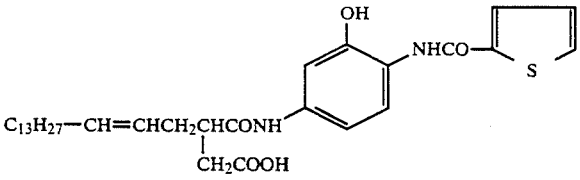
$C^c$-71
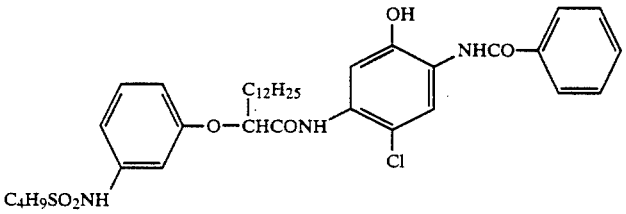
$C^c$-72
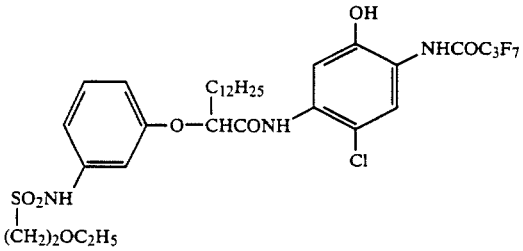
$C^c$-73
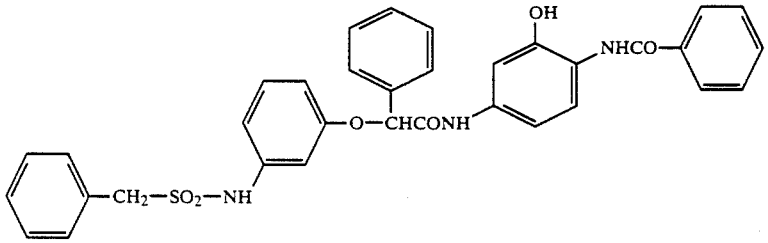
$C^c$-74
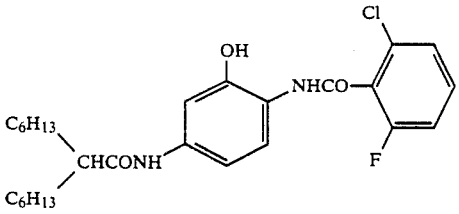
$C^c$-75
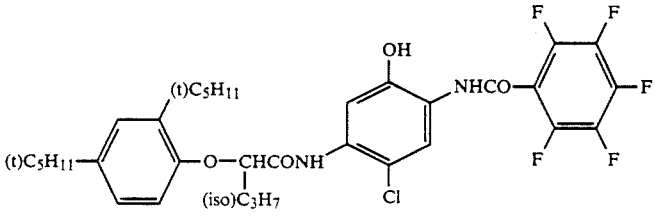

-continued
$C^c$-76
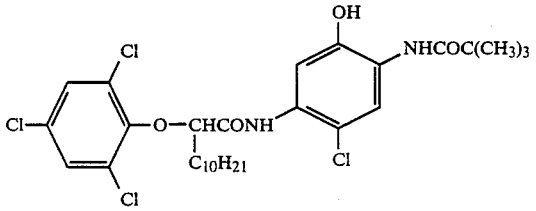
$C^c$-77
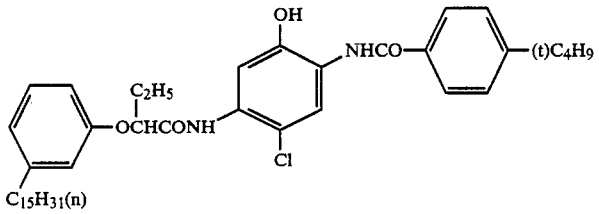
$C^c$-78
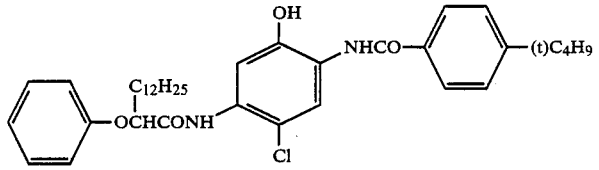
$C^c$-79
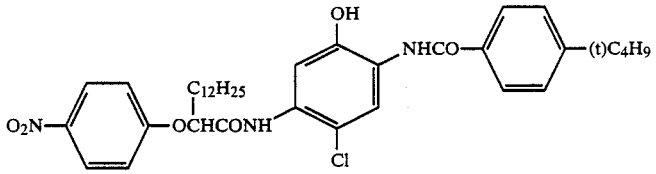
$C^c$-80
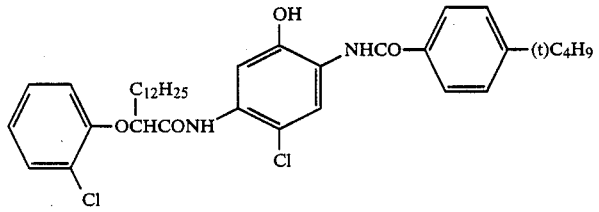
$C^c$-81
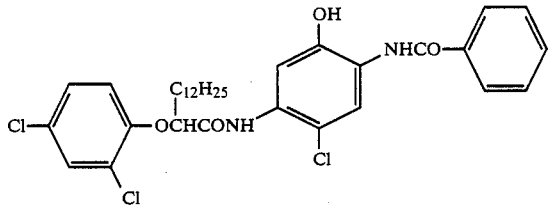
$C^c$-82
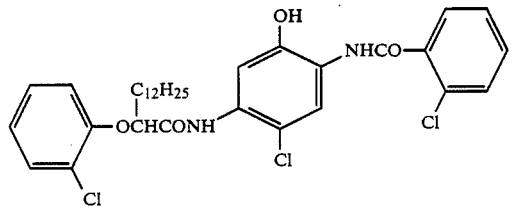

-continued
$C^c$-83
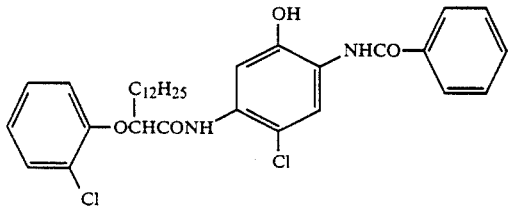
$C^c$-84
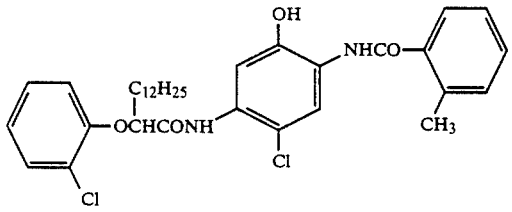
$C^c$-85
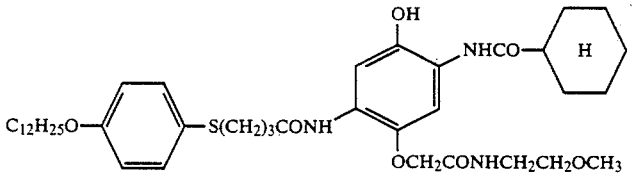
$C^c$-86
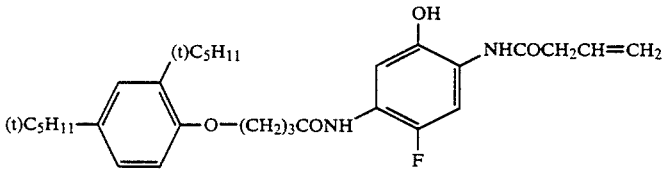
$C^c$-87
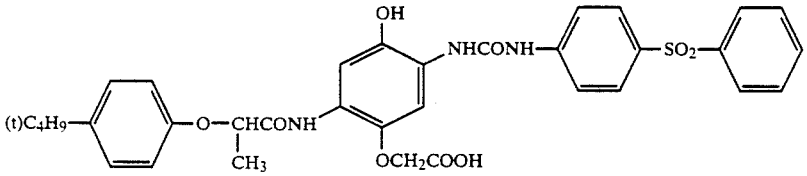
$C^c$-88
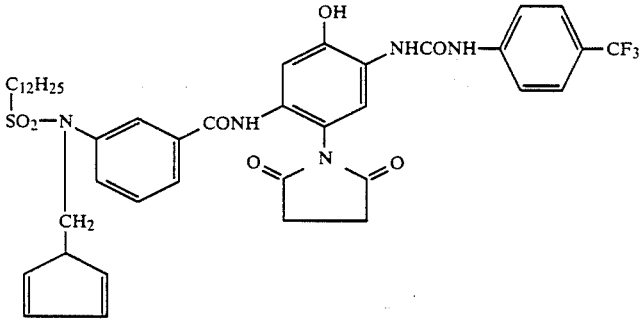
$C^c$-89
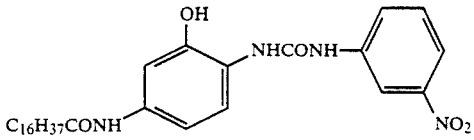

-continued
$C^c$-90
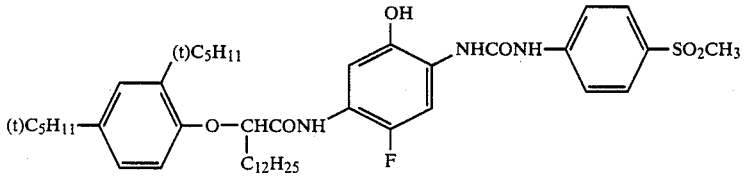
$C^c$-91
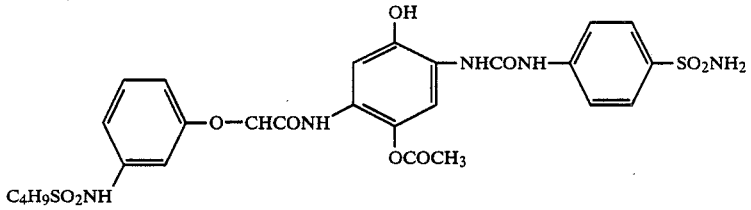
$C^c$-92
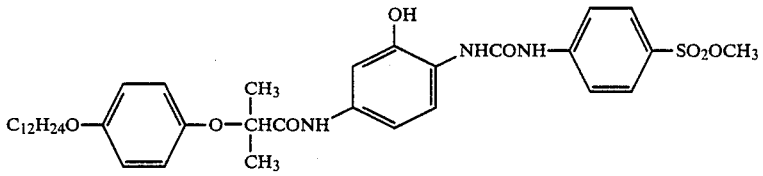
$C^c$-93
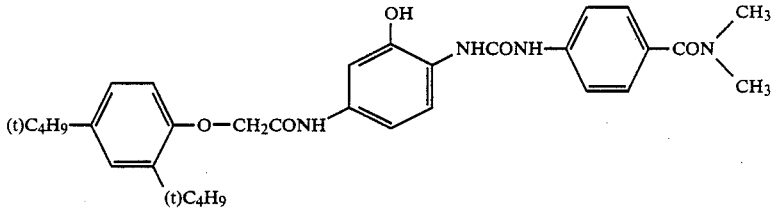
$C^c$94
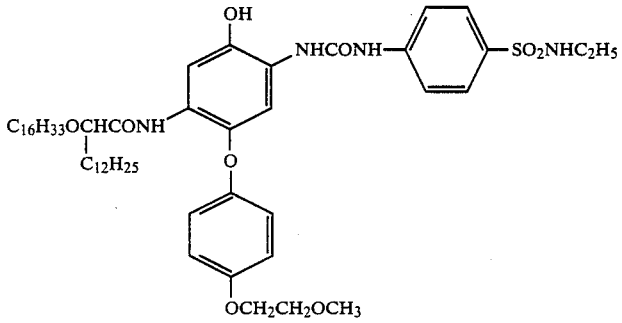
$C^c$-95
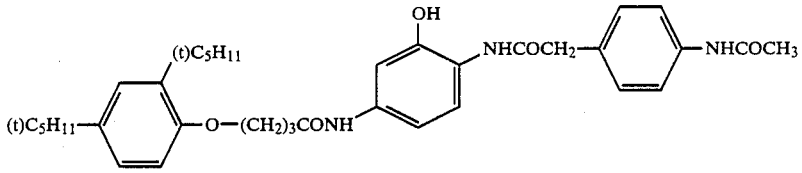
$C^c$-96
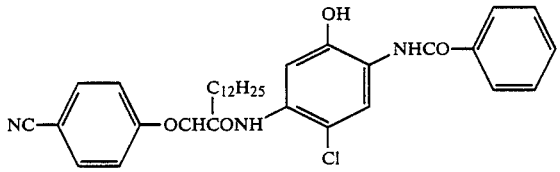

-continued
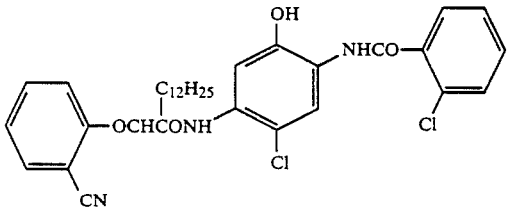
$C^c$-97
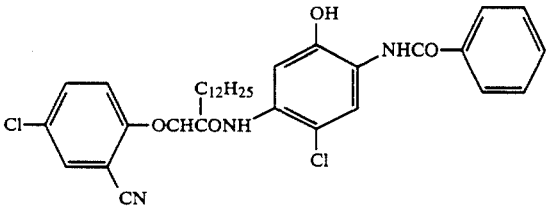
$C^c$-98
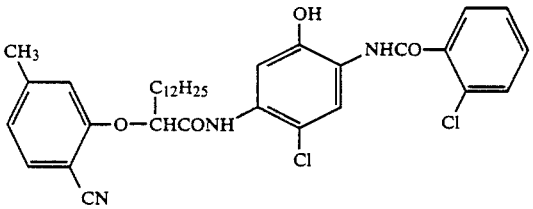
$C^c$99
Especially preferred cyan couplers are tabulated in the following pages.
| Example compound No. | $R_{c1}$ | $R_{c2}$ | $R_{c3}$ | $X_c$ | m |
|---|---|---|---|---|---|
| C-1 | $-(CF_2)_4H$ | 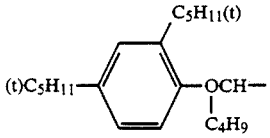 | H | —Cl | 0 |
| C-2 | 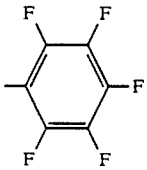 | 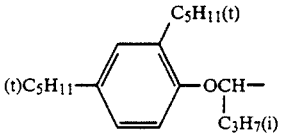 | H | —Cl | 0 |
| C-3 | 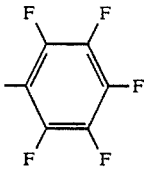 | 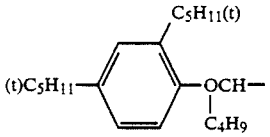 | H | —Cl | 0 |
| C-4 | 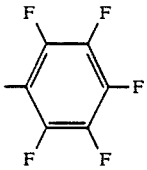 | $C_{16}H_{33}$— | —Cl | —Cl | 0 |

-continued
| Example compound No. | $R_{c1}$ | $R_{c2}$ | $R_{c3}$ | $X_c$ | m |
|---|---|---|---|---|---|
| C-5 | 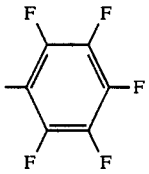 | 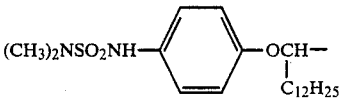 | H | 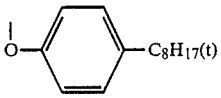 | 0 |
| C-6 | 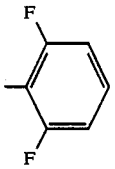 | 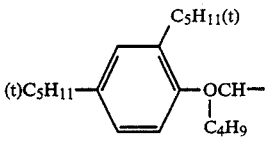 | H | H | 0 |
| C-7 | 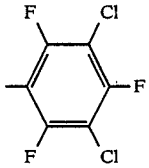 | 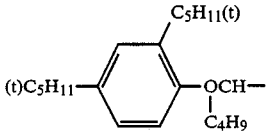 | H | —Cl | 0 |
| C-8 | 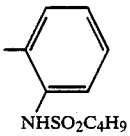 | 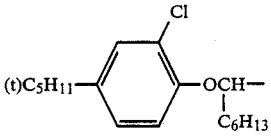 | H | —Cl | 0 |
| C-9 | 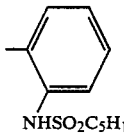 | 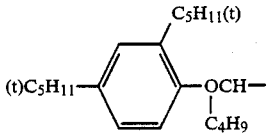 | H | 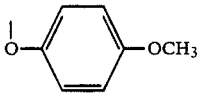 | 0 |
| C-10 | 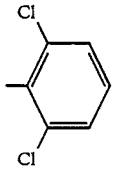 | 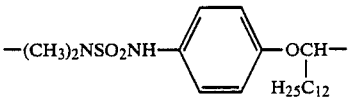 | H | —Cl | 0 |
| C-11 | 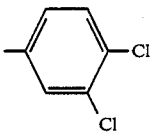 | 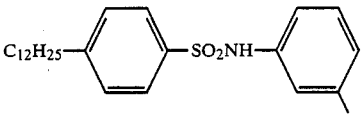 | H | —Cl | 0 |
| C-12 | 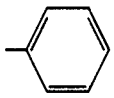 | 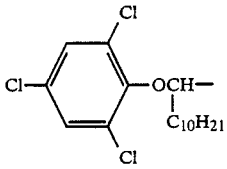 | H | $—OCH_2CONHC_3H_7$ | 0 |
| C-13 | 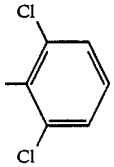 | 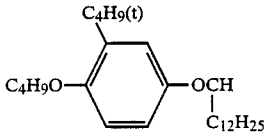 | H | —Cl | 0 |

-continued
| Example compound No. | $R_{c1}$ | $R_{c2}$ | $R_{c3}$ | $X_c$ | m |
|---|---|---|---|---|---|
| C-14 | 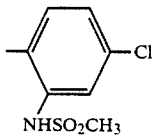 | 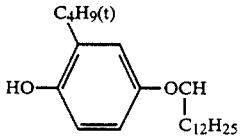 | H | —Cl | 0 |
| C-15 | 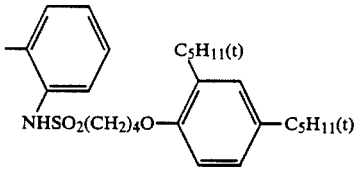 | 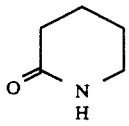 | | —Cl | 0 |
| C-16 | 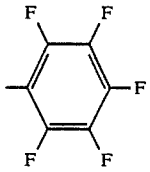 | 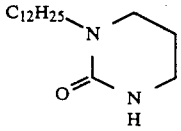 | | —Cl | 0 |
| C-17 | 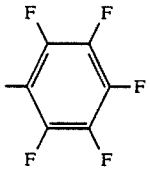 | 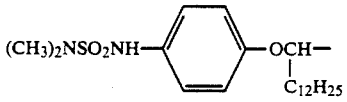 | H | —Cl | 0 |
| C-18 | 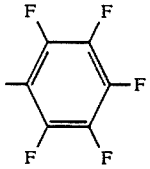 | 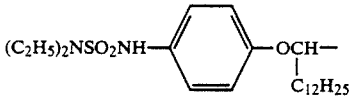 | H | —Cl | 0 |
| C-19 | 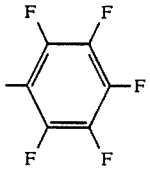 | 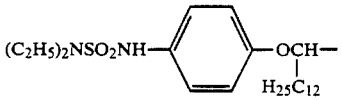 | H | 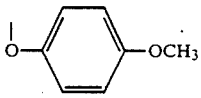 | 0 |
| C-20 | 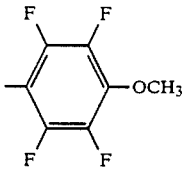 | 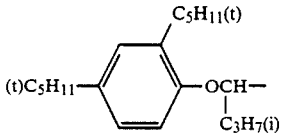 | H | —Cl | 0 |
| C-21 | 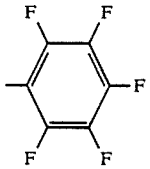 | 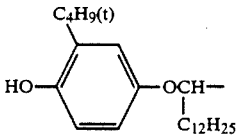 | H | —Cl | 0 |
| C-22 | 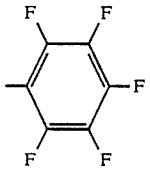 | 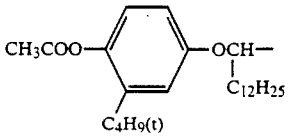 | H | —Cl | 0 |

-continued
| Example compound No. | $R_{c1}$ | $R_{c2}$ | $R_{c3}$ | $X_c$ | m |
|---|---|---|---|---|---|
| C-23 | 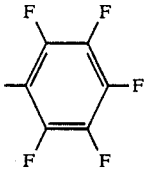 | 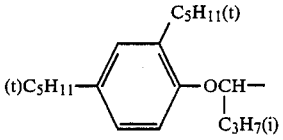 | H | 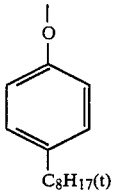 | 0 |
| C-24 | 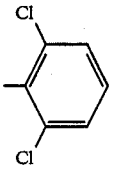 | 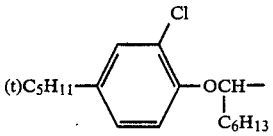 | H | —Cl | 0 |
| C-25 | 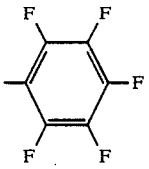 | 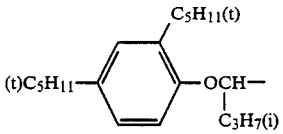 | H | $OCH_2CONHCH_2CH_2OCH_3$ | 0 |
| C-26 | 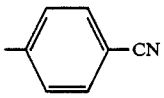 | 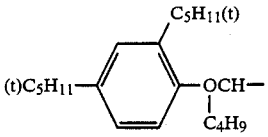 | H | H | 1 |
| C-27 | 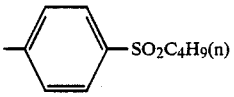 | 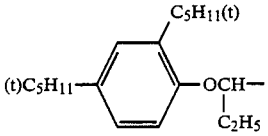 | H | H | 1 |
| C-28 | 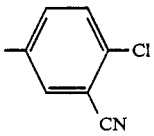 | 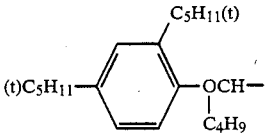 | H | H | 1 |
| C-29 | 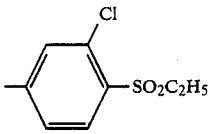 | 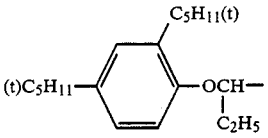 | H | —Cl | 1 |
| C-30 | 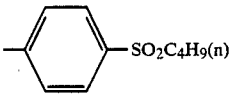 | 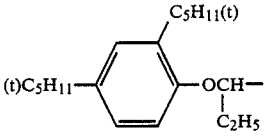 | H | $OCH_2CONH(CH_2)_2OCH_3$ | 1 |
| C-31 | 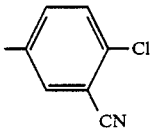 | 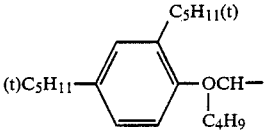 | H | 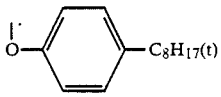 | 1 |

-continued

| Example compound No. | $R_{c1}$ | $R_{c2}$ | $R_{c3}$ | $X_c$ | m |
|---|---|---|---|---|---|
| C-32 | 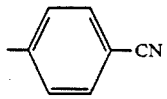 | 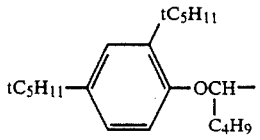 | H | 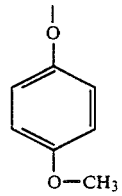 | 1 |
| C-33 | -n-$C_3F_7$ | 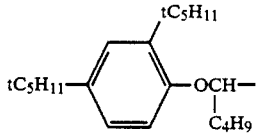 | H | H | 0 |
| C-34 | -n-$C_3F_7$ | 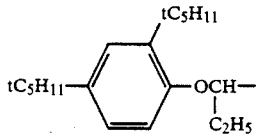 | H | H | 0 |
| C-35 | 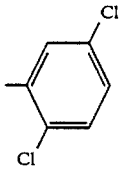 | 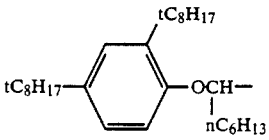 | H | H | 1 |
| C-36 | 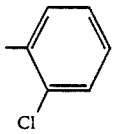 | 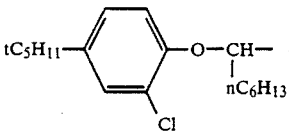 | H | Cl | 0 |
| C-37 | 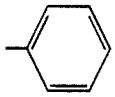 | 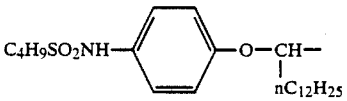 | H | Cl | 0 |
| C-38 | 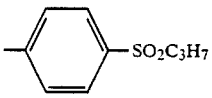 | 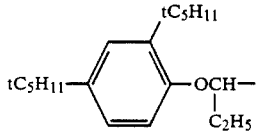 | H | H | 1 |
| C-39 | 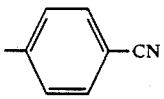 | 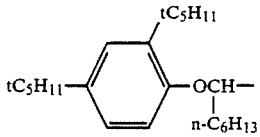 | H | 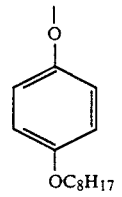 | 1 |

Next, the eighth invention of the present Application will be explained.

This eighth invention relates to color developer solutions and provides a color developer solution for silver halide color photographic light-sensitive materials, which comprises at least one compound selected from the following group [A] and at least one means selected from the following group [B].

Group [A]

(A-1) Compounds expressed by the following general formula [R-I]:

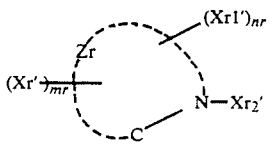

General formula [R-I]

In the formula Xr', Xri' independently represent a halogen atom, or an alkyl, aryl, amino, hydroxyl, nitro, carboxyl, or sulfonyl group; $Xr_2'$ represents a hydrogen atom, or an alkyl, or aryl group, or a double bond for ring formation; Zr represents a plurality of atoms consisting of a carbon atom, oxygen atom, nitrogen atom, and sulfur atom, which are necessary for forming a ring; nr, and mr independently represent 0, 1, 2, or 3.

(A-2) Compounds expressed by the following general formula [R-II];

General formula [R-II]

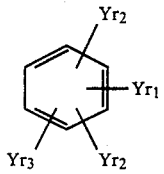

In the formula, $Yr_a$, $Yr_1$, $Ur_2$, and $Yr_3$ independently represent a hydrogen atom, halogen atom, or an amino group, hydroxyl group, nitro group, carboxyl group, or sulfonyl group.

(A-3) Compounds expressed by the following general formula [R-III]:

General formula [R-III]

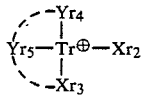

In the formula, Tr represents a nitrogen or phosphor atom; $Xr_2$, $Xr_3$ independently represent a hydrogen atom, or an alkyl group, aryl group, or halogen atom; $Yr_4$ and $Yr_5$ independently represent an alkyl or aryl group; $Yr_4$ and $Yr_5$ may form a heterocyclic ring through ring closure.

(A-4) compounds expressed by the following general formula [R-IV]:

General formula [R-IV]

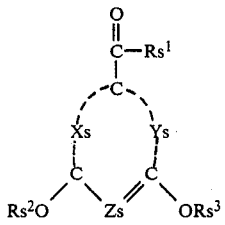

In the formula [R-IV], $Rs^1$ represent —OH, —$ORs^4$, or

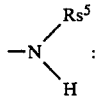

$Rs^4$ and $Rs^5$ independently represent an alkyl group, typified by a methyl, ethyl, propyl, butyl, benzyl, β-hydroxyethyl, or dodecyl group, wherein each of such a group may have a substituent (for example, an aryl group such as hydroxyl or phenyl group).

$Rs^2$ and $Rs^3$ represent —H or

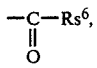

in which $Rs^6$ represents an alkyl or aryl group, illustrative of which is a long-chain alkyl group, such as an undecyl group.

Xs and Ys respectively represent a carbon and hydrogen atoms which respectively form together with other plurality of atoms six-membered rings; and Zs represents —N═ or —CH═.

Where $Z_5$ represents —N═, citrazic acid derivatives are typical compounds illustrative of the compounds expressed by the general formula [R-IV]. If Z represents —CS═, benzoic acid derivatives are typical compounds illustrative of the compounds expressed by the general formula [R-IV]. It is further noted that six-membered rings include those having a substituent group such as a halogen atom.

As far as Zs is concerned, —N═ is preferred.

The compounds expressed by the general formula [R-I] through [R-IV] are same as the earlier explained ones, examples of which have already been given.

(A-5) Polymers or copolymers respectively having pyrolidone nucleus in the molecular structure (A-6) Polyethylene glycol derivatives The groups (A-5) and (A-6) are correspondingly identical with the earlier described "polymers or copolymers having pyrolidone nucleus in the molecular structure" and "polyethylene glycol compounds".

[Group B]

(B-I) The concentration of the p-phenylenediamine-based color developing agent in the color developer solution is higher than $1.5\times10^2$ mol/liter.

(B-II) The pH of the color developer solution of 10.4 or higher.

(B-III) The concentration of the sulfite in the color developer solution is lower than $1.5\times10^2$ mol/liter.

(B-IV) The concentration of the bromide in the color developer solution is lower than $0.8\times10^{-2}$ mol/liter.

(B-V) The color developer solution contains at least one of those kinds of compounds expressed by the general formulas (A-I) through (A-VI).

The general formulas (A-I) through (A-VI) are same as those earlier described, and examples illustrative of the compounds expressed by the formulas are same as those earlier given.

In this conjunction, the following combinations are shown, by way of example, as preferred combinations.

(A-1) + (B-1)
(in which + means combination)
(A-1) + (B-2)
(A-1) + (B-3)
(A-1) + (B-4)
(A-1) + (B-5)
(A-2) + (B-1)
(A-1) + (B-1) + (B-2)
(A-2) + (B-2)
(A-3) + (B-1) + (B-2)
(A-1) + (B-1) + (B-5)
(A-1) + (A-2) + (B-1) + (B-2)
(A-3) + (B-1)
(A-2) + (B-3) + (B-4)

-continued
| |
|---|
| (A-1) + (B-1) + (B-3) |
| (A-1) + (A-5) + (B-1) + (B-2) |
| (A-1) + (A-6) + (B-1) + (B-2) + (B-5) |
| (A-5) + (A-1) + (B-1) |
| (A-1) + (A-5) + (B-1) + (B-2) + (B-5) |
| (A-1) + (A-5) + (b-1) + (B-5) |
Examples illustrative of the compounds expressed by the General formula [R-IV] are shown below. Needless to say, however, the [R-IV] compounds are not limited by these examples.
(1)
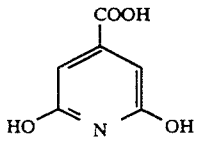
(2)
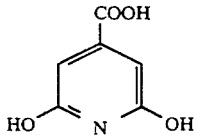
(3)
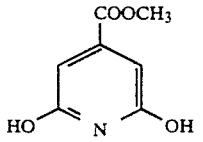
(4)
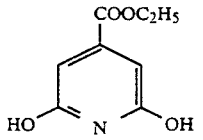
(5)
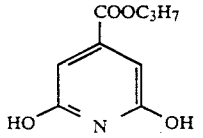
(6)
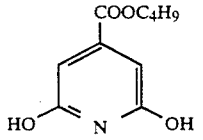
(7)
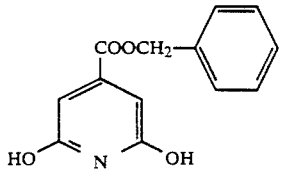
(8)
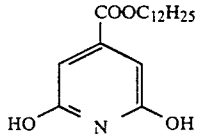
-continued
(9)
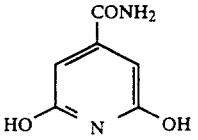
(10)
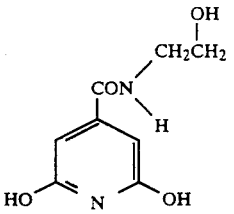
(11)
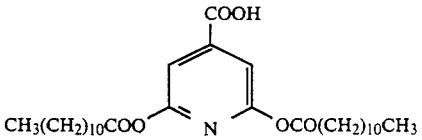
(12)
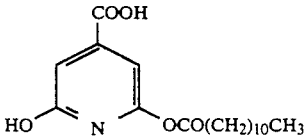
(13)
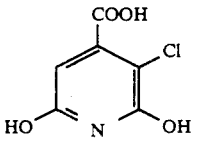
(14)
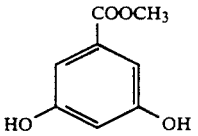
(15)
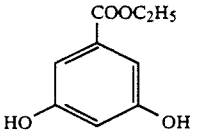
(16)
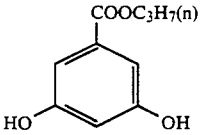
(17)
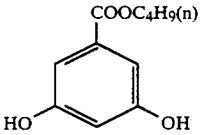
(18)
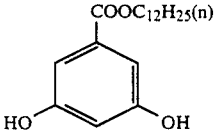

-continued (19)

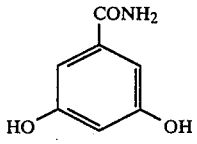

(20)

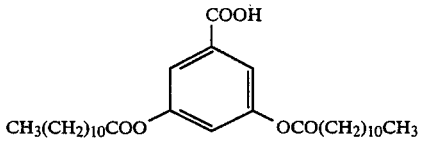

(21)

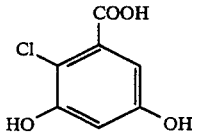

The concentration of any of the compounds expressed by the general formula [R-IV] in the color developer solution is, for example, preferably 0.1 g to 50 g per liter of the solution, more preferably 0.2 to 20 g/liter.

The color developer solution used in each of the inventions of the present application may contain various ingredients conventionally used in such a solution, for example, alkaline agents, such as sodium hydroxide and sodium carbonate, alkali metal hiocyanate, alkali metal halide, benzyl alcohol, water softener, and thickening agent, also development accelerator and the like, other than those mentioned above, as desired.

Other additives than above mentioned which may be added to the color developer solution include an anti-stain agent, sludge preventive agent, preservative, interlayer effect promotor, and chelating agent.

If a compound expressed by the following general formula [H-I] is added to the color developer solution of this eighth invention of the present application or to the color developer solution used in any of the other inventions of the present application, tar generation in the color developer solution is inhibited and thus the object of the invention can be more effectively accomplished.

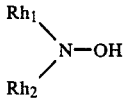

General formula [H-I]

In the formula, $R_{h1}$ and $R_{h2}$ independently represent an alkyl group or hydrogen atom, provide, however, that in no case both $R_{h1}$ and $R_{h2}$ are hydrogen atoms; $R_{h1}$ and $R_{h2}$ may bond together to form a ring.

In the general formula [H-I], while $R_{h1}$ and $R_{h2}$ are, as above mentioned, alkyl groups or hydrogen atoms except that not both of them are hydrogen atoms, the alkyl groups expressed respectively by $R_{h1}$ and $R_{h2}$ may be identical with or different from each other, being preferably alkyl groups having 1 to 3 carbon atoms. $R_{h1}$ and $R_{h2}$ may bond together to form a ring, for example, a heterocyclic ring such as piperidine or morpholine.

While various specific examples of the hydroxyamine compounds expressed by the general formula [H-I] are given in U.S. Pat. Nos. 3,287,125, 3,293,034, and 3,287,124, particularly preferred [H-I] compounds are exemplified below.

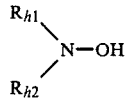

| Example compound No. | $R_1$ | $R_2$ |
|---|---|---|
| H-1 | $-C_2H_5$ | $-C_2H_5$ |
| H-2 | $-CH_3$ | $-CH_3$ |
| H-3 | $-C_3H_7(n)$ | $-C_3H_7(n)$ |
| H-4 | $-C_3H_7(i)$ | $-C_3H_7(i)$ |
| H-5 | $-CH_3$ | $-C_2H_5$ |
| H-6 | $-C_2H_5$ | $-C_3H_7(i)$ |
| H-7 | $-CH_3$ | $-C_3H_7(i)$ |
| H-8 | $-H$ | $-C_2H_5$ |
| H-9 | $-H$ | $-C_3H_7(n)$ |
| H-10 | $-H$ | $-CH_3$ |
| H-11 | $-H$ | $-C_3H_7(i)$ |
| H-12 | $-C_2H_5$ | $-C_2H_4OCH_3$ |
| H-13 | $-C_2H_4OH$ | $-C_2H_4OH$ |
| H-14 | $-C_2H_4SO_3H$ | $-C_2H_5$ |
| H-15 | $-C_2H_4COOH$ | $-C_2H_4COOH$ |
| H-16 | 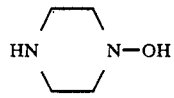 | |
| H-17 | 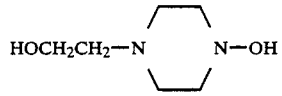 | |
| H-18 | 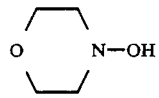 | |
| H-19 | 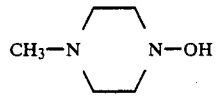 | |
| H-20 | $-CH_3$ | $-C_2H_4OCH_3$ |
| H-21 | $-C_2H_4OCH_3$ | $-C_2H_4OCH_3$ |
| H-22 | $-C_2H_4OC_2H_5$ | $-C_2H_4OC_2H_5$ |
| H-23 | $-C_3H_6OCH_3$ | $-C_3H_6OCH_3$ |
| H-24 | $-C_2H_5$ | $-C_2H_4OC_2H_5$ |
| H-25 | $-C_3H_7$ | $-C_2H_4OCH_3$ |
| H-26 | $-CH_3$ | $-C_2H_4OC_2H_5$ |
| H-27 | $-CH_3$ | $-CH_2OCH_3$ |
| H-28 | $-C_2H_5$ | $-CH_2OC_2H_5$ |
| H-29 | $-CH_2OCH_3$ | $-CH_2OCH_3$ |
| H-30 | $-C_2H_5$ | $-C_2H_4OCH_3H$ |
| H-31 | $-C_3H_6OC_3H_7$ | $-C_3H_6OC_3H_7$ |

Of these, especially preferred compounds are H-I, H-2, H-8, H-9, H-12, H-18, and H-21.

These compounds are used in the form of ordinary free amine, hydrochloride, sulfate, p-toluene sulfonate, oxalate, phosphate, acetate or the like.

The concentration of the compound, represented by formula [H-I], in the color developer solution is usually preferably 0.2 to 50 g/liter, more favorably, 0.5 to 30 g/liter, still more favorably 1 to 15 g/liter.

In the practice of any of the inventions in the present application, any known processing method for light-sensitive materials can be applied with no particular limitation. In one typical way, for example, after color developing, bleach-fixing is performed, and then washing or alternative stabilization processing is performed according to a specific requirement. In another way, pre-hardening, neutralization, color developing, stop fixing, washing (or stabilization processing in place of washing), bleaching, washing (or stabilization processing in place of washing), after-hardening, and washing (or stabilization processing in place of washing) are carried out in order of mention. In another procedure, color developing, washing (or stabilization processing in place of washing), supplementary color developing, stopping, bleaching, fixing, washing (or stabilization processing in place of washing), and stabilization are carried out in that order. In another developing procedure, post-developed silver due to color developing is halogenation-bleached, developing is repeated to increase dye formation.

"Processing in a processing bath having bleaching ability" means processing in a bleaching bath or a mono-bath bleach-fixing bath. The effects of the invention is advantageously attained with mono-bath bleach-fixing.

For use as bleaching agents in the bleaching solution or bleach-fixing solution in the bleaching stage, there are generally known those in which metallic ions, such as iron, cobalt, or copper ions, are coordinated with organic acid, such as aminocarboxylic acid, oxalic acid, or citric acid. Typical examples of such aminocarboxylic acid are:

ethylenediamine tetraacetic acid;
diethylenetriamine pentaacetic acid;
propylenediamine tetraacetic acid;
nitrilotriacetic acid;
iminodiacetic acid;
glycoletherdiamine tetraacetic acid;
ethylenediamine tetrapropionic acid;
disodium ethylenediamine tetraacetate;
pentasodium diethylenetriamine pentaacetate;
and, sodium nitrilotriacetate.

The bleaching solution and the bleach-fixing solution are used in a pH range of 0.2 to 9.5, preferably 4.0 and above, in particular, 5.0 and above. The range of processing temperatures used is 20° C. to 80° C., preferably 40° C. and above.

The bleaching solution may contain, together with aforesaid bleaching agent (preferably organoacidic ferric complex salt), various additives. For this purpose, alkali halide or ammonium halide, such as potassium bromide, sodium bromide, sodium chloride, ammonium bromide, potassium iodide, sodium iodide, and ammonium iodide, are especially preferred. Also, it is possible to add, as required, pH buffers, such as borate, oxalate, acetate, carbonate, and phosphate, solubilizers, such as triethanolamine and the like, and/or other additives, such as acetylacetone, phosphonocarboxylic acid, polyphosphoric acid, organophosphoric acid, oxycarboxylic acid, polycarboxylic acid, alkylamines, and polyethylene oxides, which are conventionally known for addition to the bleaching solution.

For the bleach-fixing bath, it is possible to use a bleach-fixing solution slightly loaded with halide, such as potassiun halide, or a bleach-fix solution of the type which is largely loaded with such halide as potassium bromide or ammonium bromide, or a special type of bleach-fixing solution composed of a combination of the bleaching agent of the invention and a large amount of such halide as potassium bromide.

In addition to potassium bromide, it is possible to use other halogen compounds, such as hydrochloric acid, hydrobromic acid, lithium bromide, sodium bromide, ammonium bromide, potassium iodide, sodium iodide, and ammonium iodide.

The silver halide fixer used in the bleach-fixing bath is a compound of the type conventionally used in the process of fixing which reacts with silver halide to form a water-soluble complex salt, typical examples of which are thiosulfates, such as potassium thiosulfate, sodium thiosulfate, and ammonium thiosulfate, thiocyanates, such as potassium thiocyanate, sodium thiocyanate, and ammonium thiocyanate, thiourea, thioether, high-concentration bromides, and iodides. These fixers can be used within the solubility range of more than 5 g/liter, preferably more than 50 g/liter, in particular, more than 70 g/liter.

As is the case with the bleaching solution, the bleaching-fixing solution may contain pH buffers composed of various acids, such as boric acid, borax, sodium hydroxide, potassium hydroxide, sodium carbonate, potassium carbonate, sodium bicarbonate, potassium bicarbonate, acetic acid, sodium acetate, and ammonium hydroxide, either in one kind alone or in a combination of two or more kinds. Further, the bleach-fix bath may contain various kinds of fluorescent whitening agents, anti-foaming agents, surfactants, or anti-mordant agents. Also, the bath may contain, as required, preservatives, such as hydroxyamine, hydrazine, sulfite, isomeric bisulfite, and bisulfite adducts of aldehyde or ketone compounds; organic chelating agents, such as acetylacetone, phosphonocarboxylic acid, polycarboxylic acid, dicarboxylic acid, and aminopolycarboxylic acid; stabilizers, such as nitro alcohol, and nitrate; solubilizers, such as alkanol amine and the like; anti-stain agents, such as organic amine and the like, other additives; and organic solvents, such as methanol, dimethylformamide, and dimethylsulfoxide.

In the practice of the inventions of the present application, it is most advantageous that bleaching or bleach-fixing is performed immediately after color developing; however, it is also possible that after color developing, such steps as washing or rinsing and stopping are performed, and then bleaching or bleach-fixing is performed, or that a prebath containing a bleach promoter may be used prior to bleaching or bleach-fixing.

In the conduct of the inventions of the present application, processing steps, other than color developing of the silver halide color photographic material e.g. bleach-fixing (or bleaching and fixing), and, where required, washing or stabilizing in place of washing are performed preferably at a temperature of 20° C. to 80° C., more favorably, higher than 40° C.

Also, it is desirable to perform the step of stabilizing in place of washing as described in Japanese Patent O.P.I. Publication Nos. 14834/1983, 105145/1983, 134634/1983, and 18631/1985, and Japanese Patent Examined Publication Nos. 2709/1983 and 89288/1984.

The silver halide emulsion layers of the color photographic light-sensitive material may contain corresponding couplers, that is, compounds which can react with an oxidation product of the color developing agent in order to form a dye.

For this purpose, except as specified for the inventions claimed herein, various kinds of yellow couplers, magenta couplers, and cyan couplers, can be used with no particular limitation. These couplers may be of the so-called two equivalent type or of the so-called four equivalent type. It is also possible to use any of these couplers in combination with a diffusible dye releasing type coupler.

For said yellow couplers, various compounds can be effectively used as such, including closed-chain ketomethylene compounds; and the so-called two equivalent type couplers, such as coupler having -o-aryl substituent on the active site, coupler having -o-acyl substituent on the active site, coupler having hydantoin compound substituent in the active site, coupler having succinimide compound substituent in the active site, coupler having urazole compound substituent in the active site, and coupler having imide succucinate substituent in the active site, coupler having fluorine substituent in the active site, coupler having chrorine or bromine substituent in the active site, and coupler having -o-sulfonyl substituent in the active site. For the typical examples of useful yellow couplers, reference is made to those mentioned in U.S. Pat. Nos. 2,875,057, 3,265,506, 3,408,194, 3,551,155, 3,582,322, 3,725,072, and 3,891,445, West German Patent No. 1,547,868, West German Laid-Open Application Nos. 2,219,917, 2,261,361, and 2,414,006, British Patent No. 1,425,020, Japanese Patent Examined Publication No. 10783/1976, and Japanese Patent O.P.I. Publication No. 26133/1972, 73147/1973, 102636/1976, 6341/1975, 123342/1975, 130442/1975, 21827/1976, 87650/1975, 82424/1977, 115219/1977, and 95346/1983.

For magenta couplers, except as specifically mentioned with respect to the general formula [M-I], or in conjunction with the [M-I] couplers, compounds of the following types may be mentioned: pyrazolone, pyrazolotriazole, pyrazolinobenzimidazole, and indazolone. As is the case with the yellow couplers, these magenta couplers can be not only of the 4 equivalent type but also of the 2 equivalent type. For typical examples of useful magenta couplers, reference is made to those mentioned in U.S. Pat. Nos. 2,600,788, 2,983,608, 3,062,653, 3,127,269, 3,311,746, 3,419,391, 3,519,429, 3,558,319, 3,582,322, 3,615,506, 3,834,908, and 3,891,445, German Patent No. 1,810,464, German Laid-Open Specification Nos. 2,408,665, 2,417,945, 2,148,959, and 2,424,467, Japanese Patent examined Publication No. 6031/1965, Japanese Patent O.P.I. Publication Nos. 20826/1976, 58922/1977, 129538/1974, 74027/1974, 159336/1975, 42121/1977, 74028/1974, 60233/1975, 26541/1976, and 55122/1978, and Japanese Patent Application No. 110943/1980.

For useful cyan couplers, as specifically mentioned with respect to the general formula [C-I], or in conjunction with the [C-I] couplers, phenolic and naphtolic couplers may be mentioned. These cyan couplers, as is the case with the yellow couplers, may be either of the 4 equivalent type or of the 2 equivalent type. For typical examples of cyan couplers, reference is made to those mentioned in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494, and 4,004,929, German Laid-Open Specification Nos. 2,414,830, and 2,454,329, Japanese Patent O.P.I. Publication No. 59838/1973, 26034/1976 5055/1973, 146827/1976, 69624/1977, 90932/1977, and 95346/1983, and Japanese Patent Examined Publication No. of 11572/1974.

The silver halide emulsion layers and other structural layers of the photographic light-sensitive material may simultaneously contain colored magenta or cyan coupler, and other couplers such as polymer coupler. For colored magenta or cyan couplers, reference is made to the relevant description in Japanese Patent Application No. 1193611/1984 of the present applicant, and for the above-mentioned polymer couplers, reference is made to the relevant description in Japanese Patent Application No. 172151/1984 of the applicant.

Aforesaid couplers may be added to the photographic structural layers according to a conventional procedure. The amount of the coupler to be added, though not definite, is preferably $1\times10^{-3}$ to 5 mol, in particular, $1\times10^{-2}$ to $10^{-1}$ mol per mol silver.

In the practice of the inventions of the present application, various other photographic additives may be incorporated into the silver halide color photographic light-sensitive material. For example, various agents mentioned in "Research Disclosure" No. 17643, such as antifoggant, stabilizer, ultraviolet absorbent, anti-stain agent, fluorescent whitening agent, dye-image stabilizer, antistatic agent, hardening agent, surfactant, plasticizer, and wetting agent, may be used.

In the silver halide color photographic light-sensitive material, the hydrophilic colloid used for emulsion preparation contains any of the following: gelatin, gelatin derivative, graft polymers of gelatin with other polymer; proteins, such as albumine and casein; cellulose derivatives, such as hydroxyethyl cellulose derivatives and carboxymethyl cellulose; starch derivatives; and synthesized hydrophilic mono- and/or co-polymers, such as polyvinyl alcohol, polyvinyl imidazole, and polyacrylamide.

As the support of the silver halide color photographic light-sensitive material, there may be mentioned, for example, glass plate; polyester film made of cellulose acetate, cellulose nitrate, polyethylene terephthalate; polyamide film, polycarbonate film, and polystyrene film. These base materials can be selectively used according to the purpose for which the light-sensitive material is used.

According to the intended use, it is possible to provide an intermediate layer of a suitable thickness. Further, various layers, such as filter layer, anticurl layer, protective layer, and antihalation layer, may be suitably used in combination. Any hydrophilic colloid which can be used as binder in aforesaid emulsion layer can be similarly used in these structural layers. These layers may contain such various photographic additives as are used in aforesaid emulsion layer.

The processing method of the present invention is applicable to silver halide color photographic light-sensitive materials, such as color negative film, color positive film, slide color reversal film, cinema color reversal film, and TV color reversal film.

EXAMPLES

Figure 1:
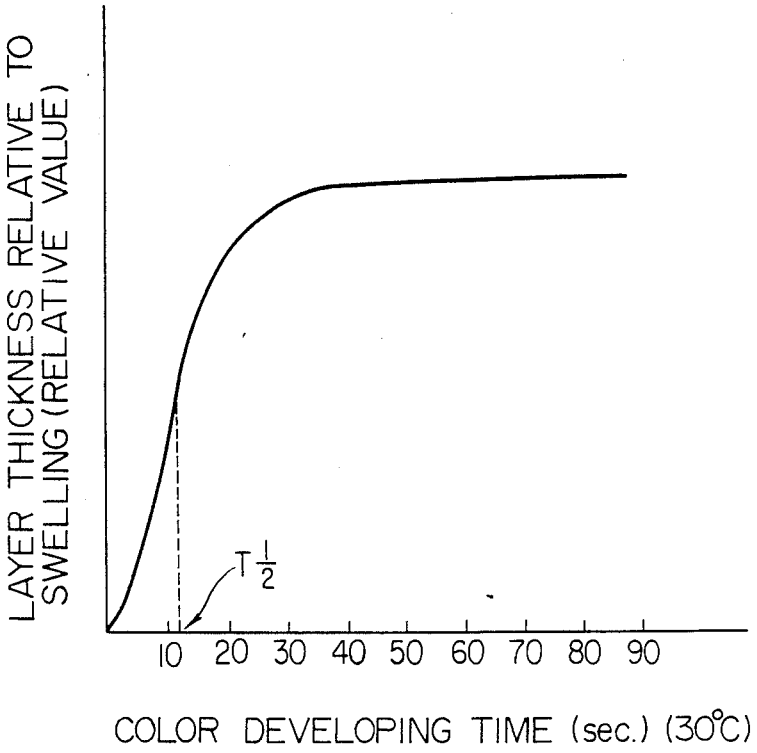
FIG. 1 is a graph used to explain the layer swelling rate, in disclosing the present invention.

The typical examples of the invention are described as follows. However, the scope of embodiments of the invention is not limited only to these examples.

With each of the following examples, the amount of addition to a silver halide photographic light-sensitive material, unless otherwise specified, is expressed by an amount per $m^2$ light-sensitive material, and the amount of silver halide or colloidal silver means the converted value representing equivalent silver.

EXAMPLE 1

Standard light sensitive material B was prepared by the following process.

In accordance with the layer constitution commonly used in the photographic art, a black colloidal silver anti-halation layer, red-sensitive silver halide emulsion layer, green-sensitive silver halide emulsion layer and blue-sensitive silver halide emulsion layer were sequentially formed upon a support (triacetate film base) in this order, incorporating various auxiliary layers between arbitrary adjacent layers, whereby, upon the above blue-sensitive silver halide emulsion layer, was disposed a high sensitivity monodispersed silver halide emulsion layer, thus preparing light-sensitive material B, wherein the amount of silver applied was 53 mg/100 $cm^2$ and the thickness of dried layers was 23 m.

First layer: An anti-halation layer formed by applying dispersion prepared by first reducing silver nitrate using a hydroquinone as a reductant to obtain a black colloidal silver featuring a high absorptivity toward light having a wavelength of 400 to 700 nm, and then dispersing 0.8 g of this colloidal silver into 3 g of gelatin.

Second layer: An intermediate layer comprising gelatin

Third layer: A low-sensitivity red-sensitive silver halide emulsion layer containing 1.5 of low-sensitivity red-sensitive silver iodo-bromide emulsion (AgI; 7 mol %), 1.6 g of gelatin; as well as 0.4 g of tricresyl phosphate (hereinafter referred to as TCP) having dissolved 0.85 g of 1 -hydroxy-4-(β-methoxyethylaminocarbonylmethoxy)-N-[δ-(2,4-di-t- amylphenoxy)butyl]-2-naphthamide (hereinafter referred to as cyan coupler (C'-0), 0.030 g of disodium 1-hydroxy-4-[4-(1-hydroxy-8-acetamido-3,6-disulfo-2-naphthylazoOphenoxy]-N-[δ-(2,4-di-amylphenoxy)butyl]-2-naphthamide (hereinafter referred to as colored cyan coupler (CC'-1).

Fourth layer: A high-sensitivity red-sensitive silver halide emulsion layer containing 1.1 g of high-sensitivity red-sensitive silver iodo-bromide emulsion (AgI; 6 mol %), 1.2 g of gelatin; as well as 0.17 g of TCP having dissolved 0.25 g of cyan coupler (C'-0), and 0.020 g of colored cyan coupler (CC'-1).

Fifth layer: An intermediate layer containing 0.04 g of dibutyl phthalate (hereinafter referred to as DBP) having dissolved 0.07 g of 2,5-di-t-octylhydroquinone (hereinafter referred to as anti-stain agent (HQ'-1)); as well as 1.2 g of gelatin.

Sixth layer: A low-sensitivity green-sensitive silver halide emulsion layer containing 1.6 g of low-sensitivity green-sensitive silver iodo-bromide emulsion (AgI; 6 mol %), 1.7 g of gelatin; as well as 0.3 g of TCP having dissolved three types of couplers i.e. 0.32 g of 1-(2,4,6-trichlorophenyl)-3-[3-(2,4-di-t-amylphenoxyacetamido)benzenamido]-5-pyrazolone (hereinafter referred to magenta coupler (M'-1)), 0.20 g of 4,4-methylenebis-11-(2,4,6-trichlorophenyl)-3-[3-(2,4-di-t-amylphenoxyacetamido)benzenamido]-5-pyrazolone (hereinafter referred to as magenta coupler (M'-2)) and 0.066 g of 1-(2,4,6-trichlorophenyl)-4-(1-naphthylazo)-3-(2-chloro-5-octadecenylsuccinimidanilino)- 5-pyrazolone (hereinafter referred to as colored magenta coupler (CM'-1).

Seventh layer: A high-sensitivity green-sensitive silver halide emulsion layer containing 1.5 g of high-sensitivity green-sensitive silver iodo-bromide emulsion (AgI; 8 mol %), 1.9 g of gelatin; as well as 0.12 g of TCP having dissolved 0.10 g of magenta coupler (M'-1), 0.098 g of magenta coupler (M'-2), and 0.049 g of colored magenta coupler (CM'-1).

Eighth layer: A yellow filter layer containing 0.2 g of yellow colloidal silver; 0.11 g of DBP having dissolved 0.2 g of anti-stain agent (HQ'-1); as well as 2.1 g of gelatin.

Ninth layer: A low-sensitivity blue-sensitive silver halide emulsion layer containing 0.95 g of low-sensitivity blue-sensitive silver iodo-bromide emulsion (AgI; 7 mol %), 1.9 g of gelatin; as well as 0.93 g of DBP having dissolved 1.84 g of α-[4-(1-benzyl-2-phenyl-3,5-dioxo-1,2,4-triazolydinyl)]-α-pyvaloyl-2-chloro-5-[γ-(2,4-di-t-amylphenoxy)butanamido]acetanilide (hereinafter referred to as yellow coupler (Y'-1)).

Tenth layer: A high-sensitivity blue-sensitive silver halide emulsion layer containing 1.2 g of high-sensitivity monodispersed blue-sensitive iodo-bromide emulsion (AgI; 6 mol %), 2.0 g of gelatin; as well as 0.23 g of DBP having dissolved 0.46 g of yellow coupler (Y'-1).

Eleventh layer: The second protective layer comprising gelatin.

Twelfth layer: The first intermediate layer containing 2.3 g of gelatin.

This light-sensitive material B was exposed under the following exposure conditions using a tungsten light source and filter, whereby a color temperature was adjusted to 4800° K., in order to provide 3.2 CMS wedge exposure light. (Exposure conditions C)

The exposured light-sensitive material B was subjected to color developing at a temperature of 38° C. with a duration of 3 min. 15 sec. by using developer A. In this course, the maximum magenta dye density M of light-sensitive material B in terms of a maximum transmitting density was 1.80, which was measured with a SAKURA photoelectric densitometer PDA-65 (manufactured by Konica Corporation).

| Developer A | |
|---|---|
| Potassium carbonate | 37.5 g |
| Sodium sulfite | 4.25 g |
| Potassium iodide | 2 mg |
| Sodium bromide | 1.3 g |
| Hydroxylamine sulfate | 2.0 g |
| 3-methyl-4-amino-N-ethyl-N-(β-hydroxyethyl)-aniline sulfate | 4.75 g |

Water was added to the above components to prepare one liter solution, which was adjusted to pH 10.0 with 45% potassium hydroxide or 50% sulfuric acid.

Next, samples were prepared as follows.

Silver halide emulsions in Table 1 i.e. emulsions containing spherical silver halide particles were prepared using a conventional double-jet precipitation process.

The following layers were sequentially formed, in this order, on a cellulose triacetate support, to prepare a multilayer color film sample.

First layer: Anti-halation layer (HC layer)

An anti-halation layer containing 0.18 g of black colloidal silver, and 1.5 g of gelatin.

Second layer: Subbing layer (IG layer)

A subbing layer containing 2.0 g of gelatin.

Third layer: Red-sensitive silver halide emulsion layer (R layer).

A red-sensitive silver halide emulsion layer containing not only each of the silver halide emulsions listed in Table 1 and sensitized to have red-sensitivity, but dispersion prepared by emulsifying and dispersing tricresyl phosphate (hereinafter referred to as TCP) having dissolved 0.2 mol/molAg of the following cyan coupler (C-1), 0.006 mol/molAG of the following colored cyan coupler (CC-1) and the example DIR compound (No. D-24), but methanol having dissolved an inhibitor, into aqueous solution containing gelatin.

Fourth layer: Intermediate layer (2G layer)

An intermediate layer comprising 0.14 g of 2,5-di-t-butylhydroquinone, and 0.07 g of dibutyl phthalate (hereinafter referred to as DBP).

FIfth layer: Green-sensitive silver halide emulsion layer (G layer)

A green-sensitive silver halide emulsion layer containing not only each of the silver halide emulsions listed in Table 1 and sensitized to have green-sensitivity, but dispersion prepared by emulsifying and dispersing TCP having dissolved 0.15 mol/molAg of the following magenta coupler (m-1), 0.015 mol/molAg of the following colored magenta coupler (CM-1) and the example DIR compound (No. D-5), into aqueous solution containing gelatin.

Sixth layer: Yellow filter layer

A yellow filter layer containing 0.3 g yellow colloidal silver, and 0.11 g of DBP having dissolved 0.2 g anti-stain agent (2,5-di-t-octylhydroquinone); as well as 2.1 g of gelatin.

Seventh layer: Low-sensitivity blue-sensitive silver halide emulsion layer (B layer)

A blue-sensitive silver halide emulsion layer containing not only each of the silver halide emulsions listed in Table 1 and sensitized to have blue-sensitivity, but dispersion prepared by emulsifying and dispersing TCP having dissolved 0.3 mol/molAg of the following yellow coupler (Y-1) and the example DIR compound (No. D-62), into aqueous solution containing gelatin.

Eighth layer: High-sensitivity monodispersed blue-sensitive silver halide emulsion layer (B layer)

A layer similar to the seventh layer, except that slightly larger silver halide particles were used.

Ninth layer: Protective layer (3G layer)

A protective layer containing 0.8 g of gelatin

In addition to the above components, each layer was allowed to contain gelatin-hardening agents (1,2-bisvinylsulphonylethane and sodium 2,4-dichloro-y-hydroxy-s-triadine), surfactant and the like.

The amount of silver applied was 50 mg/100 $cm^2$. ax The couplers used in the respective layers were as follows.

Cyan coupler ($C_1$-1)

2-(α, α, β, β, γ, γ, δ, δ-octafluorohexanamide)5-[2-(2,4-di-t-amylphenoxy)hexanamide]phenol Colored cyan coupler ($CC_1$-1)

Disodium 1-hydroxy-4-[4-(1-hydroxy-8-acetamide-3,6-disulfo-2-naphthylazo)phenoxy]-N-[δ-(2,4-di-t-amylphenoxy)butyl]-2-naphthamide Magenta coupler ($M_1$-1)

1-(2,4,6-trichlorophenyl)-3-{[2,4-di-t-amylphenoxy)-acetamido]benzamido}-3-pyrazolone and 1-(2,4,6-trichlorophenyl)-3-{[α-(2,4-di-t-amylphenoxy)}-acetamide]benzamido-4-(4-methoxyphenylazo)-5-pyrazolone Colored magenta coupler ($CM_1$-1)

1-(2,4,6-trichlorophenyl)-4-(1-naphthylazo)-3-(2-chloro-5-octadecenylsuccinimidanilino)-5-pyrazolone Yellow coupler ($Y_1$-1)

α-[4-(1-benzyl-2-phenyl-3,5-dioxo-1,2,4-triazolydinyl-α-pyvaloyl-2-chloro-5-[γ-(2,4-di-t-amylphenoxy)-butanamido]acetanilide Samples 1 through 19 were prepared respectively using the above specified compositions specified in Table 1 as the composition of silver halide, and varying the amounts of application in the third, fifth, sixth and seventh layers, varying the amount of gelatin-hardening agent in the eighth layer and adding gelatin-hardening agent into the blue-sensitive silver halide emulsion layer so as to reduce $T_{\frac{1}{2}}$ of certain samples. Next, the layer thicknesses, as well as layer swelling rates $T_{\frac{1}{2}}$, were measured. Table 1 lists the measurement results.

Each sample was exposed with green light, red light or green/red light (16 CMS) through an optical wedge, thereby treated with the following treatment steps, so as to form a dye image.

| Treatment Color developing | Time and temperature specified in Table 2 | |
|---|---|---|
| Bleaching | 4 min | (38° C.) |
| Fixing | 3 min | (30 to 38° C.) |
| Washing | 1 min | (20 to 33° C.) |
| Stabilizing | 1 min | (20 to 33° C.) |
| Drying | | |

The compositions of processing solutions used in the respective processing steps are as follows.

| (Color developer | |
|---|---|
| Sulfate of the previously mentioned example compound (E-2) | $3 \times 10^{-2}$ mol |
| Sodium sulfite anhydride | 4.25 g |
| Hydroxylamine.½ silfate | 2.0 g |
| Potassium carbonate anhydride | 30.0 g |
| Sodium bromide | 1.3 g |
| Trisodium nitrilotriacetate (monohydride) | 2.5 g |
| Potassium hydroxide | 1.0 g |
| Inhibitor (Z-5) | 0.5 g |

Water was added to the above components to prepare one liter solution, which was adjusted to pH=10.2 using 50% KOH and 50% $H_2SO_4$.

| (Bleacher) | |
|---|---|
| ferric (III) ammonium ethylene-diamine tetraacetate | 200 g |
| Ammonium bromide | 150.0 g |
| Glacial acetic acid | 10.0 ml |

Water was added to the above components to prepare one liter solution, which was adjusted to pH=6.0 using aqueous ammonium and acetic acid.

| (Fixer) | |
|---|---|
| Ammonium sulfate | 175.0 g |
| Sodium sulfite anhydride | 8.5 g |
| Sodium metabisulfite | 2.3 g |

Water was added to the above components to prepare one liter solution, which was adjusted to pH=7.0 using acetic acid.

| (Stabilizer) | |
|---|---|
| Formalin (37% aqueous solution) | 1.5 ml |
| Konidax (manufactured by Konica Corporation) | 7.5 ml |

Water was added to the above components to prepare one liter solution.

Graininess (RMS) of each obtained cyan dye is listed in Table 2. Incidentally, the addition of DIR compound into each color-sensitive layer was controlled so that the layer may indicate the same degree of desensitization and density decrease.

Using the above processing solutions and the above treatment steps, the above standard light-sensitive material B having been exposed under the above mentioned exposure conditions was treated at a temperature of 40° C. with a color developing time of 2 minutes, whereby the minimum transmitting magenta dye density was 2.2 and the magenta density in non-exposed areas was 0.38.

TABLE 1

| Light-sensitive material Sample No. | Silver halide (%) AgI | AgBr | AgCl | Layer thickness μm | Layer swelling rate $T_{\frac{1}{2}}$ (sec) |
|---|---|---|---|---|---|
| 1 | — | 10 | — | 20 | 12 |
| 2 | — | 90 | 10 | 20 | 12 |
| 3 | 0.5 | 90 | 9.5 | 20 | 12 |
| 4 | 0.5 | 89.7 | 9.8 | 30 | 25 |
| 5 | 0.5 | 99.5 | — | 30 | 16 |
| 6 | 0.5 | 99.5 | — | 20 | 16 |
| 7 | 6.0 | 94 | — | 20 | 5 |
| 8 | 6.0 | 94 | — | 20 | 10 |
| 9 | 6.0 | 94 | | 20 | 16 |
| 10 | 6.0 | 94 | — | 20 | 20 |
| 11 | 6.0 | 94 | — | 20 | 25 |
| 12 | 6.0 | 94 | — | 20 | 30 |
| 13 | 6.0 | 94 | — | 15 | 9 |
| 14 | 6.0 | 94 | — | 18 | 11 |
| 15 | 6.0 | 94 | — | 22 | 10 |
| 16 | 6.0 | 94 | — | 25 | 11 |
| 17 | 6.0 | 94 | — | 28 | 13 |
| 18 | 6.0 | 94 | — | 31 | 13 |
| 19 | 6.0 | 94 | — | 35 | 14 |

TABLE 2

| | | Graininess (RMS values) | | | | | |
|---|---|---|---|---|---|---|---|
| Color developing time (sec) | | 210 ( ) | 180 | 150 | 120 | 90 | 60 |
| Color developing temperature | | 33 (°C.) | 35 | 37.5 | 40 | 42 | 48 |
| Light-sensitive material Sample No. | 1 | 52 | 50 | 48 | 46 | 45 | 41 |
| | 2 | 53 | 51 | 49 | 49 | 48 | 50 |
| | 3 | 49 | 46 | 47 | 46 | 46 | 47 |
| | 4 | 47 | 45 | 42 | 34 | 33 | 32 |
| | 5 | 46 | 44 | 42 | 33 | 32 | 31 |
| | 6 | 46 | 38 | 36 | 34 | 33 | 32 |
| | 7 | 45 | 34 | 30 | 29 | 26 | 25 |
| | 8 | 45 | 34 | 31 | 30 | 26 | 25 |
| | 9 | 46 | 36 | 33 | 31 | 29 | 27 |
| | 10 | 47 | 37 | 34 | 32 | 29 | 28 |
| | 11 | 49 | 49 | 44 | 33 | 31 | 30 |
| | 12 | 49 | 48 | 43 | 33 | 30 | 30 |
| | 13 | 45 | 31 | 30 | 28 | 25 | 25 |
| | 14 | 45 | 33 | 31 | 29 | 25 | 25 |
| | 15 | 47 | 35 | 32 | 35 | 27 | 26 |
| | 16 | 48 | 39 | 35 | 34 | 30 | 29 |
| | 17 | 49 | 47 | 43 | 37 | 36 | 33 |
| | 18 | 49 | 46 | 44 | 39 | 39 | 38 |
| | 19 | 50 | 48 | 45 | 40 | 40 | 39 |

Graininess:
Smaller RMS values are more advantageous. Values enclosed in heavy lines correspond with preferred embodiments of the invention.

As can be understood from the results in Table 2, satisfactory graininess is obtained, when using each of the light-sensitive materials 3 through 19 and the treatment steps of the invention. Further, it is apparent that a sample with a layer thickness (i.e. a thickness of dried layers determined by subtracting a thickness of support from the whole layer thickness) of less than 25 μm is more satisfactory, and that sample with a layer swelling rate ($T_{\frac{1}{2}}$) of less than 20 sec is more satisfactory, and that samples treated with a color developing time of 180 seconds shoed satisfactory results; samples treated with a color developing time of shorter than 120 seconds showed especially excellent results.

EXAMPLE 2

Silver iodo-bromide emulsions listed in Table 4 were prepared in accordance with the following method.

Emulsion A through C were prepared using a conventional double jet precipitation process. Emulsions D through K, respectively core/shell type monodispersed emulsions, were prepared using a functional addition method. Emulsion L, a silver halide emnulsion containing tabular particles, was prepared using a double jet precipitation process with pH and pAg being controlled.

Next, using the above emulsions A through L, light-sensitive material Samples Nos. 20 through 43 respectively having layer thicknesses listed in Table 4 were prepared in compliance with the preparation method for a light-sensitive material in Example 1.

Each sample was tested in a manner identical with Example 1. The obtained data with regards to graininess (RMS value) and yellow-stain are listed in Table 5.

As shown in Table 5, the light-sensitive material of the invention is excellent in graininess.

EXAMPLE 3

With Example 1, amounts of example compound (E-2) used as a color developing agent were changed as listed in Table 6, whereby each sample was treated with a developing temperature listed in Table 6. Other conditions were identical with Example 1. However, samples used i.e. light-sensitive materials Nos. 26 and 38 are identical with those prepared in Example 2. (see Table 5.)

As can be understood in Table 6, a concentration of color developing agent, higher than $1.5\times10^{-2}$ mol/liter apparently attains favorable result. In particular, a concentration of color developing agent, higher than $2.0\times10^{-2}$ mol/liter attains more favorable result.

TABLE 4

| Emulsion No. | Average particle size $\bar{r}$ (μm) | Amount of silver halide included within range of $\bar{r} \pm 20\%$ | Average silver iodide content (%) | Silver iodide content in cores (%) | Silver iodide content in shells (%) | Volume ratio of shells (%) | Remarks |
|---|---|---|---|---|---|---|---|
| A | 0.5 | 56 | 0.3 | Emulsion containing sperical silver halide particles | | | Comparative |
| B | 0.5 | 54 | 0.5 | Emulsion containing spherical silver halide particles | | | Invention |
| C | 0.5 | 55 | 6 | Emulsion containing sperical silver halide particles | | | Invention |
| D | 0.5 | 84 | 0.3 | 0.4 | 0.2 | 40 | Comparative |
| E | 0.5 | 82 | 0.5 | 0.7 | 0.3 | 40 | Invention |
| F | 0.5 | 85 | 3.0 | 4 | 0.5 | 40 | Invention |
| G | 0.5 | 87 | 5.0 | 8 | 0.5 | 40 | Invention |
| H | 0.5 | 82 | 8.0 | 10 | 0.5 | 40 | Invention |
| I | 0.5 | 78 | 10.0 | 14 | 0.5 | 40 | Invention |
| J | 0.5 | 75 | 30 | 50 | 0.5 | 40 | Invention |
| K | 0.5 | 73 | 50 | 60 | 0.5 | 40 | Invention |
| L | 0.6 | 70 | 6 | Emulsion containing tabular silver halide particles of which particle diameter is ten times as large as particle thickness | | | |

TABLE 5

| Sample No. | Emulsion No. | Layer thickness μm | Layer swelling rate $T\frac{1}{2}$ (sec) | Color developing agent: 210 sec 33° C. Yellow-stain | 210 sec 33° C. RMS value | 150 sec 37.5° C. Yellow-stain | 150 sec 37.5° C. RMS value | 92 sec 42° C. Yellow-stain | 92 sec 42° C. RMS value |
|---|---|---|---|---|---|---|---|---|---|
| 20 | A | 31 | 25 | 0.02 | 50 | 0.02 | 48 | 0.05 | 42 |
| 21 | B | 31 | 26 | 0.02 | 47 | 0.08 | 43 | 0.12 | 33 |
| 22 | C | 31 | 25 | 0.02 | 50 | 0.07 | 41 | 0.11 | 32 |
| 23 | D | 31 | 24 | 0.02 | 49 | 0.02 | 46 | 0.04 | 42 |
| 24 | E | 31 | 26 | 0.02 | 49 | 0.06 | 42 | 0.10 | 32 |
| 25 | F | 31 | 25 | 0.02 | 50 | 0.08 | 42 | 0.11 | 28 |
| 26 | G | 31 | 27 | 0.02 | 50 | 0.09 | 42 | 0.12 | 26 |
| 27 | H | 31 | 25 | 0.02 | 52 | 0.09 | 41 | 0.12 | 25 |
| 28 | I | 31 | 25 | 0.02 | 51 | 0.08 | 42 | 0.12 | 27 |
| 29 | J | 31 | 25 | 0.02 | 50 | 0.08 | 42 | 0.10 | 30 |
| 30 | K | 31 | 26 | 0.02 | 52 | 0.07 | 43 | 0.10 | 32 |
| 31 | L* | 31 | 24 | 0.02 | 49 | 0.09 | 42 | 0.12 | 28 |
| 32 | A | 20 | 9 | 0.02 | 51 | 0.02 | 48 | 0.04 | 43 |
| 33 | B | 20 | 8 | 0.02 | 45 | 0.02 | 36 | 0.04 | 33 |
| 34 | C | 20 | 10 | 0.02 | 45 | 0.02 | 35 | 0.04 | 28 |
| 35 | D | 20 | 9 | 0.02 | 48 | 0.02 | 46 | 0.04 | 42 |
| 36 | E | 20 | 9 | 0.02 | 48 | 0.02 | 36 | 0.03 | 30 |
| 37 | F | 20 | 8 | 0.02 | 49 | 0.02 | 34 | 0.03 | 26 |
| 38 | G | 20 | 10 | 0.02 | 49 | 0.02 | 34 | 0.03 | 24 |
| 39 | H | 20 | 9 | 0.02 | 50 | 0.02 | 35 | 0.03 | 23 |
| 40 | I | 20 | 8 | 0.02 | 49 | 0.02 | 36 | 0.03 | 25 |
| 41 | J | 20 | 10 | 0.02 | 49 | 0.02 | 36 | 0.03 | 28 |
| 42 | K | 20 | 9 | 0.02 | 50 | 0.02 | 36 | 0.04 | 29 |
| 43 | L | 20 | 9 | 0.02 | 48 | 0.02 | 34 | 0.03 | 26 |
| | | | | Comparative | | | | Invention | |

*Aspect ratio, 1:10

The similar test was performed with samples respectively using example compounds (E-1), (E-3), (E-4) and (E-8) as a color developing agent, instead of color developing agent (E-2), thereby the similar results were obtained.

TABLE 6

| Light-sensitive material, sample No. | Color development agent (E-2) (mol/l) | Developing temperature (°C.) | RMS |
|---|---|---|---|
| 26 | $1.2 \times 10^{-2}$ | 53 | 42 |
| " | $1.5 \times 10^{-2}$ | 50 | 38 |
| " | $2.0 \times 10^{-2}$ | 47 | 28 |
| " | $3.0 \times 10^{-2}$ | 45 | 25 |
| " | $5.0 \times 10^{-2}$ | 42 | 25 |
| 38 | $1.2 \times 10^{-2}$ | 53 | 40 |
| " | $1.5 \times 10^{-2}$ | 50 | 35 |
| " | $2.0 \times 10^{-2}$ | 47 | 27 |
| " | $3.0 \times 10^{-2}$ | 45 | 23 |
| " | $5.0 \times 10^{-2}$ | 42 | 23 |

*Developing time: 60 sec.

EXAMPLE 4

Using emulsion G in Example 2, and in compliance with the preparation method in Example 1, respective samples were prepared by changing the amounts of applied silver as listed below. More specifically, by changing the amounts of silver added in the third, fifth, seventh and eighth layers, the respective samples independently having a specific amount of silver were prepared. Additionally, the layer thicknesses and amounts of silver added were modified as listed in Table 7. Furthermore, as shown in Table 7, some samples were provided with specific layer thicknesses and $T\frac{1}{2}$ so that they constituted the preferred embodiments of the invention, while the other samples were not. For each sample, the RMS value and yellow stain value are listed in Table 7. As can be understood, the amount of applied silver is favorably 30 mg/100 cm$^2$, more favorably 30 to 150 mg/cm$^2$, most favorably 35 to 100 mg/cm$^2$.

TABLE 7

| Layer thickness $T\frac{1}{2}$ | Amount of applied silver (mg/100 cm$^2$) | RMS | Yellow stain value |
|---|---|---|---|
| Layer thickness is controlled to be 28 to 30 μm; $T\frac{1}{2}$ is controlled to be 25 to 28 sec. | 20 | 57 | 0.10 |
| | 30 | 45 | 0.11 |
| | 35 | 41 | 0.12 |
| | 80 | 35 | 0.12 |
| | 100 | 34 | 0.13 |
| | 150 | 33 | 0.13 |
| | 200 | 33 | 0.14 |
| Layer thickness is controlled to be 18 to 20 μm; $T\frac{1}{2}$ is controlled to be 8 to 11 sec. | 20 | 56 | 0.03 |
| | 30 | 44 | 0.03 |
| | 35 | 37 | 0.03 |
| | 80 | 34 | 0.03 |
| | 100 | 33 | 0.04 |
| | 150 | 32 | 0.04 |
| | 200 | 32 | 0.07 |

EXAMPLE 5

The following samples were treated at a temperature of 42° C. with a color developing time of 60 sec, using the example compound E-2 as a color developing agent and changing the concentration to $5 \times 10^{-2}$ mol/liter. More specifically, in accordance with the preparation method for light-sensitive material Samples Nos. 27 and 39 in Example 1, Samples Nos. 27-1 through 27-5 and 39-1 through 39-5were prepared using the DIR compounds and inhibitors listed in Table 8 instead of the example DIR compound. With each sample, the RMS value and the yellow stain value were measured as in Example 4. Table 8 lists the obtained results.

TABLE 8

| Light-sensitive, material sample No. | DIR compound or inhibitor | RMS value | Yellow stain value |
|---|---|---|---|
| 27-1 | None | 33 | 0.12 |
| 27-2 | $D^d$-10 | 25 | 0.11 |
| 27-3 | $D^d$-59 | 25 | 0.11 |
| 27-4 | A-2 | 25 | 0.11 |
| 27-5 | B-1 | 27 | 0.09 |
| 39-1 | None | 30 | 0.04 |
| 39-2 | $D^d$-10 | 23 | 0.03 |
| 39-3 | $D^d$-59 | 23 | 0.03 |
| 39-4 | T-2 | 23 | 0.03 |
| 39-5 | P-1 | 24 | 0.03 |

As can be understood from the results in Table 8, when a specific DIR compound or inhibitor is used, the samples of the invention attain more favorable results. More specifically, even without any of the DIR compounds or inhibitors, the samples of the invention attain considerably favorable results, while with any of the DIR compounds or inhibitors the same examples can attain much more favorable results.

With the above light-sensitive material Sample No. 39-2, even when each of $D^d$-2, $D^d$-8, $D^d$-12, $D^d$-14, $D^d$-16, $D^d$-20, $D^d$-23, $D^d$-27, $D^d$-30, $D^d$-33, $D^d$-36, $D^d$-40, $D^d$-44, $D^d$-48, $D^d$-52, $D^d$-62, $D^d$-66, $D^d$-68, $D^d$-72, $D^d$-77, $D^d$-80, $D^d$-84 and $D^d$-88 was added as a DIR compound, instead of the example compound $D^d$-10, the same results were obtained. Additionally, with Sample No. 39-4, when each of the compounds T-1, T-3, T-5 and T-7 was added as an inhibitor instead of the example compound T-2, the same results were obtained. Further, with Sample No. 39-5, when each of the compounds P-3, P-5 and P-6 was added as an inhibitor instead of example compound P-1, the same results were obtained.

EXAMPLE 6

Light-sensitive material Sample No. 39 in Example 2 was treated using developer prepared by incorporating each of the following inhibitors into the color developer in Example 1, whereby the RMS values and yellow stain values were measured as in Example 5. The results in addition indicate that adding an inhibitor is effective.

TABLE 9

| Inhibitor | | RMS | | Yellow stain |
|---|---|---|---|---|
| Compound | Amount added | G (magenta) | R (cyan) | value |
| None | — | 30 | 28 | 0.03 |
| Z-4 | 30 (mg/l) | 27 | 23 | 0.03 |
| Z-27 | 20 (mg/l) | 27 | 23 | 0.03 |
| Z-42 | 2.0 (mg/l) | 24 | 23 | 0.03 |
| Z-20 | 2.0 (mg/l) | 24 | 22 | 0.03 |
| Z-14 | 50 (mg/l) | 21 | 22 | 0.03 |
| Z-26 | 50 (mg/l) | 21 | 22 | 0.03 |
| Z-18 | 100 (mg/l) | 23 | 22 | 0.03 |
| Z-21 | 100 (mg/l) | 23 | 22 | 0.03 |
| Z-28 | 2000 (mg/l) | 23 | 22 | 0.03 |

TABLE 9-continued

| Inhibitor | | RMS | | Yellow stain |
|---|---|---|---|---|
| Compound | Amount added | G (magenta) | R (cyan) | value |
| Z-7 | 50 (mg/l) | 23 | 22 | 0.03 |
| Z-30 | 20 (mg/l) | 23 | 22 | 0.03 |
| Z-39 | 20 (mg/l) | 23 | 22 | 0.03 |
| Z-65 | 500 (mg/l) | 24 | 22 | 0.03 |

EXAMPLE 7

Silver iodo-bromide emulsions listed in Table 10 were prepared in accordance with the following method. Emulsions A through C were prepared using a conventional double jet precipitation process. Emulsions D through K, respectively core/shell type monodispersed emulsions, were prepared using a functional addition method. Emulsion L, a silver halide emulsion containing tabular particles, was prepared using a double jet precipitation process with pH and pAg being controlled.

TABLE 10

| Emulsion No. | Average particle size ($\bar{r}$) (μm) | Amount of silver halide included within range of $\bar{r} \pm 20\%$ | Average silver iodide content (%) | Silver iodide content in cores (%) | Silver iodide content in shells (%) | Volume ratio of shells (%) | Remarks |
|---|---|---|---|---|---|---|---|
| A | 0.5 | 56 | 0.3 | Emulsion containing spherical silver halide particles | | | Comparative |
| B | 0.5 | 54 | 0.5 | Emulsion containing spherical silver halide particles | | | Invention |
| C | 0.5 | 55 | 6 | Emulsion containing spherical silver halide particles | | | Invention |
| D | 0.5 | 84 | 0.3 | 0.4 | 0.2 | 50 | Comparative |
| E | 0.5 | 82 | 0.5 | 0.7 | 0.3 | 50 | Invention |
| F | 0.5 | 85 | 2.0 | 4 | 2 | 50 | Invention |
| G | 0.5 | 87 | 4.0 | 8 | 2 | 50 | Invention |
| H | 0.5 | 82 | 8.0 | 10 | 6 | 50 | Invention |
| I | 0.5 | 78 | 10.0 | 14 | 6 | 50 | Invention |
| J | 0.5 | 75 | 30 | 50 | 10 | 50 | Invention |
| K | 0.5 | 73 | 50 | 60 | 40 | 50 | Invention |
| L | 0.6 | 70 | 6 | Emulsion containing tabular silver halide particles of which particle diameter is ten times as large as particle thickness | | | Invention |

The following layers were sequentially formed, in this order, on a cellulose triacetate support, in order to prepare the respective multi-layer color film samples.

First layer: Anti-halation layer (HC layer)

An anti-halation layer containing 0.18 g of black colloidal silver, and 1.5 g of gelatin.

Second layer: Subbing layer (IG layer)

A subbing layer containing 2.0 g of gelatin.

Third layer: Red-sensitive silver halide emulsion layer (R layer)

A red-sensitive silver halide emulsion layer containing not only the respective silver iodo-bromide emulsions listed in Table 1 and sensitized to have red-sensitivity, but dispersion prepared by emulsifying and dispersing 0.5 g of tricresyl phosphate (hereinafter referred to as TCP) having dissolved 0.4 g of 0.08 mol/molAg of the following cyan coupler ($C_7$-1), 0.006 mol/molAg of the following colored cyan coupler ($CC_7$-1) and the example DIR compound, but methanol having dissolved an inhibitor, into aqueous solution containing 1.80 g of gelatin.

Fourth layer: Intermediate layer (2G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing 4.0 g of the respective silver iodo-bromide emulsions listed in Table 10 and sensitized to have green-sensitivity, and dispersion prepared by emulsifying and dispersing 0.64 g of TCP having dissolved 0.07 mol/molAg of the following magenta couple ($M_7$-1), 0.015 mol/molAg of the following colored magenta coupler ($CM_7$-1) and example DIR compound (No. MDd-14), into aqueous solution containing 1.4 g of gelatin.

Sixth layer: Protective layer (3G layer)

A protective layer containing 0.8 g of gelatin.

In addition to the above components, each layer was allowed to contain gelatin-hardening agent (1,2-bisvinylsulphonylethane) and surfactant; further, into the third layer i.e. R layer and the fifth layer i.e. G layer, the respective silver halide emulsions listed in Table 10 and the respective DIR compounds or inhibitors listed in Table 11 were incorporated, in order to prepared samples.

Cyan coupler ($C_7$-1)

2-(α, α, β, β, γ, γ, δ, δ-octafluorohexanamido)5-[2-(2,4-di-t-amylphenoxy)hexanamido]phenol Colored cyan coupler ($CC_7$-1)

Disodium 1-hydroxy-4-[4-(1-hydroxy-8-acetamido-3,6-disulfo-2-naphthylazo)phenoxy]-N-[δ-(2,4-di-t-amylphenoxy)butyl]-2-naphthamide Magenta coupler ($M_7$-1)

1-(2,4,6-trichlorophenyl)-3-{[α-(2,4-di-t-amylphenoxy)acetamide]benzamido}-3-pyrazolone and 1-(2,4,6-trichlorophenyl)-3-{[α-(2,4-di-t-amylphenoxy)-acetamide]benzamide}-4-(4-methoxyphenylazo)-5-pyrazolone Colored magenta coupler (CM-1)

1-(2,4,6-trichlorophenyl)-4-(1-naphtylazo)-3-(2-chloro-5-octadecenylsuccinimidanilino)-5-pyrazolone Each sample was exposed with green light, red light or green/red light (16 CMS) through an optical wedge, thereby treated with the following teatment steps, so as to form a dye image.

| Treatment | | |
|---|---|---|
| Color developing | Time and temperature specified in Table 2 and 3 (40° C.) | |
| Bleach-fixing | 4 min | (38° C.) |
| Washing | 1 min | (20 to 33° C.) |
| Stabilizing | 30 sec | (20 to 33° C.) |
| Drying | | |

The compositions of processing solutions used in the respective processing steps are as follows.

| (Color developer) | |
|---|---|
| Sulfate of the previously mentioned example compound (E-2) (Amount of addition specified in Table 11 or 12) | |
| Sodium sulfite anhydride | 4.25 g |
| Hydroxylamine . ½ sulfate | 2.0 g |
| Potassium carbonate anhydride | 30.0 g |
| Sodium bromide | 30.0 g |
| Trisodium nitrilotriacetate (monohydride) | 2.5 g |
| Potassium hydroxide | 1.0 g |

Water was added to the above components to prepare one liter solution.

| (Bleach-fixer) | |
|---|---|
| Ferric ammonium ethylenediamine tetraacetate | 200 g |
| Diammonium ethylenediamine tetraacetate | 2.0 g |
| Aqueous ammonia (28% aqueous solution) | 20.0 g |
| Ammonium thiosulfate | 175.0 g |
| Sodium sulfite anhydride | 8.5 g |
| Sodium metabisulfite | 2.3 g |
| 2-amino-5-mercapto-1,3,4-thiadiazole | 1.5 g |

Water was added to the above components to prepare one liter solution, which was adjusted to pH=6.6 using acetic acid and aqueous ammonium.

| (Washing) | |
|---|---|
| Tap water | |
| (Stabilizer) | |
| Formalin (37% aqueous solution) | 1.5 ml |
| Konidax (manufactured by Konica Corporation) | 7.5 ml |

Water was added to the above components to prepare one liter solution.

Silver halide light-sensitive material sample No. 7-1 through 7-12 prepared using the above mentioned emulsions were treated with the above processing solutions and the treatment steps (wherein the concentration of color developing agent and the color developing time were varied as listed in Tables 11 and 12. Graininess (RMS value) and sharpness (MTF value) of each obtained magenta dye image are listed in Tables 11 and 12.

Incidentally, RMS values indicating graininess are obtained by multiplying 1000 times standard deviations in fluctuation of density values available when scanning a dye image having a density of 1.0 by using a microdensitometer having a circular scanning aperture diameter of 25 μm.

MTF (Modulation Transfer Function) granularities were determined by comparing degrees of MTF relative to a spatial frequency of 30 lines/mm.

Smaller RMS values of magenta dye images indicate better graininess. Larger MTF values indicate better sharpness.

TABLE 11

[RMS value]

| Light-sensitive material No. | Concentration of color developing agent E-2 (mol/l) | | | | | | | | | | | | | | | | | | | |
|---|---|---|---|---|---|---|---|---|---|---|---|---|---|---|---|---|---|---|---|---|
| | $1.2 \times 10^{-2}$ | | | | $1.5 \times 10^{-2}$ | | | | $2.0 \times 10^{-2}$ | | | | $3.0 \times 10^{-2}$ | | | | $5.0 \times 10^{-2}$ | | | |
| | Color development time (sec) | | | | | | | | | | | | | | | | | | | |
| (Emulsion No.) | 60 | 120 | 180 | 210 | 60 | 120 | 180 | 210 | 60 | 120 | 180 | 210 | 60 | 120 | 180 | 210 | 60 | 120 | 180 | 210 |
| 7-1 (A) | 47 | 49 | 51 | 55 | 44 | 48 | 49 | 53 | 40 | 43 | 48 | 52 | 40 | 45 | 50 | 52 | 41 | 42 | 49 | 51 |
| 7-2 (B) | 43 | 47 | 50 | 53 | 40 | 45 | 49 | 52 | 33 | 35 | 48 | 51 | 32 | 34 | 45 | 50 | 32 | 35 | 49 | 52 |
| 7-3 (C) | 41 | 45 | 47 | 51 | 38 | 40 | 43 | 50 | 31 | 34 | 49 | 53 | 30 | 33 | 50 | 55 | 31 | 33 | 51 | 56 |
| 7-4 (D) | 47 | 49 | 52 | 56 | 45 | 47 | 51 | 54 | 42 | 45 | 48 | 53 | 41 | 44 | 47 | 51 | 41 | 45 | 49 | 53 |
| 7-5 (E) | 43 | 44 | 48 | 51 | 41 | 42 | 44 | 50 | 33 | 34 | 47 | 51 | 29 | 34 | 49 | 53 | 28 | 34 | 50 | 54 |
| 7-6 (F) | 40 | 45 | 48 | 50 | 38 | 41 | 45 | 50 | 31 | 34 | 47 | 51 | 26 | 32 | 49 | 53 | 25 | 32 | 51 | 53 |
| 7-7 (G) | 40 | 45 | 47 | 51 | 38 | 39 | 44 | 50 | 28 | 32 | 46 | 51 | 25 | 29 | 50 | 52 | 25 | 28 | 52 | 55 |
| 7-8 (H) | 41 | 46 | 48 | 51 | 38 | 39 | 44 | 50 | 28 | 31 | 48 | 52 | 25 | 28 | 52 | 55 | 26 | 29 | 53 | 56 |
| 7-9 (I) | 40 | 46 | 49 | 51 | 38 | 41 | 47 | 52 | 29 | 33 | 47 | 53 | 27 | 32 | 51 | 54 | 28 | 34 | 51 | 53 |
| 7-10 (J) | 41 | 45 | 48 | 50 | 38 | 42 | 46 | 50 | 32 | 34 | 48 | 53 | 29 | 33 | 49 | 53 | 29 | 35 | 50 | 54 |
| 7-11 (K) | 43 | 47 | 50 | 52 | 40 | 42 | 49 | 53 | 33 | 34 | 49 | 55 | 31 | 32 | 51 | 54 | 31 | 35 | 51 | 54 |
| 7-12 (L) | 45 | 48 | 52 | 56 | 42 | 48 | 51 | 55 | 29 | 34 | 49 | 54 | 28 | 31 | 48 | 51 | 27 | 31 | 47 | 51 |

Values enclosed in heavy lines correspond with preferred embodiments of the invention

TABLE 12

[MTF value (%) at 30 line/mm]

| Light-sensitive material No. | Concentration of color developing agent E-2 (mol/l) | | | | | | | | | | | | | | | | | | | |
|---|---|---|---|---|---|---|---|---|---|---|---|---|---|---|---|---|---|---|---|---|
| | $1.2 \times 10^{-2}$ | | | | $1.5 \times 10^{-2}$ | | | | $2.0 \times 10^{-2}$ | | | | $3.0 \times 10^{-2}$ | | | | $5.0 \times 10^{-2}$ | | | |
| | Color developing time (sec) | | | | | | | | | | | | | | | | | | | |
| (Emulsion No.) | 60 | 120 | 180 | 210 | 60 | 120 | 180 | 210 | 60 | 120 | 180 | 210 | 60 | 120 | 180 | 210 | 60 | 120 | 180 | 210 |
| 7-1 (A) | 39 | 38 | 38 | 38 | 40 | 39 | 40 | 38 | 41 | 42 | 40 | 39 | 41 | 41 | 40 | 39 | 42 | 43 | 43 | 40 |
| 7-2 (B) | 42 | 41 | 41 | 39 | 43 | 44 | 42 | 39 | 49 | 49 | 41 | 39 | 52 | 51 | 40 | 38 | 55 | 54 | 40 | 39 |
| 7-3 (C) | 41 | 42 | 41 | 38 | 41 | 40 | 40 | 38 | 51 | 49 | 43 | 40 | 53 | 52 | 41 | 38 | 58 | 56 | 41 | 39 |
| 7-4 (D) | 38 | 38 | 38 | 37 | 44 | 43 | 42 | 39 | 43 | 41 | 40 | 38 | 42 | 41 | 39 | 37 | 42 | 40 | 38 | 36 |

TABLE 12-continued

| Light-sensitive material No. (Emulsion No.) | [MTF value (%) at 30 line/mm] Concentration of color developing agent E-2 (mol/l) $1.2 \times 10^{-2}$ | | | | $1.5 \times 10^{-2}$ | | | | $2.0 \times 10^{-2}$ | | | | $3.0 \times 10^{-2}$ | | | | $5.0 \times 10^{-2}$ | | | |
|---|---|---|---|---|---|---|---|---|---|---|---|---|---|---|---|---|---|---|---|---|
| | Color developing time (sec) | | | | | | | | | | | | | | | | | | | |
| | 60 | 120 | 180 | 210 | 60 | 120 | 180 | 210 | 60 | 120 | 180 | 210 | 60 | 120 | 180 | 210 | 60 | 120 | 180 | 210 |
| 7-5 (E) | 42 | 41 | 41 | 38 | 44 | 43 | 42 | 40 | 52 | 50 | 40 | 38 | 57 | 53 | 41 | 39 | 58 | 53 | 42 | 40 |
| 7-6 (F) | 41 | 41 | 40 | 38 | 42 | 42 | 42 | 39 | 55 | 52 | 41 | 39 | 61 | 56 | 42 | 39 | 63 | 59 | 43 | 39 |
| 7-7 (G) | 41 | 41 | 41 | 38 | 42 | 42 | 42 | 39 | 58 | 54 | 41 | 38 | 63 | 57 | 42 | 39 | 67 | 62 | 43 | 40 |
| 7-8 (H) | 41 | 41 | 41 | 37 | 42 | 41 | 41 | 38 | 58 | 54 | 41 | 38 | 63 | 57 | 42 | 39 | 67 | 62 | 43 | 40 |
| 7-9 (I) | 41 | 41 | 40 | 38 | 42 | 41 | 41 | 39 | 56 | 52 | 41 | 38 | 61 | 55 | 43 | 39 | 63 | 59 | 43 | 39 |
| 7-10 (J) | 41 | 41 | 41 | 38 | 41 | 40 | 40 | 38 | 53 | 50 | 40 | 37 | 57 | 52 | 42 | 38 | 61 | 57 | 42 | 39 |
| 7-11 (K) | 40 | 40 | 39 | 38 | 41 | 40 | 39 | 37 | 49 | 47 | 40 | 38 | 54 | 49 | 42 | 39 | 57 | 53 | 42 | 38 |
| 7-12 (L) | 41 | 40 | 40 | 38 | 42 | 41 | 41 | 38 | 55 | 54 | 42 | 39 | 56 | 54 | 40 | 37 | 58 | 56 | 43 | 39 |

Values enclosed in heavy lines correspond with preferred embodiments of the invention As can be understood from the results in Tables 11 and 12, satisfactory graininess and sharpness are obtained, when using the respective light-sensitive materials 7-2, 7-3 and 7-5 through 7-12 and the processing method of the invention of which color developing time is shorter than 180 sec. Further, it is apparent that the concentration of color developing agent in color developer is favorably $1.5\times10^{-2}$ mol/liter, in particular, more favorably $2.0\times10^{-2}$ mol/liter, and that a color developing time of shorter than 120 sec. attains by far favorable results.

EXAMPLE 8

Light-sensitive material samples 8-1′ and 8-7′ were prepared by eliminating DIR compounds in the third and fifth layers from light-sensitive materials 7-1 and 7-7 in Example 7. Each sample was tested for graininess of magenta dye image (RMS) in a manner identical with Example 7, wherein the concentration settings of developing agent E-2 (RMS) were $1.5\times10^{-2}$ mol/liter and $3\times10^{-2}$ mol/liter. The obtained results are listed in Table 13.

TABLE 13

| Light-sensitive material No. (Emulsion No.) | Concentration of color developing agent (mol/l) $1.5 \times 10^{-2}$ | | | $3 \times 10^{-2}$ | | |
|---|---|---|---|---|---|---|
| | Color developing time (sec) | | | | | |
| | 60 (Invention) | 120 (Invention) | 180 (Comparative) | 60 (Invention) | 120 (Invention) | 180 (Comparative) |
| 8-1′ (A) | 43 | 44 | 43 | 42 | 44 | 45 |
| 8-7′ (G) | 40 | 41 | 41 | 30 | 35 | 46 |

By correspondingly comparing light-sensitive materials Nos. 7-1 and 7-7 in Table 11 with light-sensitive materials Nos. 8-1′ and 8-7′ in Table 13, it is apparent that samples Nos. 7-1 and 7-7 in Table 11 respectively having a DIR compound are more favorable.

EXAMPLE 9

The effect attained by adding an inhibitor to color developer was examined using the sample No. 7-7 in Example 7. Sample No. 7-7 was subjected to color developing for one minute with the same processing solutions and treatment steps as used in Example 7, and then developed, while setting the amount of color developing agent added to $8\times10^{-2}$ mol/liter and incorporating the respective inhibitors listed in Table 14 into the color developer in Example 7, whereby the graininess of each obtained dye image (RMS value) was measured.

TABLE 14

| Inhibitor | | RMS | |
|---|---|---|---|
| Compound | Amount added | G (magenta) | R (cyan) |
| No addition | — | 24 | 25 |
| Z-4 | 20 (mg/l) | 21 | 20 |
| Z-27 | 20 (mg/l) | 21 | 21 |
| Z-42 | 2.0 (g/l) | 19 | 20 |
| Z-20 | 2.0 (g/l) | 19 | 22 |
| Z-5 | 0.5 (g/l) | 17 | 21 |
| Z-14 | 50 (mg/l) | 15 | 19 |
| Z-26 | 50 (mg/l) | 15 | 19 |
| Z-18 | 100 (mg/l) | 17 | 19 |
| Z-21 | 100 (mg/l) | 17 | 19 |
| Z-28 | 2000 (mg/l) | 17 | 19 |
| Z-7 | 50 (mg/l) | 17 | 18 |
| Z-30 | 20 (mg/l) | 15 | 19 |
| Z-39 | 20 (mg/l) | 17 | 19 |
| Z-65 | 500 (mg/l) | 19 | 17 |

As apparent from the results in Table 14, incorporating an organic inhibitor into a color developer solution is advantageous in embodying the invention.

EXAMPLE 10

Using a method for preparing light-sensitive material Samples Nos. 7-1 and 7-7 in Example 7, light-sensitive material Samples 1A and 7A were prepared by forming the Sixth through ninth emulsion layers, specified below, upon the fifth layer of each of Samples Nos. 7-1 and 7-7.

Sixth layer: A yellow filter layer containing 0.11 g of DBP having dissolved 0.3 g of yellow colloidal silver, and 0.2 g of anti-stain agent (2,5-di-t-octylhydroquinone); as well as 2.1 of gelatin.

Seventh layer: A low-sensitivity blue-sensitive silver halide emulsion layer containing 1.02 g of low-sensitivity blue-sensitive silver iodo-bromide emulsion (AgI; 4 mol %); 0.93 g of DBP having dissolved 1.84 g of α-[4-(1-benzyl-2-phenyl-3,5-dioxo-1,2,4-triazolydinyl)]-α-pyvaloyl-2-chloro-5-]-(2,4-di-t-amylphenoxy)-butanamido]acetanilide [hereinafter referred to as yellow coupler (Y"-1)]; as well as 1.9 g of gelatin.

Eighth layer: A high-sensitivity blue-sensitive silver halide emulsion layer containing 1.6 g of high-sensitivity monodispersed blue-sensitive silver iodo-bromide emulsion (AgI; 4 mol %); 0.23 g of DBP having dissolved 0.46 g of yellow coupler (Y"-1); as well as 2.0 g of gelatin.

Ninth layer: Protective gelatin layer (identical with the sixth layer of Example 1).

With each of the previously mentioned Samples 1A and 7A, amount of silver applied onto a support was at a rate of 80 mg/100 $cm^2$. However, Samples 1A-1 through 1A-6 were prepared from Sample 1A by varying the amount of silver respectively to 10 mg, 30 mg, 35 mg, 100 mg, 150 mg, and 300 mg/100 $cm^2$. Samples 7A-1 through 7A-6 were similarly prepared from Sample 7A. Samples thus obtained were tested for graininess in the same manner as in Example 1 with a color developing time of 90 seconds using $4\times10^{-2}$ mol/liter of compound E-4 as a color developing agent instead of Compound E-2. Results obtained are listed in Table 15.

TABLE 15

| Light-sensitive material (amount of silver applied; mg/100 $cm^2$) | Graininess | Light-sensitive material (amount of silver applied; mg/100 $cm^2$) | Graininess |
|---|---|---|---|
| 1A-1 (20) | 76 | 7A-1 (20) | 67 |
| 1A-2 (30) | 69 | 7A-2 (30) | 42 |
| 1A-3 (35) | 59 | 7A-3 (35) | 39 |
| 1A (80) | 53 | 7A (80) | 32 |
| 1A-4 (100) | 48 | 7A-4 (100) | 30 |
| 1A-5 (150) | 44 | 7A-5 (150) | 29 |
| 1A-6 (200) | 35 | 7A-6 (200) | 29 |

As is apparent from Table 15, the preferred amount of silver applied is more than 30 mg/100 $cm^2$.

However, an amount more than 150 mg/100 $cm^2$ offers no economical advantages, and graininess shows no further improvement. For this reason, an amount advantageous for practical use is 30 to 100 mg/100 $cm^2$, in particular, 35 to 100 mg/$cm^2$.

EXAMPLE 11

With pH of the color developer used in Example being changed as listed in the following Table 11-1, processing was performed with a color developing time of 120 seconds.

However, light-sensitive material Sample 16 was tested for cyan dye graininess (RMS) in the same manner as in Example 1 except that color developing was performed at 40° C. Results obtained are listed in Table 11-1.

TABLE 11-1

| pH of Color developer | 10.2 | 10.4 | 10.6 | 10.8 | 11.2 | 11.8 |
|---|---|---|---|---|---|---|
| RMS Value | 34 | 32 | 30 | 29 | 29 | 31 |

Note:
In present test, example compound Z-14 was added in compliance with a specific requirement in order to suppress fog density below 0.5.

As is apparent from the results in the table, satisfactory graininess is attained with a color developer having pH of higher than 10.4; the graininess is further improved with a color developer having pH ranging from 0.5 to 12.0, and optimized with a color developer having pH ranging from 10.6 to 11.5.

EXAMPLE 12

Light-sensitive material Sample 6 was tested for cyan dye graininess (RMS) in the same manner as in Example 1, except that the treatment time was 120 seconds, and the temperature of color developer in the course of color developing was varied as specified below in Table 12-2. Results obtained are listed in Table 12-2.

TABLE 12-2

| Color developer temperature | 38 | 41 | 43 | 48 | 55 | 65 |
|---|---|---|---|---|---|---|
| RMS Value | 36 | 33 | 31 | 30 | 29 | 29 |

Note:
In present test, example compound Z-14 was applied in compliance with a specific requirement in order to suppress fog density below 0.5.

As is apparent from the above table, satisfactory graininess is attained at a processing temperature of higher than 40° C. in the course of color developing process; the graininess is further improved at a processing temperature ranging from 42° to 70° C., and optimized in a processing temperature range of 45° to 60° C.

EXAMPLE 13

Test was performed in a manner identical with Example 1, except by varying the concentration of sodium sulfite anhydride in the color developer used in Example as specified the following Table 13-3, and using the processing conditions of a color developing time of 90 seconds and a processing temperature of 42° C. In this test, light-sensitive material Sample No. 11 was used. The resultant cyan dye graininess values (RMS) are listed in Table 13-3.

TABLE (13-3)

| Concentration of sodium sulfite (mol/l) | $3.3\times10^{-2}$ | $1.4\times10^{-2}$ | $1.1\times10^{-2}$ | $0.8\times10^{-2}$ | $0.4\times10^{-2}$ | $0.2\times10^{-2}$ |
|---|---|---|---|---|---|---|
| RMS value | 31 | 29 | 29 | 27 | 25 | 25 |

Note:
In the present test, example compound Z-14 was added in compliance with a specific requirement in order to suppress fog density below 0.5.

As is apparent from the above table, improved graininess is attained with a color developer having a sulfite concentration of lower than $1.5\times10^{-2}$ mol/liter; the graininess is further improved with a color developer having sulfite concentration ranging 0 to $1.0\times10^{-2}$ mol/liter including 0 mol/liter, and optimized with a color developer having sulfite concentration ranging 0 to $0.5\times10^{-2}$ mol/liter including 0 mol/liter.

EXAMPLE 14

Test was performed in a manner identical with Example 1, except by varying the sodium bromide concentration in the color developer used in Example 1 as specified the following Table 14-4, and using the processing conditions of a color developing time of 120 seconds and a processing temperature of 40° C. In this test, light-sensitive material Sample No. 6 was used. The resultant cyan dye graininess values (RMS) are listed in Table 14-4.

TABLE (14-4)

| Sodium bromide concentration (mol/l) | $1.3 \times 10^{-2}$ | $0.8 \times 10^{-2}$ | $0.7 \times 10^{-2}$ | $0.6 \times 10^{-2}$ | $0.4 \times 10^{-2}$ | $0.2 \times 10^{-2}$ | $0.1 \times 10^{-2}$ |
|---|---|---|---|---|---|---|---|
| RMS value | 34 | 32 | 31 | 30 | 30 | 30 | 31 |

Note:
In the present test, example compound Z-14 was added in compliance with a specific requirement in order to suppress fog density below 0.5.

As is apparent from the above table, improved graininess is attained with a color developer having a sulfite concentration of lower than $1.5\times10^{-2}$ mol/liter; the graininess is further improved with a color developer having sulfite concentration ranging 0 to $1.0\times10^{-2}$ mol/liter including 0 mol/liter, and optimized with a color developer having sulfite concentration ranging 0 to $0.5\times10^{-2}$ mol/liter including 0 mol/liter.

EXAMPLE 15

Test was performed in a manner indentical with Example 1, except by adding the respective compounds respresented by any of general formulas [A-I] through [A-VI] to the color developer used in Example 1, at a rate of 5 g/liter, as specified the following Table 15-5, and using the processing conditions of a color developing time of 90 seconds and a processing temperature of 40° C. In this test, light-sensitive material Sample No. 6 was used. The resultant cyan dye graininess values (RMS) are listed in Table 15-5.

TABLE 15-5

| Development accelerator | RMS value |
|---|---|
| No addition | 35 |
| A-I-1 | 31 |
| A-I-9 | 30 |
| A-I-11 | 30 |
| A-II-3 | 30 |
| A-II-12 | 33 |
| A-III-2 | 33 |
| A-IV-1 | 31 |
| A-IV-14 | 30 |
| A-IV-17 | 33 |
| A-IV-9 | 33 |
| A-V-5 | 30 |
| A-V-4 | 29 |
| A-V-2 | 30 |
| A-V-18 | 29 |
| A-VI (Monoethanol amine) | 31 |
| A-VI (Triethanol amine) | 31 |
| A-VI (2-ethylaminoethanol) | 32 |

Note:
In the present test, example compound Z-14 was added in compliance with a specific requirement in order to suppress fog density below 0.5.

As is apparent from the above table, the graininess is further improve by adding each of the compounds represented by any of the previously mentioned general formulas [A-1] through [A-VI] into the color developer of this invention.

EXAMPLE 16

Silver halide emulsions in Table 16-1 i.e. emulsions containing spherical silver halide particles were prepared using a conventional double-jet precipitation process.

The following layers were sequentially formed, in this order, on a cullulose triacetate support, in order to prepare the respective multi-layer color film samples.

First layer: Anti-halation layer (HC layer)

An anti-halation layer containing 0.18 g of black colloidal silver, and 1.5 g of gelatin.

Second layer: Subbing layer (IG layer)

A subbing layer containing 2.0 g of gelatin.

Third layer: Red-sensitive silver halide emulsion layer (R layer).

A red-sensitive silver halide emulsion layer containing not only each of the silver halide emulsions listed in Table 16-1 and sensitized to have red-sensitivity, but dispersion prepared by emulsifying and dispersing tricresyl phosphate (hereinafter referred to as TCP) having dissolved 0.2 mol/molAg of the following cyan coupler ($C_{16}$-1), 0.006 mol/molAg of the following colored cyan coupler ($CC_{16}$-1) and the example DIR compound (No. $D^d$-24), as well as methanol having dissolved an inhibitor, into aqueous solution containing gelatin.

Fourth layer: Intermediate layer (2G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing not only each of the silver halide emulsions listed in Table 16-1 and sensitized to have green-sensitivity, but TCP having dissolved 0.15 mol/molAg of the following magenta coupler ($M_{16}$-1), 0.015 mol/molAg of the following colored magenta coupler ($CM_{16}$-1) and the example DIR compound (No. $D^d$-5), into aqueous solution containing gelatin.

Sixth layer: Yellow filter layer

A yellow filter layer containing 0.3 g yellow colloidal silver, and 0.11 g of DBP having dissolved 0.2 g anti-stain agent (2,5-di-t-octylhydroquinone); as well as 2.1 g of gelatin.

Seventh layer: Low-sensitivity blue-sensitive silver halide emulsion layer (B layer)

A blue-sensitive silver halide emulsion layer containing not only each of the silver halide emulsions listed in Table 16-1 and sensitized to have blue-sensitivity, but dispersion prepared by emulsifying and dispersing TCP having dissolved 0.3 mol/molAg of the following yellow coupler ($BY_{16}$-1) and the example DIR compound (No. $D^d$-62), into aqueous solution containing gelatin.

Eighth layer: High-sensitivity monodispersed blue-sensitive silver halide emulsion layer (B layer)

A layer similar to the seventh layer, except that slightly larger silver halide particles were used.

Ninth layer: Protective layer (3G layer)

A protective layer containing 0.8 g of gelatin.

In addition to the above components, each layer was allowed to contain gelatin-hardening agents (1,2-bisvinylsulphonylethane and sodium 2,4-dichloro-6-hydroxy-s-triadine), surfactant and the like.

The amount of silver applied was 50 mg/100 $cm^2$.

The couplers used in the respective layers were as follows.

Cyan coupler ($C_{16}$-1)

2-(α, α, β, β, γ, γ, δ, δ-octafluohexanamide)-5-[2-(2,4-di-t-amylphenoxy)hexaneamide]phenol Colored cyan coupler ($CC_{16}$-1)

Disodium 1-hydroxy-4-[4-(1-hydroxy-8-acetamide-3,6-disulfo-2-naphthylazo)phenoxy]-N-[δ-2,4-di-t-amylphenoxy)butyl]-2-naphthamide Magenta coupler ($M_{16}$-1)

1-(2,4,6-trichlorophenyl)-3-{[α-(2,4-di-t-amylphenoxy)acetamide]benzamido}-3-pyrazolone and 1-(2,4,6-trichlorophenyl)-3-{[α-(2,4-di-t-amylphenoxy)-acetamide]benzamido}-4-(4-methoxyphenylazo)-5-pyrazolone Colored magenta coupler ($CM_{16}$-1)

1-(2,4,6-trichlorophenyl)-4-(1-naphthylazo)-3-(2-chloro-5-octadecenylsuccinamidanilino)-5-pyrazolone Yellow coupler ($Y_{16}$-1)

α-[4-(1-benzyl-2-phenyl-3,5-dioxo-1,2,4-triazolydinyl-α-pyvaloyl-2-chloro-5-[γ-(2,4-di-t-amylphenoxy)-butanamide]acetanilide Samples 16-1 through 16-21 were prepared respectively using the above specified compositions specified in Table 16-1 as the composition of silver halide, and varying the amounts of application in the third, fifth, sixth and seventh layers, varying the amount of gelatin-hardening agent in the third layer and adding gelatin-hardening agent into the blue-sensitive silver halide emulsion layer so as to reduce $T_{\frac{1}{2}}$ of certain samples. Next, the layer thicknesses, as well as layer swelling rates $T_{\frac{1}{2}}$, were measured. Table 16-2 lists the measurement results.

Each sample was exposed with green light, red light or green/red light (16 CMS) through an optical wedge, thereby treated with the following treatment steps, so as to form a dye image.

TABLE 16-2

| Treatment<br>Color developing | Time and temperature specified in | |
|---|---|---|
| Bleaching | 4 min | (38° C.) |
| Fixing | 3 min | (30 to 38° C.) |
| Washing | 1 min | (20 to 33° C.) |
| Stabilizing | 1 min | (20 to 33° C.) |
| Drying | | |

The compositions of processing solutions used in the respective processing steps are as follows.

| (Color developer 16-A) | |
|---|---|
| Sulfate of the previously mentioned example compound (E-2) | $3 \times 10^{-2}$ mols |
| Sodium sulfite anhydride | 4.25 g |
| Hydroxylamine.½ sulfate | 2.0 g |
| Potassium carbonate anhydride | 30.0 g |
| Sodium bromide | 1.3 g |
| Trisodium nitrilotriacetate (monohydride) | 2.5 g |
| Potassium hydroxide | 1.0 g |

Water was added to the above components to prepare one liter solution, which was adjusted to pH=10.2 using 50% KOH and 50% $H_2SO_4$.

(Color developer 16-B)

The color developer was prepared by adding previously mentioned inhibitor Z-5 to the above-mentioned color developer 16-A at a rate of 4 g/liter.

(Color developer 16-C)

The color developer was prepared by adding, at a rate of 3 g/liter, PVP Luviscol K-17 (manufactured by BASE corpo.), which is example compound [1] having a pyrolidone nucleus.

| (Bleacher) | |
|---|---|
| Ferric ammonium ethylenediamine tetraacetate | 200 g |
| Ammonium bromide | 150.0 g |
| Glacial acetic acid | 10.0 ml |

Water was added to the above components to prepare one liter solution, which was adjusted to pH=6.0 using aqueous ammonium.

| (Fixer) | |
|---|---|
| Ammonium thiosulfate | 175.0 g |
| Sodium sulfite anhydride | 8.5 g |
| Sodium metabisulfite | 2.3 g |

Water was added to the above components to prepare one liter solution, which was adjusted to pH=7.0 using acetic acid.

| (Stabilizer) | |
|---|---|
| Formalin (37% aqueous solution) | 1.5 ml |
| Konidax (manufactured by Konica Corporation) | 7.5 ml |

Water was added to the above components to prepare one liter solution.

Each sample was treated respectively with each of the above-mentioned color developers 16-A through C for 90 seconds at a temperature of 42° C. Each sample was also treated with color developer A for 10 seconds at a temperature of 33° C., for comparison.

Cyan dye graininess values (RMS values) thus obtained are listed in Table 16-2. The amount of DIR compound added to each color-sensitive layer was so controlled that desensitization and density decrease of each color-sensitive layer were equilibrated.

Immediately after the above process, each sample was examined for fog-density on the non-exposure portion, using blue light of an optical densitometer PDA-65A (Konica Corporation). Each sample was allowed to stand for one week under the conditions of 40° C. and 60 RH %, and then similarly examined, thereby the density increase due to storage was measured in order to determine the yellow stain increase ratio. Table 16-2 lists the measurement results.

Also, Density LD was determined by measuring exposure for attaining density of 1.0 by performing sensitometry with each sample treated with color developer 16-A for 210 seconds at a temperature of 33° C., and thereby there respective densities relative to the above-specified density 1.0 were obtained as the results of treatment with color developers 16-A through C under the conditions of a duration of 90 seconds and a temperature of 42° C. The densities obtained are listed in Table 16-3. Tables 16-2 and 16-3 indicate that satisfactory results were obtained by applying the present invention; Table 16-3 demonstrates superiority of the invention especially in terms of balance coloration.

RMS values were obtained by multiplying 1000 times stardard deviations in fluctuation of density values available when scanning an area of minimum density +1.2 by using a micro densitometer having an aperture scanning area of 250 $\mu m^2$.

TABLE 16-1

| Emulsion No. | Average particle size $\bar{(r)}$ (μm) | Amount of Silver halide included within range of $\bar{r} \pm 20\%$ | Average silver iodide content (%) | Silver iodide content in cores (%) | Silver iodide content in shells (%) | Volume ratio of shells (%) |
|---|---|---|---|---|---|---|
| A | 0.5 | 56 | 0.3 | Emulsion with spherical particles | | |
| B | 0.5 | 54 | 0.5 | Emulsion with spherical particles | | |
| C | 0.5 | 55 | 6 | Emulsion with spherical particles | | |
| D | 0.5 | 84 | 0.3 | 0.4 | 0.2 | 50 |
| E | 0.5 | 82 | 0.5 | 0.7 0.3 | 50 | |
| F | 0.5 | 85 | 3.0 | 4 | 2 | 50 |
| G | 0.5 | 87 | 6.0 | 9 | 3 | 50 |
| H | 0.5 | 82 | 8.0 | 10 | 6 | 50 |
| I | 0.5 | 78 | 10.0 | 14 | 6 | 50 |
| J | 0.5 | 75 | 30 | 50 | 10 | 50 |
| K | 0.5 | 73 | 50 | 60 | 40 | 50 |
| L | 0.6 | 70 | 6 | Emulsion containing tabular silver halide particles of which particle diameter is ten times as large as particle thickness | | |

TABLE 16-2

| | | | | Color developer 16-A | | | | Color developer 16-B with inhibitor Z-5 | | Color developer 16-C with compound (1) of the invention | |
|---|---|---|---|---|---|---|---|---|---|---|---|
| | | | | 210 sec. 33° C. | | 90 sec. 42° C. | | 90 sec. 42° C. | | 90 sec. 42° C. | |
| Sample No. | Emulsion No. | Layer thickness μm | Layer swelling T ½ (sec) | Yellow stain | RMS value | Yellow stain | RMS value | Yellow stain | RMS value | Yellow stain | RMS value |
| 16-1 | A | 20 | 12 | 0.02 | 50 | 0.04 | 44 | 0.04 | 44 | 0.04 | 43 |
| 16-2 | B | 20 | 12 | 0.02 | 46 | 0.04 | 33 | 0.04 | 32 | 0.04 | 30 |
| 16-3 | C | 20 | 11 | 0.02 | 48 | 0.04 | 29 | 0.04 | 28 | 0.04 | 25 |
| 16-4 | D | 20 | 12 | 0.02 | 49 | 0.04 | 43 | 0.04 | 43 | 0.04 | 43 |
| 16-5 | E | 20 | 12 | 0.02 | 49 | 0.04 | 30 | 0.04 | 28 | 0.04 | 25 |
| 16-6 | F | 20 | 12 | 0.02 | 48 | 0.04 | 28 | 0.04 | 26 | 0.04 | 23 |
| 16-7 | G | 20 | 11 | 0.02 | 49 | 0.04 | 26 | 0.04 | 25 | 0.04 | 22 |
| 16-8 | G | 15 | 12 | 0.02 | 48 | 0.04 | 25 | 0.04 | 23 | 0.04 | 21 |
| 16-9 | G | 20 | 11 | 0.02 | 48 | 0.04 | 26 | 0.04 | 24 | 0.04 | 21 |
| 16-10 | G | 25 | 12 | 0.02 | 49 | 0.06 | 27 | 0.06 | 25 | 0.05 | 22 |
| 16-11 | G | 30 | 12 | 0.02 | 48 | 0.11 | 28 | 0.11 | 28 | 0.10 | 25 |
| 16-12 | G | 20 | 6 | 0.02 | 48 | 0.04 | 24 | 0.04 | 23 | 0.04 | 21 |
| 16-13 | G | 20 | 16 | 0.02 | 47 | 0.04 | 25 | 0.04 | 23 | 0.04 | 21 |
| 16-14 | G | 20 | 20 | 0.02 | 48 | 0.06 | 26 | 0.06 | 25 | 0.05 | 22 |
| 16-15 | G | 20 | 25 | 0.02 | 49 | 0.11 | 28 | 0.11 | 28 | 0.10 | 25 |
| 16-16 | G | 30 | 11 | 0.02 | 48 | 0.12 | 29 | 0.12 | 29 | 0.11 | 26 |
| 16-17 | H | 20 | 12 | 0.02 | 48 | 0.04 | 24 | 0.04 | 23 | 0.04 | 21 |
| 16-18 | I | 20 | 12 | 0.02 | 49 | 0.04 | 25 | 0.04 | 23 | 0.04 | 21 |
| 16-19 | J | 20 | 12 | 0.02 | 48 | 0.04 | 26 | 0.04 | 25 | 0.04 | 22 |
| 16-20 | K | 20 | 12 | 0.02 | 50 | 0.04 | 27 | 0.04 | 27 | 0.04 | 24 |
| 16-21 | L | 20 | 12 | 0.02 | 49 | 0.04 | 25 | 0.04 | 24 | 0.04 | 21 |

TABLE 16-3

LD (density relative to exposure 1.0, attained by treatment with color developer 16-A for 210 sec. at 33° C.)

| Color developer | Sample No. 16-A B | 16-A G | 16-A R | 16-B B | 16-B G | 16-B R | 16-C B | 16-C G | 16-C R |
|---|---|---|---|---|---|---|---|---|---|
| 16-1 | 1.39 | 1.23 | 1.01 | 1.02 | 1.21 | 1.00 | 1.03 | 1.20 | 1.01 |
| 16-2 | 1.37 | 1.18 | 1.00 | 1.01 | 1.17 | 0.99 | 1.02 | 1.04 | 1.00 |
| 16-3 | 1.35 | 1.15 | 1.03 | 1.02 | 1.13 | 1.01 | 1.03 | 1.03 | 1.02 |
| 16-4 | 1.41 | 1.22 | 1.00 | 1.00 | 1.19 | 0.99 | 1.01 | 1.12 | 1.00 |
| 16-5 | 1.40 | 1.21 | 0.99 | 1.01 | 1.18 | 0.98 | 1.00 | 1.03 | 1.00 |
| 16-6 | 1.41 | 1.20 | 1.02 | 1.00 | 1.18 | 1.00 | 1.02 | 1.02 | 1.02 |
| 16-7 | 1.32 | 1.13 | 1.01 | 1.03 | 1.11 | 1.00 | 1.00 | 1.01 | 1.00 |
| 16-8 | 1.35 | 1.16 | 0.99 | 1.02 | 1.14 | 0.98 | 1.01 | 1.02 | 0.99 |
| 16-9 | 1.40 | 1.20 | 1.00 | 1.02 | 1.19 | 0.99 | 1.01 | 1.03 | 1.00 |
| 16-10 | 1.42 | 1.22 | 1.02 | 1.01 | 1.20 | 1.01 | 0.99 | 1.05 | 1.02 |
| 16-11 | 1.45 | 1.25 | 1.00 | 1.03 | 1.23 | 0.99 | 0.98 | 1.12 | 1.00 |
| 16-12 | 1.30 | 1.14 | 1.00 | 1.01 | 1.11 | 0.99 | 1.02 | 1.01 | 1.01 |
| 16-13 | 1.42 | 1.22 | 0.99 | 1.01 | 1.18 | 0.98 | 1.01 | 1.04 | 1.99 |
| 16-14 | 1.44 | 1.23 | 0.99 | 1.02 | 1.19 | 0.98 | 1.00 | 1.05 | 1.00 |
| 16-15 | 1.47 | 1.26 | 1.00 | 1.03 | 1.24 | 0.99 | 0.99 | 1.11 | 1.01 |
| 16-16 | 1.52 | 1.31 | 1.01 | 1.05 | 1.28 | 0.99 | 0.97 | 1.14 | 1.01 |
| 16-17 | 1.41 | 1.21 | 1.02 | 1.00 | 1.18 | 1.01 | 1.02 | 1.02 | 1.02 |
| 16-18 | 1.36 | 1.18 | 1.01 | 1.01 | 1.15 | 1.00 | 1.02 | 1.01 | 0.02 |

TABLE 16-3-continued

| Color developer | LD (density relative to exposure 1.0, attained by treatment with color developer 16-A for 210 sec. at 33° C.) Sample No. 16-A B | 16-A G | 16-A R | 16-B B | 16-B G | 16-B R | 16-C B | 16-C G | 16-C R |
|---|---|---|---|---|---|---|---|---|---|
| 16-19 | 1.35 | 1.17 | 1.00 | 1.02 | 1.15 | 0.99 | 1.00 | 1.04 | 0.01 |
| 16-20 | 1.33 | 1.14 | 0.99 | 1.02 | 1.11 | 0.98 | 1.01 | 1.05 | 0.99 |
| 16-21 | 1.40 | 1.21 | 1.00 | 1.02 | 1.18 | 0.99 | 1.00 | 1.01 | 1.01 |

EXAMPLE 17

In the present example, light-sensitive material sample No. 16-9, also used in Example 16, was used.

In this example, test was performed using color developers 16-A and 16-C, with various combinations of developing time and developing temperature. Table 17-4 lists time-temperature combinations.

The measuring results of RMS values and LD (green light) valued obtained in the same manner as in Example 1 are listed in Table 17-4.

These results in Table 17-4 indicate that color developers B and C respectively have excellent effect, and that 90 second developing attains the best results, followed by 120, 150, 180 seconds in this order.

The similar test was performed by using each of example compounds [4], [8], [12], [16], [20], and [23], instead of previously mentioned example compound [1], each of which was a polymer with pyrolidone nucleus, whereby modified samples commonly showed satisfactory results.

TABLE 17-4

| Color developer | 180 sec., 35° C. RMS value | 180 sec., 35° C. LD | 150 sec., 37.5° C. RMS value | 150 sec., 37.5° C. LD | 120 sec., 40° C. RMS value | 120 sec., 40° C. LD | 60 sec., 48° C. RMS value | 60 sec., 48° C. LD |
|---|---|---|---|---|---|---|---|---|
| 16-A | 36 | 1.10 | 32 | 1.13 | 29 | 1.16 | 25 | 1.35 |
| 16-C | 32 | 1.00 | 28 | 1.01 | 23 | 1.00 | 20 | 1.05 |

EXAMPLE 18

Silver halide emulsions in Table 18-1 i.e. emulsions containing spherical silver halide particles were prepared using a conventional double-jet precipitation process.

The following layers were sequentially formed, in this order, on a cellulose triacetate support, in order to prepare the respective multi-layer color film samples.

First layer: Anti-halation layer (HC layer)

An anti-halation layer containing 0.18 g of black colloidal silver, and 1.5 g of gelatin.

Second layer: Subbing layer (IG layer)

A subbing layer containing 2.0 g of gelatin.

Third layer: Red-sensitive silver halide emulsion layer (R layer).

A red-sensitive silver halide emulsion layer containing not only each sensitized to have red-sensitivity, but dispersion prepared by emulsifying and dispersing tricresyl phosphate (hereinafter referred to as TCP) having dissolved 0.2 mol/molAg of the following cyan coupler ($C_{18}$-1), 0.006 mol/molAg of the following colored cyan coupler ($CC_{18}$-1) and the example DIR compound (No. $D^d$-24), as well as methanol having dissolved an inhibitor, into aqueous solution containing gelatin.

Fourth layer: Intermediate layer (2 G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing not only each of the silver halide emulsions listed in Table 18-1 and sensitized to have green-sensitivity, but dispersion prepared by emulsifying and dispersing TCP having dissolved 0.15 mol/molAg of the following magenta coupler ($M_{18}$-1), 0.015 mol/molAg of the following colored magenta coupler ($CM_{18}$-1) and the example DIR compound (No. $D^d$-5), into aqueous solution containing gelatin.

Sixth layer: Yellow filter layer

A yellow filter layer containing 0.11 g of DBP having dissolved 0.3 g yellow colloidal silver, 0.3 g of anti-stain agent (2,5-di-t-octylhydroquinone); as well as 2.1 g of gelatin.

Seventh layer: Low-sensitivity blue-sensitive silver halide emulsion layer (B layer)

A blue-sensitive silver halide emulsion layer containing not only each of the silver halide emulsions listed in Table 18-1 and sensitized to have blue-sensitivity, but dispersion prepared by emulsifying and dispersing but TCP having dissolved 0.3 mol/molAg of the following yellow coupler ($Y_{18}$-1) and the example DIR compound (No. $D^d$-62), into aqueous solution containing gelatin.

Eighth layer: High-sensitivity monodispersed blue-sensitive silver halide emulsion layer (B layer)

A layer similar to the seventh layer, except that slightly larger silver halide particles were used.

Ninth layer: Protective layer (3 G layer)

A protective layer containing 0.8 g of gelatin.

In addition to the above components, each layer was allowed to contain gelatin-hardening agents (1,2-bisvinylsulphonylethane and sodium 2,4-dichloro-6-hydroxy-s-triadine), surfactant and the like.

The amount of silver applied was 50 mg/100 $cm^2$.

The couplers used in the respective layers were as follows.

Cyan coupler ($C_{18}$-1)

2-(α,α,β,β,γ,γ,δ,δ-octafluohexanamido)-5-[2-(2,4-di-t-amylphenoxy)hexaneamido]phenol Colored cyan coupler ($CC_{18}$-1)

Disodium 1-hydroxy-4-[4-(1-hydroxy-8-acetamide-3,6-disulfo-2-naphthylazo)phenoxy]-N-[δ-(2,4-di-t-amylphenoxy)butyl]-2-naphthamide Magenta coupler ($M_{18}$-1)

1-(2,4,6-trichlorophenyl)-3-{[α-(2,4-di-t-amylphenoxy)acetamide]benzamido}-3-pyrazolone and 1-(2,4,6-trichlorophenyl)-3-{[α-(2,4-di-t-amylphenoxy)-acetamido]benzamide}-4-(4-methoxyphenylazo)-5-pyrazolone Colored magenta coupler ($CM_{18}$-1)

1-(2,4,6-trichlorophenyl)-4-(1-naphthylazo)-3-(2-chloro-5-octadecenylsuccinamidanilino)-5-pyrazolone Yellow coupler ($Y_{18}$-1)

α-[4-(1-benzyl-2-phenyl-3,5-dioxo-1,2,4-triazolydinyl-α-pyvaloyl-2-chloro-5-[γ-(2,4-di-t-amylphenoxy)-butanamide]acetanilide Samples 1 through 21 were prepared respectively using the above specified compositions specified in Table 18-1 as the composition of silver halide, and varying the amounts of application in the third, fifth, sixth and seventh layers, varying the amount of gelatin-hardening agent in the eighth layer and adding gelatin-hardening agent into the blue-sensitive silver halide emulsion layer so as to reduce $T\frac{1}{2}$ of certain samples. Next, the layer thicknesses, as well as layer swelling rates $T\frac{1}{2}$, were measured. Table 18-2 lists the measurement results.

Each sample was exposed with green light, red light or green+red light (16 CMS) through an optical wedge, thereby treated with the following treatment steps, so as to form a dye image.

| Treatment | | |
|---|---|---|
| Color developing | Time and temperature specified in Table 18-2 | |
| Bleaching | 4 min | (38° C.) |
| Fixing | 3 min | (30 to 38° C.) |
| Washing | 1 min | (20 to 33° C.) |
| Stabilizing | 1 min | (20 to 33° C.) |
| Drying | | |

The compositions of processing solutions used in the respective processing steps are as follows.

| (Color developer 18-A) | |
|---|---|
| Sulfate of the previously mentioned example compound | $3 \times 10^{-2}$ mols |
| Sodium sulfite anhydride | 4.25 g |
| Hydroxylamine.½ sulfate | 2.0 g |
| Potassium carbonate anhydride | 30.0 g |
| Sodium bromide | 1.3 g |
| Trisodium nitrilotriacetate (monohydride) | 2.5 g |
| Potassium hydroxide | 1.0 g |
| Inhibitor Z-5 | 1.5 g |

Water was added to the above components to prepare one liter solution, which was adjusted to pH=10.2 using KOH and $H_2SO_4$.

(Color developer 18-B)

The color developer was prepared by adding previously mentioned inhibitor Z-5 to the above-mentioned color developer 18-A at a rate of 4 g/liter.

(Color developer 18-C)

The color developer was prepared by adding, at a rate of 2 g/liter, example compound [1] represented by general formula [R-IV] of the invention.

| (Bleacher) | |
|---|---|
| Ferric ammonium ethylenediamine tetraacetate | 200 g |

-continued

| (Bleacher) | |
|---|---|
| Ammonium bromide | 150.0 g |
| Glacial acetic acid | 10.0 ml |

Water was added to the above components to prepare one liter solution, which was adjusted to pH=6.0 using aqueous ammonium solution.

| (fixer) | |
|---|---|
| Ammonium thiosulfate | 175.0 g |
| Sodium sulfite anhydride | 8.5 g |
| Sodium metabisulfite | 2.3 g |

Water was added to the above components to prepare one liter solution, which was adjusted to pH=6.0 using acetic acid.

| (Stabilizer) | |
|---|---|
| Formalin (37% aqueous solution) | 1.5 ml |
| Konidax (manufactured by Konica Corporation) | 7.5 ml |

Water was added to the above components to prepare one liter solution.

Each sample was treated with each of the above-mentioned color developers 18-A through C for 90 seconds at a temperature of 42° C. Each sample was also treated with color developer A for 210 seconds at a temperature of 33° C., for comparison.

Each sample was treated respectively with each of the above-mentioned color developers 18-A, 18-B, and 18-C, for 90 seconds at a temperature of 42° C. Each sample was also treated with color developer A for 210 seconds at a temperature of 33° C., for comparison.

Cyan dye graininess values (RMS values) thus obtained are listed in Table 18-2. The amount of DIR compound added to each color-sensitive layer was so controlled that desensitization and density decrease of each color-sensitive layer were equilibrated.

Immediately after the above process, each sample was examined for fog-density on the non-exposure portion, using blue light of an optical densitometer PDA-65A (Knonica Corporation). Each sample was allowed to stand for one week under the conditions of 40° C. and 60 RH %, and then similarly examined, thereby the density increase due to storage was measured in order to determine the yellow stain increase ratio. Table 18-2 lists the measurement results.

Also, Density LD was determined by measuring exposure for attaining density of 1.0 by performing sensitometry with each sample treated with color developer 16-A for 210 seconds at a temperature of 33° C., and thereby the respective densities relative to the above-specified density 1.0 were obtained as the results of treatment with color developers 18-A, 18-B and 18-C under the conditions of a duration of 90 seconds and a temperature of 42° C. The densities obtained are listed in Table 18-3. Tables 18-2 and 18-3 indicate that satisfactory results were obtained by applying the present invention; Table 18-3 demonstrates superiority of the invention especially in terms of balanced coloration.

RMS values were obtained by multiplying 1000 times standard deviations in fluctuation of density values available when scanning an area of minimum density + 1.2 by using a micro densitometer having an aperture scanning area of 250 $\mu m^2$.

TABLE 18-3-continued

| Color developer | Sample No. 18-A B | 18-A G | 18-A R | 18-B B | 18-B G | 18-B R | 18-C B | 18-C G | 18-C R |
|---|---|---|---|---|---|---|---|---|---|
| | LD (density relative to exposure 1.0 attained by treatment with color developer per 18-A for 210 sec. at 33° C. | | | | | | | | |
| 12 | 1.30 | 1.14 | 1.00 | 1.01 | 1.11 | 0.99 | 1.02 | 1.01 | 1.01 |

TABLE 18-1

| Emulsion No. | Average particle size (r)(μm) | Amount of silver halide included within range of r ± 20% | Average silver iodide content (%) | Silver iodide content in cores (%) | Silver iodide content in shells (%) | Volume ratio of shells (%) | Remarks |
|---|---|---|---|---|---|---|---|
| A | 0.5 | 56 | 0.3 | Emulsion with spherical particles | | | Comparative |
| B | 0.5 | 54 | 0.5 | Emulsion with spherical particles | | | Invention |
| C | 0.5 | 55 | 6 | Emulsion with spherical particles | | | Invention |
| D | 0.5 | 84 | 0.3 | 0.4 | 0.2 | 50 | Comparative |
| E | 0.5 | 82 | 0.5 | 0.7 | 0.3 | 50 | Invention |
| F | 0.5 | 85 | 3.0 | 4 | 2 | 50 | Invention |
| G | 0.5 | 87 | 6.0 | 9 | 3 | 50 | Invention |
| H | 0.5 | 82 | 8.0 | 10 | 6 | 50 | Invention |
| I | 0.5 | 78 | 10.0 | 14 | 6 | 50 | Invention |
| J | 0.5 | 75 | 30 | 50 | 10 | 50 | Invention |
| K | 0.5 | 73 | 50 | 60 | 40 | 50 | Invention |
| L | 0.6 | 70 | 6 | Emulsion containing tabular silver halide particles of which particle diameter is ten times as large as particle thickness | | | Invention |

TABLE 18-2

| Sample No. | Emulsion No. | Layer thickness μm | Layer swelling T ½ (sec) | Color developer 18-A 210 sec. 33° C. Yellow stain | RMS value | Color developer 18-A 90 sec. 42° C. Yellow stain | RMS value | Color developer 18-B with inhibitor Z-5 90 sec. 42° C. Yellow stain | RMS value | Color developer 18-C with compound (1) of the invention 90 sec. 42° C. Yellow stain | RMS value |
|---|---|---|---|---|---|---|---|---|---|---|---|
| 1 | A | 20 | 12 | 0.02 | 50 | 0.04 | 44 | 0.04 | 44 | 0.04 | 43 |
| 2 | B | 20 | 12 | 0.02 | 47 | 0.04 | 33 | 0.04 | 32 | 0.04 | 30 |
| 3 | C | 20 | 11 | 0.02 | 48 | 0.04 | 30 | 0.04 | 28 | 0.04 | 25 |
| 4 | D | 20 | 12 | 0.02 | 49 | 0.04 | 43 | 0.04 | 43 | 0.04 | 43 |
| 5 | E | 20 | 12 | 0.02 | 49 | 0.04 | 30 | 0.04 | 28 | 0.04 | 25 |
| 6 | F | 20 | 12 | 0.02 | 48 | 0.04 | 28 | 0.04 | 27 | 0.04 | 23 |
| 7 | G | 10 | 11 | 0.02 | 49 | 0.04 | 26 | 0.04 | 25 | 0.04 | 22 |
| 8 | G | 15 | 12 | 0.02 | 48 | 0.04 | 25 | 0.04 | 23 | 0.04 | 22 |
| 9 | G | 20 | 11 | 0.02 | 48 | 0.04 | 26 | 0.04 | 24 | 0.04 | 21 |
| 10 | G | 25 | 12 | 0.02 | 49 | 0.06 | 27 | 0.06 | 25 | 0.05 | 22 |
| 11 | G | 30 | 12 | 0.02 | 48 | 0.11 | 28 | 0.11 | 28 | 0.10 | 25 |
| 12 | G | 20 | 6 | 0.02 | 48 | 0.04 | 24 | 0.04 | 23 | 0.04 | 21 |
| 13 | G | 20 | 16 | 0.02 | 47 | 0.04 | 25 | 0.05 | 23 | 0.04 | 21 |
| 14 | G | 20 | 20 | 0.02 | 48 | 0.06 | 26 | 0.06 | 25 | 0.05 | 22 |
| 15 | G | 20 | 25 | 0.02 | 49 | 0.11 | 28 | 0.11 | 28 | 0.10 | 25 |
| 16 | G | 30 | 11 | 0.02 | 48 | 0.12 | 29 | 0.12 | 29 | 0.11 | 25 |
| 17 | H | 20 | 12 | 0.02 | 48 | 0.04 | 24 | 0.04 | 24 | 0.04 | 21 |
| 18 | I | 20 | 12 | 0.02 | 49 | 0.04 | 25 | 0.04 | 23 | 0.04 | 21 |
| 19 | J | 20 | 12 | 0.02 | 49 | 0.04 | 26 | 0.04 | 25 | 0.04 | 22 |
| 20 | K | 20 | 12 | 0.02 | 50 | 0.04 | 27 | 0.04 | 27 | 0.04 | 24 |
| 21 | L | 20 | 12 | 0.02 | 49 | 0.04 | 25 | 0.04 | 24 | 0.04 | 21 |

TABLE 18-3

| Color developer | Sample No. 18-A B | 18-A G | 18-A R | 18-B B | 18-B G | 18-B R | 18-C B | 18-C G | 18-C R |
|---|---|---|---|---|---|---|---|---|---|
| | LD (density relative to exposure 1.0 attained by treatment with color developer per 18-A for 210 sec. at 33° C. | | | | | | | | |
| 1 | 1.39 | 1.23 | 1.10 | 1.02 | 1.21 | 1.00 | 1.03 | 1.20 | 1.01 |
| 2 | 1.37 | 1.18 | 1.00 | 1.01 | 1.17 | 0.99 | 1.02 | 1.04 | 1.00 |
| 3 | 1.35 | 1.15 | 1.03 | 1.02 | 1.13 | 1.01 | 1.03 | 1.03 | 1.01 |
| 4 | 1.41 | 1.22 | 1.00 | 1.00 | 1.18 | 0.99 | 1.01 | 1.12 | 1.00 |
| 5 | 1.40 | 1.21 | 0.99 | 1.01 | 1.18 | 0.98 | 1.00 | 1.03 | 1.00 |
| 6 | 1.41 | 1.20 | 1.02 | 1.00 | 1.18 | 1.00 | 1.02 | 1.02 | 1.02 |
| 7 | 1.32 | 1.13 | 1.01 | 1.03 | 1.11 | 1.00 | 1.01 | 1.01 | 1.00 |
| 8 | 1.35 | 1.16 | 0.99 | 1.02 | 1.14 | 0.98 | 1.01 | 1.02 | 0.99 |
| 9 | 1.40 | 1.21 | 1.00 | 1.02 | 1.19 | 0.99 | 1.01 | 1.03 | 1.00 |
| 10 | 1.42 | 1.22 | 1.02 | 1.01 | 1.20 | 1.01 | 0.99 | 1.02 | 1.02 |
| 11 | 1.45 | 1.25 | 1.00 | 1.03 | 1.23 | 0.99 | 0.98 | 1.12 | 1.00 |
| 13 | 1.42 | 1.22 | 0.99 | 1.01 | 1.18 | 0.98 | 1.01 | 1.04 | 1.99 |
| 14 | 1.44 | 1.23 | 0.99 | 1.02 | 1.19 | 0.98 | 1.00 | 1.03 | 1.00 |
| 15 | 1.47 | 1.26 | 1.00 | 1.03 | 1.24 | 0.99 | 0.99 | 1.11 | 1.01 |
| 16 | 1.52 | 1.31 | 1.01 | 1.04 | 1.28 | 0.99 | 0.97 | 1.14 | 1.01 |
| 17 | 1.41 | 1.21 | 1.02 | 1.00 | 1.18 | 1.01 | 1.02 | 1.02 | 1.02 |
| 18 | 1.36 | 1.18 | 1.01 | 1.01 | 1.15 | 1.00 | 1.02 | 1.01 | 0.02 |
| 19 | 1.35 | 1.17 | 1.00 | 1.02 | 1.15 | 0.99 | 1.00 | 1.04 | 0.01 |
| 20 | 1.33 | 1.14 | 0.99 | 1.02 | 1.11 | 0.98 | 1.01 | 1.03 | 0.99 |
| 21 | 1.40 | 1.20 | 1.00 | 1.02 | 1.18 | 0.99 | 1.00 | 1.01 | 1.01 |

EXAMPLE 19

Silver halide emulsions in Table 19-1 i.e. emulsions containing spherical silver halide particles were prepared using a conventional double-jet precipitation process.

The following layers were sequentially formed, in this order, on a cellulose triacetate support, in order to prepare the respective multi-layer color photographic light-sensitive material samples.

First layer: Anti-halation layer (HC layer)

An anti-halation layer containing 0.15 g of black colloidal silver, and 1.3 g of gelatin.

Second layer: Subbing layer (IG layer)

A subbing layer containing 1.9 g of gelatin.

Third layer: Red-sensitive silver halide emulsion layer (R layer)

A red-sensitive silver halide emulsion layer containing not only each of the silver halide emulsions listed in Table 19-1 and sensitized to have red-sensitivity, but dispersion prepared by emulsifying and dispersing tricresyl phosphate (hereinafter referred to as TCP) having dissolved 0.2 mol/molAg of the following cyan coupler ($C_{19}$-1), and 0.007 mol/molAg of the following colored cyan coupler ($CC_{19}$-1), as well as methanol having dissolved an inhibitor, into aqueous solution containing gelatin.

Fourth layer: Intermediate layer (2 G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing not only each of the silver halide emulsions listed in Table 19-1 and sensitized to have green-sensitivity, but dispersion prepared by emulsifying and dispersing TCP having dissolved 0.16 mol/molAg of the following magenta coupler ($M_{19}$-1), and 0.016 mol/molAg of the following colored magenta coupler (CM-1), into aqueous solution containing gelatin.

Sixth layer: Yellow filter layer

A yellow filter layer containing 0.3 g yellow colloidal silver, and 0.11 g of DBP having dissolved 0.19 g anti-stain agent (2,5-di-t-octylhydroquinone); as well as 2.1 g of gelatin.

Seventh layer: Low-sensitivity blue-sensitive silver halide emulsion layer (B layer)

A blue-sensitive silver halide emulsion layer containing not only each of the silver halide emulsions listed in Table 19-1 and sensitized to have blue-sensitivity, but dispersion prepared by emulsifying and dispersing TCP having dissolved 0.3 mol/molAg of the following yellow coupler ($Y_{19}$-1), into aqueous solution containing gelatin.

Eight layer: High-sensitivity monodispersed blue-sensitive silver halide emulsion layer (B layer)

A layer similar to the seventh layer, except that slightly larger silver halide particles were used.

Ninth layer: Protective layer (3 G layer)

A protective layer containing 0.9 g of gelatin.

In addition to the above components, each layer was allowed to contain gelatin-hardening agents (1,2-bisvinyl sulphonylethane and sodium 2,4-dichloro-6-hydroxy-s-triadine), surfactant and the like.

The amount of silver applied was 50 mg/100 $cm^2$.

The couplers used in the respective layers were as follows.

Cyan coupler (C-1)

2-(α,α,β,β,γ,γ, δ,δ-octafluohexanamide)-5[2-(2,4-di-t-amylphenoxy)hexaneamide]phenol Colored cyan coupler (CC-19-1)

Disodium 1-hydroxy-4-[4-(1-hydroxy-8acetamide-3,6-disulfo-2-naphthylazo)phenoxy[-N-[δ-(2,4-di-t-amylphenoxy)butyl]-2-naphthamide Magenta coupler (M19-1)

1-(2,4,6-trichlorophenyl)-3-{[α-(2,4-di-t-amylphenoxy)acetamide]benzamido}-3-pyrazolone and 1-(2,4,6-trichlorophenyl)-3-{[α-(2,4-di-t-amylphenoxy)-acetamide]benzamido}-4-(4-methoxyphenylazo)-5-pyrazolone Colored magenta coupler (CM19-1)

1-(2,4,6-trichlorophenyl)-4-(1-naphthylazo)-3-(2-chloro-5-octadecenylsuccinamidanilino)-5-pyrazolone Yellow coupler (Y16-1)

α-[4-(1-benzyl-2-phenyl-3,5-dioxo-1,2,4-triazolydinyl-α-pyvaloyl-2-chloro-5-[γ-(2,4-di-t-amylphenoxy)-butanamido]acetanilide Into the respective third layers i.e. red-sensitive silver halide emulsion layers (R layers) was incorporated TCP dissolving each of the DIR compounds listed in the following Table 19-1. In this course, the amount of a DIR compound was adjusted to 0.02 mol per mol silver halide in each of this type of layers.

Samples 1 through 19 were prepared respectively using the above specified compositions specified in Table 19-1 as the composition of silver halide, and varying the amounts of application in the third, fifth, sixth and seventh layers, varying the amount of gelatin-hardening agent in the eighth layer. Next, the layer thicknesses, as well as layer swelling rates $T_{\frac{1}{2}}$, were measured. Table 19-1 lists the measurement results.

Each sample was exposed with green light, red light or green/red light (16 CMS) through an optical wedge, thereby treated with the following treatment steps, so as to form a dye image.

| Treatment | | |
|---|---|---|
| Color developing | Time and temperature specified in Table 19-2 | |
| Bleaching | 4 min. | (38° C.) |
| Fixing | 3 min | (30 to 38° C.) |
| Washing | 1 min | (20 to 33° C.) |
| Stabilizing | 1 min | (20 to 33° C.) |
| Drying | | |

The compositions of processing solutions used in the respective processing steps are as follows.

| (Color developer) | |
|---|---|
| Sulfate of the previously mentioned example compound (E-2) | Amount listed in Table 19-1 |
| Sodium sulfite anhydride | 2.00 g |
| Hydroxylamine.½ sulfate | 2.4 g |
| Potassium carbonate anhydride | 30.0 g |
| Sodium bromide | 1.1 g |
| Trisodium nitrilotriacetate (monohydride) | 2.5 g |
| Potassium hydroxide | 1.0 g |
| Inhibitor (Z-2) | 0.5 g |

Water was added to the above components to prepare one liter solution, which was adjusted to pH=10.1 using 50% KOH and 50% $H_2SO_4$.

| (Bleacher) | |
|---|---|
| Ferric ammonium ethylenediamine tetraacetate | 200 g |
| Ammonium bromide | 150.0 g |
| Glacial acetic acid | 10.0 ml |

Water was added to the above components to prepare one liter solution, which was adjusted to pH=6.0 using aqueous ammonium.

| (Fixer) | |
|---|---|
| Ammonium thiosulfate | 170 g |
| Sodium sulfite anhydride | 8.5 g |
| Sodium metabisulfite | 2.3 g |

Water was added to the above components to prepare one liter solution, which was adjusted to pH=7.0 using acetic acid.

| (Stabilizer) | |
|---|---|
| Formalin (37% aqueous solution) | 1.5 ml |
| Konidax (manufactured by Konishiroku Photo Ind. Co., Ltd.) | 7.5 ml |

Water was added to the above components to prepare one liter solution.

Magenta dye graininess values (RMS values) obtained are listed in Table 19-2.

After allowed to stand for 24 hours at a room temperature, some samples were developed in compliance with the treatment process specified above, with addition of 350 ml of color developer to the above-specified bleacher. After this treatment, each sample was examined to determine yellow stain increase ratio on the non-exposure portion of the sample. Table 19-3 lists the measurement results.

Each sample exposed with green light was examined for the minimum magenta density within the day of treatment. Measurement results are listed in Table 19-4.

RMS values indicating graininess are obtained by multiplying 1000 times standard deviations in fluctuation of density values available when scanning an area of minimum density +1.2 by using a micro densitometer having an aperture scanning area of 250 $\mu m^2$.

TABLE 19-1

| Light sensitive material sample No. | Silver halide (%) AgI | AgBr | AgCl | Layer thickness μm | Amount of (E-2) added into color developer ($\times 10^{-2}$ mol/l) | DIR compound |
|---|---|---|---|---|---|---|
| 1 | — | 100 | — | 20 | 2 | (D'-17) |
| 2 | — | 90 | 10 | 20 | 2 | (D'-17) |
| 3 | 0.2 | 90 | 9.8 | 20 | 2 | (D'-17) |
| 4 | 0.5 | 99.5 | — | 30 | 1 | (D'-17) |
| 5 | 0.5 | 99.5 | — | 20 | 2 | No addition |
| 6 | 0.5 | 99.5 | — | 30 | 1 | No addition |
| 7 | 5.0 | 95 | — | 30 | 1 | (D'-17) |
| 8 | 5.0 | 95 | — | 20 | 1 | (D'-17) |
| 9 | 5.0 | 95 | — | 30 | 2 | (D'-17) |
| 10 | 5.0 | 95 | — | 20 | 2 | No addition |
| 11 | 5.0 | 95 | — | 20 | 2 | No addition |
| 12 | 5.0 | 95 | — | 20 | 2 | (D'-17) |
| 13 | 5.0 | 95 | — | 20 | 2 | (D'-19) |
| 14 | 5.0 | 95 | — | 20 | 2 | (D'-21) |
| 15 | 5.0 | 95 | — | 20 | 2 | (D'-27) |
| 16 | 5.0 | 95 | — | 20 | 2 | (D'-17) |
| 17 | 5.0 | 95 | — | 20 | 2 | (D'-17) |
| 18 | 5.0 | 95 | — | 14 | 2 | (D'-17) |
| 19 | 5.0 | 95 | — | 25 | 2 | (D'-17) |

TABLE 19-2

| | | Graininess RMS value | | | | | |
|---|---|---|---|---|---|---|---|
| Color developing time (sec.) | | 210 | 180 | 150 | 120 | 90 | 60 |
| Color developing temperature (°C.) | | 33 | 35 | 37.5 | 40 | 42 | 48 |
| Light-sensitive material sample No. | 1 | 51 | 50 | 47 | 44 | 44 | 42 |
| | 2 | 51 | 48 | 48 | 47 | 47 | 46 |
| | 3 | 47 | 46 | 46 | 47 | 47 | 45 |
| | 4 | 48 | 46 | 43 | 32 | 32 | 31 |
| | 5 | 45 | 40 | 36 | 36 | 34 | 34 |
| | 6 | 44 | 41 | 37 | 35 | 34 | 33 |
| | 7 | 47 | 47 | 44 | 38 | 35 | 33 |
| | 8 | 50 | 46 | 43 | 36 | 34 | 33 |
| | 9 | 48 | 46 | 44 | 38 | 33 | 32 |
| | 10 | 46 | 43 | 40 | 38 | 36 | 33 |
| | 11 | 46 | 41 | 38 | 36 | 33 | 31 |
| | 12 | 44 | 37 | 31 | 29 | 26 | 23 |
| | 13 | 44 | 32 | 30 | 28 | 25 | 23 |
| | 14 | 43 | 33 | 31 | 28 | 24 | 23 |
| | 15 | 44 | 32 | 29 | 27 | 26 | 24 |
| | 16 | 43 | 31 | 29 | 27 | 26 | 24 |
| | 17 | 44 | 32 | 31 | 28 | 25 | 22 |
| | 18 | 44 | 33 | 30 | 28 | 24 | 22 |
| | 19 | 43 | 32 | 31 | 28 | 26 | 24 |

Graininess; Smaller RMS values are more advantageous.
Values enclosed in heavy lines correspond with preferred embodiments of the invention.

TABLE 19-3

| | | Rate of yellow stain increase | | | | | |
|---|---|---|---|---|---|---|---|
| Color developing time (sec.) | | 210 | 180 | 150 | 120 | 90 | 60 |
| Color developing temperature (°C.) | | 33 | 35 | 37.5 | 40 | 42 | 48 |
| Light-sensitive material sample No. | 1 | 0.02 | 0.02 | 0.02 | 0.03 | 0.03 | 0.04 |
| | 2 | 0.02 | 0.02 | 0.02 | 0.03 | 0.04 | 0.05 |
| | 3 | 0.02 | 0.03 | 0.03 | 0.04 | 0.04 | 0.05 |
| | 4 | 0.04 | 0.04 | 0.05 | 0.05 | 0.06 | 0.06 |
| | 5 | 0.05 | 0.07 | 0.09 | 0.10 | 0.12 | 0.13 |
| | 6 | 0.03 | 0.04 | 0.04 | 0.05 | 0.06 | 0.09 |

TABLE 19-3-continued

| | Rate of yellow stain increase | | | | | |
|---|---|---|---|---|---|---|
| 7 | 0.02 | 0.03 | 0.05 | 0.06 | 0.07 | 0.07 |
| 8 | 0.02 | 0.03 | 0.03 | 0.04 | 0.04 | 0.04 |
| 9 | 0.03 | 0.05 | 0.06 | 0.07 | 0.08 | 0.09 |
| 10 | 0.05 | 0.06 | 0.07 | 0.08 | 0.11 | 0.12 |
| 11 | 0.04 | 0.06 | 0.08 | 0.09 | 0.10 | 0.11 |
| 12 | 0.02 | 0.02 | 0.02 | 0.03 | 0.03 | 0.04 |
| 13 | 0.02 | 0.02 | 0.02 | 0.02 | 0.03 | 0.03 |
| 14 | 0.02 | 0.02 | 0.02 | 0.03 | 0.03 | 0.03 |
| 15 | 0.02 | 0.02 | 0.02 | 0.02 | 0.03 | 0.04 |
| 16 | 0.02 | 0.02 | 0.02 | 0.02 | 0.03 | 0.03 |
| 17 | 0.02 | 0.02 | 0.02 | 0.02 | 0.03 | 0.04 |
| 18 | 0.02 | 0.02 | 0.02 | 0.02 | 0.03 | 0.03 |
| 19 | 0.02 | 0.02 | 0.02 | 0.03 | 0.03 | 0.03 |

Smaller yellow stain values are more advantageous.
Value enclosed in heavy lines correspond with preferred embodiment of the invention

TABLE 19-4

| | | Minimum magenta density | | | | | |
|---|---|---|---|---|---|---|---|
| Color developing time (sec.) | | 210 | 180 | 150 | 120 | 90 | 60 |
| Color developing temperature (°C.) | | 33 | 35 | 37.5 | 40 | 42 | 48 |
| Light-sensitive material sample No. | 1 | 0.54 | 0.59 | 0.63 | 0.65 | 0.68 | 0.70 |
| | 2 | 0.55 | 0.62 | 0.64 | 0.70 | 0.71 | 0.73 |
| | 3 | 0.54 | 0.61 | 0.64 | 0.65 | 0.68 | 0.69 |
| | 4 | 0.52 | 0.53 | 0.53 | 0.55 | 0.55 | 0.56 |
| | 5 | 0.54 | 0.62 | 0.65 | 0.74 | 0.76 | 0.81 |
| | 6 | 0.54 | 0.56 | 0.60 | 0.62 | 0.65 | 0.70 |
| | 7 | 0.53 | 0.54 | 0.54 | 0.55 | 0.55 | 0.56 |
| | 8 | 0.53 | 0.54 | 0.54 | 0.55 | 0.56 | 0.57 |
| | 9 | 0.53 | 0.53 | 0.53 | 0.54 | 0.55 | 0.56 |
| | 10 | 0.54 | 0.61 | 0.64 | 0.68 | 0.72 | 0.76 |
| | 11 | 0.56 | 0.57 | 0.59 | 0.63 | 0.66 | 0.72 |
| | 12 | 0.52 | 0.52 | 0.53 | 0.53 | 0.54 | 0.54 |
| | 13 | 0.52 | 0.53 | 0.53 | 0.53 | 0.54 | 0.55 |
| | 14 | 0.52 | 0.52 | 0.53 | 0.53 | 0.54 | 0.54 |
| | 15 | 0.53 | 0.53 | 0.53 | 0.53 | 0.54 | 0.55 |
| | 16 | 0.53 | 0.53 | 0.53 | 0.54 | 0.54 | 0.55 |
| | 17 | 0.52 | 0.52 | 0.53 | 0.54 | 0.55 | 0.55 |
| | 18 | 0.52 | 0.52 | 0.53 | 0.54 | 0.54 | 0.54 |
| | 19 | 0.52 | 0.53 | 0.53 | 0.53 | 0.54 | 0.54 |

Smaller magenta minimum density values are more advantageous.
Values enclosed in heavy lines correspond with preferred embodiment of the invention.

As apparent from Tables 19-2 and 19-3, the invention achieves satisfactory results in terms of both graininess and yellow stain.

Moreover, as is demonstrated in Table 19-4, the invention solves the problem of for in a magenta layer. More specifically, the minimum magenta densities of the samples according to the invention are smaller 0.54, while those of most samples otherwise treated are larger than 0.54.

Accordingly, remarkable improvement is attained in yellow stain and magenta fog density on non-exposure portion both of which are contributable to bleacher, by employing silver halide with a proper iodine content, a proper layer thickness of a light-sensitive materials, color developing agent with a proper concentration and a proper DIR compounds, as well as the suitable bleacher.

EXAMPLE 20

Silver halide emulsions in Table 20-1 i.e. emulsion containing spherical silver halide particles were prepared using a conventional double-jet precipitation process.

The following layers were sequentially formed, in this order, on a cellulose triacetate support, to prepare the respective multi-layer color photographic light-sensitive material samples.

First layer: Anti-halation layer (HC layer)

An anti-halation layer containing 0.15 g of black colloidal silver, and 1.3 g of gelatin.

Second layer: Subbing layer (IG layer)

A subbing layer containing 1.9 g of gelatin.

Third layer: Red-sensitive silver halide emulsion lkayer (R layer).

A red-sensitive silver halide emulsion layer containing not only the respective silver halide emulsion listed in Table 20-1 and sensitized to have red-sensitivity, but dispersion prepared by emulsifying and dispersing tricresyl phosphate (hereinafter referred to as TCP) having dissolved 0.2 mol/molAg of each of example cyan dye forming coupler or comparative cyan coupler listed in Table 20-1, and 0.007 mol/molAg of the following colored cyan coupler (CC20-1), as well as methanol having dissolved an inhibitor, into aqueous solution containing gelatin.

Fourth layer: Intermediate layer (2 G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing the respective silver halide emulsion listed in Table 20-1 and sensitized to have green-sensitivity, and dispersion prepared by emulsifying and dispersing TCP having dissolved 0.14 mol/molAg of the following magenta coupler (M20-1) and 0.015 mol/molAg of the following colored magenta coupler (CM20-1), into aqueous solution containing gelatin.

Sixth layer: Yellow filter layer

A yellow filter layer containing 0.3 g of yellow colloidal silver, and 0.11 g of DBP dissolving 0.18 g of anti-stain agent (2,5-di-t-octylhydroquinone); as well as 2.0 g of gelatin.

Seventh layer: Low-sensitivity blue-sensitive silver halide emulsion layer (B layer)

A blue-sensitive silver halide emulsion layer containing the respective silver halide emulsion listed in Table 20-1 and sensitized to have blue-sensitivity, and dispersion prepared by emulsifying and dispersing TCP having dissolved 0.31 mol/molAg of the following yellow coupler (Y20-1), into aqueous solution containing gelatin.

Eighth layer: High-sensitivity blue-sensitive silver halide emulsion layer (B layer)

A layer similar to the seventh layer, except that slightly larger silver halide particles were used.

Ninth layer: Protective layer (3 G layer)

A protective layer containing 0.85 g of gelatin.

In addition to the above components, each layer was allowed to contain gelatin-hardening agent (1,2-bisvinylsulphonylethane and sodium 2,4-dichloro-6-hydroxy-s-triadine), surfactant and the like.

The amount of silver applied was 50 mg/100 $cm^2$.

The couplers used in the respective layers were as follows.

Comparative coupler (20-1)

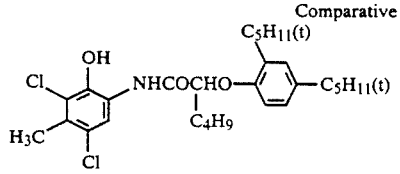

Comparative coupler (20-2)

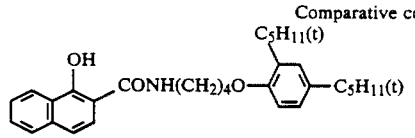

Colored cyan coupler (CC26-1)

Disodium 1-hydroxy-4-[4-(1-hydroxy-8-acetamide-3,6-disulfo-2-naphthylazo)phenoxy]-N-[δ-(2,4-di-t-amylphenoxy)butyl]-2-naphthamide Magenta coupler (M20-1)

1-(2,4,6-trichlorophenyl)-3-{[α-(2,4-di-t-amylphenoxy)-acetamide]benzamido}-3-pyrazolone and 1-(2,4,6-trichlorophenyl)-3-{[α-(2,4-di-t-amylphenoxy)-acetamido]benzamido}-4-(4-methoxyphenylazo)-5-pyrazolone Colored magenta coupler (CM20-1)

1-(2,4,6-trichlorophenyl)-4-(1-naphthylazo)-3-(2-chloro-5-octadecenylsuccinimidanilino)-5-pyrazolone Yellow coupler (Y20-1)

α-[4-(1-benzyl-2-phenyl-3,5-dioxo-1,2,4-triazolydinyl]-α-pyvaloyl-2-chloro-5-[γ-(2,4-di-t-amylphenoxy)-butanamido] acetanilide Samples 20-1 through 20-19 were prepared respectively using the above specified compositions specified in Table 20-1 as the composition of silver halide, and varying the amounts of application in the third, fifth, seventh and eighth layers, varying the amount of gelatin-hardening agent in the ninth layer. Next, the layer thickness of each sample was measured. Table 20-1 lists the measurement results.

Each sample was exposed with light (16 CMS) through an optical wedge, thereby treated with the following treatment steps, so as to form a dye image.

| Treatment | | |
|---|---|---|
| Color developing | Time and temperature specified in Table 20-1 | |
| Bleaching | 4 min | (38° C.) |
| Fixing | 3 min | (30 to 38° C.) |
| Washing | 1 min | (20 to 33° C.) |
| Stabilizing | 1 min | (20 to 33° C.) |
| Drying | | |

The compositions of processing solutions used in the respective processing steps are as follows.

| (Color developer) | |
|---|---|
| Sulfate of the previously mentioned example compound (E-2) Specified in Table 20-1 | |

-continued

| (Color developer) | |
|---|---|
| Sodium sulfite anhydride | 3.5 g |
| Hydroxylamine.½ sulfate | 1.8 g |
| Potassium carbonate anhydride | 30.0 g |
| Sodium bromide | 1.3 g |
| Trisodium nitrilotriacetate (monohydride) | 2.0 g |
| Potassium hydroxide | 1.0 g |
| Inhibitor (Z-2) | 0.5 g |

Water was added to the above components to prepare one liter solution, which was adjusted to pH=10.0 using 50% KOH and $H_2SO_4$.

| (Bleacher) | |
|---|---|
| Ferric ammonium ethylenediamine tetraacetate | 140 g |
| Ammonium bromide | 150.0 g |
| Glacial acetic acid | 10.0 ml |

Water was added to the above components to prepare one liter solution, which was adjusted to pH=6.0 using aqueous ammonium.

| (Fixer) | |
|---|---|
| Ammonium thiosulfate | 180 g |
| Sodium sulfite anhydride | 8.5 g |
| Sodium bisulfite | 2.3 g |

Water was added to the above components to prepare one liter solution, which was adjusted to pH=7.0 using acetic acid.

| (Stabilizer) | |
|---|---|
| Formalin (37% aqueous solution) | 1.5 ml |
| Konidax (manufactured by Konishiroku Photo Ind. Co., Ltd.) | 7.5 ml |

Water was added to the above components to prepare one liter solution.

Graininess (RMS) of obtained cyan dye images is listed in Table 20-2.

RMS values representing graininess are values obtained by multiplying 1000 times standard deviations in fluctuation of density values available when scanning an area of minimum density +1.2 by using a micro densitometer having an aperture scanning area of 250 $\mu m^2$.

Immediately after the above process, each sample was examined for the minimum density on the non-exposure portion, using blue light of an optical densitometer (Model PDA-65A, Konishiroku Photo Ind. C., Ltd.). Each sample was allowed to stand for one week under the conditions of 40° C. and 60 RH %, and then similarly examined, thereby the density increase due to storage was measured in order to determine the yellow stain increase ratio. Table 20-3 lists the measurement results.

Similarly, each sample exposed with red light was examined for minimum cyan density, in a same day. Table 20-4 lists the measurement results.

TABLE 20-1

| Light-sensitive material sample No. | Silver halide (%) AgI | AgBr | AgCl | Layer thickness μm | Amount of added (E-2) in color developer (× $10^{-2}$ mol/l) | Cyan coupler |
|---|---|---|---|---|---|---|
| 20-1 | — | 100 | — | 20 | 2 | (C-26) |
| 20-2 | — | 90 | 10 | 20 | 2 | (C-26) |
| 20-3 | 0.2 | 90 | 9.8 | 20 | 2 | (C-26) |
| 20-4 | 0.5 | 99.5 | — | 30 | 1 | (C-26) |
| 20-5 | 0.5 | 99.5 | — | 20 | 2 | Comparative coupler (20-1) |
| 20-6 | 0.5 | 99.5 | — | 30 | 1 | Comparative coupler (20-1) |
| 20-7 | 5.0 | 95 | — | 30 | 1 | (C-26) |
| 20-8 | 5.0 | 95 | — | 20 | 1 | (C-26) |
| 20-9 | 5.0 | 95 | — | 30 | 2 | (C-26) |
| 20-10 | 5.0 | 95 | — | 20 | 2 | Comparative coupler (20-2) |
| 20-11 | 5.0 | 95 | — | 20 | 2 | Comparative coupler (20-2) |
| 20-12 | 5.0 | 95 | — | 20 | 2 | (C-2) |
| 20-13 | 5.0 | 95 | — | 20 | 2 | (C-27) |
| 20-14 | 5.0 | 95 | — | 20 | 2 | (C-32) |
| 20-15 | 5.0 | 95 | — | 20 | 2 | (C-36) |
| 20-16 | 5.0 | 95 | — | 20 | 2 | (C-26) |
| 20-17 | 5.0 | 95 | — | 20 | 2 | (C-26) |
| 20-18 | 5.0 | 95 | — | 14 | 2 | (C-26) |
| 20-19 | 5.0 | 95 | — | 25 | 2 | (C-26) |

TABLE 20-2

| | | Graininess RMS values | | | | | |
|---|---|---|---|---|---|---|---|
| Color developing time (sec) | | 210 | 180 | 150 | 120 | 90 | 60 |
| Color developer temperature (°C.) | | 33 | 35 | 37.5 | 40 | 42 | 48 |
| Light-sensitive material sample No. | 20-1 | 54 | 52 | 50 | 48 | 48 | 45 |
| | 20-2 | 54 | 52 | 51 | 48 | 47 | 46 |
| | 20-3 | 50 | 48 | 47 | 46 | 47 | 46 |
| | 20-4 | 48 | 45 | 43 | 39 | 36 | 32 |
| | 20-5 | 48 | 43 | 40 | 38 | 36 | 35 |
| | 20-6 | 47 | 39 | 36 | 34 | 32 | 32 |
| | 20-7 | 48 | 48 | 46 | 38 | 35 | 34 |
| | 20-8 | 51 | 49 | 45 | 38 | 36 | 34 |
| | 20-9 | 50 | 46 | 44 | 34 | 32 | 30 |
| | 20-10 | 45 | 39 | 33 | 31 | 28 | 26 |
| | 20-11 | 46 | 36 | 33 | 32 | 28 | 26 |
| | 20-12 | 46 | 35 | 33 | 31 | 28 | 26 |
| | 20-13 | 45 | 35 | 32 | 29 | 28 | 25 |
| | 20-14 | 45 | 35 | 33 | 30 | 28 | 25 |
| | 20-15 | 44 | 36 | 34 | 29 | 27 | 25 |
| | 20-16 | 47 | 35 | 31 | 30 | 27 | 25 |
| | 20-17 | 44 | 34 | 32 | 29 | 28 | 26 |
| | 20-18 | 45 | 35 | 31 | 28 | 26 | 25 |
| | 20-19 | 47 | 36 | 32 | 29 | 28 | 26 |

Graininess: Smaller RMS values are more advantageous.
Value enclosed in heavy lines correspond with preferred embodiments of the invention.

TABLE 20-3

| | Degree of increase in yellow stain | | | | | |
|---|---|---|---|---|---|---|
| | Color developing time (sec) | | | | | |
| | 210 | 180 | 150 | 120 | 90 | 60 |
| Light-sensitive material sample No. | Color developer temperature (°C.) | | | | | |
| | 33 | 35 | 37.5 | 40 | 42 | 48 |
| 20-1 | 0.02 | 0.02 | 0.02 | 0.03 | 0.03 | 0.04 |
| 20-2 | 0.02 | 0.02 | 0.02 | 0.03 | 0.04 | 0.04 |
| 20-3 | 0.02 | 0.03 | 0.03 | 0.04 | 0.04 | 0.05 |
| 20-4 | 0.03 | 0.06 | 0.08 | 0.10 | 0.11 | 0.12 |
| 20-5 | 0.04 | 0.06 | 0.07 | 0.08 | 0.10 | 0.12 |
| 20-6 | 0.03 | 0.04 | 0.04 | 0.05 | 0.06 | 0.08 |
| 20-7 | 0.02 | 0.03 | 0.05 | 0.06 | 0.07 | 0.07 |
| 20-8 | 0.02 | 0.03 | 0.03 | 0.04 | 0.04 | 0.04 |
| 20-9 | 0.03 | 0.05 | 0.06 | 0.07 | 0.08 | 0.10 |
| 20-10 | 0.03 | 0.05 | 0.07 | 0.08 | 0.10 | 0.11 |
| 20-11 | 0.04 | 0.06 | 0.07 | 0.09 | 0.10 | 0.12 |
| 20-12 | 0.02 | 0.02 | 0.02 | 0.03 | 0.03 | 0.03 |
| 20-13 | 0.02 | 0.02 | 0.02 | 0.02 | 0.03 | 0.03 |

TABLE 20-3-continued

| | Degree of increase in yellow stain | | | | | |
|---|---|---|---|---|---|---|
| | Color developing time (sec) | | | | | |
| | 210 | 180 | 150 | 120 | 90 | 60 |
| Light-sensitive material sample No. | Color developer temperature (°C.) | | | | | |
| | 33 | 35 | 37.5 | 40 | 42 | 48 |
| 20-14 | 0.02 | 0.02 | 0.02 | 0.03 | 0.03 | 0.03 |
| 20-15 | 0.02 | 0.02 | 0.02 | 0.02 | 0.03 | 0.04 |
| 20-16 | 0.02 | 0.02 | 0.02 | 0.02 | 0.03 | 0.03 |
| 20-17 | 0.02 | 0.02 | 0.02 | 0.03 | 0.03 | 0.04 |
| 20-18 | 0.02 | 0.02 | 0.02 | 0.02 | 0.03 | 0.03 |
| 20-19 | 0.02 | 0.02 | 0.02 | 0.03 | 0.03 | 0.03 |

Smaller values representing yellow stains are more advantageous.
Values enclosed in heavy lines correspond with preferred embodiments of the invention.

TABLE 20-4

| | Minimum cyan density | | | | | |
|---|---|---|---|---|---|---|
| | Color developing time (sec) | | | | | |
| | 210 | 180 | 150 | 120 | 90 | 60 |
| Light-sensitive material sample No. | Color developer temperature (°C.) | | | | | |
| | 33 | 35 | 37.5 | 40 | 42 | 48 |
| 20-1 | 0.23 | 0.28 | 0.33 | 0.37 | 0.41 | 0.45 |
| 20-2 | 0.23 | 0.28 | 0.33 | 0.37 | 0.46 | 0.46 |
| 20-3 | 0.23 | 0.28 | 0.32 | 0.35 | 0.41 | 0.44 |
| 20-4 | 0.22 | 0.24 | 0.28 | 0.31 | 0.33 | 0.34 |
| 20-5 | 0.22 | 0.24 | 0.25 | 0.27 | 0.30 | 0.32 |
| 20-6 | 0.22 | 0.23 | 0.24 | 0.25 | 0.28 | 0.29 |
| 20-7 | 0.22 | 0.24 | 0.25 | 0.27 | 0.30 | 0.33 |
| 20-8 | 0.22 | 0.25 | 0.26 | 0.27 | 0.30 | 0.32 |
| 20-9 | 0.23 | 0.27 | 0.31 | 0.35 | 0.40 | 0.48 |
| 20-10 | 0.22 | 0.25 | 0.27 | 0.28 | 0.29 | 0.31 |
| 20-11 | 0.22 | 0.25 | 0.26 | 0.28 | 0.30 | 0.33 |
| 20-12 | 0.21 | 0.22 | 0.22 | 0.23 | 0.24 | 0.26 |
| 20-13 | 0.22 | 0.22 | 0.22 | 0.23 | 0.24 | 0.25 |
| 20-14 | 0.23 | 0.23 | 0.23 | 0.23 | 0.24 | 0.25 |
| 20-15 | 0.23 | 0.23 | 0.23 | 0.23 | 0.24 | 0.25 |
| 20-16 | 0.22 | 0.23 | 0.23 | 0.24 | 0.25 | 0.26 |
| 20-17 | 0.22 | 0.22 | 0.23 | 0.23 | 0.24 | 0.25 |
| 20-18 | 0.22 | 0.22 | 0.22 | 0.23 | 0.23 | 0.24 |
| 20-19 | 0.22 | 0.22 | 0.23 | 0.23 | 0.24 | 0.26 |

Smaller values representing minimum cyan densities are more advantageous.
Values enclosed in heavy lines correspond with preferred embodiments of the invention.

As apparent from the results in Tables 20-2 and 20-3, the present invention provides favorable results both in terms of graininess and yellow-stain.

Furthermore, as evidenced by Table 20-4, the present invention also solves the problem of fog in a cyan layer. More specifically, unlike the samples of the invention which respectively feature minimum cyan density of less than 0.26, the similar densities of the most of the other samples are greater than 0.26. This difference clearly demonstrates the effect of the present invention.

Accordingly, when the iodine content in silver halide, dry layer thickness of a light-sensitive material, a concentration of color developing agent, as well as a type of cyan dye forming coupler are independently within the preferred scope of the invention, the object of the invention is successfully achieved, whereby the graininess, yellow-stain due to prolonged storage, as well as the cyan fog in a non-exposure portion are improved.

EXAMPLE 21

Silver iodo-bromide emulsions listed in Table 21-5 were prepared in accordance with the following method. Emulsions A through C were prepared using a conventional double jet precipitation process. Emulsions D through K, respectively core/shell type monodispersed emulsions, were prepared using a functional addition method. Emulsion L, a silver halide emulsion containing tabular particles, was prepared using a double jet precipitation process with pH and pAg being controlled.

Next, using the above emulsions 21-A through 21-L, light-sensitive material Samples Nos. 21-20 through 21-43 respectively having layer thickness listed in Table 21-5 were prepared in compliance with the preparation method for a light-sensitive material in Example 20.

Each sample was tested in a manner identical with Example 20. The obtained data with regards to graininess (RMS value) and yellow-stain are listed in Table 21-6.

TABLE 21-5

| Emulsion No. | Average particle size $\bar{r}$ (μm) | Amount of silver halide included within range of $\bar{r} \pm 20\%$ | Average silver iodide content (%) | Silver iodide content in cores (%) | Silver iodide content in shells (%) | Volume ratio of shells (%) |
|---|---|---|---|---|---|---|
| 21-A | 0.5 | 56 | 0.3 | Emulsion containing spherical silver halide particles | | |
| 21-B | 0.5 | 54 | 0.3 | Emulsion containing spherical silver halide particles | | |
| 21-C | 0.5 | 55 | 6 | Emulsion containing spherical silver halide particles | | |
| 21-D | 0.5 | 84 | 0.3 | 0.4 | 0.2 | 50 |
| 21-E | 0.5 | 82 | 0.5 | 0.7 | 0.3 | 50 |
| 21-F | 0.5 | 85 | 3.0 | 4 | 2 | 50 |
| 21-G | 0.5 | 87 | 6.0 | 9 | 3 | 50 |
| 21-H | 0.5 | 82 | 8.0 | 10 | 6 | 50 |
| 21-I | 0.5 | 78 | 10.0 | 14 | 6 | 50 |
| 21-J | 0.5 | 75 | 30 | 50 | 10 | 50 |
| 21-K | 0.5 | 73 | 50 | 60 | 40 | 50 |
| 21-L | 0.6 | 70 | 6 | Emulsion containing tabular silver halide particles of which particle diameter is ten times as large as particle thickness | | |

TABLE 21-6

| Sample No. | Emulsion No. | Layer thickness μm | Amount of (E-2) added into color developer ($\times 10^{-2}$ mol/l) | Cyan coupler | Color developing agent: 210 sec. 33° C. Yellow-stain | RMS value | Minimum cyan density | 90 sec. 42° C. Yellow-stain | RMS value | Minimum cyan density |
|---|---|---|---|---|---|---|---|---|---|---|
| 21-20 | D | 19 | 2 | Comparative coupler (20-2) | 0.03 | 47 | 0.25 | 0.13 | 36 | 0.39 |
| 21-21 | C | 19 | 2 | Comparative coupler (20-2) | 0.03 | 45 | 0.24 | 0.08 | 31 | 0.42 |
| 21-22 | G | 19 | 2 | Comparative coupler (20-2) | 0.03 | 48 | 0.24 | 0.05 | 29 | 0.44 |
| 21-23 | L* | 19 | 2 | Comparative coupler (20-2) | 0.03 | 49 | 0.23 | 0.09 | 29 | 0.45 |
| 21-24 | D | 30 | 1 | Comparative coupler (20-2) | 0.02 | 50 | 0.22 | 0.11 | 35 | 0.38 |
| 21-25 | C | 30 | 1 | Comparative coupler (20-2) | 0.02 | 50 | 0.23 | 0.11 | 31 | 0.37 |
| 21-26 | G | 30 | 1 | Comparative coupler (20-2) | 0.02 | 48 | 0.24 | 0.13 | 36 | 0.40 |
| 21-27 | L* | 30 | 1 | Comparative coupler (20-2) | 0.02 | 51 | 0.23 | 0.12 | 30 | 0.38 |
| 21-28 | D | 30 | 1 | (C-38) | 0.02 | 48 | 0.22 | 0.10 | 44 | 0.36 |
| 21-29 | C | 30 | 1 | (C-38) | 0.02 | 46 | 0.23 | 0.08 | 36 | 0.42 |
| 21-30 | G | 30 | 1 | (C-38) | 0.02 | 45 | 0.23 | 0.08 | 32 | 0.43 |
| 21-31 | L* | 30 | 1 | (C-38) | 0.02 | 47 | 0.22 | 0.07 | 30 | 0.39 |
| 21-32 | A | 19 | 2 | (C-38) | 0.02 | 48 | 0.22 | 0.11 | 40 | 0.35 |
| 21-33 | B | 19 | 2 | (C-38) | 0.02 | 45 | 0.23 | 0.03 | 27 | 0.24 |
| 21-34 | C | 19 | 2 | (C-38) | 0.02 | 46 | 0.22 | 0.03 | 27 | 0.23 |
| 21-35 | D | 19 | 2 | (C-38) | 0.02 | 45 | 0.22 | 0.05 | 37 | 0.32 |
| 21-36 | E | 19 | 2 | (C-38) | 0.02 | 46 | 0.23 | 0.03 | 26 | 0.25 |
| 21-37 | F | 19 | 2 | (C-38) | 0.02 | 48 | 0.23 | 0.03 | 25 | 0.24 |
| 21-38 | G | 19 | 2 | (C-38) | 0.02 | 47 | 0.22 | 0.03 | 24 | 0.23 |
| 21-39 | H | 19 | 2 | (C-38) | 0.02 | 46 | 0.23 | 0.04 | 24 | 0.24 |
| 21-40 | I | 19 | 2 | (C-38) | 0.02 | 46 | 0.23 | 0.03 | 23 | 0.24 |

TABLE 21-6-continued

| Sample No. | Emulsion No. | Layer thickness μm | Amount of (E-2) added into color developer ($\times 10^{-2}$ mol/l) | Cyan coupler | Color developing agent: 210 sec. 33° C. Yellow-stain | RMS value | Minimum cyan density | 90 sec. 42° C. Yellow-stain | RMS value | Minimum cyan density |
|---|---|---|---|---|---|---|---|---|---|---|
| 21-41 | J | 19 | 2 | (C-38) | 0.02 | 46 | 0.22 | 0.03 | 25 | 0.24 |
| 21-42 | K | 19 | 2 | (C-38) | 0.02 | 47 | 0.22 | 0.04 | 26 | 0.23 |
| 21-43 | L* | 19 | 2 | (C-38) | 0.02 | 47 | 0.22 | 0.03 | 24 | 0.23 |

*Aspect ratio, 1:5

Data in heavy lines correspond with the preferred embodiments of the invention.

As shown in Table 21-6, the present invention is advantageous in terms of all of the graininess, yellow stain, and minimum cyan density.

EXAMPLE 22

With Example 27, each of the cyan coupler added to sample No. 21-38 was replaced respectively with each of cyan coupler (C-1), (C-5), (C-8), (C-21), (C-26), (C-33), (C-34), (C-35), (C-37) and (C-39), whereby each of the modified samples were tested in a manner same as in Example 21. The results obtained were similar to those in Example 21. When compared to sample No. 21-22, every modified sample No. 21-38 showed excellent result. Based on such a fact, it is apparent that incorporating a cyan coupler of the invention satisfactorily realizes the effect of the invention.

EXAMPLE 23

With Example 20, an amount of example compound (E-2) used as a color developing agent was respectively changed as listed in Table 23-7, whereby each sample was treated with a developing temperature listed in Table 23-7. Other conditions were identical with Example 35. However, samples used i.e. light-sensitive material Nos. 21-22, and 21-38 were identical with those prepared in Example 21. (See Table 21-6.)

In Table 23-7, values enclosed in heavy lines apparently correspond with preferred embodiments of the invention. As can be understood, a concentration of color developing agent, higher than $1.5\times10^{-2}$ mol/liter attains favorable result.

The photographic treatment and test were performed similarly, except that the color developing agent was replaced respectively with each of example compounds (E-1), (E-4), (E-5), (E-7) as well as the following ($D_{23}$-1) and ($D_{23}$-2), whereby the treatment with any of color developing agents of the invention (E-1), (E-4), (E-5) and (E-7) achieved the results similar to those in Table 23-7, while the treatment with ($D_{23}$-1) or ($D_{23}$-2) respectively resulted in minimum cyan density increased by 0.03 to 0.05. Furthermore, test was performed by using each of these color developers individually loaded in an automatic developing unit. As a result, with color developer solution incorporating either ($D_{23}$-1) or ($D_{23}$-2), crystals of either ($D_{23}$-1) or ($D_{23}$-2) deposited on the interior surface of the automatic developing unit. In contrast, virtually no crystal deposition was found in the test using a color developing agent of the invention.

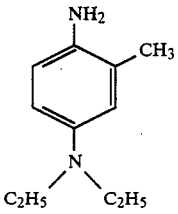

($D_{23}$-1)

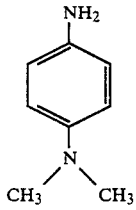

($D_{23}$-2)

TABLE 23-7

| Light-sensitive material No. | Color developing agent (E-2) (mol/l) | Developing temperature (°C.) | RMS value | Minimum cyan density |
|---|---|---|---|---|
| 21-22 | $1.0\times10^{-2}$ | 60 | 36 | 0.39 |
| 21-22 | $1.5\times10^{-2}$ | 50 | 33 | 0.37 |
| 21-22 | $2.0\times10^{-2}$ | 45 | 31 | 0.37 |
| 21-22 | $3.0\times10^{-2}$ | 42 | 31 | 0.37 |
| 21-38 | $1.0\times10^{-2}$ | 60 | 32 | 0.35 |
| 21-38 | $1.5\times10^{-2}$ | 50 | 26 | 0.27 |
| 21-38 | $2.0\times10^{-2}$ | 45 | 22 | 0.25 |
| 21-38 | $3.0\times10^{-2}$ | 42 | 24 | 0.25 |
| 21-38 | $4.0\times10^{-2}$ | 40 | 24 | 0.27 |

Developing time, 60 sec.

EXAMPLE 24

Using emulsion G in Example 21, and in compliance with the preparation method in Example 20, respective samples were prepared by changing the amounts of applied silver as listed below. More specifically, by changing the amounts of silver added in the third, fifth, seventh and eighth layers, the respective samples independently having a specific amount of silver were prepared. Additionally, the layer thicknesses and $T_{\frac{1}{2}}$ were modified as listed in Table 24-8. Using a color developer containing color developer agent (E-2) at a rate of $2.5\times10^{-2}$ mol/liter, each sample was treated for 60 seconds at 45° C., and then, the RMS value and minimum cyan density of each sample were measured. Table 24-8 lists the obtained results. As can be understood from the results in Table 24-8, the preferred amount of silver applied is more than 30 mg/100 cm$^2$, in particular, 35 to 150 mg/100 cm$^2$, and, more specifically, 40 to 100 mg/cm$^2$.

TABLE 24-8

| Layer thickness | Amount of silver applied (mg/100 cm²) | RMS | Minimum cyan density |
|---|---|---|---|
| Layer thickness 19 μm (Compatible to the previously mentioned sample No. 21-22) | 20 | 56 | 0.32 |
| | 30 | 47 | 0.30 |
| | 35 | 41 | 0.30 |
| | 40 | 36 | 0.31 |
| | 80 | 32 | 0.34 |
| | 100 | 32 | 0.36 |
| | 150 | 32 | 0.39 |
| | 200 | 36 | 0.41 |
| Layer thickness, 19 μm (Compatible to the previously mentioned sample No. 21-38) | 20 | 49 | 0.23 |
| | 30 | 32 | 0.23 |
| | 35 | 28 | 0.23 |
| | 40 | 26 | 0.23 |
| | 80 | 24 | 0.23 |
| | 100 | 25 | 0.25 |
| | 150 | 25 | 0.26 |
| | 200 | 27 | 0.29 |

EXAMPLE 25

With light-sensitive material sample No. 21-38 in Example 21, and using a color developer in Example 20 with an inhibitor added, the RMS value and minimum cyan density were measured in a manner identical with the preceeding example. More specifically, with color developing agent of which concentration being $2.0\times10^{-2}$ mol/liter, and a developing temperature of 50° C. and a developing time of 60 seconds, the following modified samples were treated. The following modified samples were prepared in a manner identical with light-sensitive material sample Nos. 21-22 through No. 21-38, in Example 20, except in that inhibitors (Z-2) was replaced with the respective inhibitors listed in Table 25-9. It is apparent from the results in Table 25-9 that the addition of an organic inhibitor of the invention is more effective.

TABLE 25-9

| Light-sensitive material No. | Inhibitor Compound | Inhibitor Amount added | RMS value | Minimum cyan density |
|---|---|---|---|---|
| 21-22 | No addition | — | 39 | 0.40 |
| | (Z-1) | 10 (mg/l) | 35 | 0.32 |
| | (Z-4) | 30 (mg/l) | 37 | 0.33 |
| | (Z-12) | 10 (mg/l) | 39 | 0.34 |
| 21-38 | No addition | — | 33 | 0.28 |
| | (Z-1) | 10 (mg/l) | 26 | 0.24 |
| | (Z-9) | 10 (mg/l) | 27 | 0.25 |
| | (Z-13) | 2.0 (g/l) | 26 | 0.25 |
| | (Z-6) | 2.0 (g/l) | 24 | 0.23 |
| | (Z-14) | 3.0 (g/l) | 27 | 0.24 |
| | (Z-4) | 30 (mg/l) | 27 | 0.24 |
| | (Z-8) | 20 (mg/l) | 27 | 0.25 |
| | (Z-5) | 400 (mg/l) | 26 | 0.24 |
| | (Z-7) | 100 (mg/l) | 27 | 0.25 |
| | (Z-10) | 2000 (mg/l) | 26 | 0.24 |
| | (Z-3) | 50 (mg/l) | 28 | 0.24 |
| | (Z-11) | 10 (mg/l) | 25 | 0.23 |
| | (Z-12) | 10 (mg/l) | 24 | 0.23 |
| | (Z-15) | 500 (mg/l) | 24 | 0.23 |

EXAMPLE 26

Silver halide emulsions in Table 26-1 were prepared as an emulsion containing spherical silver halide particles, using a conventional double-jet precipitation process.

The following layers were sequentially formed, in this order, on a cellulose triacetate support, to prepare the respective multi-layer color photographic light-sensitive material samples.

First layer: Anti-halation layer (HC layer)

An anti-halation layer containing 0.15 g of black colloidal silver, and 1.4 g of gelatin.

Second layer: Subbing layer (IG layer)

A subbing layer containing 1.9 g of gelatin.

Third layer: Red-sensitive silver halide emulsion layer (R layer).

A red-sensitive silver halide emulsion layer containing not only the respective silver halide emulsion listed in Table 26-1 and sensitized to have red-sensitivity, but dispersion prepared by emulsifying and dispersing tricresyl phosphate (hereinafter referred to as TCP) having dissolved 0.2 mole/moleAg of the following cyan coupler (C26-1) and 0.007 mole/moleAg of the following colored cyan coupler (CC26-10), but methanol having dissolved an inhibitor, into aqueous solution containing gelatin.

Fourth layer: Intermediate layer (2G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing the respective silver halide emulsion listed in Table 26-1 and sensitized to have green-sensitivity, and dispersion prepared by emulsifying and dispersing TCP having dissolved 0.14 mole/moleAg of respective example magenta coupler or comparative magenta coupler each listed in Table 26-1, and 0.015 mole/moleAg of the following colored magenta coupler (CM26-1), into aqueous solution containing gelatin.

Sixth layer: Yellow filter layer

A yellow filter layer containing 0.3 g of yellow colloidal silver, and 0.11 g of DBP having dissolved 0.22 g of antistain agent (2,5-di-t-octylhydroquinone); as well as 2.1 g of gelatin.

Seventh layer: Low-sensitivity blue-sensitive silver halide emulsion layer (B layer)

A blue-sensitive silver halide emulsion layer containing the respective silver halide emulsion listed in Table 26-1 and sensitized to have blue-sensitivity, and dispersion prepared by emulsifying and dispersing as well as TCP having dissolved 0.30 mole/moleAg of the following yellow coupler (Y26-1), into aqueous solution containing gelatin.

Eighth layer: High-sensitivity blue-sensitive silver halide emulsion layer (B layer)

A layer similar to the seventh layer, except that slightly larger silver halide particles were used.

Ninth layer: Protective layer (3G layer)

A protective layer containing 0.9 g of gelatin

In addition to the above components, each layer was allowed to contain gelatin-hardening agent (1,2-bisvinylsulphonylethane and sodium 2,4-dichloro-6-hydroxy-s-triadine), surfactant and the like.

The amount of silver applied was 52 mg/100 cm².

The couplers used in the respective layers were as follows.

Cyan coupler (C26-1)

2-(α,α,β,β,γ,γ,δ,δ-octafluorohexanamide)-5-[2-(2,4-di-t-amylphenoxy)hexaneamide]phenol Colored cyan coupler (CC26-1)

Disodum 1-hydroxy-4-[e-(1-hydroxy-8-acetamide-3,6-disulfo-2-naphthylazo)phenoxy]-N-[δ-(2,4-di-t-amylphenoxy)butyl]-2-naphthamide Magenta coupler Comparative coupler (26-1)

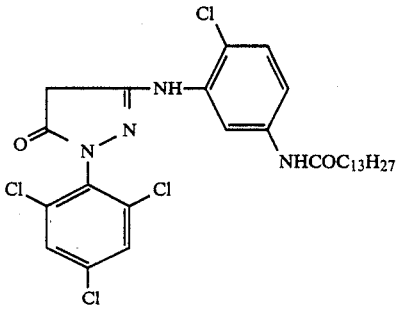

Comparative coupler (26-2)

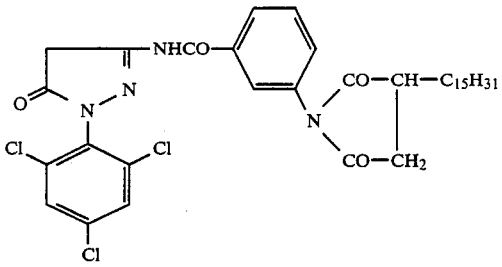

Colored magenta coupler (CM26-1)

1-(2,4,6-trichlorophenyl)-4-(1-naphthylazo)-3-(2-chloro-5-octadecenylsuccinimidanilino)-5-pyrazolone Yellow coupler (Y26-1)

α-[4-(1-benzyl-2-phenyl-3,5-dioxo-1,2,4-triazolydinyl-pyvaloyl-2-chloro-5-[γ-(2,4-di-t-amylphenoxy)-butanamide]acetanilide Samples Nos. 26-1 through 26-19 were prepared using the above specified compositions, and varying the amounts of application if the third, fifth, seventh and eighth layers, and varying the amount of gelatin-hardening agent in the ninth layer. Next, the layer thicknesses were measured. Table 26-1 lists the measurement results.

Each sample was exposed with light (16 CMS) through an optical wedge, thereby treated with the following treatment steps, so as to form a dye image.

| Treatment | |
|---|---|
| Color developing | Time and temperature specified in Table 26-2 |
| Bleaching | 4 min (38° C.) |
| Fixing | 3 min (30 to 38° C.) |
| Washing | 1 min (20 to 33° C.) |
| Stabilizing | 1 min (20 to 33° C.) |
| Drying | |

The compositions of processing solutions used in the respective processing steps are as follows.

| (Color developer) | |
|---|---|
| Sulfate of the previously mentioned example compound (E-2) Specified in Table 26-1 | |
| Sodium sulfite anhydride | 4.0 g |
| Hydroxylamine.½sulfate | 2.4 g |
| Potassium bromide anhydride | 30.0 g |
| Sodium bromide | 1.3 g |
| Trisodium nitrilotriacetate (monohydride) | 2.5 g |
| Potassium hydroxide | 1.0 g |
| Inhibitor (Z-2) | 0.5 g |

Water was added to the above components to prepare one liter solution, which was adjusted to pH=10.0 using KOH and 50% $H_2SO_4$.

| (Bleacher) | |
|---|---|
| Ferric ammonium ethylenediamine tetraacetate | 160.0 g |
| Ammonium bromide | 150.0 g |
| Glacial acetic acid | 10.0 ml |

Water was added to the above components to prepare one liter solution, which was adjusted to pH=6.0 using aqueous ammonium.

| (Fixer) | |
|---|---|
| Ammonium thiosulfate | 175.0 g |
| Sodium sulfite anhydride | 8.5 g |

Water was added to the above components to prepare one liter solution, which was adjusted to pH=6.0 using acetic acid.

| (Stabilizer) | |
|---|---|
| Formalin (37% aqueous solution) | 1.5 ml |
| Konidax (manufactured by Konica Corporation) | 7.5 ml |

Water was added to the above components to prepare one liter solution.

Graininess (RMS) of obtained magenta dye images is listed in Table 26-2.

Immediately after the above process, each sample was examined for the minimum density on the non-exposure portion, using blue light of an optical densitometer (Model PDA-65A, Konishiroku Photo. Ind. Co., Ltd.). Each sample was allowed to stand for one week under the conditions of 60° C. and 60 RH %, and then similarly examined, thereby the density increase due to storage was measured in order to determine the yellow stain increase ratio. Table 26-3 lists the measurement results.

Similarly, each sample exposed with green light was examined for minimum magenta density, in a same day. Table 26-4 lists the measurement results.

RMS values representing graininess are values obtained by multiplying 1000 times standard deviations in fluctuation of density values available when scanning an area of minimum density +1.0 by using a micro densitometer having an aperture scanning area of 250 $\mu m^2$.

TABLE 26-1

| Light-sensitive material Sample No. | Silver halide (%) AgI | AgBr | AgCl | Layer thickness μm | Amount of added (E-2) in color developer ($\times 10^{-2}$mol/l) | Magenta coupler |
|---|---|---|---|---|---|---|
| 26-1 | — | 100 | — | 20 | 2 | (M-61) |
| 26-2 | — | 90 | 10 | 20 | 2 | (M-61) |
| 26-3 | 0.2 | 90 | 9.8 | 20 | 2 | (M-61) |
| 26-4 | 0.5 | 99.5 | — | 30 | 1 | (M-61) |
| 26-5 | 0.5 | 99.5 | — | 20 | 2 | Comparative coupler (26-1) |
| 26-6 | 0.5 | 99.5 | — | 30 | 1 | Comparative coupler (26-1) |
| 26-7 | 5.0 | 95 | — | 30 | 1 | (M-61) |
| 26-8 | 5.0 | 95 | — | 20 | 1 | (M-61) |
| 26-9 | 5.0 | 95 | — | 30 | 2 | (M-61) |
| 26-10 | 5.0 | 95 | — | 20 | 2 | Comparative coupler (26-2) |
| 26-11 | 5.0 | 95 | — | 20 | 2 | Comparative coupler (26-2) |
| 26-12 | 5.0 | 95 | — | 20 | 2 | (M-61) |
| 26-13 | 5.0 | 95 | — | 20 | 2 | (M-1) |
| 26-14 | 5.0 | 95 | — | 20 | 2 | (M-18) |
| 26-15 | 5.0 | 95 | — | 20 | 2 | (M-21) |
| 26-16 | 5.0 | 95 | — | 20 | 2 | (M-61) |
| 26-17 | 5.0 | 95 | — | 20 | 2 | (M-61) |
| 26-18 | 5.0 | 95 | — | 14 | 2 | (M-61) |
| 26-19 | 5.0 | 95 | — | 25 | 2 | (M-61) |

TABLE 26-2

Graininess RMS values

| Light-sensitive material Sample No. | Color developing time (sec) 210 | 180 | 150 | 120 | 90 | 60 |
|---|---|---|---|---|---|---|
| | Color developer temperature (°C.) 33 | 35 | 37.5 | 40 | 42 | 48 |
| 26-1 | 54 | 50 | 48 | 46 | 45 | 45 |
| 26-2 | 54 | 49 | 49 | 47 | 47 | 45 |
| 26-3 | 48 | 47 | 45 | 46 | 46 | 46 |
| 26-4 | 49 | 46 | 43 | 33 | 32 | 31 |
| 26-5 | 45 | 39 | 37 | 35 | 33 | 33 |
| 26-6 | 47 | 39 | 37 | 36 | 32 | 32 |
| 26-7 | 49 | 48 | 44 | 34 | 34 | 32 |
| 26-8 | 51 | 48 | 43 | 33 | 33 | 32 |
| 26-9 | 48 | 45 | 44 | 34 | 32 | 31 |
| 26-10 | 46 | 45 | 31 | 30 | 27 | 28 |
| 26-11 | 45 | 37 | 34 | 33 | 29 | 28 |
| 26-12 | 46 | 37 | 32 | 30 | 27 | 25 |
| 26-13 | 43 | 34 | 32 | 28 | 27 | 25 |
| 26-14 | 45 | 35 | 29 | 28 | 28 | 24 |
| 26-15 | 44 | 34 | 31 | 28 | 27 | 25 |
| 26-16 | 44 | 33 | 30 | 28 | 27 | 25 |
| 26-17 | 43 | 34 | 31 | 28 | 27 | 24 |
| 26-18 | 46 | 35 | 30 | 28 | 26 | 24 |
| 26-19 | 45 | 34 | 31 | 29 | 27 | 25 |

Graininess: Smaller RMS values are more advantageous.
Values enclosed in heavy lines correspond with preferred embodiments of the invention.

TABLE 26-3

Degree of increase in yellow stain

| Light-sensitive material Sample No. | Color developing time (sec) 210 | 180 | 150 | 120 | 90 | 60 |
|---|---|---|---|---|---|---|
| | Color developer temperature (°C.) 33 | 35 | 37.5 | 40 | 42 | 48 |
| 26-1 | 0.02 | 0.02 | 0.02 | 0.02 | 0.04 | 0.04 |
| 26-2 | 0.02 | 0.02 | 0.02 | 0.03 | 0.04 | 0.05 |
| 26-3 | 0.02 | 0.03 | 0.03 | 0.04 | 0.04 | 0.05 |
| 26-4 | 0.02 | 0.03 | 0.05 | 0.06 | 0.06 | 0.07 |
| 26-5 | 0.02 | 0.04 | 0.05 | 0.06 | 0.08 | 0.09 |
| 26-6 | 0.02 | 0.05 | 0.07 | 0.09 | 0.10 | 0.11 |
| 26-7 | 0.02 | 0.03 | 0.04 | 0.04 | 0.05 | 0.06 |
| 26-8 | 0.02 | 0.03 | 0.04 | 0.05 | 0.06 | 0.07 |

TABLE 26-3-continued

Degree of increase in yellow stain

| Light-sensitive material Sample No. | Color developing time (sec) 210 | 180 | 150 | 120 | 90 | 60 |
|---|---|---|---|---|---|---|
| | Color developer temperature (°C.) 33 | 35 | 37.5 | 40 | 42 | 48 |
| 26-9 | 0.02 | 0.03 | 0.04 | 0.05 | 0.05 | 0.06 |
| 26-10 | 0.02 | 0.04 | 0.05 | 0.06 | 0.08 | 0.09 |
| 26-11 | 0.02 | 0.04 | 0.06 | 0.08 | 0.10 | 0.11 |
| 26-12 | 0.02 | 0.02 | 0.02 | 0.02 | 0.03 | 0.03 |
| 26-13 | 0.02 | 0.02 | 0.02 | 0.02 | 0.03 | 0.03 |
| 26-14 | 0.02 | 0.02 | 0.02 | 0.02 | 0.03 | 0.04 |
| 26-15 | 0.02 | 0.02 | 0.02 | 0.02 | 0.03 | 0.03 |
| 26-16 | 0.02 | 0.02 | 0.02 | 0.02 | 0.02 | 0.03 |
| 26-17 | 0.02 | 0.02 | 0.02 | 0.02 | 0.02 | 0.04 |
| 26-18 | 0.02 | 0.02 | 0.02 | 0.02 | 0.02 | 0.03 |
| 26-19 | 0.02 | 0.02 | 0.02 | 0.02 | 0.02 | 0.03 |

Smaller values representing yellow stains are more advantageous.
Values enclosed in heavy lines corredspond with preferred embodiments of the invention.

TABLE 26-4

Minimum magenta density

| Light-sensitive material Sample No. | Color developing time (sec) 210 | 180 | 150 | 120 | 90 | 60 |
|---|---|---|---|---|---|---|
| | Color developer temperature (°C.) 33 | 35 | 37.5 | 40 | 42 | 48 |
| 26-1 | 0.49 | 0.54 | 0.58 | 0.61 | 0.61 | 0.62 |
| 26-2 | 0.49 | 0.55 | 0.59 | 0.63 | 0.69 | 0.70 |
| 26-3 | 0.49 | 0.56 | 0.60 | 0.70 | 0.73 | 0.75 |
| 26-4 | 0.49 | 0.50 | 0.51 | 0.54 | 0.54 | 0.53 |
| 26-5 | 0.49 | 0.58 | 0.61 | 0.73 | 0.77 | 0.80 |
| 26-6 | 0.49 | 0.51 | 0.55 | 0.56 | 0.57 | 0.61 |
| 26-7 | 0.49 | 0.50 | 0.51 | 0.52 | 0.52 | 0.55 |
| 26-8 | 0.50 | 0.52 | 0.53 | 0.53 | 0.54 | 0.55 |
| 26-9 | 0.50 | 0.51 | 0.51 | 0.51 | 0.52 | 0.55 |
| 26-10 | 0.50 | 0.56 | 0.60 | 0.66 | 0.70 | 0.74 |
| 26-11 | 0.49 | 0.51 | 0.53 | 0.57 | 0.61 | 0.62 |
| 26-12 | 0.49 | 0.50 | 0.50 | 0.50 | 0.51 | 0.52 |
| 26-13 | 0.49 | 0.50 | 0.50 | 0.51 | 0.51 | 0.52 |
| 26-14 | 0.49 | 0.49 | 0.50 | 0.50 | 0.51 | 0.52 |
| 26-15 | 0.49 | 0.50 | 0.50 | 0.50 | 0.51 | 0.51 |
| 26-16 | 0.50 | 0.50 | 0.51 | 0.51 | 0.51 | 0.52 |

TABLE 26-4-continued

| Light-sensitive material | Minimum magenta density | | | | | |
|---|---|---|---|---|---|---|
| | Color developing time (sec) | | | | | |
| | 210 | 180 | 150 | 120 | 90 | 60 |
| | Color developer temperature (°C.) | | | | | |
| Sample No. | 33 | 35 | 37.5 | 40 | 42 | 48 |
| 26-17 | 0.49 | 0.50 | 0.50 | 0.50 | 0.51 | 0.52 |
| 26-18 | 0.51 | 0.50 | 0.50 | 0.50 | 0.51 | 0.52 |
| 26-19 | 0.49 | 0.49 | 0.50 | 0.50 | 0.51 | 0.51 |

Smaller values representing minimum magenta densities are more advantageous. Values enclosed in heavy lines correspond with preferred embodiments of the invention.

As apparent from the results in Tables 26-2 and 26-3, the present invention provides favorable results both in terms of graininess and yellow-stain.

Furthermore, as evidenced by Table 26-4, the present invention also solves the problem of fog in a magenta layer. More specifically, unlike the samples of the invention which respectively feature minimum magenta density of less than 0.52, the similar densities of the most of the other samples are greater than 0.52. This difference clearly demonstrates the effect of the present invention.

EXAMPLE 27

Silver iodo-bromide emulsions listed in Table 25-5 were prepared in accordance with the following method. Emulsions A through C were prepared using a conventional double jet precipitation process. Emulsions D through K, respectively core/shell type monodispersed emulsions, were prepared using a functional addition method. Emulsion L, a silver halide emulsion containing tabular particles, was prepared using a double jet precipitation process with pH and pAg being controlled.

Next, using the above emulsions A through L, light-sensitive material Samples Nos. 27-20 through 27-43 respectively having layer thicknesses listed in Table 27-5 were prepared in compliance with the preparation method for a light-sensitive material in Example 26.

Each sample was tested in a manner identical with Example 26. The obtained data with regards to graininess (RMS value), yellow-stain and minimum magenta dye density are listed in Table 27-6.

TABLE 27-5

| Sample No. | Average particle size (r) (μm) | Amount of silver halide included within range of r ± 20% | Average silver iodide content (%) | Silver iodide content in cores (%) | Silver iodide content in shells (%) | Volume ratio of shells (%) |
|---|---|---|---|---|---|---|
| A | 0.5 | 56 | 0.3 | Emulsion with spherical particles | | |
| B | 0.5 | 54 | 0.3 | Emulsion with spherical particles | | |
| C | 0.5 | 55 | 6 | Emulsion with spherical particles | | |
| D | 0.5 | 84 | 0.3 | 0.4 | 0.2 | 50 |
| E | 0.5 | 82 | 0.5 | 0.7 | 0.3 | 50 |
| F | 0.5 | 85 | 3.0 | 4 | 2 | 50 |
| G | 0.5 | 87 | 6.0 | 9 | 3 | 50 |
| H | 0.5 | 82 | 8.0 | 10 | 6 | 50 |
| I | 0.5 | 78 | 10.0 | 14 | 6 | 50 |
| J | 0.5 | 75 | 30 | 50 | 10 | 50 |
| K | 0.5 | 73 | 50 | 60 | 40 | 50 |
| L | 0.6 | 70 | 6 | Emulsion containing tabular silver halide particles of which particle diameter is ten times as large as particle thickness | | |

TABLE 27-6

| Sample No. | Emulsion No. | Layer thickness μm | Amount of added (E-2) in color developer ($\times 10^{-2}$ mol/l) | Magenta coupler | Color developing agent: 210 sec. 33° C. Yellow-stain | RMS value | Minimum magenta density | 90 sec. 42° C. Yellow-stain | RMS value | Minimum magenta density |
|---|---|---|---|---|---|---|---|---|---|---|
| 27-20 | D | 19 | 2 | Comparative coupler (26-2) | 0.02 | 46 | 0.51 | 0.04 | 42 | 0.70 |
| 27-21 | C | 19 | 2 | Comparative coupler (26-2) | 0.02 | 43 | 0.51 | 0.03 | 26 | 0.74 |
| 27-22 | G | 19 | 2 | Comparative coupler (26-2) | 0.02 | 49 | 0.51 | 0.04 | 25 | 0.77 |
| 27-23 | L* | 19 | 2 | Comparative coupler (26-2) | 0.02 | 48 | 0.51 | 0.03 | 26 | 0.73 |
| 27-24 | D | 30 | 1 | Comparative coupler (26-2) | 0.02 | 47 | 0.50 | 0.04 | 43 | 0.69 |
| 27-25 | C | 30 | 1 | Comparative coupler (26-2) | 0.02 | 49 | 0.50 | 0.12 | 33 | 0.63 |
| 27-26 | G | 30 | 1 | Comparative coupler (26-2) | 0.02 | 46 | 0.50 | 0.12 | 28 | 0.63 |
| 27-27 | L* | 30 | 1 | Comparative coupler (26-2) | 0.02 | 49 | 0.50 | 0.12 | 28 | 0.61 |
| 27-28 | D | 30 | 1 | M-4 | 0.02 | 47 | 0.50 | 0.04 | 44 | 0.53 |
| 27-29 | C | 30 | 1 | M-4 | 0.02 | 48 | 0.51 | 0.10 | 32 | 0.52 |
| 27-30 | G | 30 | 1 | M-4 | 0.02 | 49 | 0.50 | 0.12 | 29 | 0.53 |
| 27-31 | L* | 30 | 1 | M-4 | 0.02 | 48 | 0.50 | 0.12 | 28 | 0.52 |
| 27-32 | A | 19 | 2 | M-4 | 0.02 | 50 | 0.50 | 0.04 | 43 | 0.53 |
| 27-33 | B | 19 | 2 | M-4 | 0.02 | 46 | 0.51 | 0.04 | 32 | 0.52 |
| 27-34 | C | 19 | 2 | M-4 | 0.02 | 47 | 0.51 | 0.04 | 29 | 0.52 |
| 27-35 | D | 19 | 2 | M-4 | 0.02 | 48 | 0.51 | 0.04 | 43 | 0.52 |
| 27-36 | E | 19 | 2 | M-4 | 0.02 | 48 | 0.50 | 0.04 | 29 | 0.52 |
| 27-37 | F | 19 | 2 | M-4 | 0.02 | 50 | 0.50 | 0.03 | 26 | 0.52 |
| 27-38 | G | 19 | 2 | M-4 | 0.02 | 49 | 0.50 | 0.03 | 22 | 0.52 |
| 27-39 | H | 19 | 2 | M-4 | 0.02 | 48 | 0.50 | 0.03 | 21 | 0.51 |
| 27-30 | I | 19 | 2 | M-4 | 0.02 | 51 | 0.50 | 0.04 | 23 | 0.52 |
| 27-31 | J | 19 | 2 | M-4 | 0.02 | 49 | 0.49 | 0.05 | 25 | 0.51 |

TABLE 27-6-continued

| Sample No. | Emulsion No. | Layer thickness μm | Amount of added (E-2) in color developer ($\times 10^{-2}$ mol/l) | Magenta coupler | Color developing agent 210 sec. 33° C. Yellow-stain | RMS value | Minimum magenta density | 90 sec. 42° C. Yellow-stain | RMS value | Minimum magenta density |
|---|---|---|---|---|---|---|---|---|---|---|
| 27-42 | K | 19 | 2 | M-4 | 0.02 | 48 | 0.50 | 0.05 | 28 | 0.52 |
| 27-43 | L* | 19 | 2 | M-4 | 0.02 | 49 | 0.50 | 0.03 | 22 | 0.52 |

*Aspect ratio is 1:5

Values enclosed in heavy lines correspond with preferred embodiments of the invention.

As apparent from the results in Table 27-6, the invention is capable of attaining favorable results in regards with graininess, yellow-stain and minimum magenta density.

EXAMPLE 28

With Example 27, Sample Nos. 27-22 and 27-38 were modified to have magenta coupler, respectively, (M-2), (M-10), (M-20), (M-23), (M-31), (M-32), (M-37), (M-39), (M-44), (M-63), (M-65) or (M-68), and subjected to the test in Example 27. The results obtained were similar to those mentioned above. Additionally, instead of (M-4), some of the above couplers were used to prepare four samples, which were tested in a manner identical with example 27, whereby it was found Sample No. 27-38 is favorable than Sample No. 27-22.

EXAMPLE 29

With Example 26, an amount of example compound (E-2) used as a color developing agent was respectively changed as listed in Table 29-7, whereby each sample was treated with a developing temperature listed in Table 29-7. Other conditions were identical with example 26. However, samples used i.e. light-sensitive material Nos. 27-22 and 27-38 were identical with those prepared in Example 27. (See Table 27-6.)

In Table 28-7, values enclosed in heavy lines apparently correspond with preferred embodiments of the invention. As can be understood, a concentration of color developing agent, higher than $1.5\times 10^{-1}$ mole/-liter attains favorable result.

The similar test was performed with samples respectively using example compounds (E-1), (E-4), (E-5) and (E-7) as a color developing agent, instead of color developing agent (E-2), thereby the similar results were obtained.

TABLE 29-7

| Light-sensitive material No. | Color developing agent (E-2) (mol/l) | Developing temperature (°C.) | RMS value | Minimum magenta density |
|---|---|---|---|---|
| 27-22 | $1.0 \times 10^{-2}$ | 60 | 39 | 0.75 |
| 27-22 | $1.5 \times 10^{-2}$ | 50 | 29 | 0.75 |
| 27-22 | $2.0 \times 10^{-2}$ | 45 | 26 | 0.73 |
| 27-22 | $3.0 \times 10^{-2}$ | 42 | 25 | 0.69 |
| 27-38 | $1.0 \times 10^{-2}$ | 60 | 35 | 0.50 |
| 27-38 | $1.5 \times 10^{-2}$ | 50 | 27 | 0.54 |
| 27-38 | $2.0 \times 10^{-2}$ | 45 | 23 | 0.52 |
| 27-38 | $3.0 \times 10^{-2}$ | 42 | 22 | 0.53 |
| 27-38 | $4.0 \times 10^{-2}$ | 40 | 22 | 0.53 |

Developing time: 60 sec.

EXAMPLE 29

Using emulsion G in Example 27, and in compliance with the preparation method in Example 26, respective samples were prepared by changing the amounts of applied silver as listed below. More specifically, by changing the amounts of silver added in the third, fifth, seventh and eighth layers, the respective samples independently having a specific amount of silver were prepared. Additionally, the layer thicknesses and amounts of silver added were modified as listed in Table 29-8. Using a color developer containing color developer agent (E-2) at a rate of $2.5\times 10^{-2}$ mole/liter, each sample was treated for 60 seconds, and then, the RMS value and minimum magenta density of each sample were measured. Table 20-8 lists the obtained results. As can be understood from the results in Table 29-8, the preferred amount of silver applied is more than 30 mg/100 $cm^2$, in particular, 35 to 150 mg/100 $cm^2$, and, more specifically, 40 to 100 mg/$cm^2$.

TABLE 29-8

| Layer thickness | Amount of silver applied (mg/100 $cm^2$) | RMS | Minimum magenta density |
|---|---|---|---|
| Layer thickness | 20 | 56 | 0.67 |
| (19 μm) | 30 | 46 | 0.67 |
| (Equivalent to | 35 | 41 | 0.71 |
| previously | 40 | 34 | 0.75 |
| mentioned | 80 | 34 | 0.78 |
| sample No. | 100 | 33 | 0.82 |
| 27-22) | 150 | 32 | 0.98 |
| | 200 | 33 | 1.18 |
| Layer thickness | 20 | 54 | 0.55 |
| (19 μm) | 30 | 40 | 0.55 |
| (Equivalent to | 35 | 38 | 0.55 |
| previously | 40 | 33 | 0.55 |
| mentioned | 80 | 33 | 0.55 |
| sample No. | 100 | 32 | 0.56 |
| 27-38) | 150 | 32 | 0.59 |
| | 200 | 31 | 0.64 |

EXAMPLE 30

With a sample similar to sample No. 27-38 in Example 27, and using a color developer, in Example 26, which in this Example 30 incorporating an inhibitor, RMS value and minimum magenta density were measured in a manner identical with Example 27. Using color developing agent (E-2) at a concentration of $2.0\times 10^{-2}$ mole/liter and under the conditions of a temperature of 50° C. and a color developing time of 60 seconds, the following respective samples were processed. That is, the respective samples were prepared in a manner correspondingly identical with those of light-sensitive material samples No. 27-22 and No. 27-38 in Example 26, except that the respective inhibitors listed in Table 30-9 were used instead of inhibitor (Z-2). As apparent from the results in Table 30-9, the addition of an organic inhibitor of the invention is advantageous.

TABLE 30-9

| Light-sensitive material No. | Inhibitor Compound | Inhibitor Amount added | RMS value | Minimum magenta density |
|---|---|---|---|---|
| 30-22 | No | — | 33 | 0.93 |
| | (Z-1) | 10 (mg/l) | 28 | 0.80 |
| | (Z-4) | 30 (mg/l) | 28 | 0.77 |
| | (Z-12) | 10 (mg/l) | 29 | 0.74 |
| 30-38 | No | — | 34 | 0.62 |
| | (Z-1) | 10 (mg/l) | 27 | 0.55 |
| | (Z-9) | 10 (mg/l) | 27 | 0.56 |
| | (Z-13) | 2.0 (g/l) | 26 | 0.55 |
| | (Z-6) | 2.0 (g/l) | 24 | 0.53 |
| | (Z-14) | 3.0 (g/l) | 27 | 0.54 |
| | (Z-4) | 30 (mg/l) | 24 | 0.53 |
| | (Z-8) | 20 (mg/l) | 28 | 0.56 |
| | (Z-5) | 400 (mg/l) | 26 | 0.56 |
| | (Z-7) | 100 (mg/l) | 27 | 0.55 |
| | (Z-10) | 2000 (mg/l) | 26 | 0.53 |
| | (Z-3) | 50 (mg/l) | 28 | 0.54 |
| | (Z-11) | 10 (mg/l) | 28 | 0.55 |
| | (Z-12) | 10 (mg/l) | 26 | 0.54 |
| | (Z-15) | 500 (mg/l) | 24 | 0.53 |

EXAMPLE 31

The respective silver iodo-bromide emulsions listed in Table 31-1 were prepared in the following preparation processes. $A_{31}$ through $C_{31}$ were prepared a conventional double jet precipitation method. $D_{31}$ through $K_{31}$, core/shell type mono-dispersed emulsions, were prepared by a functional addition method. $L_{31}$, an emulsion containing tabular silver halide particle, was prepared by a double jet precipitation method with pAg being controlled.

TABLE 31-1

| Sample No. | Average particle size (r)(μm) | Amount of silver halide included within range of r ± 20% | Average silver iodide content (%) | Silver iodide content in cores (%) | Silver iodide content in shells (%) | Volume ratio of shells (%) | Remarks |
|---|---|---|---|---|---|---|---|
| $A_{31}$ | 0.5 | 56 | 0.3 | Emulsion with spherical particles | | | |
| $B_{31}$ | 0.5 | 54 | 0.5 | Emulsion with spherical particles | | | |
| $C_{31}$ | 0.5 | 55 | 6 | Emulsion with spherical particles | | | |
| $D_{31}$ | 0.5 | 84 | 0.3 | 0.4 | 0.2 | 50 | |
| $E_{31}$ | 0.5 | 82 | 0.5 | 0.7 | 0.3 | 50 | |
| $F_{31}$ | 0.5 | 85 | 2.0 | 4 | 2 | 50 | |
| $G_{31}$ | 0.5 | 87 | 4.0 | 8 | 2 | 50 | |
| $H_{31}$ | 0.5 | 82 | 8.0 | 10 | 6 | 50 | |
| $I_{31}$ | 0.5 | 78 | 10.0 | 14 | 6 | 50 | |
| $J_{31}$ | 0.5 | 75 | 30 | 50 | 10 | 50 | |
| $K_{31}$ | 0.5 | 73 | 50 | 60 | 40 | 50 | |
| $L_{31}$ | 0.6 | 70 | 6 | Emulsion containing tabular silver halide particles of which particle diameter is ten times as large as particle thickness | | | |

The following layers were sequentially formed, in this order, on a cellulose triacetate support, in order to prepare the respective multi-layer color film samples.

First layer: Anti-halation layer (HC layer)

An anti-halation layer containing 0.18 g of black colloidal silver, and 1.5 g of gelatin.

Second layer: Subbing layer (IG layer)

A subbing layer containing 2.0 g of gelatin.

Third layer: Red-sensitive silver halide emulsion layer (R layer).

A red-sensitive silver halide emulsion layer containing not only 4.0 g of the respective silver iodo-bromide emulsion listed in Table 31-1 and sensitized to have red-sensitivity, but dispersion prepared by emulsifying and dispersing 0.5 g of tricresyl phosphate (hereinafter referred to as TCP) having dissolved 0.08 mole/moleAg of the following cyan coupler ($C_{31}$-1), 0.006 mole/moleAg of the following colored cyan coupler ($CC_{31}$-1), and the respective example DIR compound (No. $D^d$-11 or D'-33), but methanol having dissolved an inhibitor, into aqueous solution containing 1.80 g of gelatin.

Fourth layer: Intermediate layer (2G layer)

An intermediate layer comprising 0.14 g of 2,5-di-t-butylhydroquinone, and 0.07 g of dibutyl phthalate hereinafter referred to as DBP).

Fifth layer: Green-sensitive silver halide emulsion layer (G layer)

A green-sensitive silver halide emulsion layer containing 4.0 g of the respective silver iodo-bromide emulsion listed in Table 31-1 and sensitized to have green-sensitivity, and dispersion prepared by emulsifying and dispersing 0.64 g of TCP having dissolved 0.07 mole/moleAg of the following magenta coupler ($M_{31}$-1), and 0.015 mole/moleAg of the following colored magenta coupler ($CM_{31}$-1), and example DIR compound (No. $D^d$-14), into aqueous solution containing 1.4 g of gelatin.

Sixth layer: Protective layer (3G layer)

A protective layer containing 0.8 g of gelatin.

In addition to the above components, each layer was allowed to contain gelatin-hardening agent (1,2-bisvinylsulphonylethane), and surfactant and the like. Additionally, the respective third layer (R layer) and fifth layer (G layer) were allowed to incorporate the respective silver halide emulsions listed in Table 31-1 as well as DIR compound or inhibitor listed in Table 31-2, thus the respective samples were prepared.

Cyan coupler ($C_{31}$-1)

2-(α,α,β,β,γ,γ,δ,δ-octafluorohexanamido)-5-[2-(2,4-di-t-amylphenoxy)hexaneamido]phenol Colored cyan coupler ($CC_{31}$-1)

Disodium 1-hedroxy-4-[e-(1-hydroxy-8-acetamido-3,6-disulfo-2-naphthylazo)phenoxy]-N-[δ-(2,4-di-t-amylphenoxy)butyl]-2-naphthamido Magenta coupler ($M_{31}$-1)

1-(2,4,6-trichlorophenyl)-3-{[α-(2,4-di-t-amylphenoxy) acetamide]benzamido}-3-pyrazolone and 1-(2,4,6-trichlorophenyl)-3-{[α2,4-amylphenoxy)-acetamido]-benzamido}-4-(4-methoxyphenylazo)-5-pyrazolone Colored magenta coupler ($CM_{31}$-1)

1-(2,4,6-trichlorophenyl)-4-(1-naphthylazo)-3-(2-chloro-5-octadecenylsuccinimidanilino)-5-pyrazolone Each sample was exposure with green light, red light, and green light+red light (16 CMS) through an optical wedge, thereby treated with the following treatment steps, so as to form a dye image.

| [Treatment] | | |
|---|---|---|
| Color developing | Time specified in Table 31-2 on 31-3 (40° C.) | |
| Bleach-fixing | 4 min | (38° C.) |
| Washing | 1 min | (20 to 33° C.) |
| Stabilizing | 1 min | (20 to 33° C.) |
| Drying | | |

The compositions of processing solutions used in the respective processing steps are as follows.

| [Color developer] | |
|---|---|
| Sulfate of the previously mentioned example compound (E-2) | (Amount added specified in Table 31-2 or 31-3) |
| Sodium sulfite anhydride | 4.25 g |
| Hydroxylamine.½ sulfate | 2.0 g |
| Sodium carbonate anhydride | 30.0 g |
| Sodium bromide | 1.3 g |
| Trisodium nitrilotriacetate (monohydride) | 2.5 g |
| Potassium hydroxide | 1.0 g |

Water was added to the above components to prepare one liter solution.

| [Bleach-fixer] | |
|---|---|
| Ferric ammonium ethylenediamine tetraacetate | 200.0 g |
| Diammonium ethylenediamine tetraacetate | 2.0 g |
| Aqueous ammonia (28% aqueous solution) | 10.0 g |

-continued

| | |
|---|---|
| Ammonium thiosulfate | 175.0 g |
| Sodium sulfite anhydride | 8.5 g |
| Sodium metasulfite | 2.3 g |
| 2-amino-5-methyl-mercapto-1,3,4-thiazole | 1.5 g |

Water was added to the components above to prepare one liter solution, which was adjusted to pH=6.6 using acetic acid or aqueous ammonia.

| [Washer] | |
|---|---|
| Tap water | |
| [Stabilizer] | |
| Formalin (37% aqueous solution) | 1.5 m |
| Konidax (manufactured by Konishiroku Photo Ind. Co., Ltd.) | 7.5 m |

Water was added to the components above to prepare one liter solution.

Silver halide light-sensitive material samples (Nos. 31-1 through 31-12) prepared using the previously specified emulsions were subjected to the above-described treatment (with varied color developing agent concentration and varied color developing time as listed in Table 31-2 and 31-3), thereby graininess values (RMS values) as well as sharpness values (MTF values) were determined. Tables 31-2 and 31-3 respectively listed the obtained results.

The graininess values (RMS values) were determined by comparing values obtained by multiplying 1000 times standard deviations in fluctuation of density values available when scanning a dye having density of 1.0 by using a micro densitometer having a circular scanning aperture with a diameter of 25 $\mu m^2$.

MTF (Modulation Transfer Function) granularities were determined by comparing degrees of MTF relative to a spatial frequency of 30 lines/mm.

Smaller RMS values of magenta dye images indicate better graininess. Larger MTF values indicate better sharpness.

TABLE 31-2

(Graininess)

| Light-sensitive material (Emulsion No.) | | Color developing agent (E-2) concentration (Mole/liter) $1.5 \times 10^{-2}$ | | | $2.0 \times 10^{-2}$ | | | $3.0 \times 10^{-2}$ | | | $5.0 \times 10^{-2}$ | | |
|---|---|---|---|---|---|---|---|---|---|---|---|---|---|
| | | Color developing time (sec.) | | | | | | | | | | | |
| | | 60 ( ) | 120 ( ) | 180 ( ) | 60 ( ) | 120 ( ) | 180 ( ) | 60 ( ) | 120 ( ) | 180 ( ) | 60 ( ) | 120 ( ) | 180 ( ) |
| 31-1 | (A31) | 44 | 48 | 49 | 49 | 43 | 48 | 40 | 45 | 50 | 41 | 42 | 49 |
| 31-2 | (B31) | 40 | 45 | 49 | 33 | 35 | 48 | 32 | 34 | 45 | 32 | 35 | 49 |
| 31-3 | (C31) | 38 | 40 | 43 | 31 | 34 | 49 | 30 | 33 | 50 | 31 | 33 | 51 |
| 31-4 | (D31) | 45 | 47 | 51 | 42 | 45 | 48 | 41 | 44 | 47 | 41 | 45 | 49 |
| 31-5 | (E31) | 41 | 42 | 44 | 33 | 34 | 47 | 29 | 34 | 49 | 28 | 34 | 50 |
| 31-6 | (F31) | 38 | 41 | 45 | 31 | 34 | 47 | 26 | 32 | 49 | 25 | 42 | 51 |
| 31-7 | (G31) | 38 | 39 | 44 | 28 | 32 | 46 | 25 | 29 | 50 | 25 | 28 | 52 |
| 31-8 | (H31) | 38 | 39 | 44 | 28 | 31 | 48 | 25 | 28 | 52 | 26 | 29 | 53 |
| 31-9 | (I31) | 38 | 41 | 47 | 29 | 33 | 47 | 27 | 32 | 51 | 28 | 34 | 51 |
| 31-10 | (J31) | 38 | 42 | 46 | 32 | 34 | 48 | 29 | 33 | 49 | 29 | 35 | 50 |
| 31-11 | (K31) | 40 | 42 | 49 | 33 | 34 | 49 | 31 | 32 | 51 | 31 | 35 | 51 |
| 31-12 | (L31) | 42 | 48 | 51 | 29 | 34 | 49 | 28 | 31 | 48 | 27 | 31 | 47 |

☐ indicates the preferred embodiments of the invention.

TABLE 31-3

([MTF values (%), 30 lines/mm])

| Light-sensitive material (Emulsion No.) | | Color developing agent (E-2) concentration (Mole/liter) $1.5 \times 10^{-2}$ | | | $2.0 \times 10^{-2}$ | | | $3.0 \times 10^{-2}$ | | | $5.0 \times 10^{-2}$ | | |
|---|---|---|---|---|---|---|---|---|---|---|---|---|---|
| | | Color developing time (sec.) | | | | | | | | | | | |
| | | 60 ( ) | 120 ( ) | 180 ( ) | 60 ( ) | 120 ( ) | 180 ( ) | 60 ( ) | 120 ( ) | 180 ( ) | 60 ( ) | 120 ( ) | 180 ( ) |
| 31-1 | (A31) | 40 | 39 | 40 | 41 | 43 | 40 | 41 | 41 | 40 | 42 | 43 | 43 |
| 31-2 | (B31) | 43 | 44 | 42 | 49 | 35 | 41 | 52 | 51 | 40 | 55 | 54 | 40 |
| 31-3 | (C31) | 41 | 40 | 40 | 51 | 34 | 43 | 53 | 52 | 41 | 58 | 56 | 41 |
| 31-5 | (D31) | 44 | 43 | 42 | 43 | 41 | 40 | 42 | 41 | 39 | 42 | 40 | 38 |
| 31-6 | (E31) | 44 | 43 | 42 | 52 | 50 | 40 | 57 | 53 | 41 | 58 | 53 | 42 |
| 31-7 | (F31) | 42 | 42 | 42 | 55 | 52 | 41 | 61 | 56 | 42 | 63 | 59 | 43 |
| 31-8 | (G31) | 42 | 42 | 42 | 58 | 54 | 41 | 63 | 57 | 42 | 67 | 62 | 43 |
| 31-9 | (H31) | 42 | 41 | 41 | 58 | 54 | 41 | 63 | 57 | 42 | 67 | 62 | 43 |
| 31-10 | (I31) | 42 | 41 | 41 | 56 | 52 | 41 | 61 | 55 | 43 | 63 | 59 | 43 |
| 31-11 | (J31) | 41 | 40 | 40 | 53 | 50 | 40 | 57 | 52 | 42 | 61 | 57 | 42 |
| 31-12 | (K31) | 41 | 40 | 39 | 49 | 47 | 40 | 54 | 49 | 42 | 57 | 53 | 42 |
| | (L31) | 42 | 41 | 41 | 55 | 54 | 42 | 56 | 54 | 40 | 58 | 56 | 43 |

☐ indicates the preferred embodiments of the invention.

Tables 31-2 and 31-3 demonstrates surprising results; using light-sensitive materials Nos. 31-2, 31-3, 31-5 through 31-12, together with a color developer containing color developing agent by the concentration of higher than $2.0 \times 10^{-2}$ mole/liter, a processing method of the invention with a color developing time of shorter than 120 seconds, attains both favorable graininess and sharpness.

EXAMPLE 32

Samples 32-1′ and 32-7′ were prepared by modifying sample No. 31-1 in Example 31, in that DIR compound was eliminated from the third anf fifth layers, whereby the prepared samples were tested in a manner identical with Example 31, except only two concentration settings for color developing agents E-2 were used i.e. $1.5 \times 10^{-2}$ mole/liter and $3 \times 10^{-2}$ mole/liter, in order to determine graininess values (RMS values) of magenta dye. Table 32-4 lists the results.

TABLE 32-4

| Light-sensitive material No. (Emulsion No.) | Developing agent concentration (mole/liter) $1.5 \times 10^{-2}$ | | | $3 \times 10^{-2}$ | | |
|---|---|---|---|---|---|---|
| | Color developing time (sec.) | | | | | |
| | 60 | 120 | 180 | 60 | 120 | 180 |
| 32-1′ (A) | 43 | 44 | 43 | 42 | 44 | 45 |
| 32-7′ (G) | 40 | 41 | 41 | 30 | 35 | 46 |

When comparing, with each other, light-sensitive material sample Nos. 31-1 in Table 31-2, sample Nos. 32-1′, 32-7, and 32-7′ in Table 32-4, it is apparent that Samples Nos. 31-1 and 31-7 with a DIR compound listed in Table 31-2 are advantageous in embodying the present invention.

EXAMPLE 33

Using Sample No. 31-7 in Example 31, the effect by adding an inhibitor to a color developer was examined. Color developing was performed using processing solutions as well as processing steps identical with those of Example 31, except that duration of color developing was one minute, a rate of added color developing agent was $8 \times 10^{-2}$ mole/liter, and each of the inhibitors in Table 33-5 was added to the color developer, thereby grainines (RMS value) was measured.

TABLE 33-5

| Inhibitor Compound | Rate of addition | RMS G (magenta) | RMS R (cyan) |
|---|---|---|---|
| No | — | 24 | 25 |
| Z-4 | 20 (mg/l) | 21 | 20 |
| Z-27 | 20 (mg/l) | 21 | 21 |
| Z-42 | 2.0 (g/l) | 19 | 20 |
| Z-20 | 2.0 (g/l) | 19 | 22 |
| Z-5 | 0.5 (g/l) | 17 | 21 |
| Z-14 | 50 (mg/l) | 15 | 19 |
| Z-26 | 50 (mg/l) | 15 | 19 |
| Z-18 | 100 (mg/l) | 17 | 19 |
| Z-21 | 100 (mg/l) | 17 | 19 |
| Z-28 | 2000 (mg/l) | 17 | 19 |
| Z-7 | 50 (mg/l) | 17 | 18 |
| Z-30 | 20 (mg/l) | 15 | 19 |
| Z-39 | 20 (mg/l) | 17 | 19 |
| Z-65 | 500 (mg/l) | 19 | 17 |

As apparent from the results in Table 33-5, incorporating an organic inhibitor into a color developer solution is advantageous in embodying the invention.

EXAMPLE 34

Using a method for preparing light-sensitive material Samples Nos. 31-1 and 31-7 in Example 31, light-sensitive material Samples 34-1A and 34-7A were prepared by forming the sixth through ninth emulsion layers, specified below, upon the fifth layer of each of Sample Nos. 31-1 and 31-7.

Sixth layer: A yellow filter layer containing 0.3 g of yellow colloidal silver, and 0.11 g of DBP having dissolved 0.2 g of anti-stain agent (2,5-di-t-octylhydroquinone); as well as 2.1 g of gelatin.

Seventh layer: A low-sensitivity blue-sensitive silver halide emulsion layer containing 1.02 g of low-sensitivity blue-sensitive silver iodo-bromide emulsion (AgI; 4 mole %); 0.93 g of DBP having dissolved 1.84 g of α-[4-(1-benzyl-2-phenyl-3,5-dioxo-1,2,4-triazolydinyl)]-α-pyvaloyl-2-chloro-5-[γ-(2,4-di-t-amylphenoxy)-butanamide]acetanilide [hereinafter referred to as yellow coupler (Y-1)]; as well as 1.9 g of gelatin.

Eighth layer: A high-sensitivity blue-sensitive silver halide emulsion layer containing 1.6 g of high-sensitivity monodispersed blue-sensitive silver iodo-bromide emulsion (AgI; 4 mole %); 0.23 g of DBP having dissolved 0.46 g of yellow coupler (Y-1) in Example 1; as well as 2.0 g of gelatin.

Ninth layer: Protective gelatin layer (identical with the sixth layer of Example 31)

With each of the previously mentioned Sample Nos. 34-1A and 34-7A, amount of silver applied onto a support was at a rate of 80 mg/100 cm$^2$. However, Sample Nos. 34-1A-1 through 34-1A-6 were prepared from Sample 34-1A by varying the amount of silver respectively to 10 mg, 30 mg, 35 mg, 100 mg, 150 mg, and 300 mg/100 cm$^2$. Sample Nos. 34-7A-1 though 34-7A-6 were similarly prepared from Sample No. 34-7A. Samples thus obtained were tested for graininess in the same manner as in Example 31 with a color developing time of 90 seconds using $44\times10^{-2}$ mole/liter of Compound E-4 as a color developing agent instead of Compound E-2. Results obtained are listed in Table 34-6.

TABLE 34-6

| Light-sensitive material No. (Amount of silver applied; mg/100 cm$^2$) | Graininess | Light-sensitive material No. (Amount of silver applied; mg/100 cm$^2$) | Graininess |
|---|---|---|---|
| 34-1A-1 (20) | 76 | 34-7 A-1 (20) | 67 |
| 34-1A-2 (30) | 69 | 34-7A-2 (30) | 42 |
| 34-1A-3 (35) | 59 | 34-7A-3 (35) | 39 |
| 34-1A (80) | 53 | 34-7A (80) | 32 |
| 34-1A-4 (100) | 48 | 34-7A-4 (100) | 30 |
| 34-1A-5 (150) | 44 | 34-7A-5 (150) | 29 |
| 34-1A-6 (200) | 35 | 34-7A-6 (200) | 29 |

As is apparent from Table 15, the preferred amount of silver applied is more than 30 mg/100 cm$^2$.

However, an amount more than 150 mg/100 cm$^2$ offers less economical advantages, and graininess shows no further improvement. For this reason, an amount advantageous for practical use is 30 to 100 mg/100 cm$^2$, in particular, 35 to 100 mg/cm$^2$.

EXAMPLE 35

Silver halide emulsions in Table 35-i i.e. emulsions containing spherical silver halide particles were prepared using a conventional double-jet precipitation process.

The following layers were sequentially formed, in this order, on a cellulose triacetate support, in order to prepare the respective multi-layer color photographic light-sensitive material samples.

First layer: Anti-halation layer (HC layer)

An anti-halation layer containing 0.18 g of black colloidal silver, and 1.5 g of gelatin.

Second layer: Subbing layer (IG layer)

A subbing layer containing 2.0 g of gelatin.

Third layer: Red-sensitive silver halide emulsion layer (R layer)

A red-sensitive silver halide emulsion layer containing not only each of the silver halide emulsions listed in Table 35-1 and sensitized to have red-sensitivity, but dispersion prepared by emulsifying and dispersing tricresyl phosphate (hereinafter referred to as TCP) having dissolved 0.2 mole/moleAg of example cyan coupler in Table 35-1 or the following comparative coupler, 0.006 mole/moleAg of the following colored cyan coupler ($CC_{35}$-1), and example DIR compound (No. $D^d$-24), as well as methanol having dissolved an inhibitor, into aqueous solution containing gelatin.

Fourth layer: Intermediate layer (2G layer)

An intermediate layer comprising 0.14 g of 2,5-di-t-butylhydroquinone, and 0.07 g of dibutyl phthalate (hereinafter referred to as DBP).

Fifth layer: Green-sensitive silver halide emulsion layer (G layer)

A green-sensitive silver halide emulsion layer containing not only each of the silver halide emulsions listed in Table 35-1 and sensitized to have green-sensitivity, but dispersion prepared by emulsifying and dispersing TCP having dissolved 0.15 mole/moleAg of the following magenta coupler ($M_{35}$-1), and 0.015 mole/moleAg of the following colored magenta coupler ($CM_{35}$-1), and example DIR compound (No. $D^d$-5), into aqueous solution containing gelatin.

Sixth layer: Yellow filter layer

A yellow filter layer containing 0.3 g yellow colloidal silver, 0.11 g of DBP having dissolved 0.19 g anti-stain agent (2,5-di-t-octylhydroquinone); as well as 2.1 g of gelatin.

Seventh layer: Low-sensitivity blue-sensitive silver halide emulsion layer (B layer)

A blue-sensitive silver halide emulsion layer containing not only each of the silver halide emulsions listed in Table 35-1 and sensitized to have blue-sensitivity, but dispersion prepared by emulsifying and dispersing TCP having dissolved 0.3 mole/moleAg of the following yellow coupler (Y-1) and example DIR compound (No. $D^d$-62), into aqueous solution containing gelatin.

Eighth layer: High-sensitivity monodispersed blue-sensitive silver halide emulsion layer (B layer)

A layer similar to the seventh layer, except that slightly larger silver halide particles were used.

Ninth layer: Protective layer (3G layer)

A protective layer containing 0.8 g of gelatin

In addition to the above components, each layer was allowed to contain gelatin-hardening agents (1,2-bis-vinylsulphonyleethane and sodium 2,4-dichloro-6-hydroxy-s-triadine), surfactant and the like.

The amount of silver applied was 50 mg/100 cm$^2$.

The couplers used in the respective layers were as follows. Comparative coupler 35-(1)

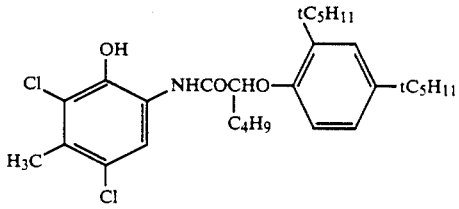

-continued

Comparative coupler 35-(2)

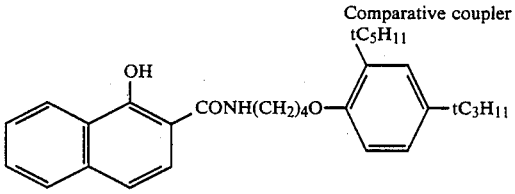

Colored cyan coupler ($CC_{35}$-1)

Disodium 1-hydroxy-4-[e-(1-hydroxy-8-acetamide-3,6-disulfo-2-naphthylazo)phenoxy]-N-[δ-(2,4-di-t-amylphenoxy)butyl]-2-naphthamide Magenta coupler ($M_{35}$-1)

1-(2,4,6-trichlorophenyl)-3-{[α-(2,4-di-t-amylphenoxy)acetamide]benzamido}-3-pyrazolone and 1-(2,4,6-trichlorophenyl)-3-{[α-(2,4-di-t-amylphenoxy)-acetamide]benzamide}-4-(4-methoxyphenylazo)-5-pyrazolone Colored magenta coupler ($CM_{35}$-1)

1-(2,4,6-trichlorophenyl)-4-(1-naphthylazo)-3-(2-chloro-5-octadecenylsuccinamidanilino)-5-pyrazolone Yellow coupler ($Y_{35}$-1)

α-[4-(1-benzyl-2-phenyl-3,5-dioxo-1,2,4-triazolydinyl-pyvaloyl-2-chloro-5-[α-(2,4-di-t-amylphenoxy)-butanamide]acetanilide Samples 35-1 through 35-19 were prepared respectively using the above specified compositions specified in Table 35-1 as the composition of silver halide, and varying the amounts of application in the third, fifth, sixth and seventh layers, varying the amount of gelatin-hardening agent in the third layer and adding gelatin-hardening agent into the blue-sensitive silver halide emulsion layer so as to reduce T1/2 of certain samples. Next, the layer thicknesses, as well as layer swelling rates T1/2, were measured. Table 35-1 lists the measurement results.

Each sample was exposed with green light, red light or green/red light (16 CMS) through an optical wedge, thereby treated with the following treatment steps, so as to form a dye image.

| Treatment | | |
|---|---|---|
| Color developing | Time and temperature specified in Table 35-2 | |
| Bleaching | 4 min | (38° C.) |
| Fixing | 3 min | (30 to 38° C.) |
| Washing | 1 min | (20 to 33° C.) |
| Stabilizing | 1 min | (20 to 33° C.) |
| Drying | | |

The compositions of processing solutions used in the respective processing steps are as follows.

| (Color developer) | |
|---|---|
| Sulfate of the previously mentioned example compound (E-2) | $3 \times 10^{-2}$ moles |
| Sodium sulfite anhydride | 4.25 g |
| Hydroxylamine.½ sulfate | 2.0 g |
| Potassium carbonate anhydride | 30.0 g |
| Sodium bromide | 1.3 g |
| Trisodium nitrilotriacetate (monohydride) | 2.5 g |
| Potassium hydroxide | 1.0 g |

-continued

| (Color developer) | |
|---|---|
| Inhibitor Z-5 | 0.5 g |

Water was added to the above components to prepare one liter solution, which was adjusted to pH=10.2 using KOH and $H_2SO_4$.

| (Bleacher) | |
|---|---|
| Ferric ammonium ethylenediamine tetraacetate | 200.0 g |
| Ammonium bromide | 150.0 g |
| Glacial acetic acid | 10.0 ml |

Water was added to the above components to prepare one liter solution, which was adjusted to pH=6.0 using aqueous ammonium.

| (Fixer) | |
|---|---|
| Ammonium thiosulfate | 175.0 g |
| Sodium sulfite anhydride | 8.5 g |
| Sodium metabisulfite | 2.3 g |

Water was added to the above components to prepare one liter solution, which was adjusted to pH=7.0 using acetic acid.

| (Stabilizer) | |
|---|---|
| Formalin (37% aqueous solution) | 1.5 ml |
| Konidax (manufactured by Konishiroku Photo Ind. Co., Ltd.) | 7.5 ml |

Water was added to the above components to prepare one liter solution.

Graininess values (RMS values) of obtained cyan dye are listed in Table 35-2. RMS values are values obtained by multiplying 1000 times standard deviations in fluctuation of density values available when scanning an area of minimum density+1.2 by using a micro densitometer having an aperture scanning area of 250 $\mu m^2$. The amount of DIR compound added to each color-sensitive layer was so controlled that desensitization and density decrease of each color-sensitive layer were equilibrated.

Immediately after the above process, each sample was examined for fog-density on the non-exposure portion, using blue light of an optical densitometer PDA-65A (Konishiroku Photo Ind. Co., Ltd.). Each sample was allowed to stand for one week under the conditions of 40° C. and 60RH %, and then similarly examined, thereby the density increase due to storage was measured in order to determine the yellow stain increase ratio. Table 35-3 lists the measurement results.

Each sample treated was irradiated with an arc lamp for 200 hours under the conditions of 30° C. and 80RH %. Both before and after the irradiation, the cyan dye densities of the respective samples were measured with the above-referred optical densitometer. The obtained results of fading ratio of cyan dye are listed in Table 35-4.

TABLE 35-1

| Light-sensitive material Sample No. | Silver halide (%) AgI | AgBr | AgCl | Layer thickness μm | Layer swelling T ½ (sec.) | Cyan coupler |
|---|---|---|---|---|---|---|
| 35-1 | — | 100 | — | 20 | 12 | $C^c$- 31 |
| 35-2 | — | 90 | 10 | 20 | 12 | " |
| 35-2 | 0.2 | 90 | 9.8 | 20 | 12 | " |
| 35-4 | 0.5 | 99.5 | — | 30 | 25 | " |
| 35-5 | 0.5 | 99.5 | — | 20 | 12 | Comparative coupler 35-(1) |
| 35-6 | 0.5 | 99.5 | — | 20 | 12 | $C^c$- 31 |
| 35-7 | 6.0 | 94 | — | 30 | 25 | " |
| 35-8 | 6.0 | 44 | — | 20 | 25 | " |
| 35-9 | 6.0 | 94 | — | 30 | 15 | " |
| 35-10 | 6.0 | 94 | — | 20 | 12 | Comparative coupler 35-(1) |
| 35-11 | 6.0 | 94 | — | 20 | 12 | Comparative coupler 35-(2) |
| 35-12 | 6.0 | 94 | — | 20 | 12 | $C^c$-31 |
| 35-13 | 6.0 | 94 | — | 20 | 12 | $C^c$-75 |
| 35-14 | 6.0 | 94 | — | 20 | 12 | $C^c$-5 |
| 35-15 | 6.0 | 94 | — | 20 | 12 | $C^c$-28 |
| 36-16 | 6.0 | 94 | — | 20 | 5 | $C^c$-31 |
| 35-17 | 6.0 | 94 | — | 20 | 20 | $C^c$-31 |
| 35-18 | 6.0 | 94 | — | 14 | 13 | " |
| 35-19 | 6.0 | 94 | — | 25 | 12 | " |

TABLE 35-2

| Light-sensitive material sample No. | Graininess (RMS values) Color developing time (sec.) 210 | 180 | 150 | 120 | 90 | 60 |
|---|---|---|---|---|---|---|
| | Color developing temperature (°C.) 33 | 35 | 37.5 | 40 | 42 | 48 |
| 35-1 | 52 | 50 | 48 | 47 | 46 | 44 |
| 35-2 | 53 | 50 | 49 | 48 | 47 | 49 |
| 35-3 | 46 | 46 | 46 | 47 | 48 | 49 |
| 35-4 | 47 | 45 | 42 | 33 | 31 | 31 |
| 35-5 | 45 | 38 | 36 | 34 | 33 | 33 |
| 35-6 | 45 | 37 | 35 | 33 | 32 | 31 |
| 35-7 | 49 | 49 | 44 | 34 | 33 | 32 |
| 35-8 | 50 | 48 | 43 | 34 | 31 | 31 |
| 35-9 | 48 | 46 | 44 | 34 | 32 | 30 |
| 35-10 | 45 | 35 | 32 | 30 | 28 | 27 |
| 35-11 | 45 | 36 | 32 | 31 | 28 | 26 |
| 35-12 | 44 | 34 | 32 | 29 | 27 | 25 |
| 35-13 | 45 | 34 | 32 | 29 | 27 | 25 |
| 35-14 | 44 | 35 | 31 | 29 | 28 | 25 |
| 35-15 | 45 | 35 | 32 | 29 | 27 | 24 |
| 35-16 | 44 | 33 | 30 | 29 | 26 | 24 |
| 35-17 | 45 | 35 | 32 | 29 | 28 | 25 |
| 35-18 | 45 | 34 | 30 | 28 | 26 | 24 |
| 35-19 | 45 | 35 | 32 | 29 | 28 | 25 |

Smaller graininess values (RMS values) are more advantageous.
Data enclosed in heavy lines correspond with the preferred embodiments of the invention.

TABLE 35-3

| Light-sensitive material sample No. | Increase ratio of yellow stains Color developing time (Sec.) 210 | 180 | 150 | 120 | 90 | 60 |
|---|---|---|---|---|---|---|
| | Color developing temperature (°C.) 33 | 35 | 37.5 | 40 | 42 | 48 |
| 35-1 | 0.02 | 0.02 | 0.02 | 0.02 | 0.03 | 0.04 |
| 35-2 | 0.02 | 0.02 | 0.02 | 0.03 | 0.04 | 0.05 |
| 35-3 | 0.02 | 0.03 | 0.03 | 0.04 | 0.04 | 0.05 |
| 35-4 | 0.02 | 0.06 | 0.08 | 0.09 | 0.12 | 0.12 |
| 35-5 | 0.02 | 0.02 | 0.02 | 0.02 | 0.03 | 0.03 |
| 35-6 | 0.02 | 0.02 | 0.02 | 0.02 | 0.03 | 0.03 |
| 35-7 | 0.02 | 0.06 | 0.08 | 0.09 | 0.11 | 0.12 |
| 35-8 | 0.02 | 0.05 | 0.07 | 0.09 | 0.10 | 0.12 |
| 35-9 | 0.02 | 0.05 | 0.06 | 0.07 | 0.08 | 0.10 |
| 35-10 | 0.02 | 0.02 | 0.02 | 0.02 | 0.03 | 0.03 |
| 35-11 | 0.02 | 0.02 | 0.02 | 0.02 | 0.03 | 0.03 |
| 35-12 | 0.02 | 0.02 | 0.02 | 0.02 | 0.03 | 0.03 |
| 35-13 | 0.02 | 0.02 | 0.02 | 0.02 | 0.03 | 0.03 |

TABLE 35-3-continued

| Light-sensitive material sample No. | Increase ratio of yellow stains Color developing time (Sec.) 210 | 180 | 150 | 120 | 90 | 60 |
|---|---|---|---|---|---|---|
| | Color developing temperature (°C.) 33 | 35 | 37.5 | 40 | 42 | 48 |
| 35-14 | 0.02 | 0.02 | 0.02 | 0.02 | 0.03 | 0.03 |
| 35-15 | 0.02 | 0.02 | 0.02 | 0.02 | 0.03 | 0.04 |
| 35-16 | 0.02 | 0.02 | 0.02 | 0.02 | 0.02 | 0.03 |
| 35-17 | 0.02 | 0.02 | 0.02 | 0.02 | 0.03 | 0.04 |
| 35-18 | 0.02 | 0.02 | 0.02 | 0.02 | 0.02 | 0.03 |
| 35-19 | 0.02 | 0.02 | 0.02 | 0.02 | 0.03 | 0.04 |

Smaller yellow stain values are more advantageous.
Data enclosed in heavy lines correspond with the preferred embodiments of the invention.

TABLE 35-4

| Light-sensitive material Sample No. | Light fading ratios of cyan dyes Color developing time (Sec.) 210 | 180 | 150 | 120 | 90 | 60 |
|---|---|---|---|---|---|---|
| | Color developing temperature (°C.) 33 | 35 | 37.5 | 40 | 42 | 48 |
| 35-1 | 14 | 14 | 14 | 14 | 15 | 15 |
| 35-2 | 14 | 14 | 14 | 15 | 15 | 15 |
| 35-3 | 14 | 14 | 14 | 15 | 15 | 15 |
| 35-4 | 15 | 21 | 24 | 25 | 27 | 29 |
| 35-5 | 13 | 19 | 22 | 24 | 25 | 27 |
| 35-6 | 14 | 14 | 14 | 15 | 15 | 15 |
| 35-7 | 15 | 22 | 24 | 26 | 27 | 30 |
| 35-8 | 15 | 21 | 23 | 25 | 26 | 27 |
| 35-9 | 15 | 20 | 23 | 25 | 25 | 26 |
| 35-10 | 13 | 18 | 21 | 22 | 24 | 26 |
| 35-11 | 13 | 17 | 20 | 22 | 23 | 23 |
| 35-12 | 14 | 14 | 14 | 15 | 15 | 15 |
| 35-13 | 14 | 14 | 14 | 15 | 15 | 15 |
| 35-14 | 14 | 14 | 15 | 15 | 15 | 15 |
| 35-15 | 14 | 14 | 15 | 15 | 15 | 16 |
| 35-16 | 14 | 14 | 14 | 14 | 15 | 15 |
| 35-17 | 14 | 14 | 14 | 15 | 15 | 16 |
| 35-18 | 14 | 14 | 14 | 15 | 15 | 15 |
| 35-19 | 14 | 14 | 15 | 15 | 15 | 16 |

Data enclosed in heavy lines correspond with the preferred embodiments of the invention.

As can be understood from Tables 35-2, 35-3, and 35-4, the invention offers outstanding results; favorable graininess as well as yellow stain, and smaller cyan dye fading ratios.

EXAMPLE 36

Silver iodo-bromide emulsions listed in Table 36-5 were prepared in accordance with the following method. Emulsions 36-A through 36-C were prepared using a conventional double jet precipitation process. Emulsions 36-D through 36-K, respectively core/shell type monodispersed emulsions, were prepared using a functional addition method. Emulsion 36-L, a silver halide emulsion containing tabular particles, was prepared using a double jet precipitation process with pH and pAg being controlled.

Next, using the above emulsions 36-A through 36-L, light-sensitive material Samples Nos. 36–20 through 36–43 respectively having layer thickness and layer swelling ratio listed in Table 36-5 were prepared in compliance with the preparation method for a light-sensitive material in Example 35.

Each sample was tested in a manner identical with Example 35. The obtained data with regards to graininess (RMS value) and yellow-stain are listed in Table 36-6.

TABLE 36-5

| Emulsion No. | Average particle size r (μm) | Amount of silver halide included within range of r ± 20% | Average silver iodide content (%) | Silver iodide content in cores (%) | Silver iodide content in shells (%) | Volume ratio of shells (%) |
|---|---|---|---|---|---|---|
| 36-A | 0.5 | 56 | 0.3 | Emulsion containing spherical silver halide particles | | |
| 36-B | 0.5 | 54 | 0.5 | Emulsion containing spherical silver halide particles | | |
| 36-C | 0.5 | 55 | 6 | Emulsion containing spherical silver halide particles | | |
| 36-D | 0.5 | 84 | 0.3 | 0.4 | 0.2 | 50 |
| 36-E | 0.5 | 82 | 0.5 | 0.7 | 0.3 | 50 |
| 36-F | 0.5 | 85 | 3.0 | 4 | 2 | 50 |
| 36-G | 0.5 | 87 | 6.0 | 9 | 3 | 50 |
| 36-H | 0.5 | 82 | 8.0 | 10 | 6 | 50 |
| 36-I | 0.5 | 78 | 10.0 | 14 | 6 | 50 |
| 36-J | 0.5 | 75 | 30 | 50 | 10 | 50 |
| 36-K | 0.5 | 73 | 50 | 60 | 40 | 50 |
| 36-L | 0.6 | 70 | 6 | Emulsion containing tabular silver halide particles of which particle diameter is ten times as large as particle thickness | | |

TABLE 36-6

| | | | | | Color developing | | | | | |
|---|---|---|---|---|---|---|---|---|---|---|
| | | | | | 210 sec. 33° C. | | | 90 sec. 42° C. | | |
| Light-sensitive material No. | Emulsion No. | Layer thickness μm | Layer swelling T½ (sec.) | Cyan Coupler | Yellow stain | RMS value | Cyan dye fading ratio | Yellow stain | RMS value | Cyan dye fading ratio |
| 36-20 | D | 20 | 12 | Comparative coupler 35-(2) | 0.02 | 47 | 13 | 0.04 | 42 | 23 |
| 36-21 | C | 20 | 11 | Comparative coupler 35-(2) | 0.02 | 45 | 13 | 0.04 | 28 | 23 |
| 36-22 | G | 20 | 12 | Comparative coupler 35-(2) | 0.02 | 49 | 13 | 0.03 | 24 | 26 |
| 36-23 | L | 20 | 12 | Comparative coupler 35-(2) | 0.02 | 48 | 13 | 0.03 | 26 | 23 |
| 36-24 | D | 30 | 25 | $C^c$-75 | 0.02 | 48 | 15 | 0.04 | 42 | 20 |
| 36-25 | C | 30 | 26 | " | 0.02 | 50 | 15 | 0.11 | 33 | 31 |
| 36-26 | G | 30 | 26 | " | 0.02 | 49 | 15 | 0.12 | 28 | 30 |
| 36-27 | L | 30 | 26 | " | 0.02 | 49 | 15 | 0.12 | 29 | 29 |
| 36-28 | D | 20 | 26 | " | 0.02 | 48 | 15 | 0.04 | 31 | 19 |
| 36-29 | C | 20 | 26 | " | 0.02 | 49 | 15 | 0.09 | 41 | 27 |
| 36-30 | G | 20 | 25 | " | 0.02 | 50 | 15 | 0.11 | 28 | 26 |
| 36-31 | L* | 20 | 26 | " | 0.02 | 49 | 15 | 0.11 | 28 | 25 |
| 36-32 | A | 20 | 11 | " | 0.02 | 50 | 14 | 0.04 | 43 | 15 |
| 36-33 | B | 20 | 12 | " | 0.02 | 45 | 14 | 0.04 | 32 | 15 |
| 36-34 | C | 20 | 11 | " | 0.02 | 45 | 14 | 0.04 | 28 | 15 |
| 36-35 | D | 20 | 11 | " | 0.02 | 48 | 14 | 0.04 | 42 | 15 |
| 36-36 | E | 20 | 12 | " | 0.02 | 48 | 14 | 0.04 | 29 | 15 |
| 36-37 | F | 20 | 11 | " | 0.02 | 48 | 14 | 0.03 | 25 | 15 |
| 36-38 | G | 20 | 12 | " | 0.02 | 49 | 14 | 0.03 | 22 | 15 |
| 36-39 | H | 20 | 11 | " | 0.02 | 50 | 14 | 0.03 | 21 | 15 |
| 36-40 | I | 20 | 12 | " | 0.02 | 48 | 14 | 0.04 | 23 | 16 |
| 36-41 | J | 20 | 12 | " | 0.02 | 49 | 14 | 0.05 | 25 | 17 |
| 36-42 | K | 20 | 12 | " | 0.02 | 49 | 14 | 0.05 | 27 | 18 |
| 36-43 | L | 20 | 12 | " | 0.02 | 48 | 14 | 0.03 | 23 | 15 |

*Aspect ratio, 1:5

As is apparent from Table 36-6, the invention attains advantages in terms of graininess, yellow stain, and cyan dye fading ratio.

By replacing example cyan coupler $C^c$-75, respectively with the example cyan couplers $C^c$-1, $C^c$-4, $C^c$-7, $C^c$-9, $C^c$-13, $C^c$-17, $C^c$-21, $C^c$-25, $C^c$-29, $C^c$-32, $C^c$-33, $C^c$-38, $C^c$-39, $C^c$-43, $C^c$-44, $C^c$-48, $C^c$-49, $C^c$-53, $C^c$-55, $C^c$-58, $C^c$-62, $C^c$-66, $C^c$-70, $C^c$-74, $C^c$-78, $C^c$-81, $C^c$-86, $C^c$-89, $C^c$-92,$C^c$-95 and $C^c$-98, the above-mentioned test was performed, whereby the similar results were attained.

EXAMPLE 37

With Example 35, an amount of example compound E-2 used as a color developing agent was respectively changed as listed in Table 27-7, whereby each sample was treated with a developing temperature listed in Table 37-7. Other conditions were identical with Example 35. However, samples used i.e. light-sensitive material Nos. 36-26, and 36-38 were identical with those prepared in Example 36. (See Table 36-5.)

In Table 37-7, values enclosed in heavy lines apparently correspond with preferred embodiments of the invention. As can be understood, a concentration of color developing agent, higher than $2.0\times10^{-2}$ mole/-liter attains favorable result.

The similar test was performed with samples respectively using example compounds E-1, and E-4, as a color developing agent, instead of color developing agent (E-2), thereby the similar results were obtained.

TABLE 37-7

| Light-sensitive material No. | Color developing agent (E-2) (mole/liter) | Developing temperature (°C.) | RMS value | Cyan dye fading ratio (%) |
|---|---|---|---|---|
| 36-26 | $1.5\times10^{-2}$ | 50 | 38 | 23 |
| " | $2.0\times10^{-2}$ | 47 | 28 | 26 |
| " | $3.0\times10^{-2}$ | 45 | 25 | 28 |
| " | $5.0\times10^{-2}$ | 42 | 25 | 31 |
| 36-38 | $1.5\times10^{-2}$ | 50 | 34 | 14 |
| " | $2.0\times10^{-2}$ | 47 | 26 | 14 |
| " | $3.0\times10^{-2}$ | 45 | 21 | 15 |
| " | $5.0\times10^{-2}$ | 42 | 21 | 16 |

Developing time: 60 sec.

EXAMPLE 38

Using emulsion 36-G in Example 36 as well as the previously described example cyan coupler $C^c$-60, and in compliance with the preparation method in Example 35, respective samples were prepared by changing the amounts of applied silver as listed below. More specifically, by changing the amounts of silver added in the third, fifth, sixth and seventh layers, the respective samples independently having a specific amount of silver were prepared. Additionally, the layer thicknesses and T1/2 were modified as listed in Table 38-8 so that some samples comply with the invention while the other do not. Using a color developer containing color developer agent E-2 at a rate of $3\times10^{-2}$ mole/liter, each sample was treated for 60 seconds at 45° C., and then, the RMS value and cyan fading ratio of each sample were measured. Table 38-8 lists the obtained results. As can be understood from the results in Table 38-8, the preferred amount of silver applied is more than 30 mg/100 cm$^2$, in particular, 30 to 150 mg/100 cm$^2$, and, more specifically, 35 to 100 mg/cm$^2$.

TABLE 38-8

| Layer thickness $T\frac{1}{2}$ | Amount of silver applied (mg/100 cm$^2$) | RMS value | Cyan dye fading ratio |
|---|---|---|---|
| Layer thickness, | 20 | 57 | 19 |
| 28 to 30 μm | 30 | 45 | 21 |
| $T\frac{1}{2}$, adjusted | 35 | 42 | 23 |
| to 25 to 28 sec. | 80 | 34 | 26 |
| | 100 | 34 | 31 |
| | 150 | 33 | 34 |
| | 200 | 33 | 45 |
| Layer thickness, | 20 | 55 | 10 |
| 18 to 20 μm | 30 | 43 | 12 |
| $T\frac{1}{2}$, adjusted | 35 | 36 | 13 |
| to 8 to 20 sec. | 80 | 34 | 15 |
| | 100 | 32 | 17 |
| | 150 | 32 | 18 |
| | 200 | 32 | 21 |

What is claimed:

1. A processing method for processing a silver halide color photographic light-sensitive material with color developing of not more than 180 seconds, comprising color developing in a first developer solution for not more than 180 seconds, a silver halide color photographic light-sensitive material having a support, provided thereon, with at least one silver halide emulsion layer, and at least one of said emulsion layers containing silver iodo-bromide with not less than 0.5 mole % of silver iodide; said color developing for not more than 180 seconds being accomplished under color developing condition wherein said processing method when used to process a silver halide color photographic light-sensitive material B, will provide a dye image with a maximum magenta density M satisfying $M\geqq2.0$, when said light-sensitive material is exposed under exposure conditions C described below and subjected to said color developing but for a duration of not more than 2.5 minutes;

said light-sensitive material being defined by properties whereby said light-sensitive material B provides a maximum magenta density of $M<2.0$ when said light-sensitive material B contains, in a silver halide emulsion layer, both of a silver iodo-bromide with an iodine content of not less than 0.5 mole % and a magenta coupler, and is exposed under the exposure conditions C specified below and then subjected to color developing for a duration of three minutes 15 seconds at 38° C. with the following developer A;

| Developer A | |
|---|---|
| Potassium carbonate | 37.5 g |
| Sodium sulfite | 4.25 g |
| Potassium iodide | 2 mg |
| Sodium bromide | 1.3 g |
| Hydroxylamine sulfate | 2.0 g |
| 3-methyl-4-amino-N-ethyl-(B-hydroxyethyl)-aniline sulfate | 4.75 g |

water is added to the above components to prepare a one liter solution, which is adjusted to pH 10.0 with 45% potassium hydroxide or 50% sulfuric acid;

exposure conditions C:

using a tungsten light source and filter, a color temperature is adjusted to 4800° K., in order to provide 3.2 CMS wedge exposure light.

2. Processing method as claimed in claim 1 for a silver halide color photographic light-sensitive material, and which is capable of forming with said light-sensitive material B a dye image whereby the magenta fog density in a non-exposure portion is lower than 0.5.

3. Processing method as claimed in claim 1 or 2 for a silver halide color photographic light-sensitive material, wherein the concentration of color developing agent in said first developer solution used is not lower than $1.5\times10^{-2}$ mole/liter.

4. Processing method as claimed in claim 1 or 2 for a silver halide color photographic light-sensitive material, wherein the pH of said first developer solution is not lower than 10.4.

5. Processing method as claimed in claim 1 or 2 for a silver halide color photographic light-sensitive material, wherein the color in said first developing temperature is not lower than 40° C.

6. Processing method as claimed in claim 1 or 2 for a silver halide color photographic light-sensitive material, wherein the sulfite concentration in the said first developer solution is not higher than $1.5\times10^{-2}$ mole/-liter.

7. Processing method as claimed in claim 1 or 2 for a silver halide color photographic light-sensitive material, wherein the bromide concentration in the said first developer solution used is not higher than $0.8\times10^{-2}$ mole/liter.

8. Processing method as claimed in claim 1 or 2 for a silver halide color photographic light-sensitive material, wherein said first developer solution contains at least one of compounds represented by any of the following general formulas [A-I] through [A-VI];

General formula [A-I]

$$X_{a1}\text{-}(CH_2)_{\overline{na1}}(X_{a2}\text{-}(CH_2)_{\overline{na2}})_{\overline{ma1}}X_{a3}\text{-}(CH_2)_{\overline{na3}}X_{a4}$$

wherein $Xa_2$ and $Xa_3$ independently represent a sulfur atom or oxygen atom; $Xa_1$ and $Xa_4$ independently represent a SH group or OH group; $na_1$, $na_2$, $na_3$ and $ma_1$ independently represent an integer ranging from 0 to 500, whereby at least one of $na_1$, $na_2$ and $na_3$ is an integer greater than 0; additionally, at least one of $Xa_1$, $Xa_2$, $Xa_3$, and $Xa_4$ is a sulfur atom;

General formula [A-II]

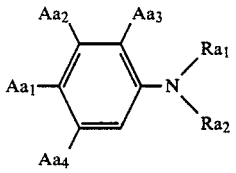

wherein $Ra_1$ and $Ra_2$ independently represent a hydrogen atom, or an alkyl group such as a methyl group, ethyl group or propyl group, or a heterocyclic group which is capable of forming a ring, involving an oxygen or nitrogen atom, together with $Ra_1$ and $Ra_2$; $Aa_2$, $Aa_3$ and $Aa_4$ independently represent a hydrogen atom, or an alkyl group such as a methyl or ethyl group, or a halogen atom such as a chlorine, fluorine, or bromine atom; $Aa_1$ represents a hydroxy group or

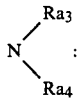

additionally, $Ra_3$ and $Ra_4$ independently represent a hydrogen atom, or an alkyl group having 1 to 3 carbon atoms;

General formula [A-III]

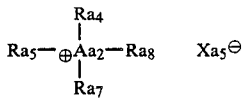

wherein $Ra_5$, $Ra_6$, $Ra_7$ and $Ra_8$ independently represent a hydrogen atom, alkyl group, aralkyl group, or a substituted or unsubstituted aryl group, $Aa_2$ represents a nitrogen or phosphorus atom; $Ra_8$ represents a substituted or unsubstituted alkylene group; $Ra_5$ and $Ra_8$ may form a ring, or independently be substituted or unsubstituted pyridinium group; $Xa_5$ represents an anion group such as a halogen atom, OH, sulfuric group or nitric group;

General formula [A-IV]

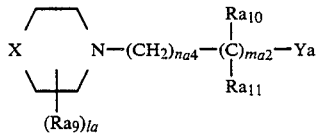

wherein Ya represents a hydrogen atom, hydroxy group or

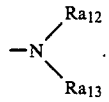

$Ra_9$, $Ra_{10}$, $Ra_{11}$, $Ra_{12}$ and $Ra_{13}$ independently represent a hydrogen atom; or a substituted or unsubstituted group, having 1 to 3 carbon atoms, such as an alkyl group, carbamoyl group, acetyl group and amino group; X represents an oxygen atom, sulfur atom or

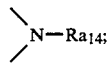

at the same time, $Ra_{11}$ represents a hydrogen atom, or a substituted or unsubstituted alkyl group having 1 to 3 carbon atoms; la, $ma_2$ and $na_4$ independently represent an integer 0, 1, 2 or 3;

General formula [A-V]

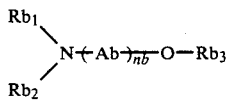

wherein $Rb_1$ and $Rb_2$ independently represent a hydrogen atom, alkyl group, alkoxy group, aryl group; or a nitrogen-containing heterocycle which may be formed by $Rb_1$ and $Rb_2$, or a nitrogen-containing heterocycle which may be formed by $Rb_1$ and Ab, or by $Rb_2$ and Ab; $Rb_3$ represents an alkyl group; Ab represents an alkylene group; nb represents an integer ranging from 0 to 6;

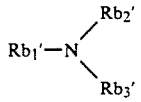

General formula [A-VI]

wherein $Rb_1'$ represents a hydroxy alkyl group having 2 to 6 carbon atoms; $Rb_2'$ and $Rb_3'$ independently represent a hydrogen atom; or an alkyl group having 1 to 6 carbon atoms, or a hydroxy alkyl group or benzyl group each having 2 to 6 carbon atoms, or

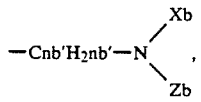

in these formulas, nb represents an integer ranging from 1 to 6; Xb and Zb independently represent a hydrogen atom, an alkyl group having 1 to 6 carbon atoms or a hydroxy alkyl group having 2 to 6 carbon atoms.

9. Processing method as claimed in claim 1 or 2 for a silver halide color photographic light-sensitive material, wherein said first developer solution contains at least one of compounds represented by any of the following general formulas [R-I] through [R-III]; General formula [R-I]

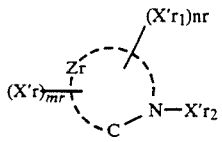

wherein X'r and $X'r_1$ independently represent a halogen atom, alkyl group, aryl group, amino group, hydroxy group, nitro group, carboxyl group or sulfonyl group; $X'r_2$ represents a hydrogen atom, alkyl group, aryl group, or a divalent group for forming a ring; Zr represents a plurality of atoms selected from the group consisting of a carbon atom, oxygen atom, nitrogen atom and sulfur atom, being necessary for forming a ring; nr and mr independently represent 0, 1, 2 or 3:

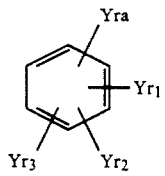

wherein Yra, $[Rr_1]$ $Yr_1$, $Yr_2$ and $Yr_3$ independently represent a hydrogen atom, halogen atom, alkyl group, amino group, hydroxy group, nitro group, carboxyl group or sulfonyl group;

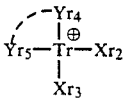

wherein Tr represents a nitrogen atom, or phosphorus atom; $Xr_2$ and $Xr_3$ independently represent a hydrogen atom, alkyl group, aryl group, or halogen atom, $Yr_4$, and $Yr_5$, independently represent an alkyl group, or aryl group; $Yr_4$, and $Yr_5$ may jointly undergo ring closure to form a heterocycle.

10. Processing method as claimed in claim 1 or 2 for a silver halide color photographic light-sensitive material, wherein said light-sensitive material contains at least one of compounds represented by the following general formula [R-IV]:

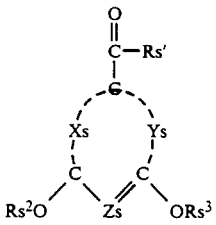

General formula [R-IV]

in Formula [R-IV], $Rs^1$ represents —OH, —$ORs^4$ or

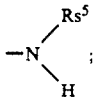

$Rs^4$ and $Rs^5$ independently represent an alkyl group; said alkyl group represented either by $Rs^4$ or $Rs^5$ may have a substituent:

Rs and Rs independently represent —H or

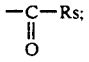

Rs represents an alkyl group or aryl group, each of which may have a substituent:

Xs and Ys respectively represent a carbon atom and a hydrogen atom, each of which forms a six-membered ring together with other plurality of atoms; Zs represents —N=.

11. Processing method as claimed in claim 1 or 2 for a silver halide color photographic light-sensitive material, wherein said first developer solution contains at least polymer or copolymer which has within the molecular structure a pyrolidone nucleus; or at least one ethylene glycol compound.

* * * * *